US009318053B2

(12) United States Patent
Umezaki et al.

(10) Patent No.: US 9,318,053 B2
(45) Date of Patent: Apr. 19, 2016

(54) SEMICONDUCTOR DEVICE AND DRIVING METHOD THEREOF

(75) Inventors: Atsushi Umezaki, Kanagawa (JP); Hajime Kimura, Atsugi-Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 1155 days.

(21) Appl. No.: 11/427,134

(22) Filed: Jun. 28, 2006

(65) Prior Publication Data

US 2007/0001941 A1 Jan. 4, 2007

(30) Foreign Application Priority Data

Jul. 4, 2005 (JP) ..... 2005-194684

(51) Int. Cl.

| | |
|---|---|
| ***G09G 3/30*** | (2006.01) |
| ***G09G 3/32*** | (2006.01) |
| ***G09G 3/00*** | (2006.01) |
| *G09G 3/20* | (2006.01) |

(52) U.S. Cl.

CPC ..... *G09G 3/3266* (2013.01); *G09G 3/006* (2013.01); *G09G 3/3283* (2013.01); *G09G 3/2007* (2013.01); *G09G 2330/08* (2013.01); *G09G 2330/10* (2013.01); *G09G 2330/12* (2013.01)

(58) Field of Classification Search

CPC ..... G09G 3/30; G09G 3/32; G09G 3/3208; G09G 3/3216; G09G 3/3225

USPC ..... 345/76–104; 315/169.3

See application file for complete search history.

(56) References Cited

U.S. PATENT DOCUMENTS

| | | | | |
|---|---|---|---|---|
| 5,504,504 | A * | 4/1996 | Markandey et al. | 345/214 |
| 5,719,651 | A * | 2/1998 | Okada et al. | 349/85 |
| 6,433,485 | B2 | 8/2002 | Tai et al. | |
| 6,518,941 | B1 | 2/2003 | Kimura | |
| 6,633,135 | B2 | 10/2003 | Nara et al. | |

(Continued)

FOREIGN PATENT DOCUMENTS

| | | |
|---|---|---|
| CN | 1376014 A | 10/2002 |
| CN | 1536544 A | 10/2004 |

(Continued)

OTHER PUBLICATIONS

Office Action, Chinese Application No. 201010163101.2, dated Aug. 23, 2011, 10 pages with English translation.

(Continued)

*Primary Examiner* — Alexander Eisen
*Assistant Examiner* — Nelson Lam
(74) *Attorney, Agent, or Firm* — Fish & Richardson P.C.

(57) ABSTRACT

The semiconductor device includes a plurality of pixels each including a plurality of sub-pixels, a power supply line and a plurality of signal lines for operating the plurality of pixels, a driver circuit for outputting signals to the plurality of signal lines, a signal input circuit for controlling the driver circuit, a compensation circuit which determines if a pixel has a normal state, a defective bright spot, or a point defect in the case where a current value detected shows an abnormal value, and accordingly outputs a compensation signal to the signal input circuit, and a current value detection circuit which detects a current value flowing through the power supply line when each sub-pixel is lighted. Thus, a pixel including a sub-pixel which shows an abnormal current value when lighted is compensated by a signal output from the driver circuit.

8 Claims, 57 Drawing Sheets

(56) References Cited

U.S. PATENT DOCUMENTS

| | | | | |
|---|---|---|---|---|
| 6,633,301 | B1 * | 10/2003 | Dallas et al. | 345/597 |
| 6,633,306 | B1 * | 10/2003 | Marz et al. | 345/698 |
| 6,768,482 | B2 | 7/2004 | Asano et al. | |
| 7,023,232 | B2 | 4/2006 | Yano et al. | |
| 7,061,014 | B2 | 6/2006 | Hosono et al. | |
| 7,064,346 | B2 | 6/2006 | Kawasaki et al. | |
| 7,227,519 | B1 * | 6/2007 | Kawase et al. | 345/77 |
| 7,274,363 | B2 | 9/2007 | Ishizuka et al. | |
| 7,282,782 | B2 | 10/2007 | Hoffman et al. | |
| 7,292,024 | B2 * | 11/2007 | Zhang et al. | 324/158.1 |
| 7,323,356 | B2 | 1/2008 | Hosono et al. | |
| 8,076,674 | B2 | 12/2011 | Kwak | |
| 2002/0135598 | A1 * | 9/2002 | Tezuka et al. | 345/613 |
| 2003/0057895 | A1 | 3/2003 | Kimura | |
| 2003/0063053 | A1 * | 4/2003 | Yamazaki et al. | 345/82 |
| 2003/0071772 | A1 | 4/2003 | Kimura | |
| 2003/0222894 | A1 * | 12/2003 | Toji et al. | 345/694 |
| 2003/0231085 | A1 * | 12/2003 | Arai | H01P 1/202 333/204 |
| 2004/0080479 | A1 * | 4/2004 | Credelle | 345/88 |
| 2004/0150592 | A1 * | 8/2004 | Mizukoshi et al. | 345/76 |
| 2004/0150594 | A1 * | 8/2004 | Koyama et al. | 345/82 |
| 2004/0212573 | A1 * | 10/2004 | Sundahl et al. | 345/82 |
| 2005/0093567 | A1 * | 5/2005 | Nara | G09G 3/006 324/762.09 |
| 2005/0099372 | A1 * | 5/2005 | Nakamura et al. | 345/79 |
| 2005/0110719 | A1 * | 5/2005 | Satoh et al. | 345/76 |
| 2005/0162599 | A1 * | 7/2005 | Kurihara et al. | 349/139 |
| 2005/0168491 | A1 * | 8/2005 | Takahara et al. | 345/690 |
| 2005/0174064 | A1 * | 8/2005 | Agostinelli | G09G 3/3216 315/169.3 |
| 2005/0179628 | A1 | 8/2005 | Kimura | |
| 2005/0179675 | A1 * | 8/2005 | Hekstra et al. | 345/204 |
| 2005/0219261 | A1 * | 10/2005 | Asai et al. | 345/613 |
| 2005/0259142 | A1 | 11/2005 | Kwak | |
| 2006/0007249 | A1 * | 1/2006 | Reddy et al. | 345/690 |
| 2006/0028408 | A1 * | 2/2006 | Kim | 345/76 |
| 2006/0139252 | A1 * | 6/2006 | Lee | 345/76 |
| 2006/0164407 | A1 * | 7/2006 | Cok | 345/204 |
| 2006/0244107 | A1 | 11/2006 | Sugihara et al. | |
| 2006/0244476 | A1 * | 11/2006 | Zhang et al. | 324/770 |
| 2006/0253755 | A1 * | 11/2006 | Wu | 714/726 |
| 2006/0255827 | A1 * | 11/2006 | Nara | G09G 3/006 324/62.09 |
| 2007/0194379 | A1 | 8/2007 | Hosono et al. | |
| 2007/0210722 | A1 * | 9/2007 | Konno et al. | 315/185 S |
| 2009/0160740 | A1 * | 6/2009 | Leon et al. | 345/76 |
| 2010/0171442 | A1 * | 7/2010 | Draper et al. | 315/297 |

FOREIGN PATENT DOCUMENTS

| | | | |
|---|---|---|---|
| CN | 1567416 | A | 1/2005 |
| CN | 1702720 | A | 11/2005 |
| CN | 1703731 | A | 11/2005 |
| EP | 1134811 | A1 | 9/2001 |
| EP | 0 949 603 | B1 | 1/2006 |
| JP | 03-126120 | * | 5/1991 |
| JP | 05-251705 | A | 9/1993 |
| JP | 2005-251705 | A | 9/1993 |
| JP | 11-073158 | | 3/1999 |
| JP | 2000-044236 | A | 2/2000 |
| JP | 2000-150900 | A | 5/2000 |
| JP | 2002-040074 | A | 2/2002 |
| JP | 2002-040082 | A | 2/2002 |
| JP | 2002-076356 | A | 3/2002 |
| JP | 2002-229513 | A | 8/2002 |
| JP | 2002-289859 | A | 10/2002 |
| JP | 2003-195813 | | 7/2003 |
| JP | 2003-234187 | A | 8/2003 |
| JP | 2003-280593 | A | 10/2003 |
| JP | 2004-045648 | A | 2/2004 |
| JP | 2005-033172 | A | 2/2005 |
| TW | 200405073 | A | 4/2004 |
| WO | 03/040441 | A1 | 5/2003 |
| WO | 03/058594 | A1 | 7/2003 |
| WO | 03/100756 | A2 | 12/2003 |

OTHER PUBLICATIONS

Chinese Office Action (Chinese Patent Application No. 201010163101.2) dated May 30, 2012 with English translation.

Chinese Office Action (CN Application No. 201010163101.2) mailed Jan. 31, 2013 w/full English translation, 21 pages.

Korean Office Action (KR Application No. 2006-0061845) dated Mar. 25, 2013, with English translation, 14 pages.

Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355. English.

Nomura.K et al., "Carrier transport in transparent oxide semiconductor with intrinsic structural randomness probed using single-crystalline InGaO3(ZnO)5 films,", Appl. Phys. Lett. (Applied Physics Letters, Sep. 13, 2004, vol. 85, No. 11, pp. 1993-1995. English.

Kamiya. T et al., "1a-F-5 Room temperature fabrication and carrier transport of amorphous semiconductor exhibiting large electron Hall mobilities > 10 cm2/Vs,", (The 65th Autumn Meeting, 2004) The Japan Society of Applied Physics, Sep. 1, 2004, No. 2, p. 791. Full translation.

Nomura.K et al., "31a-ZA-6 Carrier Transport in Transparent Amorphous Oxide Semiconductor InGaZnO4,", (The 51st Spring Meeting,2004); The Japan Society of Applied Physics and Related Societies, Mar. 28, 2004, No. 2, p. 669. Full translation.

Kimizuka.N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3—ZnGa2O4—ZnO System,", Journal of Solid State Chemistry, Apr. 1, 1995, vol. 116, No. 1, pp. 170-178. English.

Nomura.K et al., "Thin-Film Transistor Fabricated in Single-Crystalline Transparent Oxide Semiconductor,", Science, May 23, 2003, vol. 300, No. 5623, pp. 1269-1272. English.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492. English.

* cited by examiner

SEMICONDUCTOR DEVICE AND DRIVING METHOD THEREOF

BACKGROUND OF THE INVENTION

1. Field of the Invention

The present invention relates to a semiconductor device having a plurality of pixels arranged in matrix, which displays images with a video signal (also referred to as an image signal or a picture signal) input to each of the plurality of pixels, and a driving method thereof. In particular, the invention relates to a semiconductor device having a function of detecting and compensating defective pixels which would be caused in each column, and a driving method thereof.

2. Description of the Related Art

A driving method is proposed, by which gray scales capable of being displayed on a display screen are increased by providing a plurality of sub-pixels in one pixel (Reference 1: Japanese Patent Laid-Open No. Hei11-73158). For example, in Reference 1, one pixel is constructed from a pluraliuty of sub-pixels, thereby a gray scale which can be expressed with only light emission and non-light emission of one sub-pixel (hereinafter also referred to as a time gray scale method) can be combined with a gray scale which can be expressed with only a combination of the plurality of sub-pixels (hereinafter also referred to as an area gray scale method, and such a combination is hereinafter also referred to as an area/time gray scale method). Thus, the pixel disclosed in Reference 1 can increase gray scales which can be expressed with the area/time gray scale method.

There is also a driving method proposed, by which the characteristics of a light-emitting element in each pixel are detected to compensate degradation of the light-emitting element. For example, there are such a display device and driving method proposed that, if there is any degraded light-emitting pixel as a result of detection of the characteristics of a light-emitting element in each pixel, the luminance of the light-emitting element is compensated with a video signal input to each pixel, thereby compensating image burn-in (ghosting) or the like which is caused by changes in the characteristics of the light-emitting element (Reference 2: Japanese Patent Laid-Open No. 2003-195813).

However, in the conventional driving method of a pixel configuration where one pixel has a plurality of sub-pixels, there has been a problem in that if pixels have defects before shipment, any particular measures cannot be taken, which results in a lower yield. Further, even when pixels have defects after the display device starts to be used, any particular measures cannot be taken.

SUMMARY OF THE INVENTION

In view of the foregoing, it is an object of the invention to provide a semiconductor device and a driving method thereof, where a defective pixel can be driven in a similar manner to a normal pixel.

A semiconductor device of the invention includes: a plurality of pixels each having a plurality of sub-pixels; a power supply line and a plurality of signal lines for operating the plurality of pixels; a driver circuit for outputting signals to the plurality of signal lines; a signal input circuit for controlling the driver circuit; a compensation circuit which determines if a pixel has a normal state, a defective bright spot, or a point defect in the case where a current value detected shows an abnormal value (e.g., a case where there is no change in the current value if a defective bright spot occurs or a case where the current value is increased if a point defect or the like occurs resulting from a short-circuit between an anode and a cathode of a light-emitting element), and accordingly outputs a compensation signal to the signal input circuit; and a current value detection circuit which detects a current value flowing through the power supply line when each sub-pixel is lighted. Thus, a pixel including a sub-pixel which shows an abnormal current value when lighted is compensated by a signal output from the driver circuit. As a method for compensating a video signal, supposing that one sub-pixel has a point defect, for example, compensation is performed in such a manner that gray scales are expressed with the sub-pixels other than the defective sub-pixel. Accordingly, a low gray scale and a middle gray scale can be expressed though a high gray scale cannot be expressed. Meanwhile, supposing that one sub-pixel has a defective bright spot, compensation is performed in such a manner that gray scales are expressed with the sub-pixels other than the defective sub-pixel. Accordingly, a middle gray scale and a high gray scale can be expressed though a low gray scale cannot be expressed. According to the driving method described above, a certain level of gray scales can be expressed and defective pixels can be made less noticeable, as long as an active matrix display device is provided with a plurality of sub-pixels, and a detection circuit and a compensation circuit for a defective pixel, even when there is a defect such as a defective bright spot and a point defect.

A semiconductor device in accordance with one aspect of the invention includes: a plurality of pixels each having a plurality of sub-pixels; a power supply line and a plurality of signal lines for operating the plurality of pixels; a driver circuit for outputting signals to the plurality of signal lines; a signal input circuit for controlling the driver circuit; a compensation circuit which determines if a pixel has a normal state, a defective bright spot, or a point defect in the case where a current value detected shows an abnormal value (e.g., a case where there is no change in the current value if a defective bright spot occurs or a case where the current value is increased if a point defect or the like occurs resulting from a short-circuit between an anode and a cathode of a light-emitting element), and accordingly outputs a compensation signal to the signal input circuit; and a current value detection circuit which detects a current value flowing through the power supply line when each sub-pixel is lighted. Thus, a pixel including a sub-pixel which shows an abnormal current value when lighted is compensated by a signal output from the driver circuit. As a method for compensating a video signal, supposing that one sub-pixel has a point defect, for example, compensation is performed in such a manner that gray scales are expressed with the sub-pixels other than the defective sub-pixel. Accordingly, a low gray scale and a middle gray scale can be expressed though a high gray scale cannot be expressed. Meanwhile, supposing that one sub-pixel has a defective bright spot, compensation is performed in such a manner that gray scales are expressed with the sub-pixels other than the defective sub-pixel. Accordingly, a middle gray scale and a high gray scale can be expressed though a low gray scale cannot be expressed. According to the driving method described above, a certain level of gray scales can be expressed and defective pixels can be made less noticeable, as long as an active matrix display device is provided with a plurality of sub-pixels, and a detection circuit and a compensation circuit for a defective pixel, even when there is a defect such as a defective bright spot and a point defect. Note that the semiconductor device means a device including transistors or non-linear elements. In addition, not all the transistors or non-linear elements are required to be formed over an SOI substrate, a quartz substrate, a glass substrate, a resin substrate, or the like.

A semiconductor device in accordance with one aspect of the invention includes: a source driver; a gate driver; a first source signal line; a second source signal line; a gate signal line; a power supply line; a pixel; a first sub-pixel; a second sub-pixel; a first TFT; a second TFT; a third TFT; a fourth TFT; a first capacitor having a pair of electrodes; a second capacitor having a pair of electrodes; a first light-emitting element having a pair of electrodes; a second light-emitting element having a pair of electrodes; and a counter electrode which corresponds to the other electrode of the first light-emitting element having the pair of electrodes, and also corresponds to the other electrode of the second light-emitting element having the pair of electrodes. The source driver outputs video signals to the first source signal line and the second source signal line; the gate driver scans the gate signal line; and the power supply line is electrically connected to one of either a source or a drain of the first TFT and one of either a source or a drain of the second TFT; the other of either the source or the drain of the first TFT is electrically connected to one electrode of the first light-emitting element; the other of either the source or the drain of the second TFT is electrically connected to one electrode of the second light-emitting element; a gate of the first TFT is electrically connected to one electrode of the first capacitor and one of either a source or a drain of the third TFT; a gate of the second TFT is electrically connected to one electrode of the second capacitor and one of either a source or a drain of the fourth TFT; the other electrode of the first capacitor and the other electrode of the second capacitor are electrically connected to the power supply line; the other of either the source or the drain of the third TFT is electrically connected to the first source signal line; the other of either the source or the drain of the fourth TFT is electrically connected to the second source signal line; and a gate of the third TFT and a gate of the fourth TFT are electrically connected to the gate signal line.

Since each of the third TFT and the fourth TFT operates as a switching element, it may be replaced with either an electrical switch or a mechanical switch as long as it can control a current flow. As the switching element, any of a transistor, a diode, and a logic circuit constructed from them can be employed. Further, the first TFT and the second TFT may also be operated as switching elements. In such a case, if the operating point of the first TFT and the first light-emitting element and the operating point of the second TFT and the second light-emitting element are set so as to allow the first TFT and the second TFT to operate in the linear region, variations in the threshold voltage of the first TFT and the second TFT will not affect the display; therefore, a display device with higher image quality can be provided.

A semiconductor device in accordance with one aspect of the invention includes: a source driver; a gate driver; a first source signal line; a second source signal line; a gate signal line; a power supply line; a pixel; a first sub-pixel; a second sub-pixel; a first TFT; a second TFT; a third TFT; a fourth TFT; a first capacitor having a pair of electrodes; a second capacitor having a pair of electrodes; a first light-emitting element having a pair of electrodes; a second light-emitting element having a pair of electrodes; and a counter electrode which corresponds to the other electrode of the first light-emitting element having the pair of electrodes, and also corresponds to the other electrode of the second light-emitting element having the pair of electrodes. The source driver outputs video signals to the first source signal line and the second source signal line; the gate driver scans the gate signal line; the power supply line is electrically connected to one of either a source or a drain of the first TFT and one of either a source or a drain of the second TFT; the other of either the source or the drain of the first TFT is electrically connected to one electrode of the first light-emitting element; the other of either the source or the drain of the second TFT is electrically connected to one electrode of the second light-emitting element; a gate of the first TFT is electrically connected to one electrode of the first capacitor and one of either a source or a drain of the third TFT; a gate of the second TFT is electrically connected to one electrode of the second capacitor and one of either a source or a drain of the fourth TFT; the other electrode of the first capacitor and the other electrode of the second capacitor are electrically connected to the power supply line; the other of either the source or the drain of the third TFT is electrically connected to the first source signal line; the other of either the source or the drain of the fourth TFT is electrically connected to the second source signal line; and a gate of the third TFT and a gate of the fourth TFT are electrically connected to the gate signal line.

Since each of the third TFT and the fourth TFT operates as a switching element, it may be replaced with either an electrical switch or a mechanical switch as long as it can control a current flow. As the switching element, any of a transistor, a diode, and a logic circuit constructed from them can be employed. Further, the first TFT and the second TFT may also be operated as switching elements. In such a case, if the operating point of the first TFT and the first light-emitting element and the operating point of the second TFT and the second light-emitting element are set so as to allow the first TFT and the second TFT to operate in the linear region, variations in the threshold voltage of the first TFT and the second TFT will not affect the display; therefore, a display device with higher image quality can be provided.

In this specification, a "semiconductor device" means any device which can function by utilizing the semiconductor characteristics, and includes any device having a circuit constructed from a non-linear element such as a transistor and a diode which is disclosed in this specification.

In the invention, a "display device" means a device having display elements (e.g., liquid crystal elements or light-emitting elements). Note that the display device also includes a display panel itself where a plurality of pixels including display elements such as liquid crystal elements or EL elements are formed over a substrate together with a peripheral driver circuit for driving the pixels. In addition, it may include a peripheral driver circuit provided over a substrate by wire bonding or bump bonding, namely, by chip-on-glass (COG) bonding. Further, it may include a flexible printed circuit (FPC) or a printed wiring board (PWB) attached to a display panel (e.g., an IC, a resistor, a capacitor, an inductor, or a transistor). Such display devices may also include an optical sheet such as a polarizing plate or a retardation plate. Further, it may include a backlight (which may include a light guide plate, a prism sheet, a diffusion sheet, a reflective sheet, and a light source (e.g., an LED or a cold-cathode tube)).

In addition, a "light-emitting device" means a display device having self-luminous display elements, in particular, such as EL elements or elements used for an FED. A "liquid crystal display device" means a display device having liquid crystal elements.

Note that a display element, a display device, a light-emitting element, or a light-emitting device may be in various modes and may include various elements. For example, there is a display medium of which contrast changes by an electromagnetic function, such as an EL element (e.g., an organic EL element, an inorganic EL element, or an EL element containing both organic and inorganic materials), an electron-emissive element, a liquid crystal element, electronic ink, a grating light valve (GLV), a plasma display (PDP), a digital micromirror device (DMD), a piezoceramic display, and a carbon nanotube. In addition, a display device using an EL element includes an EL display; a display device using an electron-emissive element includes a field emission display (FED), a surface-conduction electron-emitter display (SED), and the like; a display device using a liquid crystal element includes a liquid crystal display, a transmissive liquid crystal display, a semi-transmissive liquid crystal display, and a reflective liquid crystal display; and a display device using electronic ink includes electronic paper.

Note that a switch in the invention may be in various modes. For example, there are an electrical switch and a mechanical switch. That is, anything which can control a current flow can be used, and various elements may be used without limiting to a certain element. For example, it may be a transistor, a diode (e.g., a PN diode, a PIN diode, a Schottky diode, or a diode-connected transistor), a thyristor, or a logic circuit constructed from them. Therefore, in the case of using a transistor as a switch, the polarity thereof (conductivity type) is not particularly limited because it operates just as a switch. However, when off-current is preferred to be small, a transistor of a polarity with small off-current is desirably used. As a transistor with small off-current, there are a transistor provided with an LDD region, a transistor with a multi-gate structure, and the like. Further, it is desirable that an n-channel transistor be employed when a potential of a source terminal of the transistor which is operated as a switch is closer to the low-potential-side power supply (e.g., Vss, GND, or 0 V), while a p-channel transistor be employed when the potential of the source terminal is closer to the high-potential-side power supply (e.g., Vdd). This helps the switch operate efficiently because the absolute value of the gate-source voltage of the transistor can be increased.

Note also that a CMOS switch may also be used by combining both n-channel and p-channel transistors. When a CMOS is used as a switch, a current can flow through the switch when either of the p-channel or n-channel transistor is turned on. Thus, it can effectively function as a switch. For example, a voltage can be appropriately output even when a voltage of a signal input to the switch is high or low. Further, since a voltage swing of a signal for turning on/off the switch can be suppressed, power consumption can be suppressed.

In the case of using a transistor as a switch, the switch has an input terminal (one of either a source terminal or a drain terminal), an output terminal (the other of either the source terminal or the drain terminal), and a terminal (gate terminal) for controlling electrical conduction. Meanwhile, in the case of using a diode as a switch, the switch may not have a terminal for controlling electrical conduction. Therefore, the number of wires for controlling terminals can be suppressed.

Transistors applicable to the invention are not limited to a certain type, and the invention can employ a thin film transistor (TFT) using a non-single crystalline semiconductor film typified by amorphous silicon or polycrystalline silicon, a MOS transistor formed with a semiconductor substrate or an SOI substrate, a junction transistor, a bipolar transistor, a transistor formed with a compound semiconductor, an organic semiconductor, or a carbon nanotube, or other transistors. In the case of using a non-single crystalline semiconductor film, it may contain hydrogen or halogen. In addition, a substrate over which transistors are formed is not limited to a certain type, and the transistors may be formed over a single crystalline substrate, an SOI substrate, a glass substrate, a plastic substrate, a paper substrate, a cellophane substrate, a quartz substrate, or the like. Alternatively, after forming transistors over a substrate, the transistors may be transposed onto another substrate.

The structure of a transistor in the invention may be in various modes, and thus is not limited to a certain structure. For example, a multi-gate structure having two or more gate electrodes may be used. When using a multi-gate structure, such a structure is provided that channel regions are connected in series, which means a plurality of transistors are connected in series. Therefore, by employing a multi-gate structure, off-current can be reduced as well as the withstand voltage can be increased to improve the reliability of the transistor, and even when a drain-source voltage fluctuates at the time when the transistor operates in the saturation region, flat characteristics can be obtained without causing fluctuations of a drain-source current that much. In addition, such a structure may also be employed that gate electrodes are formed above and below a channel. By using such a structure that gate electrodes are formed above and below a channel, the channel region can be enlarged to increase the value of a current flowing therein, and a depletion layer can be easily formed to increase the S value. When gate electrodes are formed above and below a channel, such a structure is provided that a plurality of transistors are connected in parallel.

In addition, any of the following structures may be employed: a structure where a gate electrode is formed above a channel; a structure where a gate electrode is formed below a channel; a staggered structure; an inversely staggered structure; and a structure where a channel region is divided into a plurality of regions and connected in parallel or series. In addition, a channel (or a part of it) may overlap a source electrode or a drain electrode. By forming a structure where a channel (or a part of it) overlaps a source electrode or a drain electrode, it can be prevented that charges gather in a part of the channel, which would otherwise result in the unstable operation. In addition, an LDD region may be provided. By providing an LDD region, off-current can be reduced as well as the withstand voltage can be increased to improve the reliability of the transistor, and even when a drain-source voltage fluctuates at the time when the transistor operates in the saturation region, flat characteristics can be obtained without causing fluctuations of a drain-source current.

In the invention, various types of transistors may be used, and such transistors may be formed over various types of substrates. Accordingly, the whole circuits may be formed over a glass substrate, a plastic substrate, a single crystalline substrate, an SOI substrate, or any other substrate. By forming the whole circuits over the same substrate, the number of component parts can be reduced to cut cost, as well as the number of connections with the circuit components can be reduced to improve the reliability. Alternatively, a part of the circuits may be formed over one substrate, while the other parts of the circuits may be formed over another substrate. That is, not the whole circuits are required to be formed over the same substrate. For example, a part of the circuits may be formed with transistors over a glass substrate, while the other parts of the circuits may be formed over a single crystalline substrate, so that the IC chip is connected to the glass substrate by COG (Chip-On-Glass) bonding. Alternatively, the IC chip may be connected to the glass substrate by TAB (Tape Automated Bonding) or a printed board. In this manner, by forming a part of the circuits over the same substrate, the number of component parts can be reduced to cut cost, as well as the number of connections with the circuit components can be reduced to improve the reliability. In addition, by forming a portion with a high driving voltage or a high driving frequency, which consumes large power, over different substrates, increase in power consumption can be prevented.

Note that a gate means a part or all of a gate electrode and a gate wire (also called a gate line, a gate signal line, or the like). A gate electrode means a conductive film which overlaps a semiconductor for forming a channel region or an LDD (Lightly Doped Drain) region with a gate insulating film sandwiched therebetween. A gate wire means a wire for connecting gate electrodes of different pixels, or a wire for connecting a gate electrode with another wire.

Note that there is a portion functioning as both a gate electrode and a gate wire. Such a region may be called either a gate electrode or a gate wire. That is, there is a region where a gate electrode and a gate wire cannot be clearly distinguished from each other. For example, in the case where a channel region overlaps a gate wire which is extended, the overlapped region functions as both a gate wire and a gate electrode. Accordingly, such a region may be called either a gate electrode or a gate wire.

In addition, a region formed of the same material as the gate electrode, while being connected to the gate electrode may be called a gate electrode. Similarly, a region formed of the same material as the gate wire, while being connected to the gate wire may be called a gate wire. In the strict sense, such a region may not overlap the channel region or may not have a function of connecting to another gate electrode. However, there is a region formed of the same material as the gate electrode or the gate wire, while being connected to the gate electrode or the gate wire, in view of the manufacturing margin. Accordingly, such a region may also be called either a gate electrode or a gate wire.

In addition, in the case of a multi-gate transistor, for example, a gate electrode of a transistor is connected to a gate electrode of another transistor with the use of a conductive film which is formed of the same material as the gate electrode. Since this region connects one gate electrode to another gate electrode, it may be called a gate wire, and it may also be called a gate electrode since the multi-gate transistor may be regarded as one transistor. That is, the region may be called a gate electrode or a gate wire as long as it is formed of the same material as the gate electrode or the gate wire and connected thereto. In addition, a part of a conductive film which connects a gate electrode to a gate wire, for example, may also be called a gate electrode or a gate wire.

Note that a gate terminal means a part of a gate electrode, or a part of a region electrically connected to the gate electrode.

Note that a source means a part or all of a source region, a source electrode, and a source wire (also called a source line, a source signal line, or the like). A source region is a semiconductor region containing a large amount of p-type impurities (e.g., boron, or gallium) or n-type impurities (e.g., phosphorus or arsenic). Accordingly, it does not include a region containing a slight amount of p-type impurities or n-type impurities, namely an LDD (Lightly Doped Drain) region. A source electrode is a conductive layer formed of a different material from the source region, while being electrically connected to the source region. Note that there is a case where a source electrode and a source region are collectively called a source electrode. A source wire is a wire for connecting source electrodes of different pixels, or a wire for connecting a source electrode to another wire.

Note that there is a portion functioning as both a source electrode and a source wire. Such a region may be called either a source electrode or a source wire. That is, there is a region where a source electrode and a source wire cannot be clearly distinguished from each other. For example, in the case where a source region overlaps a source wire which is extended, the overlapped region functions as both a source wire and a source electrode. Accordingly, such a region may be called either a source electrode or a source wire.

In addition, a region formed of the same material as a source electrode, while being connected to the source electrode may be called a source electrode. A part of a source wire which overlaps a source region may be called a source electrode as well. Similarly, a region formed of the same material as the source wire, while being connected to the source wire may be called a source wire as well. In the strict sense, such a region may not have a function of connecting to another source electrode. However, there is a region formed of the same material as the source electrode or the source wire, while being connected to the source electrode or the source wire, in view of the manufacturing margin. Accordingly, such a region may also be called either a source electrode or a source wire.

In addition, a part of a conductive film which connects a source electrode to a source wire may be called a source electrode or a source wire, for example.

Note that a source terminal means a part of a source region, a source electrode, or a part of a region electrically connected to the source electrode.

Note also that a drain has a similar structure to the source.

In this specification, "a transistor (TFT) is turned on" means such a state that a voltage higher than the threshold voltage is applied between a gate and a source of the transistor, thereby a current flows through the source and the drain. Meanwhile, "a transistor (TFT) is turned off" means such a state that a voltage equal to or lower than the threshold voltage is applied between a gate and a source of the transistor, thereby no current flows through the source and the drain.

In this specification, a "connection" means an electrical connection. Accordingly, in each configuration disclosed in this specification, another element which enables an electrical connection (e.g., a switch, a transistor, a diode, or a capacitor) may be interposed between elements having a predetermined connection relation, as long as the electrical connection is unchanged. Needless to say, elements may be connected without interposing another element therebetween, and thus an electrical connection includes a direct connection.

In this specification, a transistor is only required to operate as a switching transistor, and either an n-channel transistor or a p-channel transistor may be used unless the polarity (conductivity type) is specified.

In this specification, a "source signal line" means a wire connected to an output of a source driver, in order to transmit a video signal for controlling the operation of a pixel from the source driver.

In addition, in this specification, a "gate signal line" means a wire connected to an output of a gate driver, in order to transmit a scan signal for controlling selection/non-selection of video signal writing to a pixel from the gate driver.

In this specification, a state in which a light-emitting element emits light regardless of an input of a video signal is called a defective bright spot, while a state in which a light-emitting element does not emit light regardless of an input of a video signal is called a point defect (defective dark spot).

In the invention, when it is described that an object is formed on another object, it does not necessarily mean that the object is in direct contact with the another object. In the case where the above two objects are not in direct contact with each other, still another object may be sandwiched therebetween. Accordingly, when it is described that a layer B is formed on a layer A, it means either a case where the layer B is formed in direct contact with the layer A, or a case where another layer (e.g., a layer C and/or a layer D) is formed in direct contact with the layer A, and then the layer B is formed in direct contact with the layer C or D. In addition, when it is described that an object is formed over or above another object, it does not necessarily mean that the object is in direct contact with the another object, and still another object may be sandwiched therebetween. Accordingly, when it is described that a layer B is formed over or above a layer A, it means either a case where the layer B is formed in direct contact with the layer A, or a case where another layer (e.g., a layer C and/or a layer D) is formed in direct contact with the layer A, and then the layer B is formed in direct contact with the layer C or D. Similarly, when it is described that an object is formed below or under another object, it means either case where the objects are in direct contact with each other or not.

A display device of the invention includes a plurality of pixels each including a plurality of sub-pixels; a power supply line and a plurality of signal lines for operating the plurality of pixels; a driver circuit for outputting signals to the plurality of signal lines; a signal input circuit for controlling the driver circuit; a compensation circuit which determines if a pixel has a normal state, a defective bright spot, or a point defect in the case where a current value detected shows an abnormal value (e.g., a case where there is no change in the current value if a defective bright spot occurs or a case where the current value is increased if a point defect or the like occurs resulting from a short-circuit between an anode and a cathode of a light-emitting element), and accordingly outputs a compensation signal to the signal input circuit; and a current value detection circuit which detects a current value flowing through the power supply line when each sub-pixel is lighted. Thus, a pixel including a sub-pixel which shows an abnormal current value when lighted is compensated with a signal output from the driver circuit. As a method for compensating a video signal, supposing that one sub-pixel has a point defect, for example, compensation is performed in such a manner that gray scales are expressed with the sub-pixels other than the defective sub-pixel. By performing compensation in this manner, even high gray scales can be expressed. Meanwhile, supposing that one sub-pixel has a defective bright spot, compensation is performed in such a manner that gray scales are expressed with the sub-pixels other than the defective sub-pixel. By performing compensation in this manner, even low gray scales can be expressed. According to the driving method descried above, a certain level of gray scales can be expressed and defective pixels can be made less noticeable, as long as an active matrix display device is provided with a plurality of sub-pixels, and a detection circuit and a compensation circuit for a defective pixel, even when there is a defect such as a defective bright spot and a point defect.

BRIEF DESCRIPTION OF THE DRAWINGS

In the accompanying drawings.

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein.

[Embodiment Mode 1]

Figure 1:
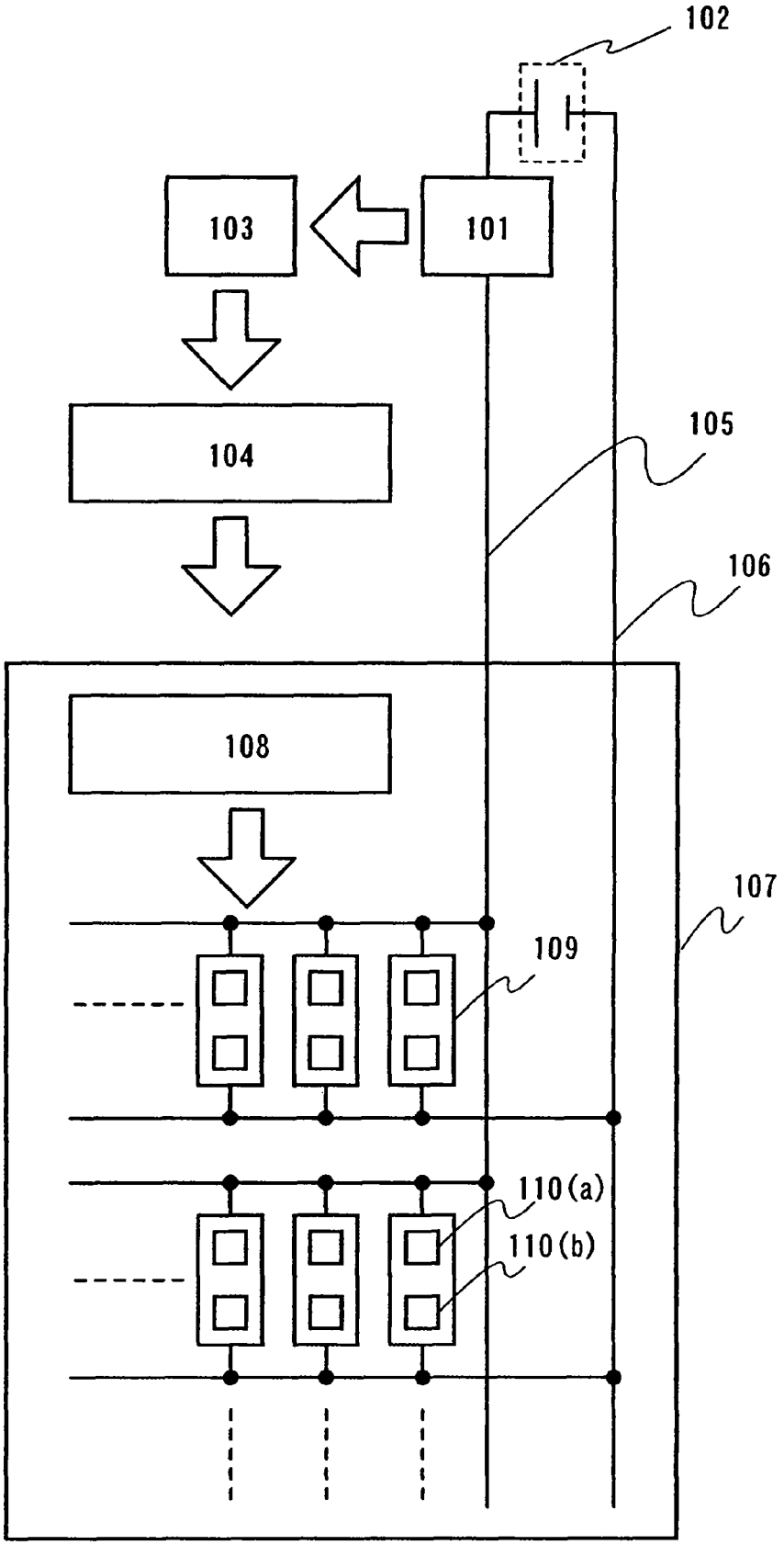
FIG. 1 shows Embodiment Mode 1.

Description will be made of a display device with a first configuration, with reference to FIG. 1. In FIG. 1, reference numeral 101 denotes a current value detection circuit, 102 denotes a power supply, 103 denotes a compensation circuit, 104 denotes a signal input circuit, 105 denotes a power supply line, 106 denotes a wire, 107 denotes a panel, 108 denotes a driver circuit, 109 denotes a pixel, and 110(*a*) and 110(*b*) denote sub-pixels.

In this semiconductor device, the power supply line 105 is connected to the sub-pixels 110(*a*) and 110(*b*) which constitute the pixel 109; the wire 106 is connected to the sub-pixels 110(*a*) and 110(*b*) which constitute the pixel 109; the power supply line 105 is connected to a positive side of the power supply 102 through the current value detection circuit 101; a negative side of the power supply 102 is connected to the wire 106; the current value detection circuit 101 outputs a current detected to the compensation circuit 103; the compensation circuit 103 outputs compensation signals to the signal input circuit 104; and the signal input circuit 104 outputs control signals to the driver circuit 108.

Description will be made below of functions of the current value detection circuit 101, the compensation circuit 103, the signal input circuit 104, and the driver circuit 108.

The current value detection circuit 101 has a function of detecting a current value of the power supply line 105 at the time of lighting one of either the sub-pixel 110(*a*) or 110(*b*) which constitutes the pixel 109, and outputting the current value to the compensation circuit 103. The compensation circuit 103 has a function of outputting compensation signals for compensating control signals such as video signals, start pulses, clocks, and inverted clocks to the signal input circuit 104 based on the data obtained from the current value detection circuit 101. The signal input circuit 104 has a function of outputting control signals such as video signals, start pulses, clocks, and inverted clocks for operating the driver circuit 108 to the driver circuit 108. The driver circuit 108 has a function of outputting signals for controlling the luminance of the pixel 109 and the sub-pixels 110(*a*) and 110(*b*) which constitute the pixel 109. Each of the sub-pixels 110(*a*) and 110(*b*) includes a light-emitting element having a pair of electrodes, and a circuit for controlling the light-emitting element. This circuit is controlled with a signal output from the driver circuit 108, and it inputs a potential of the power supply line 105 to one of the electrodes of the light-emitting element in the case of lighting the light-emitting element, while it does not input a potential of the power supply line 105 thereto in the case of not lighting the light-emitting element, and thus is in a floating state. The other electrode of the light-emitting element is connected to the wire 106. A current may be supplied to one electrode of the light-emitting element in lighting the light-emitting element.

In the invention, a defective pixel is detected, and a control signal to be output from the signal input circuit 104 is compensated with the compensation circuit 103, thereby the defective pixel is made less noticeable. Description will be made below of such operations, while dividing them into several operating periods.

An operation of detecting a defective pixel is described. As a detection method of a defective pixel, a light-emitting element in each sub-pixel is lighted, and a current value of the power supply line 105 is detected with the current value detection circuit 101. Then, a defective pixel is detected by comparing the current value of each sub-pixel. For example, if a point defect occurs (a state in which a light-emitting element in a sub-pixel does not emit light even with an input of a control signal for lighting the sub-pixel from the driver circuit), a current value in the sub-pixel is larger than that in the normal sub-pixel. This is because, since a point defect of a light-emitting element occurs in the case where one electrode of the light-emitting element is short-circuited to the other electrode, a resistance value of a light-emitting element in a sub-pixel having a point defect, to which a potential of the power supply line 105 is inputted, is smaller than the resistance value of a light-emitting element in a sub-pixel which has no point defect. Therefore, the current value of the power supply line 105 in the sub-pixel is larger than that in the sub-pixel which has no point defect. Meanwhile, if a defective bright spot occurs (a state in which a light-emitting element in a sub-pixel constantly emits light regardless of a control signal output from the driver circuit), a current value thereof is smaller than that in the normal sub-pixel. More specifically, there is only a small difference between a current value of a normal pixel and a current value of the power supply line 105 in the case where all of the pixels are lighted. This is because, since a defective bright spot of a light-emitting element occurs in the case where a potential applied to one electrode of the light-emitting element is higher than that of the wire 106 to which the other electrode of the light-emitting element is connected, a current value of the power supply line 105 changes only slightly even when a potential of the power supply line 105 is input to a light-emitting element in a sub-pixel having a defective bright spot.

A method for compensating a defective pixel is described below. Note that the description will be made separately on a case where a defective pixel has a point defect and a case where a defective pixel has a defective bright spot.

With regard to a point defect, if the sub-pixel 110(*a*) has a point defect between the sub-pixel 110(*a*) and the sub-pixel 110(*b*) which constitute the pixel 108, the sub-pixel 110(*a*) does not emit light. Therefore, a gray scale is expressed with only the sub-pixel 110(*b*). Note that since the sub-pixel 110(*a*) is in a non-light-emission state regardless of a control signal from the driver circuit 108, a gray scale is required to be expressed with only the sub-pixel 110(*b*). Therefore, whereas a low gray scale can be expressed, a high gray scale cannot be expressed.

With regard to a defective bright spot, if the sub-pixel 110(*a*) has a defective bright spot between the sub-pixel 110(*a*) and the sub-pixel 110(*b*) which constitute the pixel 108, the sub-pixel 110(*a*) continuously emits light regardless of a control signal from the driver circuit 108. Therefore, a gray scale is expressed with only the sub-pixel 110(*b*). Note that since the sub-pixel 110(*a*) is in a light-emission state, a gray scale is required to be expressed with only the sub-pixel 110(*b*). Therefore, whereas a high gray scale can be expressed, a low gray scale cannot be expressed.

Such defects are detected based on the current value of the power supply line 105 with the use of the current value detection circuit 101, and a defective pixel is determined by the compensation circuit 103 based on the current value. Then, a compensation signal is output to the signal input circuit 104 based on the determination result. Thus, the signal input circuit 104 outputs a control signal to the driver circuit 108 based on the compensation signal input from the compensation circuit 103, and performs such an operation that makes the defective pixel less noticeable. That is, a pixel showing an abnormal current value is driven by being input with a signal which is compensated for making the defective pixel less noticeable.

In the case where one sub-pixel has a point defect, a signal (video signal) output from the driver circuit 108, for example, may be compensated so that gray scales are expressed with the sub-pixels other than the defective sub-pixel. By performing compensation in such a manner, even high gray scales can be expressed.

Similarly, in the case where one sub-pixel has a defective bright spot, even low gray scales can be expressed by performing compensation such that gray scales are expressed with the sub-pixels other than the defective sub-pixel.

In this manner, even when a defective pixel occurs, it can be made less noticeable, which can prevent a defective display even with such a defective pixel.

Although the above description applies to the case where two sub-pixels are provided, three sub-pixels may be provided as well. If there are three sub-pixels and the ratio of the respective areas is set to 1:2:4, the number of gray scales which can be expressed can be increased by eight times as large as that in the case of a display with one sub-pixel. In addition, the ratio of the areas may be 1:1:1 as well. By setting the ratio of the areas to 1:1:1, a degradation level of each sub-pixel can be made uniform. By increasing the number of sub-pixels, the scale of a driver circuit can be suppressed as compared with the case of providing no sub-pixels, and thus power consumption can be suppressed.

In addition, even when providing two sub-pixels, if the ratio of the respective areas is set to 1:2, the number of gray scales which can be displayed can be increased by four times as large as that in the case of a display with one sub-pixel.

As described above, this embodiment mode has a feature that the current value of the power supply line 105 is detected. By detecting a current value of the power supply line 105, current values in a plurality of sub-pixels can be concurrently detected even in the case where a plurality of power supply lines are provided, for example, such as a case where power supply lines are provided corresponding to R, G, and B pixels, or a case where different power supply lines are connected to the respective sub-pixels. Accordingly, a period for detecting current values of sub-pixels can be shortened.

In this embodiment mode, inspection is made of whether there is a point defect or a defective bright spot in the sub-pixels 110(*a*) and 110(*b*), by detecting a current value of a light-emitting element in each sub-pixel.

As described above, in the invention, even when a defect such as a defective bright spot or a point defect occurs, decrease in gray scales in accordance with the defective area can be suppressed as long as a plurality of sub-pixels, and a detection circuit and a compensation circuit for a defective pixel are provided, thereby the defective pixel can be made less noticeable.

[Embodiment Mode 2]

Figure 2:
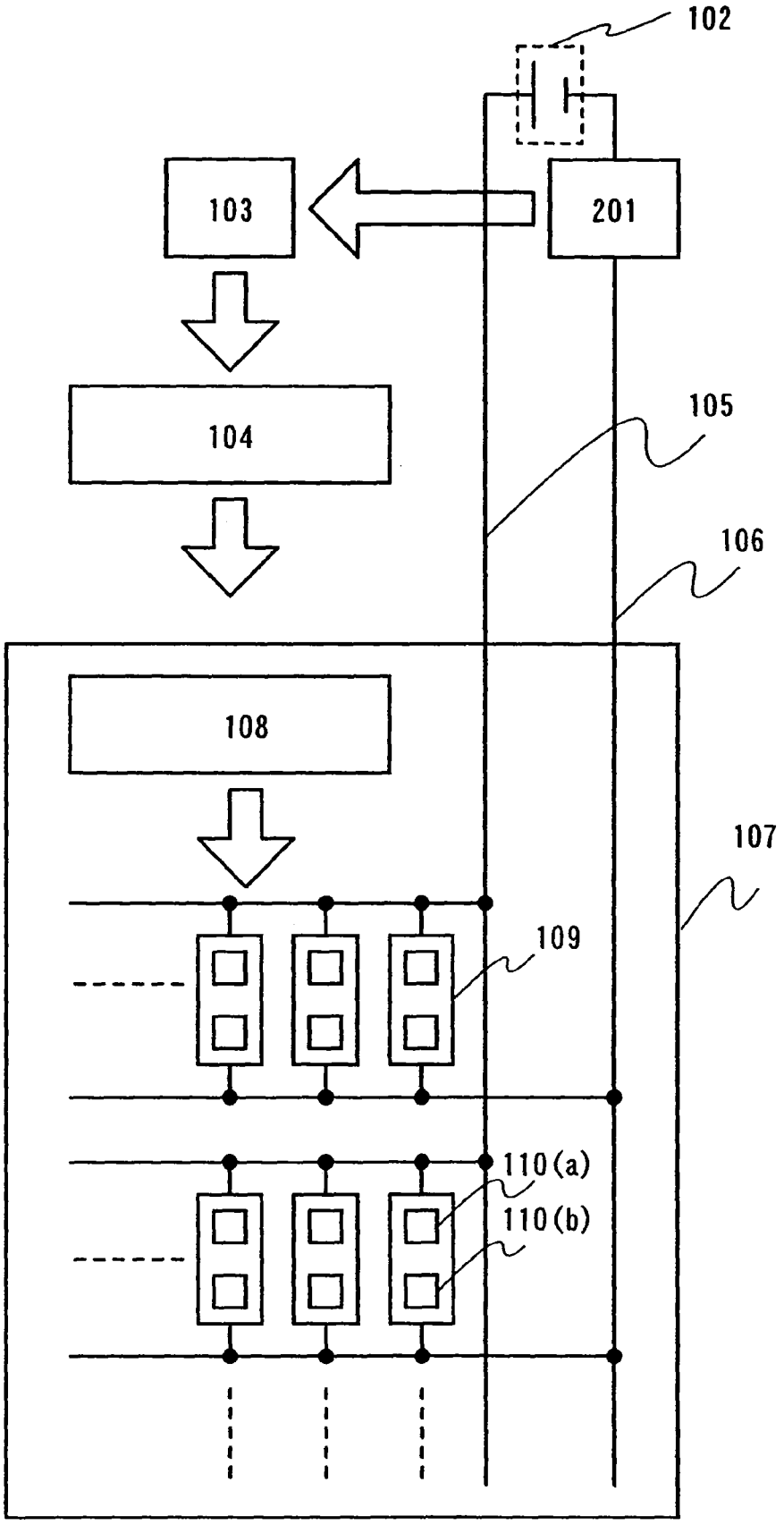
FIG. 2 shows Embodiment Mode 2.

Description will be made of a display device with a second configuration, with reference to FIG. 2. In FIG. 2, reference numeral 201 denotes a current value detection circuit, 102 denotes a power supply, 103 denotes a compensation circuit, 104 denotes a signal input circuit, 105 denotes a power supply line, 106 denotes a wire, 107 denotes a panel, 108 denotes a driver circuit, 109 denotes a pixel, and 110(*a*) and 110(*b*) are sub-pixels.

In this semiconductor device, the power supply 102 is connected to the sub-pixels 110(*a*) and 110(*b*) which constitute the pixel 109; the wire 106 is connected to the sub-pixels 110(*a*) and 110(*b*) which constitute the pixel 109; the power supply line 105 is connected to a positive side of the power supply 102; a negative side of the power supply 102 is connected to the wire 106 through the current value detection circuit 201; the current value detection circuit 201 outputs a current detected to the compensation circuit 103; the compensation circuit 103 outputs compensation signals to the signal input circuit 104; and the signal input circuit 104 outputs control signals to the driver circuit 108.

Description will be made below of functions of the current value detection circuit 201, the compensation circuit 103, and the signal input circuit 104, and the driver circuit 108.

The current value detection circuit 201 has a function of detecting a current value of the wire 106 which is connected to a counter electrode, at the time of lighting one of either the sub-pixel 110(*a*) or 110(*b*) which constitutes the pixel 109, and outputting the current value to the compensation circuit 103. The compensation circuit 103 has a function of outputting compensation signals for compensating control signals such as video signals, start pulses, clocks, and inverted clocks to the signal input circuit 104 based on the data obtained from the current value detection circuit 201. The signal input circuit 104 has a function of outputting control signals such as video signals, start pulses, clocks, and inverted clocks for operating the driver circuit 108 to the driver circuit 108. The driver circuit 108 has a function of outputting signals for controlling the luminance of the pixel 109 and the sub-pixels 110(*a*) and 110(*b*) which constitute the pixel 109. Each of the sub-pixels 110(*a*) and 110(*b*) includes a light-emitting element having a pair of electrodes, and a circuit for controlling the light-emitting element. This circuit is controlled with a signal output from the driver circuit 108, and it inputs a potential of the power supply line 105 to one of the electrodes of the light-emitting element in the case of lighting the light-emitting element, while it does not input a potential of the power supply line 105 thereto in the case of not lighting the light-emitting element, and thus is in a floating state. The other electrode of the light-emitting element is connected to the wire 106 to which the counter electrode is connected. A current may be supplied to one electrode of the light-emitting element in lighting the light-emitting element.

In this embodiment mode, a defective pixel is detected, and a control signal to be output from the signal input circuit 104 is compensated with the compensation circuit 103, thereby the defective pixel is made less noticeable. Description will be made below of such operations, while dividing them into several operating periods.

An operation of detecting a defective pixel is described. As a detection method of a defective pixel, a light-emitting element in each sub-pixel is lighted, and a current value of the wire 106 connected to the counter electrode is detected with the current value detection circuit 201. Then, a defective pixel is detected by comparing the current value of each sub-pixel. For example, if a point defect occurs (a state in which a light-emitting element in a sub-pixel does not emit light even with an input of a control signal for lighting the sub-pixel from the driver circuit), a current value in the sub-pixel is larger than that in the normal sub-pixel. This is because, since a point defect of a light-emitting element occurs in the case where one electrode of the light-emitting element is short-circuited to the other electrode, a resistance value of a light-emitting element in a sub-pixel having a point defect, to which a potential of the power supply line 105 is inputted, is smaller than the resistance value of a light-emitting element in a sub-pixel which has no point defect. Therefore, the current value of the wire 106 connected to the counter electrode in the sub-pixel is larger than that in the sub-pixel which has no point defect. Meanwhile, if a defective bright spot occurs (a state in which a light-emitting element in a sub-pixel constantly emits light regardless of a control signal output from the driver circuit), a current value thereof is smaller than that in the normal sub-pixel. More specifically, there is only a small difference between a current value of a normal pixel and a current value of the wire 106 connected to the counter electrode in the case where all of the pixels are lighted. This is because, since a defective bright spot of a light-emitting element occurs in the case where a potential applied to one electrode of the light-emitting element is higher than that of the wire 106 to which the other electrode of the light-emitting element is connected, a current value of the wire 106 changes only slightly even when a potential of the power supply line 105 is input to a light-emitting element in a sub-pixel having a defective bright spot.

A method for compensating a defective pixel will be described below. Note that the description will be made separately on a case where a defective pixel has a point defect and a case where a defective pixel has a defective bright spot.

With regard to a point defect, if the sub-pixel 110(*a*) has a point defect between the sub-pixel 110(*a*) and the sub-pixel 110(*b*) which constitute the pixel 108, the sub-pixel 110(*a*) does not emit light. Therefore, a gray scale is expressed with only the sub-pixel 110(*b*). Note that the sub-pixel 110(*a*) is in a non-light-emission state regardless of a control signal from the driver circuit 108, and thus a gray scale is required to be expressed with only the sub-pixel 110(*b*). Therefore, whereas a low gray scale can be expressed, a high gray scale cannot be expressed.

With regard to a defective bright spot, if the sub-pixel 110(*a*) has a defective bright spot between the sub-pixel 110(*a*) and the sub-pixel 110(*b*) which constitute the pixel 108, the sub-pixel 110(*a*) continuously emits light regardless of a control signal from the driver circuit 108. Therefore, a gray scale is expressed with only the sub-pixel 110(*b*). Note that the sub-pixel 110(*a*) is in a light-emission state, and thus a gray scale is required to be expressed with only the sub-pixel 110(*b*). Therefore, whereas a high gray scale can be expressed, a low gray scale cannot be expressed.

Pixels having such defects are determined by the compensation circuit 103 based on the current value detected by the current value detection circuit 201, and the compensation circuit 103 outputs a compensation signal to the signal input circuit 104 based on the determination result. Thus, the signal input circuit 104 outputs a control signal to the driver circuit 108 based on the input compensation signal, and performs such an operation that makes the defective pixel less noticeable.

In this manner, even when a defective pixel occurs, it can be made less noticeable, which can prevent a defective display even with such a defective pixel.

Although the above description applies to the case where two sub-pixels are provided, three sub-pixels may be provided as well. When there are three sub-pixels and the ratio of the respective areas is set to 1:2:4, the number of gray scales which can be expressed can be increased by eight times as large as that in the case of a display with one sub-pixel. In addition, the ratio of the areas may be 1:1:1 as well. By setting the ratio of the areas to 1:1:1, a degradation level of each sub-pixel can be made uniform. By increasing the number of sub-pixels, the scale of a driver circuit can be suppressed as compared with the case of providing no sub-pixels, and thus power consumption can be suppressed.

In addition, even when providing two sub-pixels, if the ratio of the respective areas is set to 1:2, the number of gray scales which can be expressed can be increased by four times as large as that in the case of a display with one sub-pixel. By setting the ratio of the areas to 1:1, a degradation level of each sub-pixel can be made uniform.

This embodiment mode has a feature that the current value of the wire 106 is detected. By detecting a current value of the wire 106, a current value of each light-emitting element can be detected without increasing the circuit scale, even when there is a plurality of power supply lines since the wire 106 is used in common for all of the pixels.

In this embodiment mode, inspection of whether there is a point defect or a defective bright spot in the sub-pixels 110(*a*) and 110(*b*) is carried out by detecting a current value of a light-emitting element in each sub-pixel. In addition, the invention can reduce the circuit scale, in particular, the circuit scale of the compensation circuit 103.

[Embodiment Mode 3]

Description will be made of an exemplary configuration of the current value detection circuits 101 and 201 described in Embodiment Modes 1 and 2, with reference to FIG. 3.

Figure 3:
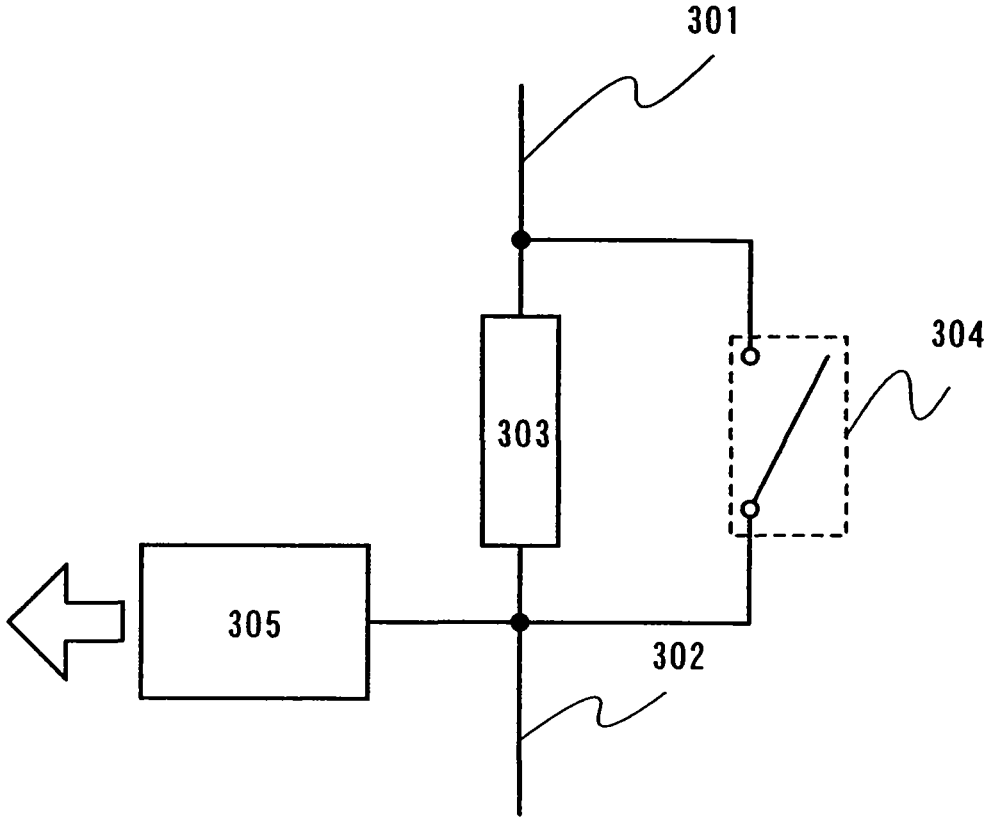
FIG. 3 shows Embodiment Mode 3.

In FIG. 3, reference numerals 301 and 302 denote power supply lines, 303 denotes a resistor, 304 denotes a switching element, and 305 denotes an analog-digital converter circuit.

In this semiconductor device, the power supply line 301 is connected to one terminal of the resistor 303 and one terminal of the switching element 304. The power supply line 302 is connected to the other terminal of the resistor 303, the other terminal of the switching element 304, and an input of the analog-digital converter circuit 305. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The resistor 303 is a resistor having a resistance component. The switching element 304 is a switching element having a switching property. The analog-digital converter circuit 305 is a circuit for converting a potential at the other terminal of the resistor 303 into a digital value. The converted value is not limited to a digital value, and it may be any value as long as it can be recognized by the compensation circuit 103.

A current value at the time of lighting a light-emitting element in each of the sub-pixels 110(*a*) and 110(*b*) is detected. When the light-emitting element is lighted, a current corresponding to the characteristics of the light-emitting element flows from the power supply line 302 to the power supply line 301 through the resistor 303. Since the power supply line 301 is connected to the power supply 102, the other terminal of the resistor 303 has a potential value which is obtained by subtracting a voltage drop at the resistor 303 from a potential at one terminal of the resistor 303 in the case of Embodiment Mode 1, or a potential value which is obtained by adding a voltage drop at the resistor 303 to a potential at one terminal of the resistor 303 in the case of Embodiment Mode 2. In this manner, in the case of lighting a light-emitting element in each of the sub-pixels 110(*a*) and 110(*b*), a current value flowing through the power supply line 302 is converted into a voltage to be input to the analog-digital converter circuit 305. At this time, the switching element 304 is set off.

In addition, the switching element 304 is connected in parallel with the resistor 303. Thus, in the case of displaying an image by lighting the light-emitting elements in the plurality of sub-pixels 110(*a*) and 110(*b*) in a normal state, a current value flowing through the power supply line 302 is extremely large as compared with that in the case of lighting a light-emitting element in each sub-pixel. Therefore, a voltage drop due to the resistor 303 is increased, which results in a low voltage applied to the power supply line 105 and the wire 106 connected to the counter electrode. Thus, it is requited to turn on the switching element 304 in the normal drive in order to eliminate the effect of the resistor 303.

The resistance value of the resistor 303 is set such that a potential of the power supply line 302 after a voltage has dropped has a level between a positive potential and a negative potential of the power supply 102. Accordingly, effects of a voltage drop can be reduced, thereby characteristics of a light-emitting element can be detected more accurately.

[Embodiment Mode 4]

Description will be made of an exemplary configuration of the current value detection circuits 101 and 201 described in Embodiment Modes 1 and 2, with reference to FIG. 4.

Figure 4:
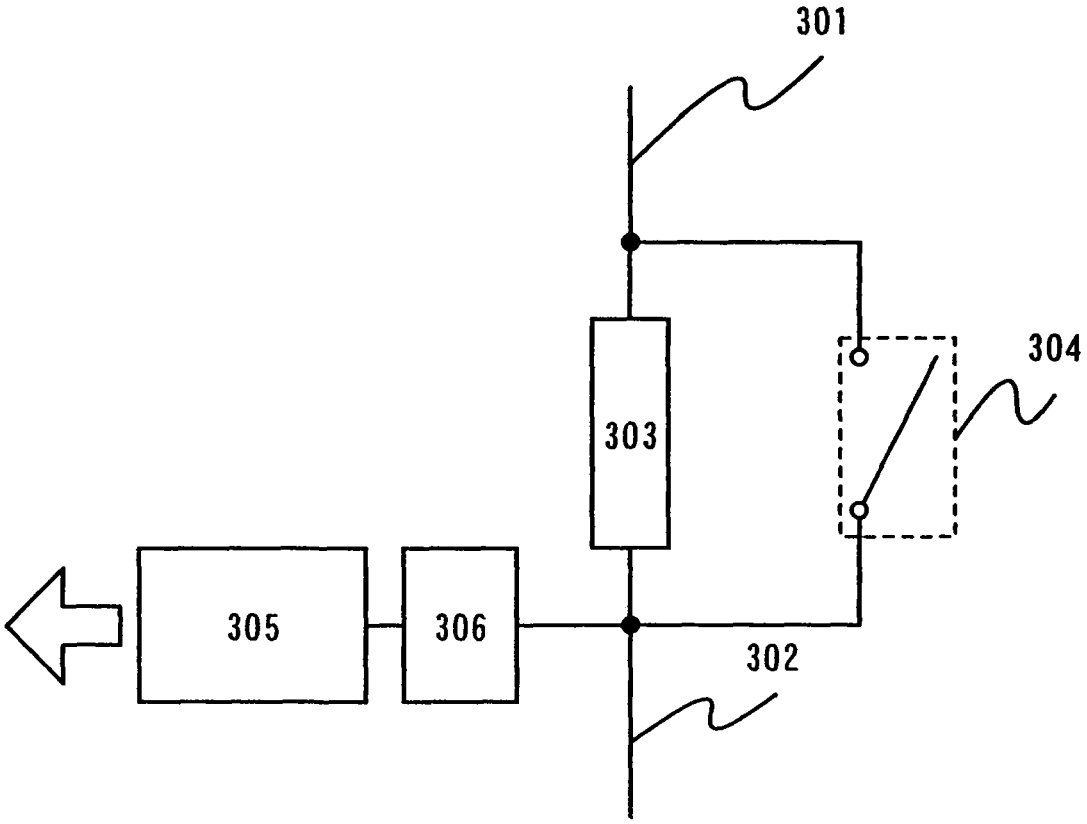
FIG. 4 shows Embodiment Mode 4.

In FIG. 4, reference numerals 301 and 302 denote power supply lines, 303 denotes a resistor, 304 denotes a switching element, 305 denotes an analog-digital converter circuit, and 306 denotes a noise-reduction circuit.

In this semiconductor device, the power supply line 301 is connected to one terminal of the resistor 303 and one terminal of the switching element 304. The power supply line 302 is connected to the other terminal of the resistor 303, the other terminal of the switching element 304, and an input of the noise-reduction circuit 306. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The resistor 303 is a resistor having a resistance component. The switching element 304 is a switching element having a switching property. The analog-digital converter circuit 305 is a circuit for converting a potential at the other terminal of the resistor 303 into a digital value. The noise-reduction circuit 306 is a circuit for reducing noise generated in the potential at the other terminal of the resistor 303. The converted value is not limited to a digital value, and it may be any value as long as it can be recognized by the compensation circuit 103.

A current value at the time of lighting a light-emitting element in each of the sub-pixels 110(*a*) and 110(*b*) is detected. When the light-emitting element is lighted, a current corresponding to the characteristics of the light-emitting element flows from the power supply line 302 to the power supply line 301 through the resistor 303. Since the power supply line 301 is connected to the power supply 102, the other terminal of the resistor 303 has a potential value which is obtained by subtracting a voltage drop at the resistor 303 from a potential at one terminal of the resistor 303 in the case of Embodiment Mode 1, or a potential value which is obtained by adding a voltage drop at the resistor 303 to a potential at one terminal of the resistor 303 in the case of Embodiment Mode 2. In this manner, in the case of lighting a light-emitting element in each of the sub-pixels 110(*a*) and 110(*b*), a current value flowing through the power supply line 302 is converted into a voltage and then input to the noise-reduction circuit 306 for reducing noise. Then, the signal is output to an input of the analog-digital converter circuit 305. At this time, the switching element 304 is set off.

In addition, the switching element 304 is connected in parallel with the resistor 303. Thus, in the case of displaying an image by lighting the light-emitting elements in the plurality of sub-pixels 110(*a*) and 110(*b*) in a normal state, a current value flowing through the power supply line 302 is extremely large as compared with that in the case of lighting a light-emitting element in each sub-pixel. Therefore, a voltage drop due to the resistor 303 is increased, which results in a low voltage applied to the power supply line 105 and the wire 106 connected to the counter electrode. Thus, it is requited to turn on the switching element 304 in the normal drive in order to eliminate the effect of the resistor 303.

The resistance value of the resistor 303 is set such that a potential of the power supply line 302 after a voltage has dropped has a level between a positive potential and a negative potential of the power supply 102. Accordingly, effects of a voltage drop can be reduced, thereby characteristics of a light-emitting element can be detected more accurately.

[Embodiment Mode 5]

Description will be made of an exemplary configuration of the current value detection circuits 101 and 201 described in Embodiment Modes 1 and 2, with reference to FIG. 5.

Figure 5:
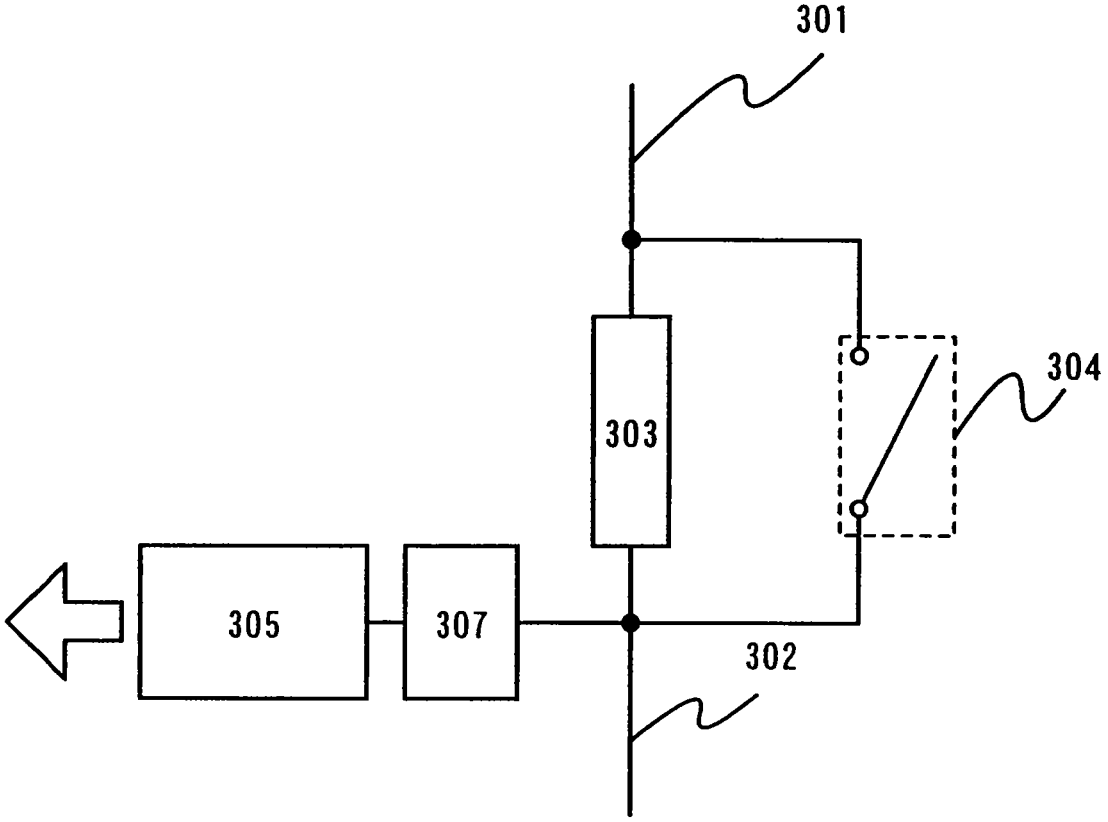
FIG. 5 shows Embodiment Mode 5.

In FIG. 5, reference numerals 301 and 302 denote power supply lines, 303 denotes a resistor, 304 denotes a switching element, 305 denotes an analog-digital converter circuit, and 307 denotes an amplifier circuit.

In this semiconductor device, the power supply line 301 is connected to one terminal of the resistor 303 and one terminal of the switching element 304. The power supply line 302 is connected to the other terminal of the resistor 303, the other terminal of the switching element 304, and an input of the amplifier circuit 307. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The resistor 303 is a resistor having a resistance component. The switching element 304 is a switching element having a switching property. The analog-digital converter circuit 305 is a circuit for converting a potential at the other terminal of the resistor 303 into a digital value. The amplifier circuit 307 is a circuit for amplifying a potential at the other terminal of the resistor 303. The converted value is not limited to a digital value, and it may be any value as long as it can be recognized by the compensation circuit 103.

A current value at the time of lighting a light-emitting element in each of the sub-pixels 110(*a*) and 110(*b*) is detected. When the light-emitting element is lighted, a current corresponding to the characteristics of the light-emitting element flows from the power supply line 302 to the power supply line 301 through the resistor 303. Since the power supply line 301 is connected to the power supply 102, the other terminal of the resistor 303 has a potential value which is obtained by subtracting a voltage drop at the resistor 303 from a potential at one terminal of the resistor 303 in the case of Embodiment Mode 1, or a potential value which is obtained by adding a voltage drop at the resistor 303 to a potential at one terminal of the resistor 303 in the case of Embodiment Mode 2. In this manner, in the case of lighting a light-emitting element in each of the sub-pixels 110(*a*) and 110(*b*), a current value flowing through the power supply line 302 is converted into a voltage and then input to the amplifier circuit 307. Thus, the signal is amplified to be output to an input of the analog-digital converter circuit 305.

In addition, the switching element 304 is connected in parallel with the resistor 303. Thus, in the case of displaying an image by lighting the light-emitting elements in the plurality of sub-pixels 110(*a*) and 110(*b*) in a normal state, a current value flowing through the power supply line 302 is extremely large as compared with that in the case of lighting a light-emitting element in each sub-pixel. Therefore, a voltage drop due to the resistor 303 is increased, which results in a low voltage applied to the power supply line 105 and the wire 106 connected to the counter electrode. Thus, it is requited to turn on the switching element 304 in the normal drive in order to eliminate the effect of the resistor 303.

The resistance value of the resistor 303 is set such that a potential of the power supply line 302 after a voltage has dropped has a level between a positive potential and a negative potential of the power supply 102. Accordingly, effects of a voltage drop can be reduced, thereby characteristics of a light-emitting element can be detected more accurately.

[Embodiment Mode 6]

Description will be made of an exemplary configuration of the current value detection circuits 101 and 201 described in Embodiment Modes 1 and 2, with reference to FIG. 6.

Figure 6:
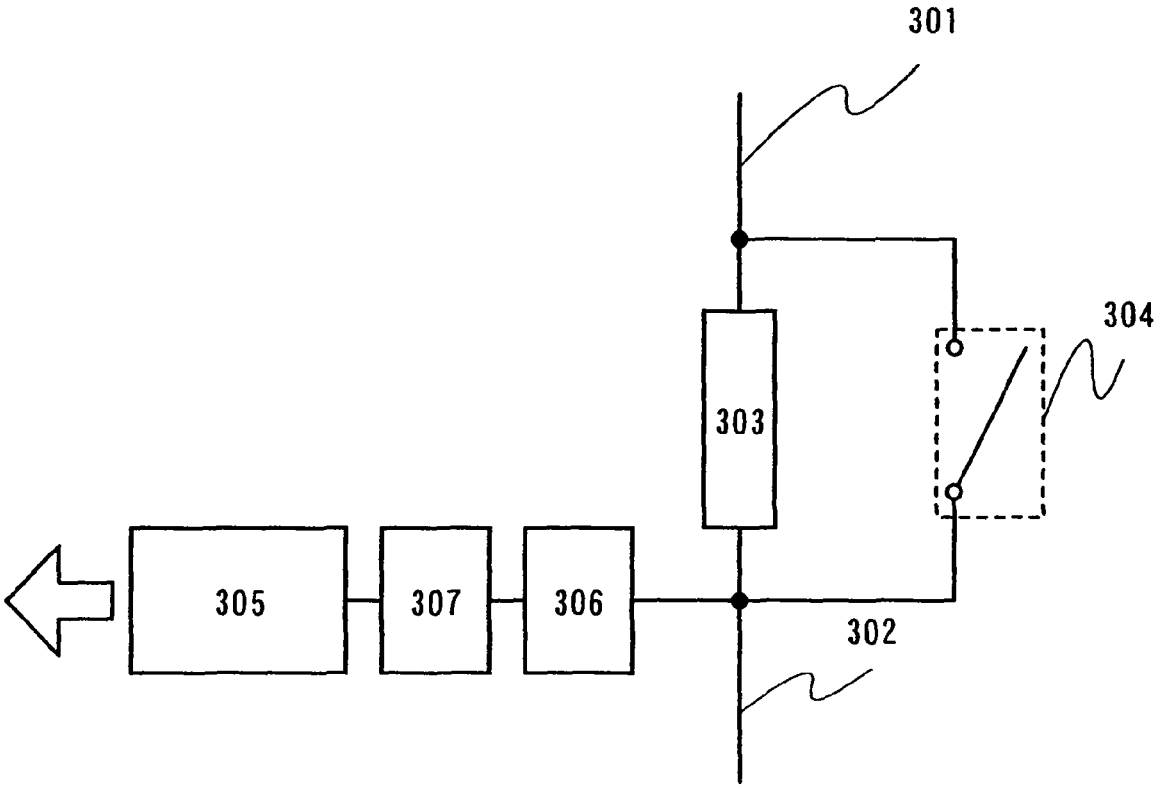
FIG. 6 shows Embodiment Mode 6.

In FIG. 6, reference numerals 301 and 302 denote power supply lines, 303 denotes a resistor, 304 denotes a switching element, 305 denotes an analog-digital converter circuit, 306 denotes a noise-reduction circuit, and 307 denotes an amplifier circuit.

In this semiconductor device, the power supply line 301 is connected to one terminal of the resistor 303 and one terminal of the switching element 304. The power supply line 302 is connected to the other terminal of the resistor 303, the other terminal of the switching element 304, and an input of the noise-reduction circuit 306. An output of the noise-reduction circuit 306 is connected to an input of the amplifier circuit 307, and an output of the amplifier circuit 307 is connected to an input of the analog-digital converter circuit 305. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The resistor 303 is a resistor having a resistance component. The switching element 304 is a switching element having a switching property. The analog-digital converter circuit 305 is a circuit for converting a potential at the other terminal of the resistor 303 into a digital value. The noise-reduction circuit 306 is a circuit for reducing noise generated in the potential at the other terminal of the resistor 303, and the amplifier circuit 307 is a circuit for amplifying a potential at the other terminal of the resistor 303. The converted value is not limited to a digital value, and it may be any value as long as it can be recognized by the compensation circuit 103.

A current value at the time of lighting a light-emitting element in each of the sub-pixels 110(*a*) and 110(*b*) is detected. When the light-emitting element is lighted, a current corresponding to the characteristics of the light-emitting element flows from the power supply line 302 to the power supply line 301 through the resistor 303. Since the power supply line 301 is connected to the power supply 102, the other terminal of the resistor 303 has a potential value which is obtained by subtracting a voltage drop at the resistor 303 from a potential at one terminal of the resistor 303 in the case of Embodiment Mode 1, or a potential value which is obtained by adding a voltage drop at the resistor 303 to a potential at one terminal of the resistor 303 in the case of Embodiment Mode 2. In this manner, in the case of lighting a light-emitting element in each of the sub-pixels 110(*a*) and 110(*b*), a current value flowing through the power supply line 302 is converted into a voltage and then input to the noise-reduction circuit 306 for reducing noise. Then, the signal is output to an input of the amplifier circuit 307 to be amplified, and thus is output to an input of the analog-digital converter circuit 305. At this time, the switching element 304 is set off.

In addition, the switching element 304 is connected in parallel with the resistor 303. Thus, in the case of displaying an image by lighting the light-emitting elements in the plurality of sub-pixels 110(*a*) and 110(*b*) in a normal state, a current value flowing through the power supply line 302 is extremely large as compared with that in the case of lighting a light-emitting element in each sub-pixel. Therefore, a voltage drop due to the resistor 303 is increased, which results in a low voltage applied to the power supply line 105 and the wire 106 connected to the counter electrode. Thus, it is requited to turn on the switching element 304 in the normal drive in order to eliminate the effect of the resistor 303.

The resistance value of the resistor 303 is set such that a potential of the power supply line 302 after a voltage has dropped has a level between a positive potential and a negative potential of the power supply 102. Accordingly, effects of a voltage drop can be reduced, thereby characteristics of a light-emitting element can be detected more accurately.

[Embodiment Mode 7]

Description will be made of an exemplary configuration of the current value detection circuits 101 and 201 described in Embodiment Modes 1 and 2, with reference to FIG. 7.

Figure 7:
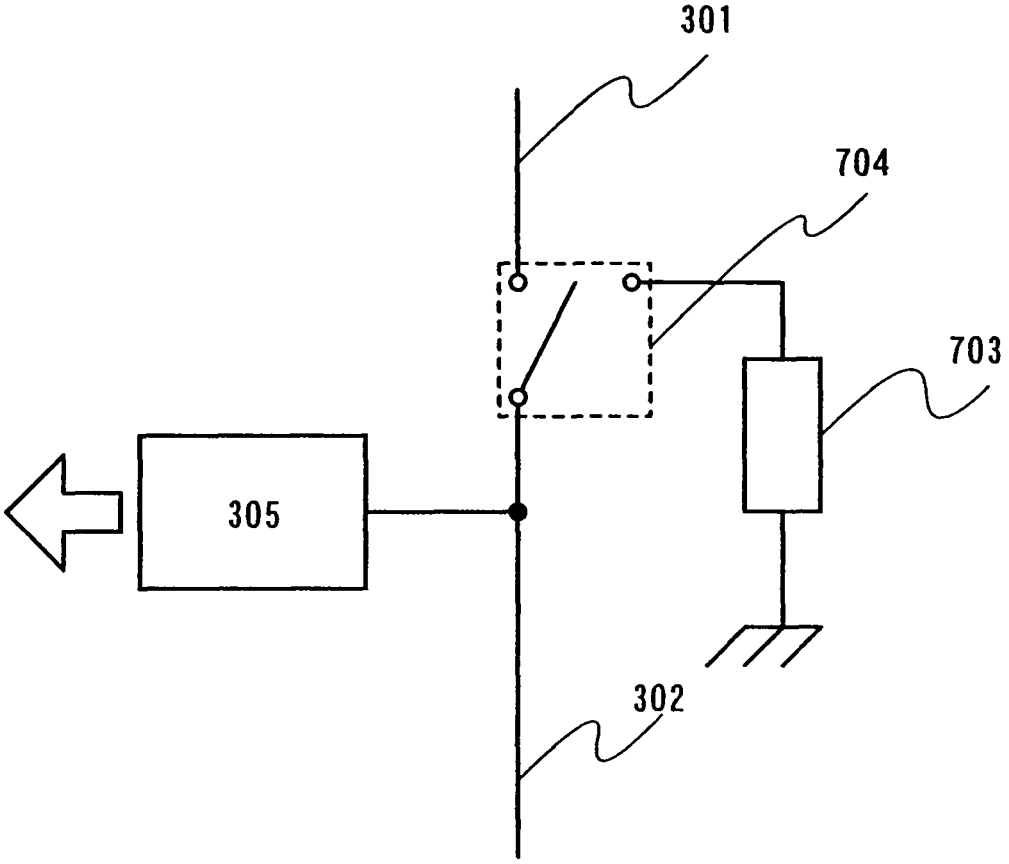
FIG. 7 shows Embodiment Mode 7.

In FIG. 7, reference numerals 301 and 302 denote power supply lines, 703 denotes a constant current source, 704 denotes a selector circuit, and 305 denotes an analog-digital converter circuit.

In this semiconductor device, the power supply line 301 is connected to a first terminal of the selector circuit 704. The power supply line 302 is connected to a second terminal of the selector circuit 704 and an input of the analog-digital converter circuit 305. The constant current source 703 is connected to a third terminal of the selector circuit 704. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The constant current source 703 is a circuit for supplying a constant current. The selector circuit 704 is a circuit for selecting either of the first terminal or the third terminal to be connected to the second terminal. The analog-digital converter circuit 305 is a circuit for converting a potential of the power supply line 302 into a digital value. The converted value is not limited to a digital value, and it may be any value as long as it can be recognized by the compensation circuit 103.

In the case of lighting a light-emitting element in each of the sub-pixels 110(*a*) and 110(*b*), the first terminal and the second terminal of the selector circuit 704 are connected in the normal drive. That is, the power supply line 301 and the power supply line 302 are connected. In this embodiment mode, the constant current source 703 is used for determining if the light-emitting element in each of the sub-pixels 110(*a*) and 110(*b*) has a point defect, a defective bright spot, or a normal state. By connecting the second terminal and the third terminal of the selector circuit 704, a constant current is supplied to the light-emitting element in each of the sub-pixels 110(*a*) and 110(*b*), and a consequent potential change in the power supply line 302 is inspected. In this manner, the potential of the power supply line 302 is input to the analog-digital converter circuit 305.

In this embodiment mode, there are no components such as circuit groups, resistors, or capacitors between the input of the analog-digital converter circuit 305 and the light-emitting element in each of the sub-pixels 110(*a*) and 110(*b*), as in the normal drive. Therefore, noise can be suppressed, and characteristics of a light-emitting element in each sub-pixel can be inspected with the same conditions as in the normal drive.

[Embodiment Mode 8]

Description will be made of an exemplary configuration of the current value detection circuits 101 and 201 described in Embodiment Modes 1 and 2, with reference to FIG. 8.

Figure 8:
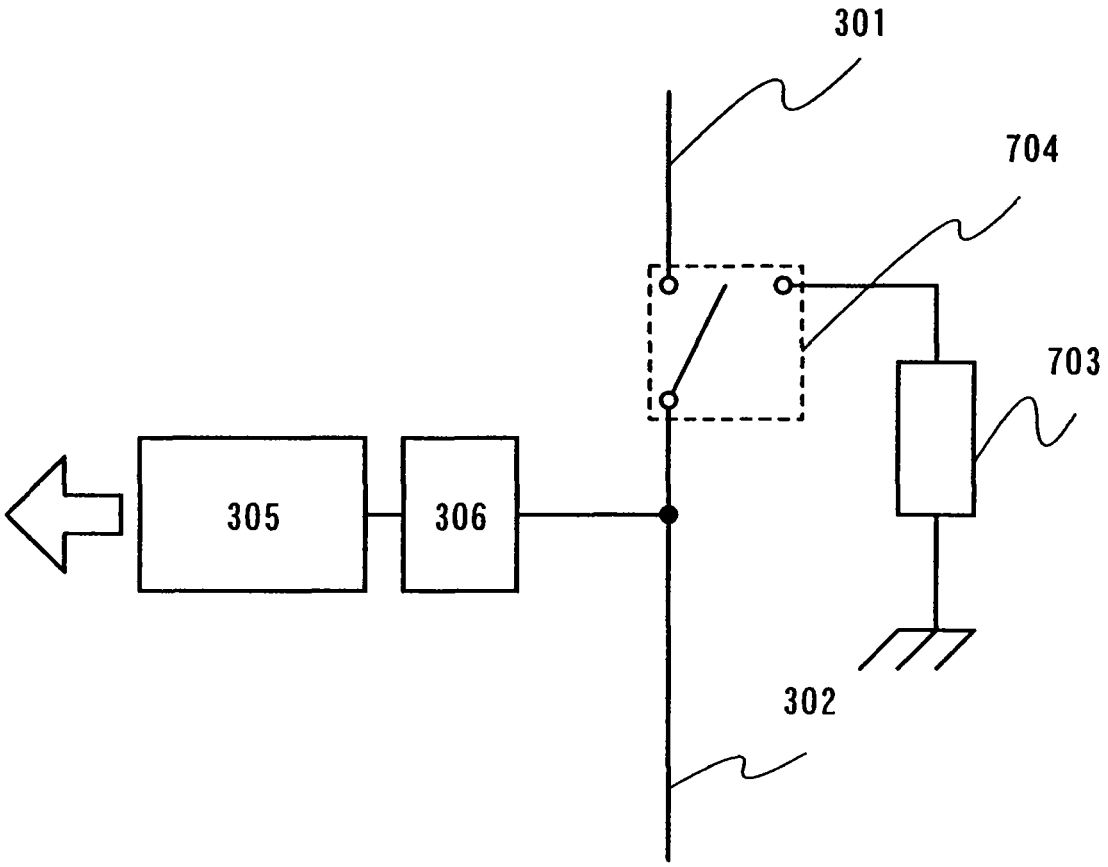
FIG. 8 shows Embodiment Mode 8.

In FIG. 8, reference numerals 301 and 302 denote power supply lines, 703 denotes a constant current source, 704 denotes a selector circuit, 305 denotes an analog-digital converter circuit, and 306 is a noise-reduction circuit.

In this semiconductor device, the power supply line 301 is connected to a first terminal of the selector circuit 704. The power supply line 302 is connected to a second terminal of the selector circuit 704 and an input of the noise-reduction circuit 306. The constant current source 703 is connected to a third terminal of the selector circuit 704. An output of the noise-reduction circuit 306 is connected to an input of the analog-digital converter circuit 305. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The constant current source 703 is a circuit for supplying a constant current. The selector circuit 704 is a circuit for selecting either of the first terminal or the third terminal to be connected to the second terminal. The analog-digital converter circuit 305 is a circuit for converting a potential of the power supply line 302 into a digital value. The noise-reduction circuit 306 is a circuit for reducing noise generated in the potential of the power supply line 302. The converted value is not limited to a digital value, and it may be any value as long as it can be recognized by the compensation circuit 103.

In the case of lighting a light-emitting element in each of the sub-pixels 110(*a*) and 110(*b*), the first terminal and the second terminal of the selector circuit 704 are connected in the normal drive. That is, the power supply line 301 and the power supply line 302 are connected. In this embodiment mode, the constant current source 703 is used for determining if the light-emitting element in each of the sub-pixels 110(*a*) and 110(*b*) has a point defect, a defective bright spot, or a normal state. By connecting the second terminal and the third terminal of the selector circuit 704, a constant current is supplied to the light-emitting element in each of the sub-pixels 110(*a*) and 110(*b*), and a consequent potential change in the power supply line 302 is inspected. In this manner, the potential of the power supply line 302 is output to the input of the noise-reduction circuit 306 for reducing noise, and then input to the analog-digital converter circuit 305.

In this embodiment mode, there are no components such as circuit groups, resistors, or capacitors between the input of the analog-digital converter circuit 305 and the light-emitting element in each of the sub-pixels 110(*a*) and 110(*b*), as in the normal drive. Therefore, noise can be suppressed, and characteristics of a light-emitting element in each sub-pixel can be inspected with the same conditions as in the normal drive.

[Embodiment Mode 9]

Description will be made of an exemplary configuration of the current value detection circuits 101 and 201 described in Embodiment Modes 1 and 2, with reference to FIG. 9.

Figure 9:
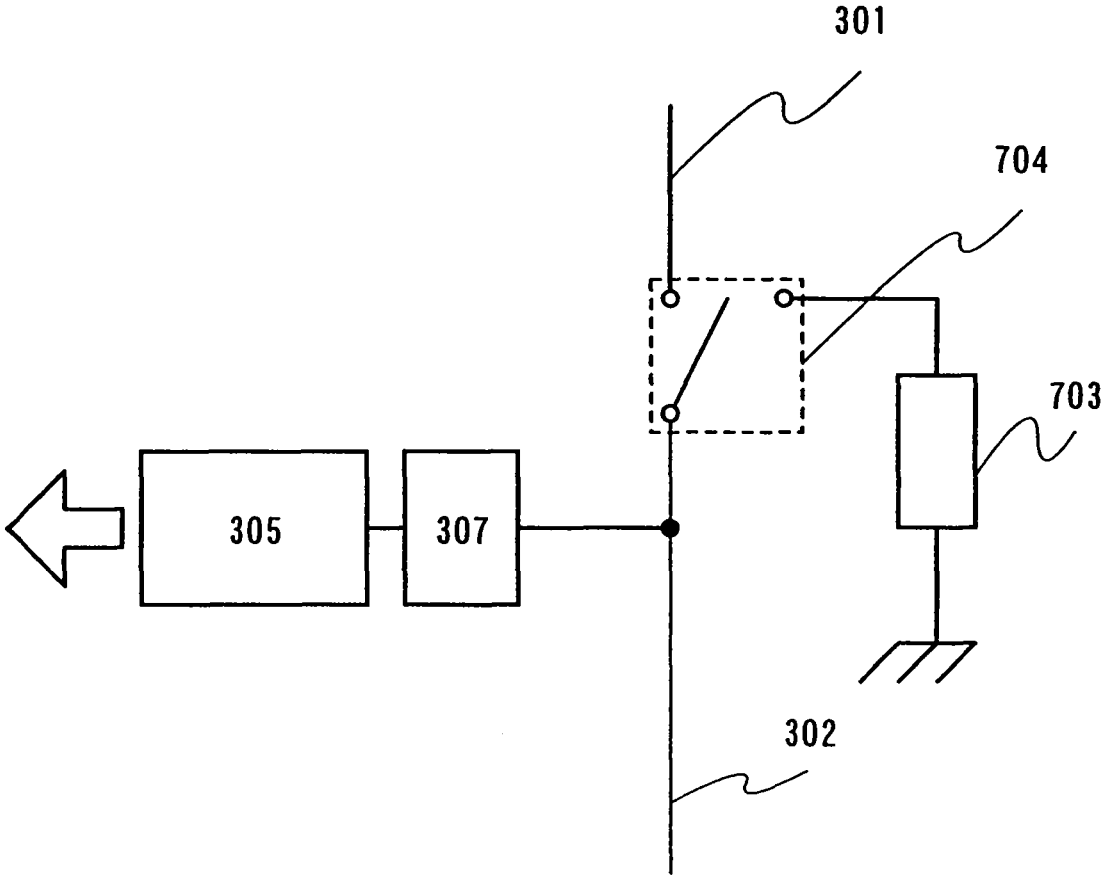
FIG. 9 shows Embodiment Mode 9.

In FIG. 9, reference numerals 301 and 302 denote power supply lines, 703 denotes a constant current source, 704 denotes a selector circuit, 305 denotes an analog-digital converter circuit, and 307 is an amplifier circuit.

In this semiconductor device, the power supply line 301 is connected to a first terminal of the selector circuit 704. The power supply line 302 is connected to a second terminal of the selector circuit 704 and an input of the amplifier circuit 307. The constant current source 703 is connected to a third terminal of the selector circuit 704. An output of the amplifier circuit 307 is connected to an input of the analog-digital converter circuit 305. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The constant current source 703 is a circuit for supplying a constant current. The selector circuit 704 is a circuit for selecting either of the first terminal or the third terminal to be connected to the second terminal. The analog-digital converter circuit 305 is a circuit for converting a potential of the power supply line 302 into a digital value, and the amplifier circuit 307 is a circuit for amplifying a potential of the power supply line 302. The converted value is not limited to a digital value, and it may be any value as long as it can be recognized by the compensation circuit 103.

In the case of lighting a light-emitting element in each of the sub-pixels 110(*a*) and 110(*b*), the first terminal and the second terminal of the selector circuit 704 are connected in the normal drive. That is, the power supply line 301 and the power supply line 302 are connected. In this embodiment mode, the constant current source 703 is used for determining if the light-emitting element in each of the sub-pixels 110(*a*) and 110(*b*) has a point defect, a defective bright spot, or a normal state. By connecting the second terminal and the third terminal of the selector circuit 704, a constant current is supplied to the light-emitting element in each of the sub-pixels 110(*a*) and 110(*b*), and a consequent potential change in the power supply line 302 is inspected. In this manner, the potential of the power supply line 302 is output to an input of the amplifier circuit 307 to be amplified, and then input to the analog-digital converter circuit 305.

In this embodiment mode, there are no components such as circuit groups, resistors, or capacitors between the input of the analog-digital converter circuit 305 and the light-emitting element in each of the sub-pixels 110(*a*) and 110(*b*), as in the normal drive. Therefore, noise can be suppressed, and characteristics of a light-emitting element in each sub-pixel can be inspected with the same conditions as in the normal drive.

[Embodiment Mode 10]

Description will be made of an exemplary configuration of the current value detection circuits 101 and 201 described in Embodiment Modes 1 and 2, with reference to FIG. 10.

Figure 10:
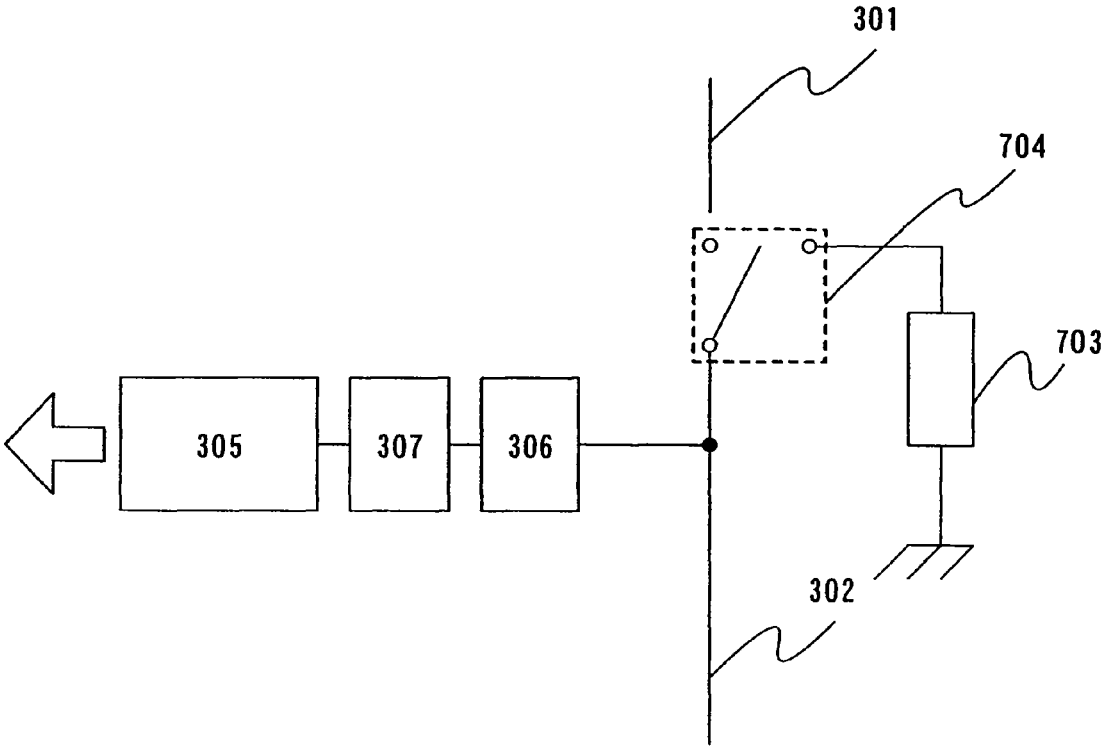
FIG. 10 shows Embodiment Mode 10.

In FIG. 10, reference numerals 301 and 302 denote power supply lines, 703 denotes a constant current source, 704 denotes a selector circuit, 305 denotes an analog-digital converter circuit, 306 denotes a noise-reduction circuit, and 307 is an amplifier circuit.

In this semiconductor device, the power supply line 301 is connected to a first terminal of the selector circuit 704. The power supply line 302 is connected to a second terminal of the selector circuit 704 and an input of the noise-reduction circuit 306. The constant current source 703 is connected to a third terminal of the selector circuit 704. An output of the noise-reduction circuit 306 is connected to an input of the amplifier circuit 307, and an output of the amplifier circuit 307 is connected to an input of the analog-digital converter circuit 305. In addition, the power supply line 301 is connected to the positive side of the power supply 102 (in Embodiment Mode 1) or the negative side thereof (in Embodiment Mode 2), while the power supply line 302 is connected to the power supply line 105 (in Embodiment Mode 1) or the wire 106 (in Embodiment Mode 2).

The constant current source 703 is a circuit for supplying a constant current. The selector circuit 704 is a circuit for selecting either of the first terminal or the third terminal to be connected to the second terminal. The analog-digital converter circuit 305 is a circuit for converting a potential of the power supply line 302 into a digital value. The noise-reduction circuit 306 is a circuit for reducing noise generated in the potential of the power supply line 302. The amplifier circuit 307 is a circuit for amplifying a potential of the power supply line 302. The converted value is not limited to a digital value, and it may be any value as long as it can be recognized by the compensation circuit 103.

In the case of lighting a light-emitting element in each of the sub-pixels 110(*a*) and 110(*b*), the first terminal and the second terminal of the selector circuit 704 are connected each other in the normal drive. That is, the power supply line 301 and the power supply line 302 are connected. In this embodiment mode, the constant current source 703 is used for determining if the light-emitting element in each of the sub-pixels 110(*a*) and 110(*b*) has a point defect, a defective bright spot, or a normal state. By connecting the second terminal and the third terminal of the selector circuit 704, a constant current is supplied to the light-emitting element in each of the sub-pixels 110(*a*) and 110(*b*), and a consequent potential change in the power supply line 302 is inspected. In this manner, the potential of the power supply line 302 is output to the input of the noise-reduction circuit 306 for reducing noise, and then output to the input of the amplifier circuit 307. Thus, the signal is amplified to be input to the analog-digital converter circuit 305.

In this embodiment mode, there are no components such as circuit groups, resistors, or capacitors between the input of the analog-digital converter circuit 305 and the light-emitting element in each of the sub-pixels 110(*a*) and 110(*b*), as in the normal drive. Therefore, noise can be suppressed, and characteristics of a light-emitting element in each sub-pixel can be inspected with the same conditions as in the normal drive.

[Embodiment Mode 11]

Description will be made of an exemplary configuration of the analog-digital converter circuit 305 described in Embodiment Modes 3 to 10, with reference to FIG. 11.

Figure 11:
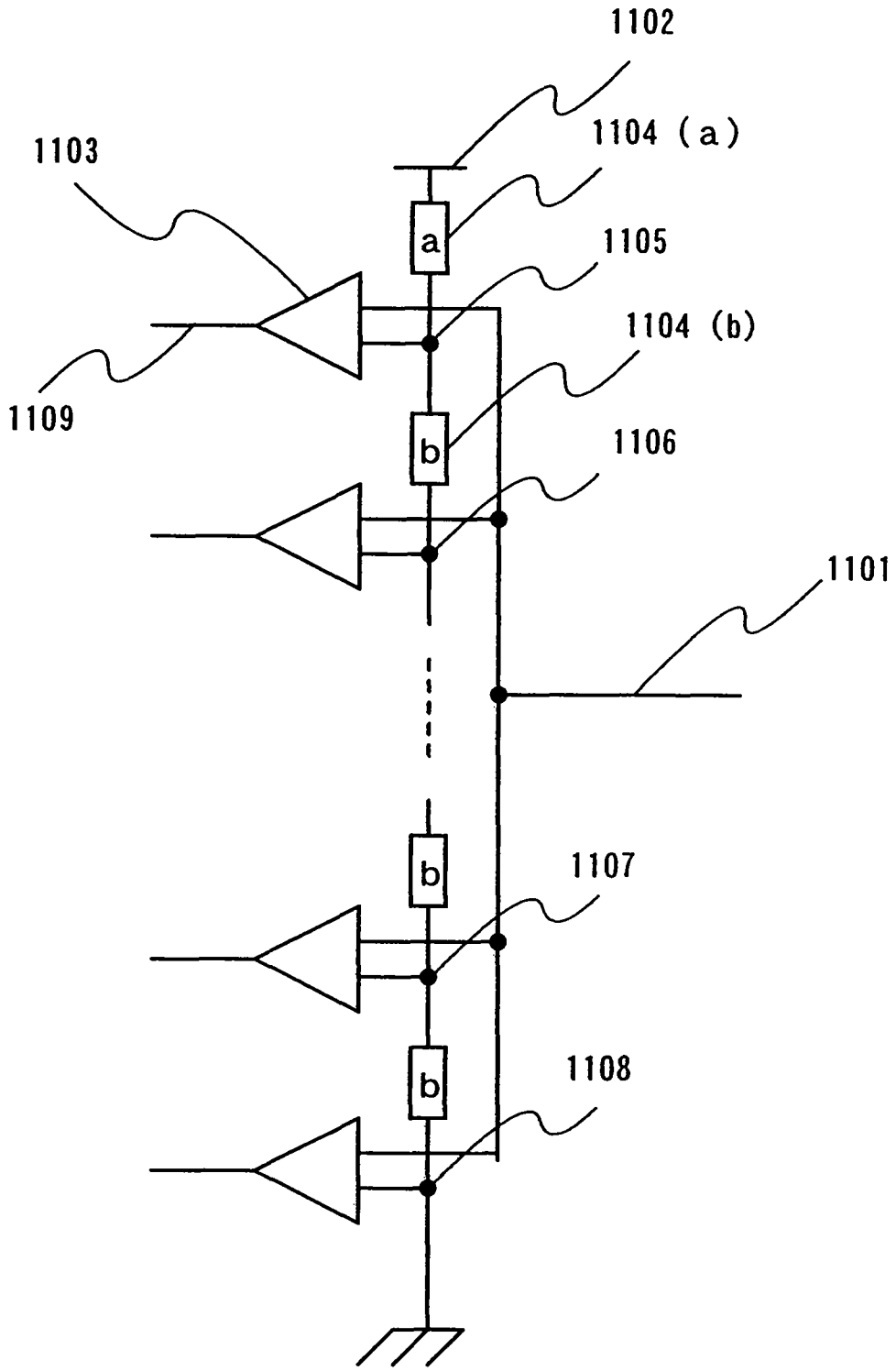
FIG. 11 shows Embodiment Mode 11.

In the semiconductor device in FIG. 11, reference numeral 1101 denotes a data signal input line, 1102 denotes a power supply, 1103 denotes an operational amplifier, 1104(*a*) and 1104(*b*) denote resistors, 1105 denotes a comparative potential (first row), 1106 denotes a comparative potential (second row), 1107 denotes a comparative potential ((n−1)-th row), 1108 denotes a comparative potential (n-th row), and 1109 denotes an output of the operational amplifier.

The data input line 1101 is input to a first input terminal of the operational amplifier 1103, and the power supply 1102 is connected to a reference potential (ground potential, herein) through the resistor 1104(*a*) and a plurality of the resistors 1104(*b*), thereby a potential generated in each resistor 1104(*b*) is used as a comparative potential which is to be input to a second input terminal of the operational amplifier 1103.

The data input line 1101 has a potential of the power supply line 302 or an amplified potential of the power supply line 302. The operational amplifier 1103 is a circuit which compares potentials at the first and second input terminals to determine which is higher than the other. A circuit group connected between the power supply 1102 and the reference potential through the resistor 1104(*a*) and the plurality of resistors 1104(*b*) corresponds to a circuit for inputting different potentials to the respective second input terminals of the operational amplifiers 1103. Each of the potentials output from the opposite terminals of the resistor 1104(*a*) and the plurality of resistors 1104(*b*) corresponds to a potential which is obtained by resistance-dividing the potentials of the power supply 1102 and the reference potential. In this manner, each operational amplifiers 1103 compares a potential from the data input line 1101 with a potential of the comparative potential 1105, 1106, 1107, or 1108, thereby a potential of the data input line 1101 can be detected.

Although a potential of the data input line 1101 is not converted into a digital value in this embodiment mode, a certain level of potential values can be inspected. Therefore, such a comparator circuit can be used without the need of converting an analog value into a digital value.

In addition, not only the operational amplifier 1103, but any circuit which can compare potentials at the first and second input terminals can be used. Further, although the number of the operational amplifiers 1103 is not specifically limited, it is desirably two. This is because, if the potentials connected to the second input terminals of the two operational amplifiers 1103 are set to the maximum level and the minimum level respectively, it can be determined that a pixel has a defect when the potentials input to the first terminals are equal to or higher than the maximum level or equal to or lower than the minimum level. The maximum level and the minimum level of the potentials are determined in consideration of variations of the potentials of the data input line 1101.

[Embodiment Mode 12]

Description will be made of an exemplary noise-reduction circuit 306 described in Embodiment Modes 3 to 10, with reference to FIG. 12.

Figure 12:
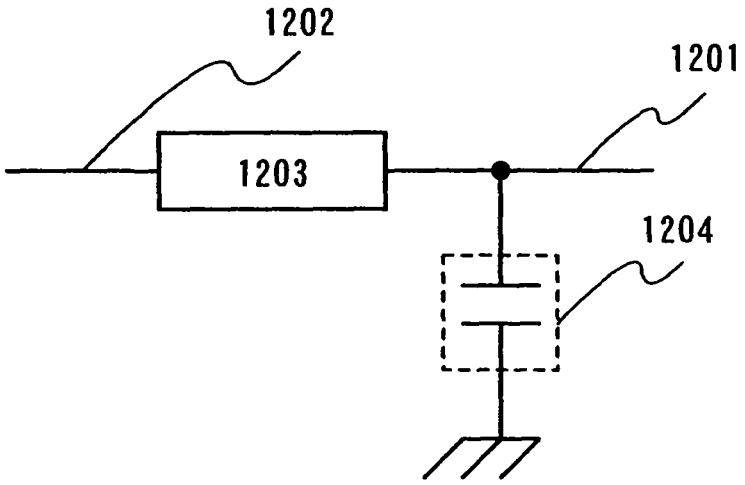
FIG. 12 shows Embodiment Mode 12.

In FIG. 12, reference numeral 1201 denotes a data input line, 1202 denotes a data output line, 1203 denotes a resistor, and 1204 denotes a capacitor.

In this semiconductor device, the data input line 1201 is connected to one electrode of the resistor 1203 and one electrode of the capacitor 1204, the other electrode of the capacitor 1204 is connected to the reference potential, and the other electrode of the resistor 1203 is connected to the data output line 1202.

Assuming that the resistance value of the resistor 1203 is R [Ω] and the capacitance value of the capacitor 1204 is C [μF], noise with a frequency higher than ½ pRC is cut. Therefore, noise with a high frequency can be reduced.

[Embodiment Mode 13]

Description will be made of an exemplary configuration of the amplifier circuit 307 described in Embodiment Modes 3 to 10, with reference to FIG. 13.

Figure 13:
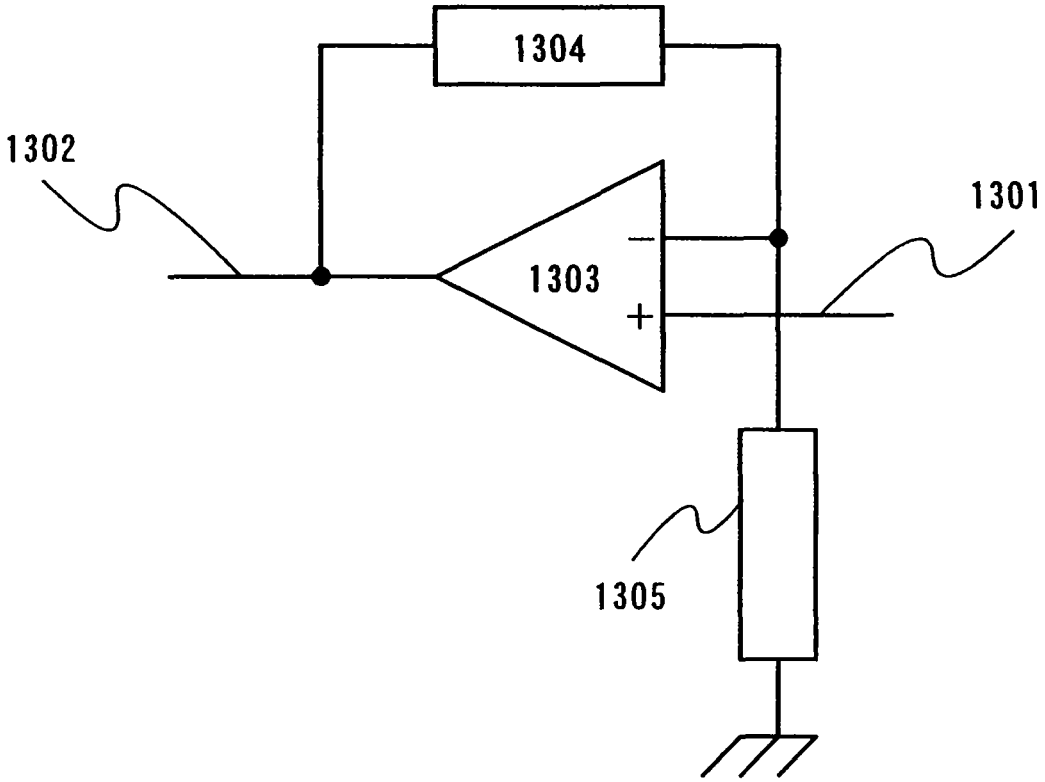
FIG. 13 shows Embodiment Mode 13.

In FIG. 13, reference numeral 1301 denotes a data input line, 1302 denotes a data output line, 1303 denotes an operational amplifier, and 1304 and 1305 denote resistors.

In this semiconductor device, the data input line 1301 is input to a first input terminal of the operational amplifier 1303; a second input terminal of the operational amplifier 1303 is connected to one terminal of the resistor 1304 and one terminal of the resistor 1305; the other terminal of the resistor 1305 is connected to a reference potential; and the other terminal of the resistor 1304 is connected to the data output line 1302 as an output of the operational amplifier 1303.

Assuming that the resistance value of the resistor 1304 is R(4) [Ω], the resistance value of the resistor 1305 is R(5) [Ω], and a potential input from the data input line 1301 is Vsin, the data output line 1302 has a potential $Vout=Vin\cdot\{[R(4)+R(5)]/R(5)\}$. In this manner, the potential obtained from the power supply line 302 can be amplified, thereby it becomes easier to convert an analog value into a digital value in the analog-digital converter circuit 305.

[Embodiment Mode 14]

Description will be made of an exemplary configuration of the panel 107 described in Embodiment Modes 1 and 2, with reference to FIG. 14.

Figure 14:
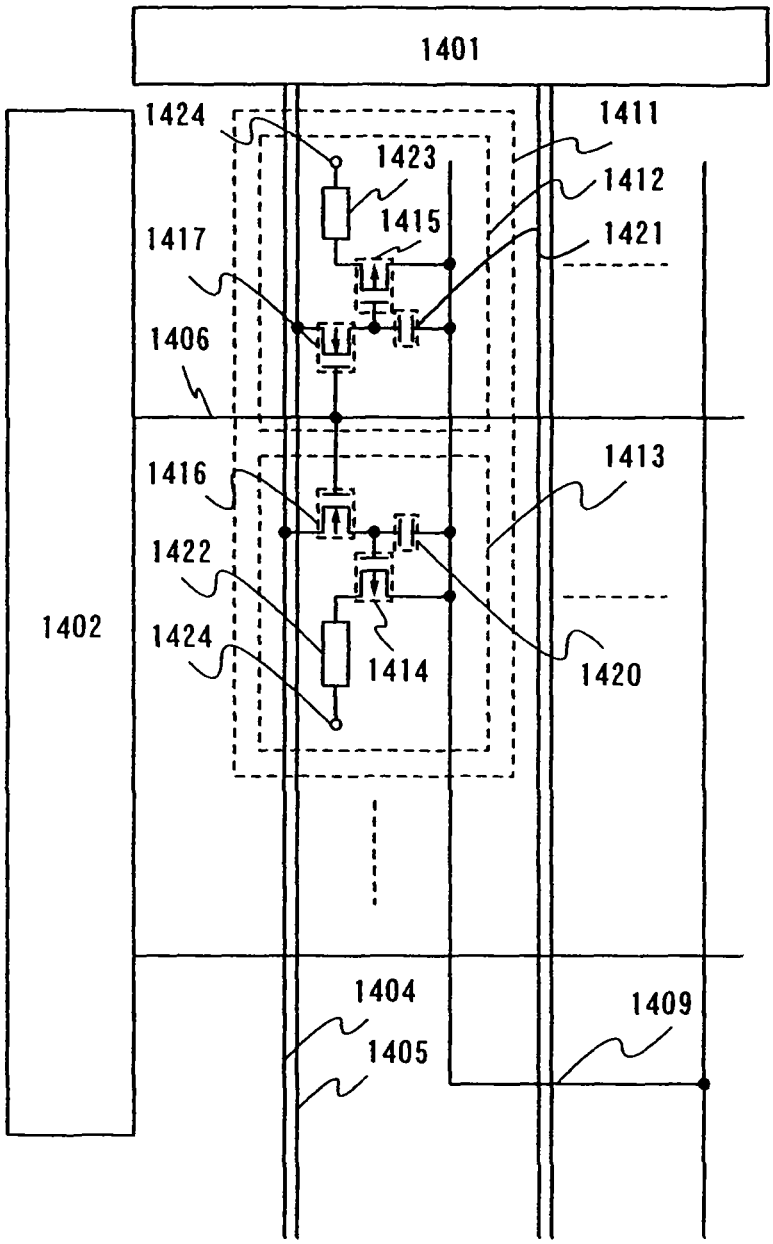
FIG. 14 shows Embodiment Mode 14.

In FIG. 14, reference numeral 1401 denotes a source driver, 1402 denotes a gate driver, 1404 and 1405 denote source signal lines, 1406 denotes a gate signal line, 1409 denotes a power supply line, 1411 denotes a pixel, 1412 and 1413 denote sub-pixels, 1414, 1415, 1416, and 1417 denote TFT's, 1420 and 1421 denote capacitors each having a pair of electrodes, 1422 and 1423 denote light-emitting elements each having a pair of electrodes, and 1424 denotes a counter electrode corresponding to the other electrode of the light-emitting element 1422 and the other electrode of the light-emitting element 1423. Note that in this embodiment mode, the TFTs 1414 and 1415 are p-channel thin film transistors, while the TFTs 1416 and 1417 are n-channel thin film transistors.

The source driver 1401 is connected to and outputs video signals to the source signal lines 1404 and 1405. The gate driver 1402 is connected to and scans the gate signal line 1406. The power supply line 1409 is connected to one of either a source or a drain of the TFT 1414 and one of either a source or a drain of the TFT 1415. The other of either the source or the drain of the TFT 1414 is connected to one electrode of the light-emitting element 1422, and the other of either the source or the drain of the TFT 1415 is connected to one electrode of the light-emitting element 1423. A gate of the TFT 1414 is connected to one electrode of the capacitor 1420 and one of either a source or a drain of the TFT 1416, while a gate of the TFT 1415 is connected to one electrode of the capacitor 1421 and one of either a source or a drain of the TFT 1417. The other electrode of the capacitor 1420 and the other electrode of the capacitor 1421 are connected to the power supply line 1409. The other of either the source or the drain of the TFT 1416 is connected to the source signal line 1404, and the other of either the source or the drain of the TFT 1417 is connected to the source signal line 1405. Gates of the TFT 1416 and the TFT 1417 are connected to the gate signal line 1406.

When the TFT 1416 is turned on, a video signal is written to the gate of the TFT 1414 and one electrode of the capacitor 1420 through the source signal line 1404. When the TFT 1417 is turned on, a video signal is written to the gate of the TFT 1415 and one electrode of the capacitor 1421 through the source signal line 1405. The gates of the TFT 1416 and the TFT 1417 are connected to the common gate signal line 1406; therefore, they are turned on at the same time. The value of a current flowing in each of the TFT 1414 and the TFT 1415 is determined by a relationship between a potential of a video signal input to the gate thereof and a potential of the power supply line 1409, thereby currents flowing into the light-emitting element 1422 and the light-emitting element 1423 are determined. That is, luminance is determined by a video signal. In this manner, TFTs for controlling a current flowing into a light-emitting element in each sub-pixel is also called a luminance determination circuit of a light-emitting element. Since video signals are separately input to the sub-pixel 1412 and the sub-pixel 1413, the luminance of the sub-pixel 1412 and the luminance of the sub-pixel 1413 can be varied from each other. Therefore, provided that areas of the light-emitting element 1422 and the light-emitting element 1423 are designed to have a ratio of 1:2 with the condition that one sub-pixel can display 16 gray scales, 64 gray scales can be displayed. In this manner, a larger number of gray scales can be displayed.

Although the luminance of the light-emitting element 1422 and the light-emitting element 1423 is determined by the value of currents flowing therein in the aforementioned driving method, the luminance can be determined by the light-emitting time as well. Description will be made below of this case.

In the invention, a video signal input from each of the source signal line 1404 and the source signal line 1405 is set to have a potential with a binary value which can turn on/off the TFT 1414 and the TFT 1415. Accordingly, either a light-emitting state or a non-light-emitting state can be selected. In this case, by dividing one frame period into a plurality of sub-frame periods, gray scales (luminance) are expressed. For example, by dividing one frame into six sub-frames, setting the length of the respective light-emitting periods to 1:2:4:8:16:32, and combining each sub-frame, gray scales (luminance) with 64 levels can be expressed. Note that the invention is not limited to this, and for example, the above length may be 1:2:4:8:8:8:8:8:8. This example corresponds to the case where the light-emitting periods of the 16 and 32 are divided into 8, 8, and 8, 8, 8, 8 respectively.

In the aforementioned method of expressing gray scales (luminance) with the light-emitting time, an erasing period may be provided. An erasing period corresponds to the period in which, in the case where one frame period is divided into a plurality of sub-frames, light emission of a light-emitting element is suspended for a while in one sub-frame until the next sub-frame starts. As a method for this operation, the TFT 1414 and the TFT 1415 may be turned off. In order to realize this, a sub-frame period may be divided in half, so that a writing operation can be performed in one of the periods, while an erasing operation can be performed in the other period. In the erasing operation, video signals which can turn off the TFT 1414 and the TFT 1415 are output from the source signal line 1404 and the source signal line 1405 respectively.

Although this embodiment mode illustrates the case where two source signal lines are provided, the invention is not limited to this, and more than two source signal lines may be provided in accordance with the increase in the number of sub-pixels.

Since each of the TFT 1416 and the TFT 1417 operates as a switching element, it may be replaced with either an electrical switch or a mechanical switch as long as it can control a current flow. As the switching element, for example, a diode or a logic circuit constructed from a diode and a transistor may be employed. In addition, if the operating point of the TFT 1414 and the light-emitting element 1422 and the operating point of the TFT 1415 and the light-emitting element 1423 are set so as to allow the TFT 1414 and the TFT 1415 to operate in the linear region, variations in the threshold voltage of the TFT 1414 and the TFT 1415 will not affect the display; therefore, a display device with higher image quality can be provided.

[Embodiment Mode 15]

Description will be made of an exemplary configuration of the panel 107 described in Embodiment Modes 1 and 2, with reference to FIG. 15.

Figure 15:
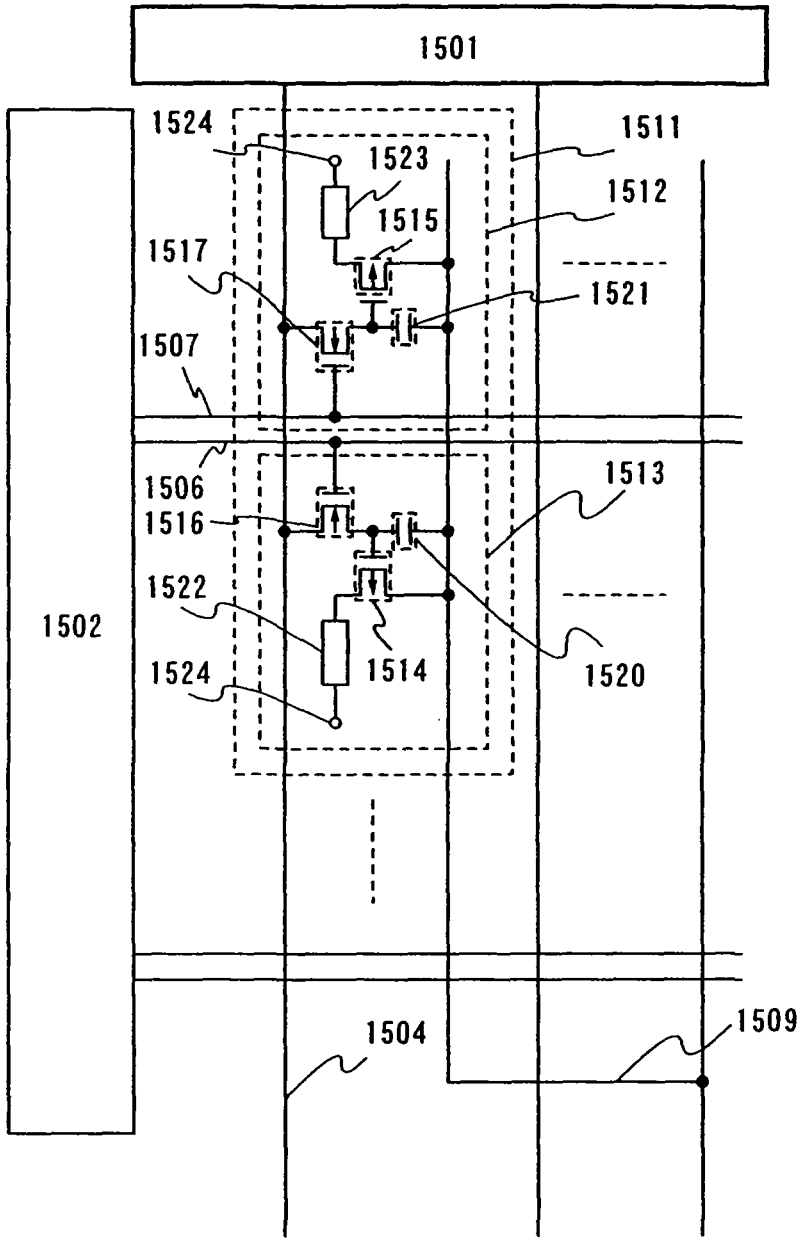
FIG. 15 shows Embodiment Mode 15.

In FIG. 15, reference numeral 1501 denotes a source driver, 1502 denotes a gate driver, 1504 denotes a source signal line, 1506 and 1507 denote gate signal lines, 1509 denotes a power supply line, 1511 denotes a pixel, 1512 and 1513 denote sub-pixels, 1514, 1515, 1516, and 1517 denote TFTs, 1520 and 1521 denote capacitors each having a pair of electrodes, 1522 and 1523 denote light-emitting elements each having a pair of electrodes, and 1524 denotes a counter electrode corresponding to the other electrode of the light-emitting element 1522 and the other electrode of the light-emitting element 1523. Note that in this embodiment mode, the TFTs 1514 and 1515 are p-channel thin film transistors, while the TFTs 1516 and 1517 are n-channel thin film transistors.

The source driver 1501 is connected to and outputs video signals to the source signal line 1504. The gate driver 1502 is connected to and scans the gate signal line 1506 and the gate signal line 1507. The power supply line 1509 is connected to one of either a source or a drain of the TFT 1514 and one of either a source or a drain of the TFT 1515. The other of either the source or the drain of the TFT 1514 is connected to one electrode of the light-emitting element 1522, and the other of either the source or the drain of the TFr 1515 is connected to one electrode of the light-emitting element 1523. A gate of the TFT 1514 is connected to one electrode of the capacitor 1520 and one of either a source or a drain of the TFT 1516, while a gate of the TFT 1515 is connected to one electrode of the capacitor 1521 and one of either a source or a drain of the TFT 1517. The other electrode of the capacitor 1520 and the other electrode of the capacitor 1521 are connected to the power supply line 1509. The other of either the source or the drain of the TFT 1516 and the other of either the source or the drain of the TFT 1517 are connected to the source signal line 1504. A gate of the TFT 1516 is connected to the gate signal line 1506 and a gate of the TFT 1517 is connected to the gate signal line 1507.

When the TFT 1516 is turned on, a video signal is written to the gate of the TFT 1514 and one electrode of the capacitor 1520 through the source signal line 1504. When the TFT 1517 is turned on, a video signal is written to the gate of the TFT 1515 and one electrode of the capacitor 1521 through the source signal line 1504. The gate of the TFT 1516 is connected to the gate signal line 1506, while the gate of the TFT 1517 is connected to the gate signal line 1507; therefore, they are separately turned on, and thus the source signal line 1504 can be used in common. The value of a current flowing in each of the TFT 1514 and the TFT 1515 is determined by a relationship between a potential of a video signal input to the gate thereof and a potential of the power supply line 1509, thereby currents flowing into the light-emitting element 1522 and the light-emitting element 1523 are determined. That is, luminance is determined by a video signal. Since video signals are separately input to the sub-pixel 1512 and the sub-pixel 1513, the luminance of the sub-pixel 1512 and the luminance of the sub-pixel 1513 can be varied from each other. Therefore, provided that areas of the light-emitting element 1522 and the light-emitting element 1523 are designed to have a ratio of 1:2 with the condition that one sub-pixel can display 16 gray scales, 64 gray scales can be displayed. In this manner, a larger number of gray scales can be displayed.

Although the luminance of the light-emitting element 1522 and the light-emitting element 1523 is determined by the value of currents flowing therein in the aforementioned driving method, the luminance can be determined by the light-emitting time as well. Description will be made below of this case.

In the invention, a video signal input from the source signal line 1504 is set to have a potential with a binary value which can turn on/off the TFT 1514 and the TFT 1515. Accordingly, either a light-emitting state or a non-light-emitting state can be selected. In this case, by dividing one frame period into a plurality of sub-frame periods, gray scales (luminance) are expressed. For example, by dividing one frame into six sub-frames, setting the length of the respective light-emitting periods to 1:2:4:8:16:32, and combining each sub-frame, gray scales (luminance) with 64 levels can be expressed. Note that the invention is not limited to this, and for example, the above length of a light-emitting period in each sub-frame may be 1:2:4:8:8:8:8:8:8. This example corresponds to the case where the light-emitting periods of 16 and 32 are divided into 8, 8, and 8, 8, 8, 8 respectively.

In the aforementioned method of expressing gray scales (luminance) with the light-emitting time, an erasing period may be provided. An erasing period corresponds to the period in which, in the case where one frame period is divided into a plurality of sub-frames, light emission of a light-emitting element is suspended for a while in one sub-frame until the next sub-frame starts. As a method for this operation, the TFT 1514 and the TFT 1515 may be turned off. In order to realize this, a sub-frame period may be divided in half, so that a writing operation can be performed in one period, while an erasing operation can be performed in the other period. In the erasing operation, video signals which can turn off the TFT 1514 and the TFT 1515 are output from the source signal line 1504.

Although this embodiment mode illustrates the case where two gate signal lines are provided, the invention is not limited to this, and more than two gate signal lines may be provided in accordance with the increase in the number of sub-pixels.

Since each of TFF 1516 and the TFT 1517 operates as a switching element, it may be replaced with either an electrical switch or a mechanical switch as long as it can control a current flow. As the switching element, for example, a diode or a logic circuit constructed from a diode and a transistor may be employed. Further, each of the TFT 1514 and the TFT 1515 may also be operated as a switching element. In addition, if the operating point of the TFT 1514 and the light-emitting element 1522 and the operating point of the TFI 1515 and the light-emitting element 1523 are set so as to allow the TFT 1514 and the TFT 1515 to operate in the linear region, variations in the threshold voltage of the TFT 1514 and the TFT 1515 will not affect the display; therefore, a display device with higher image quality can be provided.

[Embodiment Mode 16]

Description will be made of an exemplary configuration of the panel 107 described in Embodiment Modes 1 and 2, with reference to FIG. 16.

Figure 16:
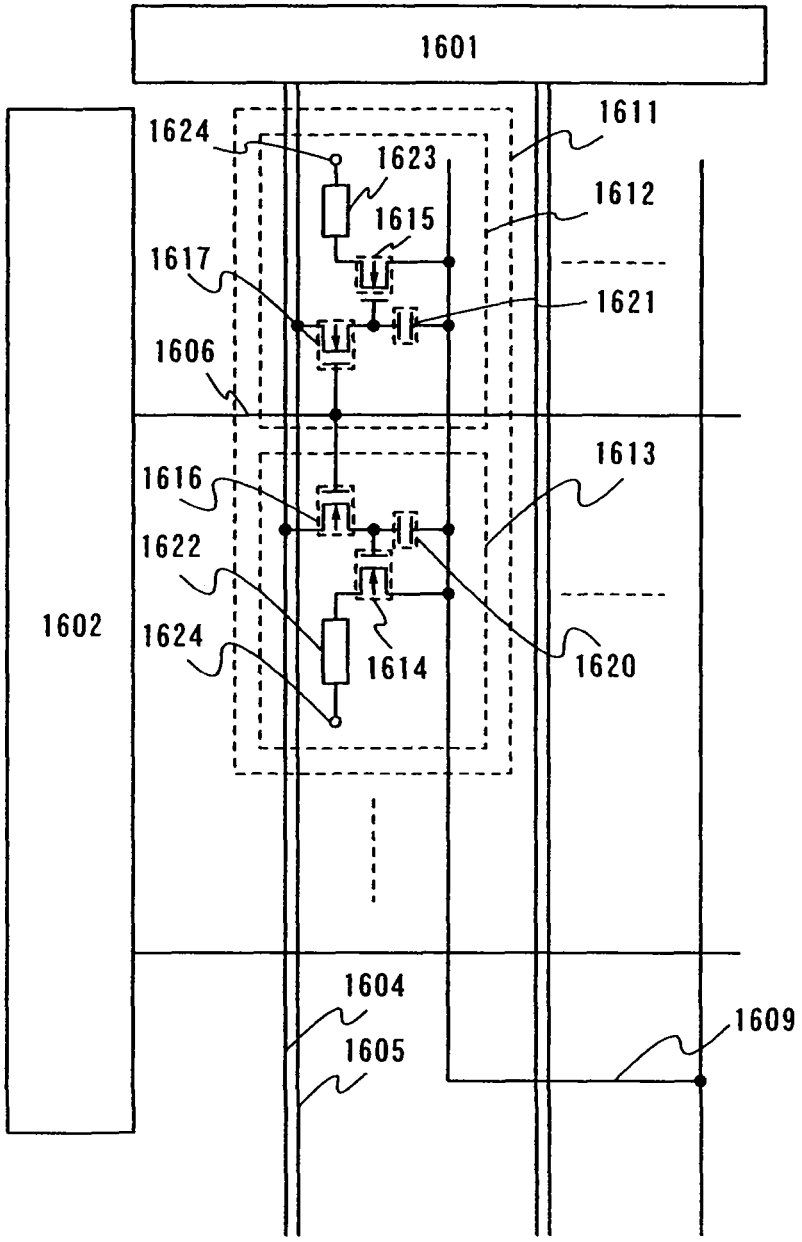
FIG. 16 shows Embodiment Mode 16.

In FIG. 16, reference numeral 1601 denotes a source driver, 1602 denotes a gate driver, 1604 and 1605 denote source signal lines, 1606 denotes a gate signal line, 1609 denotes a power supply line, 1611 denotes a pixel, 1612 and 1613 denote sub-pixels, 1614, 1615, 1616, and 1617 denote TFTs, 1620 and 1621 denote capacitors each having a pair of electrodes, 1622 and 1623 denote light-emitting elements each having a pair of electrodes, and 1624 denotes a counter electrode corresponding to the other electrode of the light-emitting element 1622 and the other electrode of the light-emitting element 1623. Note that in this embodiment mode, the TFTs 1614 and 1615, 1616, and 1617 are n-channel thin film transistors.

The source driver 1601 is connected to and outputs video signals to the source signal line 1604 and the source signal line 1605. The gate driver 1602 is connected to and scans the gate signal line 1406. The power supply line 1609 is connected to one of either a source or a drain of the TFT 1614 and one of either a source or a drain of the TFT 1615. The other of either the source or the drain of the TFT 1614 is connected to one electrode of the light-emitting element 1622, and the other of either the source or the drain of the TFT 1615 is connected to one electrode of the light-emitting element 1623. A gate of the TFT 1614 is connected to one electrode of the capacitor 1620 and one of either a source or a drain of the TFT 1616, while a gate of the TFT 1615 is connected to one electrode of the capacitor 1621 and one of either a source or a drain of the TFT 1617. The other electrode of the capacitor 1620 and the other electrode of the capacitor 1621 are connected to the power supply line 1609. The other of either the source or the drain of the TFT 1616 is connected to the source signal line 1604, and the other of either the source or the drain of the TFT 1617 is connected to the source signal line 1605. Gates of the TFT 1616 and the TFT 1617 are connected to the gate signal line 1606.

When the TFT 1616 is turned on, a video signal is written to the gate of the TFT 1614 and one electrode of the capacitor 1620 through the source signal line 1604. When the TFT 1617 is turned on, a video signal is written to the gate of the TFT 1615 and one electrode of the capacitor 1621 through the source signal line 1605. The gates of the TFT 1616 and the TFT 1617 are connected to the common gate signal line 1606; therefore, they are turned on at the same time. The value of a current flowing in each of the TFT 1614 and the TFT 1615 is determined by a relationship between a potential of a video signal input to the gate thereof and a potential of the power supply line 1609, thereby currents flowing into the light-emitting element 1622 and the light-emitting element 1623 are determined. That is, luminance is determined by a video signal. Since video signals are separately input to the sub-pixel 1612 and the sub-pixel 1613, the luminance of the sub-pixel 1612 and the sub-pixel 1613 can be varied from each other. Therefore, provided that areas of the light-emitting element 1622 and the light-emitting element 1623 are designed to have a ratio of 1:2 with the condition that one sub-pixel can display 16 gray scales, 64 gray scales can be displayed. In this manner, a larger number of gray scales can be displayed.

Although the luminance of the light-emitting element 1622 and the light-emitting element 1623 is determined by the value of currents flowing therein in the aforementioned driving method, the luminance can be determined by the light-emitting time as well. Description will be made below of this case.

In this embodiment mode, a video signal input from each of the source signal line 1604 and the source signal line 1605 is set to have a potential with a binary value which can turn on/off the TFT 1614 and the TFT 1615. Accordingly, either a light-emitting state or a non-light-emitting state can be selected. In this case, by dividing one frame period into a plurality of sub-frame periods, gray scales (luminance) are expressed. For example, by dividing one frame into six sub-frames, setting the length of the respective light-emitting periods to 1:2:4:8:16:32, and combining each sub-frame, gray scales (luminance) with 64 levels can be expressed. Note that the invention is not limited to this, and for example, the above length may be 1:2:4:8:8:8:8:8:8. This example corresponds to the case where the light-emitting periods of 16 and 32 are divided into 8, 8, and 8, 8, 8, 8 respectively.

In the aforementioned method of expressing gray scales (luminance) with the light-emitting time, an erasing period may be provided. An erasing period corresponds to the period in which, in the case where one frame period is divided into a plurality of sub-frames, light emission of a light-emitting element is suspended for a while in one sub-frame until the next sub-frame starts. As a method for this operation, the TFT 1614 and the TFT 1615 may be turned off. In order to realize this, a sub-frame period may be divided in half, so that a writing operation can be performed in one period, while an erasing operation can be performed in the other period. In the erasing operation, video signals which can turn off the TFT 1614 and the TFT 1615 are output from the source signal line 1604 and the source signal line 1605 respectively.

Although this embodiment mode illustrates the case where two sub-pixels are provided, the number of the sub-pixels may be more than two. In addition, although two source signal lines are provided, the invention is not limited to this, and more than two source signal lines may be provided in accordance with the increase in the number of sub-pixels.

In this embodiment mode, all of the TFTs in the pixel 1611 are n-channel TFTs; therefore, such TFTs can be manufactured with amorphous silicon.

Since each of the TFT 1616 and the TFT 1617 operates as a switching element, it may be replaced with either an electrical switch or a mechanical switch as long as it can control a current flow. As the switching element, for example, a diode or a logic circuit constructed from a diode and a transistor may be employed. Further, each of the TFT 1614 and the TFT 1615 may also be operated as a switching element. In addition, if the operating point of the TFT 1614 and the light-emitting element 1622 and the operating point of the TFT 1615 and the light-emitting element 1623 are set so as to allow the TFT 1614 and the TFT 1615 to operate in the linear region, variations in the threshold voltage of the TFT 1614 and the TFT 1615 will not affect the display; therefore, a display device with higher image quality can be provided.

[Embodiment Mode 17]

Description will be made of an exemplary configuration of the panel 107 described in Embodiment Modes 1 and 2, with reference to FIG. 17.

Figure 17:
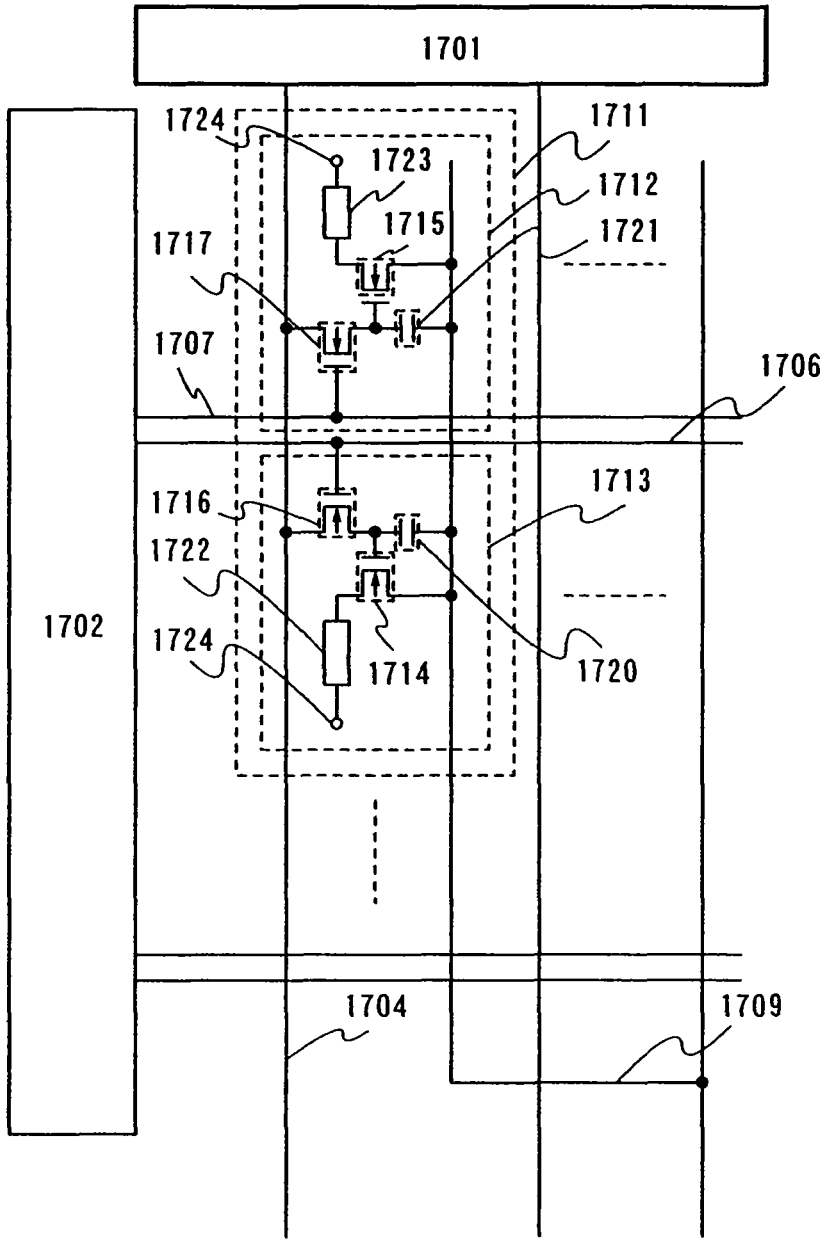
FIG. 17 shows Embodiment Mode 17.

In FIG. 17, reference numeral 1701 denotes a source driver, 1702 denotes a gate driver, 1704 denotes a source signal line, 1706 and 1707 denote gate signal lines, 1709 denotes a power supply line, 1711 denotes a pixel, 1712 and 1713 denote sub-pixels, 1714, 1715, 1716, and 1717 denote TFTs, 1720 and 1721 denote capacitors each having a pair of electrodes, 1722 and 1723 denote light-emitting elements each having a pair of electrodes, and 1724 denotes a counter electrode corresponding to the other electrode of the light-emitting element 1722 and the other electrode of the light-emitting element 1723. Note that in this embodiment mode, the TFTs 1714 and 1715, 1716, and 1717 are n-channel thin film transistors.

The source driver 1701 is connected to and outputs video signals to the source signal line 1704. The gate driver 1702 is connected to and scans the gate signal line 1706 and the gate signal line 1707. The power supply line 1709 is connected to one of either a source or a drain of the TFT 1714 and one of either a source or a drain of the TFT 1715. The other of either the source or the drain of the TFT 1714 is connected to one electrode of the light-emitting element 1722, and the other of either the source or the drain of the TFT 1715 is connected to one electrode of the light-emitting element 1723. A gate of the TFT 1714 is connected to one electrode of the capacitor 1720 and one of either a source or a drain of the TFT 1716, while a gate of the TFT 1715 is connected to one electrode of the capacitor 1721 and one of either a source or a drain of the TFT 1717. The other electrode of the capacitor 1720 and the other electrode of the capacitor 1721 are connected to the power supply line 1709. The other of either the source or the drain of the TFT 1716 and the other of either the source or the drain of the TFT 1717 are connected to the source signal line 1704. A gate of the TFT 1716 is connected to the gate signal line 1706, while a gate of the TFT 1717 is connected to the gate signal line 1707.

When the TFT 1716 is turned on, a video signal is written to the gate of the TFT 1714 and one electrode of the capacitor 1720 through the source signal line 1704. When the TFT 1717 is turned on, a video signal is written to the gate of the TFT 1715 and one electrode of the capacitor 1721 through the source signal line 1704. The gate of the TFT 1716 is connected to the gate signal line 1706, while the gate of the TFT 1717 is connected to the gate signal line 1707; therefore, they are separately turned on, and thus the source signal line 1704 can be used in common. The value of a current flowing in each of the TFT 1714 and the TFT 1715 is determined by a relationship between a potential of a video signal input to the gate thereof and a potential of the power supply line 1709, thereby currents flowing into the light-emitting element 1722 and the light-emitting element 1723 are determined. That is, luminance is determined by a video signal. Since video signals are separately input to the sub-pixel 1712 and the sub-pixel 1713, the luminance of the sub-pixel 1712 and the luminance of the sub-pixel 1713 can be varied from each other. Therefore, provided that areas of the light-emitting element 1722 and the light-emitting element 1723 are designed to have a ratio of 1:2 with the condition that one sub-pixel can display 16 gray scales, 64 gray scales can be displayed. In this manner, a larger number of gray scales can be displayed.

Although the luminance of the light-emitting element 1722 and the light-emitting element 1723 is determined by the value of currents flowing therein in the aforementioned driving method, the luminance can be determined by the light-emitting time as well. Description will be made below of this case.

In the invention, a video signal input from the source signal line 1704 is set to have a potential with a binary value which can turn on/off the TFT 1714 and the TFT 1715. Accordingly, either a light-emitting state or a non-light-emitting state can be selected. In this case, by dividing one frame period into a plurality of sub-frame periods, gray scales (luminance) are expressed. For example, by dividing one frame into six sub-frames, setting the length of the respective light-emitting periods to 1:2:4:8:16:32, and combining each sub-frame, gray scales (luminance) with 64 levels can be expressed. Note that the invention is not limited to this, and for example, the above length may be 1:2:4:8:8:8:8:8:8. This example corresponds to the case where the light-emitting periods of 16 and 32 are divided into 8, 8, and 8, 8, 8, 8 respectively.

In the aforementioned method of expressing gray scales (luminance) with the light-emitting time, an erasing period may be provided. An erasing period corresponds to the period in which, in the case where one frame period is divided into a plurality of sub-frames, light emission of a light-emitting element is suspended for a while in one sub-frame until the next sub-frame starts. As a method for this operation, the TFT 1714 and the TFT 1715 may be turned off. In order to realize this, a sub-frame period may be divided in half, so that a writing operation can be performed in one period, while an erasing operation can be performed in the other period. In the erasing operation, video signals which can turn off the TFT 1714 and the TFT 1715 are output from the source signal line 1704.

Although this embodiment mode illustrates the case where two gate signal lines are provided, the invention is not limited to this, and more than two gate signal lines may be provided in accordance with the increase in the number of sub-pixels.

In this embodiment mode, all of the TFTs in the pixel 1711 are n-channel TFTs; therefore, such TFTs can be manufactured with amorphous silicon.

Since each of the TFT 1716 and the TFT 1717 operates as a switching element, it may be replaced with either an electrical switch or a mechanical switch as long as it can control a current flow. As the switching element, for example, a diode or a logic circuit constructed from a diode and a transistor may be employed. Further, each of the TFT 1714 and the TFT 1715 may also be operated as a switching element. In addition, if the operating point of the TFT 1714 and the light-emitting element 1722 and the operating point of the TFT 1715 and the light-emitting element 1723 are set so as to allow the TFT 1714 and the TFT 1715 to operate in the linear region, variations in the threshold voltage of the TFT 1714 and the TFT 1715 will not affect the display; therefore, a display device with higher image quality can be provided.

[Embodiment Mode 18]

Description will be made of an exemplary configuration of the panel 107 described in Embodiment Modes 1 and 2, with reference to FIG. 18.

Figure 18:
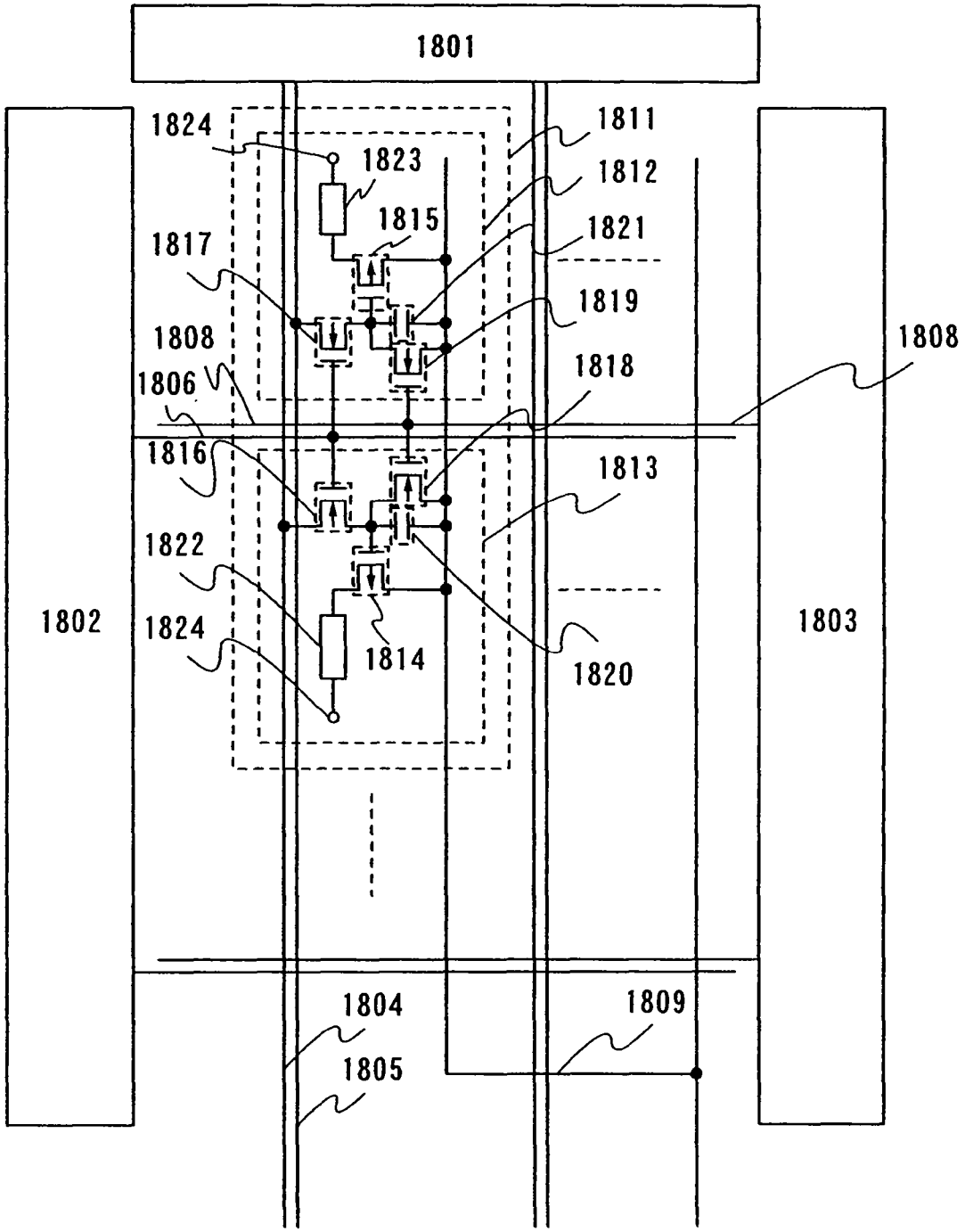
FIG. 18 shows Embodiment Mode 18.

In FIG. 18, reference numeral 1801 denotes a source driver, 1802 and 1803 denote gate drivers, 1804 and 1805 denote source signal lines, 1806 and 1808 denote gate signal lines, 1809 denotes a power supply line, 1811 denotes a pixel, 1812 and 1813 denote sub-pixels, 1814, 1815, 1816, 1817, 1818, and 1819 denote TFTs, 1820 and 1821 denote capacitors each having a pair of electrodes, 1822 and 1823 denote light-emitting elements each having a pair of electrodes, and 1824 denotes a counter electrode corresponding to the other electrode of the light-emitting element 1822 and the other electrode of the light-emitting element 1823. Note that in this embodiment mode, the TFTs 1814 and 1815 are p-channel thin film transistors, while the TFTs 1816, 1817, 1818, and 1819 are n-channel thin film transistors.

The source driver 1801 is connected to and outputs video signals to the source signal line 1804 and the source signal line 1805. The gate driver 1802 is connected to and scans the gate signal line 1806, while the gate driver 1803 is connected to and scans the gate signal line 1808. The power supply line 1809 is connected to one of either a source or a drain of the TFT 1814, one of either a source or a drain of the TFT 1815, one of either a source or a drain of the TFT 1818, and one of either a source or a drain of the TFT 1819. The other of either the source or the drain of the TFT 1814 is connected to one electrode of the light-emitting element 1822, and the other of either the source or the drain of the TFT 1815 is connected to one electrode of the light-emitting element 1823. A gate of the TFT 1814 is connected to one electrode of the capacitor 1820, the other of either the source or the drain of the TFT 1818, and one of either a source or a drain of the TFT 1816. A gate of the TFT 1815 is connected to one electrode of the capacitor 1821, the other of either the source or the drain of the TFT 1819, and the other of either the source or the drain of the TFT 1817. The other electrode of the capacitor 1820 and the other electrode of the capacitor 1821 are connected to the power supply line 1809. The other of either the source or the drain of the TFT 1816 is connected to the source signal line 1804, and the other of either the source or the drain of the TFT 1817 is connected to the source signal line 1805. Gates of the TFT 1816 and the TFT 1817 are connected to the gate signal line 1806, while gates of the TFT 1818 and the TFT 1819 are connected to the gate signal line 1808.

When the TFT 1816 is turned on, a video signal is written to the gate of the TFT 1814 and one electrode of the capacitor 1820 through the source signal line 1804. When the TFT 1817 is turned on, a video signal is written to the gate of the TFT 1815 and one electrode of the capacitor 1821 through the source signal line 1805. The gates of the TFT 1816 and the TFT 1817 are connected to the common gate signal line 1806; therefore, they are turned on at the same time. The value of a current flowing in each of the TFT 1814 and the TFT 1815 is determined by a relationship between a potential of a video signal input to the gate thereof and a potential of the power supply line 1809, thereby currents flowing into the light-emitting element 1822 and the light-emitting element 1823 are determined. That is, luminance is determined by a video signal. Since video signals are separately input to the sub-pixel 1812 and the sub-pixel 1813, the luminance of the sub-pixel 1812 and the luminance of the sub-pixel 1813 can be varied from each other. Therefore, provided that areas of the light-emitting element 1822 and the light-emitting element 1823 are designed to have a ratio of 1:2 with the condition that one sub-pixel can display 16 gray scales, 64 gray scales can be displayed. In this manner, a larger number of gray scales can be displayed. In addition, when the TFT 1818 and the TFT 1819 are turned on, a potential of the power supply line 1809 is applied to the gates of the TFT 1814 and the TFT 1815; therefore, gate-source potentials of the TFT 1814 and the TFT 1815 become 0 V, thereby these transistors are turned off. Thus, the light-emitting element 1822 and the light-emitting element 1823 do not emit light, and an erasing period can be provided accordingly.

Although this embodiment mode illustrates the case where two source signal lines are provided, the invention is not limited to this, and more than two source signal lines may be provided in accordance with the increase in the number of sub-pixels.

Since each of the TFT 1816 and the TFT 1817 operates as a switching element, it may be replaced with either an electrical switch or a mechanical switch as long as it can control a current flow. As the switching element, for example, a diode or a logic circuit constructed of a diode and a transistor may be employed. In addition, the TFT 1814 and the TFT 1815 may also be operated as switching elements. In such a case, if the operating point of the TFT 1814 and the light-emitting element 1822 and the operating point of the TFT 1815 and the light-emitting element 1823 are set so as to allow the TFT 1814 and the TFT 1815 to operate in the linear region, variations in the threshold voltage of the TFT 1814 and the TFT 1815 will not affect the display; therefore, a display device with higher image quality can be provided.

[Embodiment Mode 19]

Description will be made of an exemplary configuration of the panel 107 described in Embodiment Modes 1 and Mode 2, with reference to FIG. 19.

Figure 19:
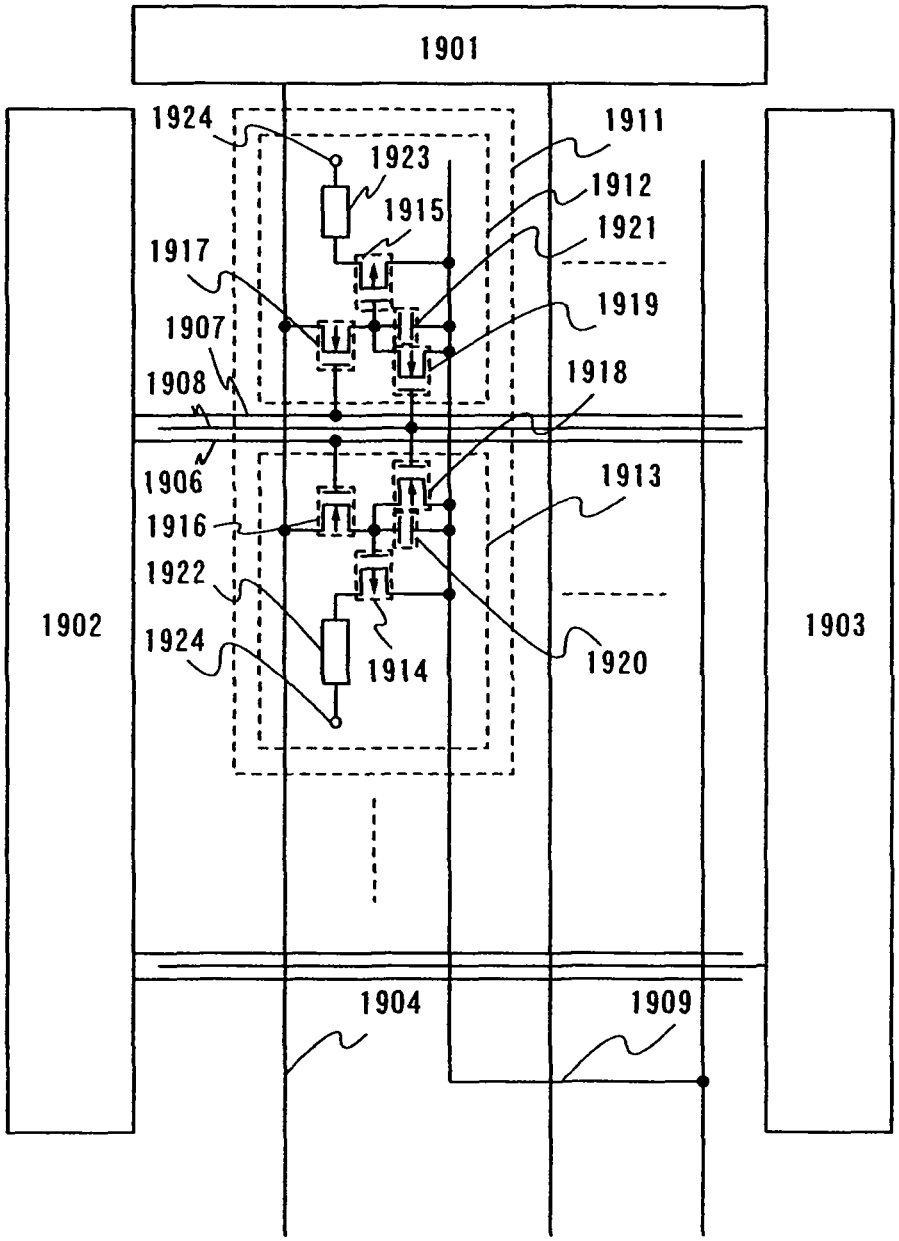
FIG. 19 shows Embodiment Mode 19.

In FIG. 19, reference numeral 1901 denotes a source driver, 1902 and 1903 denote gate drivers, 1904 denotes a source signal line, 1906, 1907, and 1908 denote gate signal lines, 1909 denotes a power supply line, 1911 denotes a pixel, 1912 and 1913 denote sub-pixels, 1914, 1915, 1916, and 1917 denote TFTs, 1920 and 1921 denote capacitors each having a pair of electrodes, 1922 and 1923 denote light-emitting elements each having a pair of electrodes, and 1924 denotes a counter electrode corresponding to the other electrode of the light-emitting element 1922 and the other electrode of the light-emitting element 1923. Note that in this embodiment mode, the TFTs 1914 and 1915 are p-channel thin film transistors, while the TFTs 1916, 1917, 1918, and 1919 are n-channel thin film transistors.

The source driver 1901 is connected to and outputs video signals to the source signal line 1904. The gate driver 1902 is connected to and scans the gate signal line 1906 and the gate signal line 1907, while the gate driver 1903 is connected to and scans the gate signal line 1908. The power supply line 1909 is connected to one of either a source or a drain of the TFT 1914, one of either a source or a drain of the TFT 1915, one of either a source or a drain of the TFT 1918, and one of either a source or a drain of the TFT 1919. The other of either the source or the drain of the TFT 1914 is connected to one electrode of the light-emitting element 1922, and the other of either the source or the drain of the TFT 1915 is connected to one electrode of the light-emitting element 1923. A gate of the TFT 1914 is connected to one electrode of the capacitor 1920, the other of either the source or the drain of the TFT 1918, and one of either a source or a drain of the TFT 1916. A gate of the TFT 1915 is connected to one electrode of the capacitor 1921, the other of either the source or the drain of the TFT 1919, and the other of either the source or the drain of the TFT 1917. The other electrode of the capacitor 1920 and the other electrode of the capacitor 1921 are connected to the power supply line 1909. The other of either the source or the drain of the TFT 1916 and the other of either the source or the drain of the TFT 1917 are connected to the source signal line 1904. A gate of the TFT 1916 is connected to the gate signal line 1906, a gate of the TFT 1917 is connected to the gate signal line 1907, and gates of the TFT 1918 and the TFT 1919 are connected to the gate signal line 1908.

When the TFT 1916 is turned on, a video signal is written to the gate of the TFT 1914 and one electrode of the capacitor 1920 through the source signal line 1904. When the TFT 1917 is turned on, a video signal is written to the gate of the TFT 1915 and one electrode of the capacitor 1921 through the source signal line 1904. The gate of the TFT 1916 is connected to the gate signal line 1906, while the gate of the TFT 1917 is connected to the gate signal line 1907; therefore, they are separately turned on and thus the source signal line 1904 can be used in common. The value of a current flowing in each of the TFT 1914 and the TFT 1915 is determined by a relationship between a potential of a video signal input to the gate thereof and a potential of the power supply line 1909, thereby currents flowing into the light-emitting element 1922 and the light-emitting element 1923 are determined. That is, luminance is determined by a video signal. Since video signals are separately input to the sub-pixel 1912 and the sub-pixel 1913, the luminance of the sub-pixel 1912 and the luminance of the sub-pixel 1913 can be varied from each other. Therefore, provided that areas of the light-emitting element 1922 and the light-emitting element 1923 are designed to have a ratio of 1:2 with the condition that one sub-pixel can display 16 gray scales, 64 gray scales can be displayed. In this manner, a larger number of gray scales can be displayed. In addition, when the TFT 1918 and the TFT 1919 are turned on, a potential of the power supply line 1909 is applied to the gates of the TFT 1914 and the TFT 1915; therefore, gate-source potentials of the TFT 1914 and the TFT 1915 become 0 V, thereby these transistors are turned off. Thus, the light-emitting element 1922 and the light-emitting element 1923 do not emit light, and an erasing period can be provided accordingly.

Although this embodiment mode illustrates the case where two gate signal lines are provided, the invention is not limited to this, and more than two gate signal lines may be provided in accordance with the increase in the number of sub-pixels.

Since each of the TFT 1916 and the TFT 1917 operates as a switching element, it may be replaced with either an electrical switch or a mechanical switch as long as it can control a current flow. As the switching element, for example, a diode or a logic circuit constructed from a diode and a transistor may be employed. In addition, the TFT 1914 and the TFT 1915 may also be operated as switching elements. In such a case, if the operating point of the TFT 1914 and the light-emitting element 1922 and the operating point of the TFT 1915 and the light-emitting element 1923 are set so as to allow the TFT 1914 and the TFT 1915 to operate in the linear region, variations in the threshold voltage of the TFT 1914 and the TFT 1915 will not affect the display; therefore, a display device with higher image quality can be provided.

[Embodiment Mode 20]

Description will be made of an exemplary structure of the panel 107 described in Embodiment Modes 1 and 2, with reference to FIG. 20.

Figure 20:
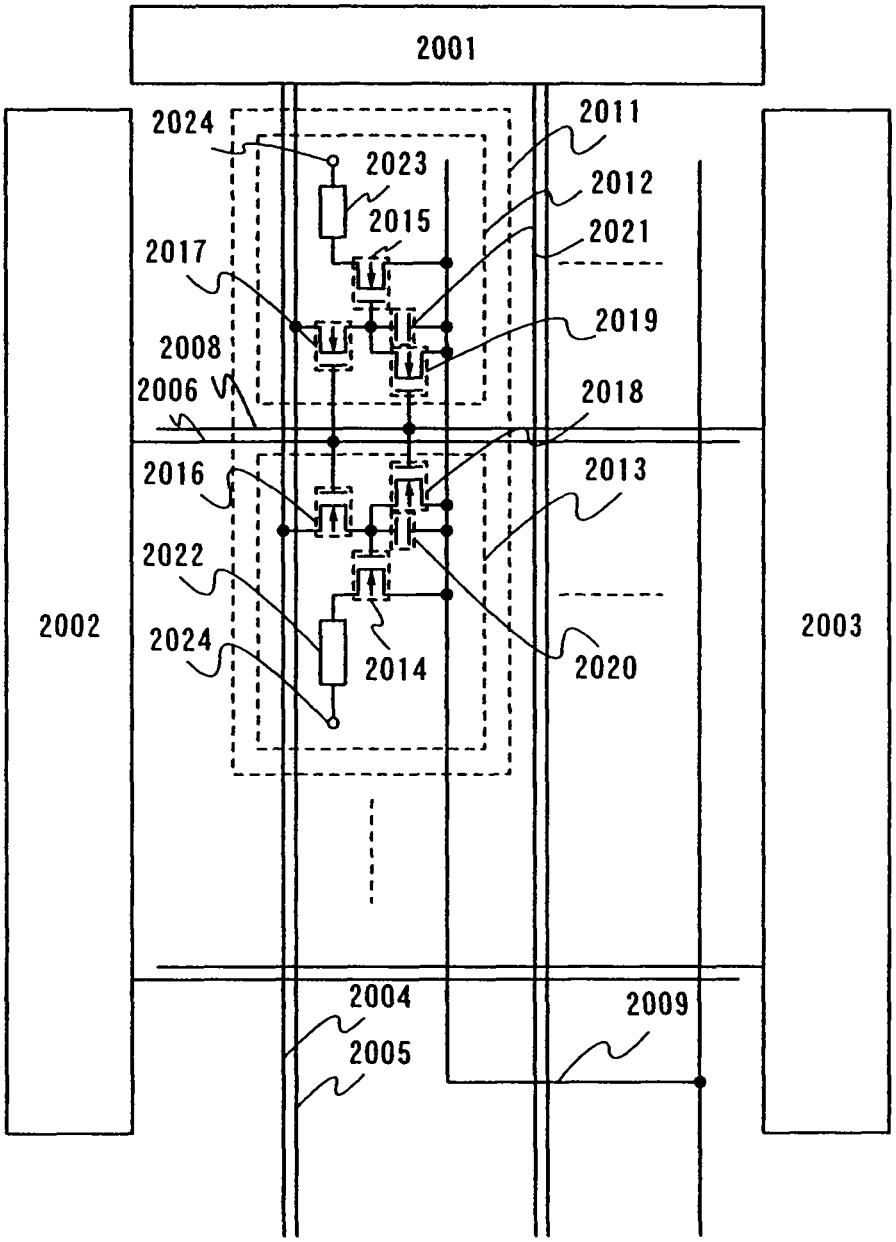
FIG. 20 shows Embodiment Mode 20.

In FIG. 20, reference numeral 2001 denotes a source driver, 2002 and 2003 denote gate drivers, 2004 and 2005 denote source signal lines, 2006 and 2008 denote gate signal lines, 2009 denotes a power supply line, 2011 denotes a pixel, 2012 and 2013 denote sub-pixels, 2014, 2015, 2016, 2017, 2018, and 2019 denote TFTs, 2020 and 2021 denote capacitors each having a pair of electrodes, 2022 and 2023 denote light-emitting elements each having a pair of electrodes, and 2024 denotes a counter electrode corresponding to the other electrode of the light-emitting element 2022 and the other electrode of the light-emitting element 2023. Note that in this embodiment mode, the TFTs 2014, 2015, 2016, 2017, 2018, and 2019 are n-channel thin film transistors.

The source driver 2001 is connected to and outputs video signals to the source signal line 2004 and the source signal line 2005. The gate driver 2002 is connected to and scans the gate signal line 2006. The power supply line 2009 is connected to one of either a source or a drain of the TFT 2014, one of either a source or a drain of the TFT 2015, one of either a source or a drain of the TFT 2018, and one of either a source or a drain of the TFT 2019. The other of either the source or the drain of the TFT 2014 is connected to one electrode of the light-emitting element 2022, and the other of either the source or the drain of the TFT 2015 is connected to one electrode of the light-emitting element 2023. A gate of the TFT 2014 is connected to one electrode of the capacitor 2020, the other of either the source or the drain of the TFT 2018, and one of either a source or a drain of the TFT 2016. A gate of the TFT 2015 is connected to one electrode of the capacitor 2021, the other of either the source or the drain of the TFT 2019, and the other of either the source or the drain of the TFT 2017. The other electrode of the capacitor 2020 and the other electrode of the capacitor 2021 are connected to the power supply line 2009. The other of either the source or the drain of the TFT 2016 is connected to the source signal line 2004, and the other of either the source or the drain of the TFT 2017 is connected to the source signal line 2005. Gates of the TFT 2016 and the TFT 2017 are connected to the gate signal line 2006, while gates of the TFT 2018 and the TFT 2019 are connected to the gate signal line 2008.

When the TFT 2016 is turned on, a video signal is written to the gate of the TFT 2014 and one electrode of the capacitor 2020 through the source signal line 2004. When the TFT 2017 is turned on, a video signal is written to the gate of the TFT 2015 and one electrode of the capacitor 2021 through the source signal line 2005. The gates of the TFT 2016 and the TFT 2017 are connected to the common gate signal line 2006; therefore, they are turned on at the same time. The value of a current flowing in each of the TFT 2014 and the TFT 2015 is determined by a relationship between a potential of a video signal input to the gate thereof and a potential of the power supply line 2009, thereby currents flowing into the light-emitting element 2022 and the light-emitting element 2023 are determined. That is, luminance is determined by a video signal. Since video signals are separately input to the sub-pixel 2012 and the sub-pixel 2013, the luminance of the sub-pixel 2012 and the luminance of the sub-pixel 2013 can be varied from each other. Therefore, provided that areas of the light-emitting element 2022 and the light-emitting element 2023 are designed to have a ratio of 1:2 with the condition that one sub-pixel can display 16 gray scales, 64 gray scales can be displayed. In this manner, a larger number of gray scales can be displayed. In addition, when the TFT 2018 and the TFT 2019 are turned on, a potential of the power supply line 2009 is applied to the gates of the TFT 2014 and the TFT 2015; therefore, gate-source potentials of the TFT 2014 and the TFT 2015 become 0 V, thereby these transistors are turned off. Thus, the light-emitting element 2022 and the light-emitting element 2023 do not emit light, and an erasing period can be provided accordingly.

Although this embodiment mode illustrates the case where two sub-pixels are provided, the number of the sub-pixels may be more than two. In addition, although two gate signal lines are provided, the invention is not limited to this, and more than two gate signal lines may be provided in accordance with the increase in the number of sub-pixels.

In this embodiment mode, all of the TFTs in the pixel 2011 are n-channel TFTs; therefore, such TFTs can be manufactured with amorphous silicon.

Since each of the TFT 2016 and the TFT 2017 operates as a switching element, it may be replaced with either an electrical switch or a mechanical switch as long as it can control a current flow. As the switching element, for example, a diode or a logic circuit constructed from a diode and a transistor may be employed. In addition, the TFT 2014 and the TFT 2015 may also be operated as switching elements. In such a case, if the operating point of the TFT 2014 and the light-emitting element 2022 and the operating point of the TFT 2015 and the light-emitting element 2023 are set so as to allow the TFT 2014 and the TFT 2015 to operate in the linear region, variations in the threshold voltage of the TFT 2014 and the TFT 2015 will not affect the display; therefore, a display device with higher image quality can be provided.

[Embodiment Mode 21]

Description will be made of an exemplary panel 107 described in Embodiment Modes 1 and 2, with reference to FIG. 21.

Figure 21:
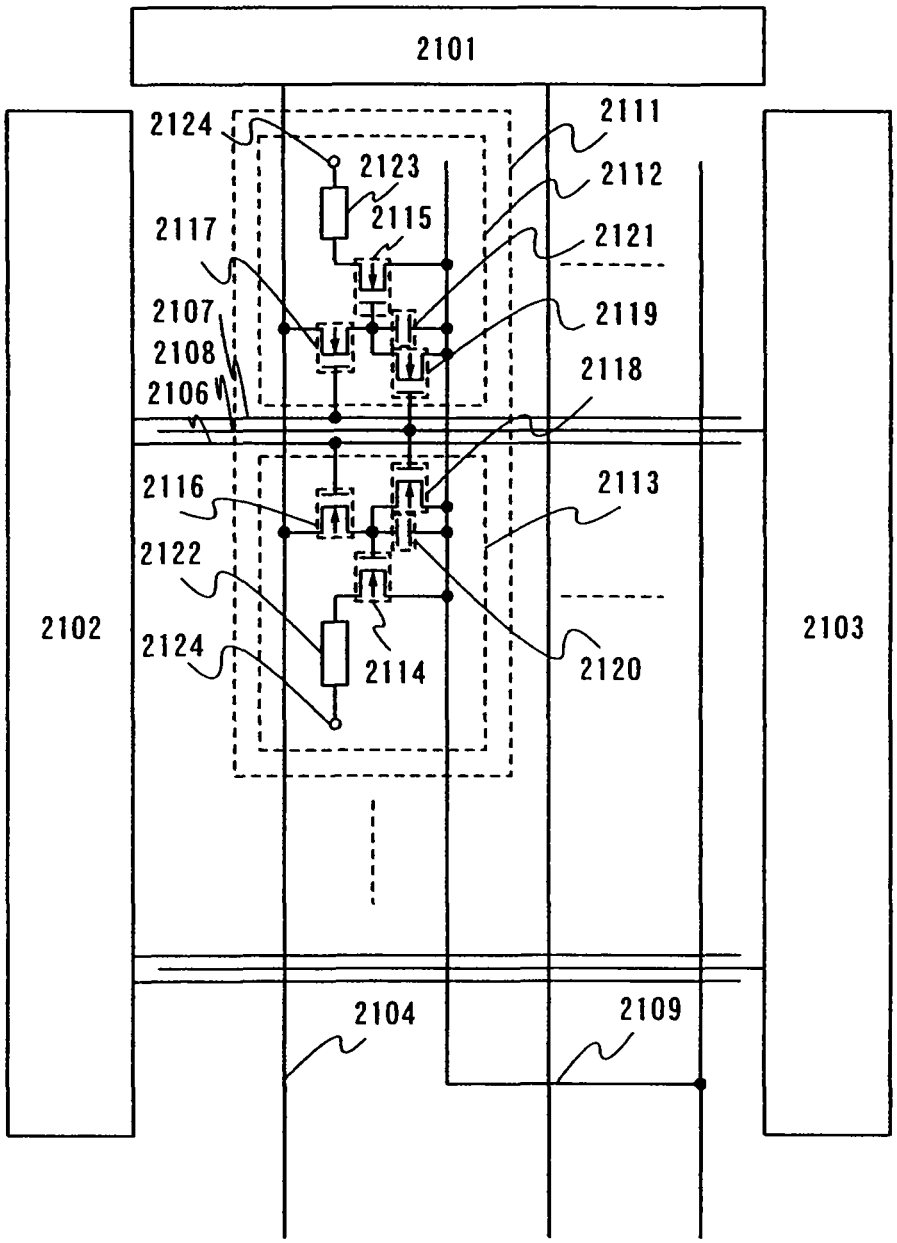
FIG. 21 shows Embodiment Mode 21.

In FIG. 21, reference numeral 2101 denotes a source driver, 2102 and 2103 denote gate drivers, 2104 denotes a source signal line, 2106, 2107, and 2108 denote gate signal lines, 2109 denotes a power supply line, 2111 denotes a pixel, 2112 and 2113 denote sub-pixels, 2114, 2115, 2116, and 2117 denote TFTs, 2120 and 2121 denote capacitors each having a pair of electrodes, 2122 and 2123 denote light-emitting elements each having a pair of electrodes, and 2124 denotes a counter electrode corresponding to the other electrode of the light-emitting element 2122 and the other electrode of the light-emitting element 2123. Note that in this embodiment mode, the TFTs 2114 and 2115 are p-channel thin film transistors, while the TFTs 2116, 2117, 2118, and 2119 are n-channel thin film transistors.

The source driver 2101 is connected to and outputs video signals to the source signal line 2104. The gate driver 2102 is connected to and scans the gate signal line 2106 and the gate signal line 2107, while the gate driver 2103 is connected to and scans the gate signal line 2108. The power supply line 2109 is connected to one of either a source or a drain of the TFT 2114, one of either a source or a drain of the TFT 2115, one of either a source or a drain of the TFT 2118, and one of either a source or a drain of the TFT 2119. The other of either the source or the drain of the TFT 2114 is connected to one electrode of the light-emitting element 2122, and the other of either the source or the drain of the TFT 2115 is connected to one electrode of the light-emitting element 2123. A gate of the TFT 2114 is connected to one electrode of the capacitor 2120, the other of either the source or the drain of the TFT 2118, and one of either a source or a drain of the TFI 2116. A gate of the TFT 2115 is connected to one electrode of the capacitor 2121, the other of either the source or the drain of the TFT 2119, and the other of either the source or the drain of the TFT 2117. The other electrode of the capacitor 2120 and the other electrode of the capacitor 2121 are connected to the power supply line 2109. The other of either the source or the drain of the TFT 2116 and the other of either the source or the drain of the TFT 2117 are connected to the source signal line 2104. The gate of the TFT 2116 is connected to the gate signal line 2106, the gate of the TFT 2117 is connected to the gate signal line 2107, and the gates of the TFT 2118 and the TFT 2119 are connected to the gate signal line 2108.

When the TFT 2116 is turned on, a video signal is written to the gate of the TFT 2114 and one electrode of the capacitor 2120 through the source signal line 2104. When the TFT 2117 is turned on, a video signal is written to the gate of the TFT 2115 and one electrode of the capacitor 2121 through the source signal line 2104. The gate of the TFT 2116 is connected to the gate signal line 2106, while the gate of the TFT 2117 is connected to the gate signal line 2107; therefore, they are separately turned on and thus the source signal line 2104 can be used in common. The value of a current flowing in each of the TFT 2114 and the TFT 2115 is determined by a relationship between a potential of a video signal input to the gate thereof and a potential of the power supply line 2109, thereby currents flowing into the light-emitting element 2122 and the light-emitting element 2123 are determined. That is, luminance is determined by a video signal. Since video signals are separately input to the sub-pixel 2112 and the sub-pixel 2113, the luminance of the sub-pixel 2112 and the luminance of the sub-pixel 2113 can be varied from each other. Therefore, provided that areas of the light-emitting element 2122 and the light-emitting element 2123 are designed to have a ratio of 1:2 with the condition that one sub-pixel can display 16 gray scales, 64 gray scales can be displayed. In this manner, a larger number of gray scales can be displayed. In addition, when the TFT 2118 and the TFT 2119 are turned on, a potential of the power supply line 2109 is applied to the gates of the TFT 2114 and the TFT 2115; therefore, gate-source potentials of the TFT 2114 and the TFT 2115 become 0 V, thereby these transistors are turned off. Thus, the light-emitting element 2122 and the light-emitting element 2123 do not emit light, and an erasing period can be provided accordingly.

Although this embodiment mode illustrates the case where two gate signal lines are provided, the invention is not limited to this, and more than two gate signal lines may be provided in accordance with the increase in the number of sub-pixels.

In this embodiment mode, all of the TFTs in the pixel 2111 are n-channel TFTS; therefore, such TFTs can be manufactured with amorphous silicon.

Since each of the TFT 2116 and the TFT 2117 operates as a switching element, it may be replaced with either an electrical switch or a mechanical switch as long as it can control a current flow. As the switching element, for example, a diode or a logic circuit constructed from a diode and a transistor may be employed. In addition, the TFT 2114 and the TFT 2115 may also be operated as switching elements. In such a case, if the operating point of the TFT 2114 and the light-emitting element 2122 and the operating point of the TFT 2115 and the light-emitting element 2123 are set so as to allow the TFT 2114 and the TFT 2115 to operate in the linear region, variations in the threshold voltage of the TFT 2114 and the TFT 2115 will not affect the display; therefore, a display device with higher image quality can be provided.

[Embodiment Mode 22]

Description will be made of an exemplary configuration of the panel 107 described in Embodiment Modes 1 and 2, with reference to FIG. 22.

Figure 22:
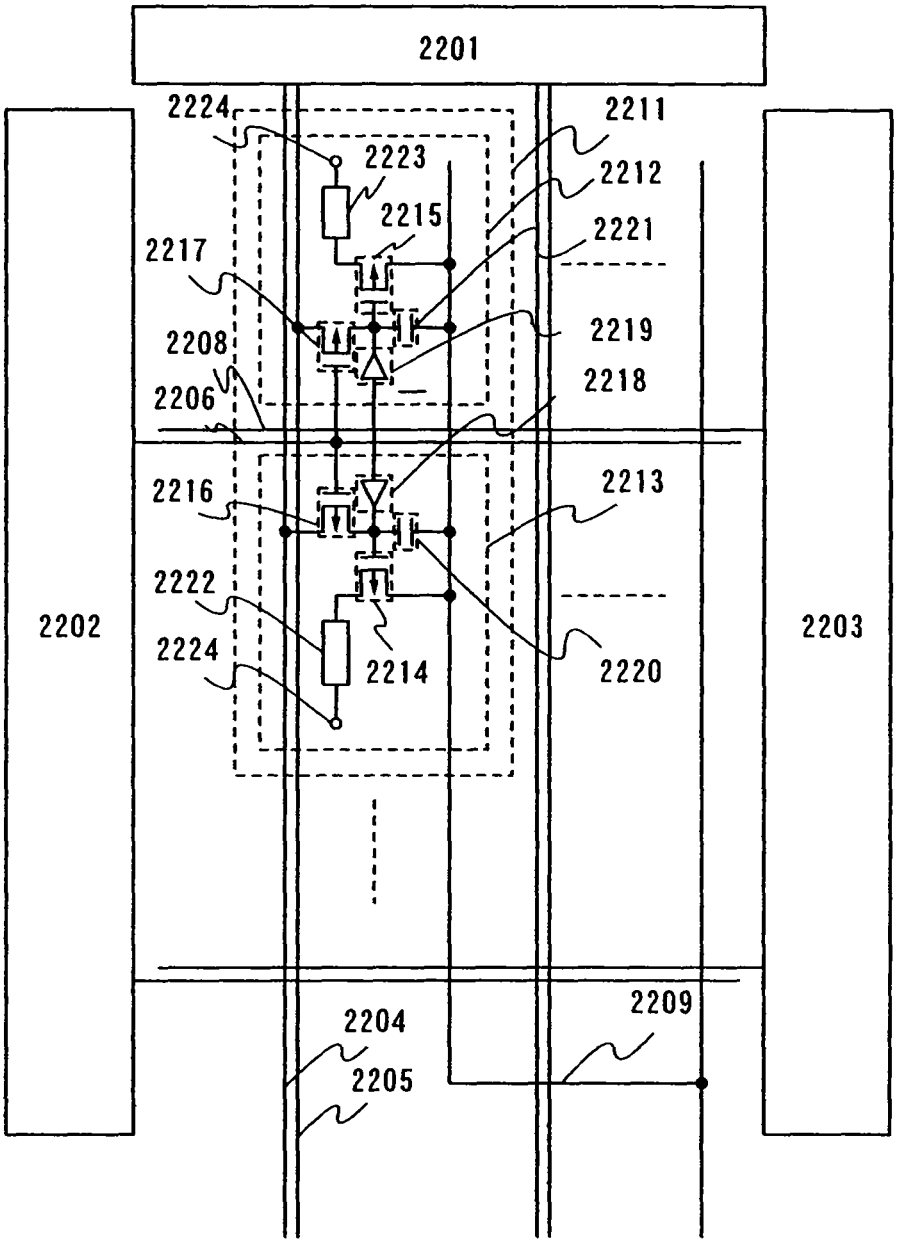
FIG. 22 shows Embodiment Mode 22.

In FIG. 22, reference numeral 2201 denotes a source driver, 2202 and 2203 denote gate drivers, 2204 and 2205 denote source signal lines, 2206 and 2208 denote gate signal lines, 2209 denotes a power supply line, 2211 denotes a pixel, 2212 and 2213 denote sub-pixels, 2214, 2215, 2216, and 2217 denote TFTs, 2218 and 2219 denote diodes, 2220 and 2221 denote capacitors each having a pair of electrodes, 2222 and 2223 denote light-emitting elements each having a pair of electrodes, and 2224 denotes a counter electrode corresponding to the other electrode of the light-emitting element 2222 and the other electrode of the light-emitting element 2223. Note that in this embodiment mode, the TFTs 2214 and 2215 are p-channel thin film transistors, while the TFTs 2216 and 2217 are n-channel thin film transistors.

The source driver 2201 is connected to and outputs video signals to the source signal line 2204 and the source signal line 2205. The gate driver 2202 is connected to and scans the gate signal line 2206, while the gate driver 2203 is connected to and scans the gate signal line 2208. The power supply line 2209 is connected to one of either a source or a drain of the TFT 2214 and one of either a source or a drain of the TFT 2215. The other of either the source or the drain of the TFT 2214 is connected to one electrode of the light-emitting element 2222, and the other of either the source or the drain of the TFT 2215 is connected to one electrode of the light-emitting element 2223. A gate of the TFT 2214 is connected to one electrode of the capacitor 2220, an output of the diode 2218, and one of either a source or a drain of the TFT 2216. A gate of the TFT 2215 is connected to one electrode of the capacitor 2221, an output of the diode 2219, and the other of either the source or the drain of the TFT 2217. The other electrode of the capacitor 2220 and the other electrode of the capacitor 2221 are connected to the power supply line 2209. The other of either the source or the drain of the TFT 2216 is connected to the source signal line 2204, and the other of either the source or the drain of the TFT 2217 is connected to the source signal line 2205. The gates of the TFT 2216 and the TFT 2217 are connected to the gate signal line 2206. Inputs of the diode 2218 and the diode 2219 are connected to the gate signal line 2208.

When the TFT 2216 is turned on, a video signal is written to the gate of the TFT 2214 and one electrode of the capacitor 2220 through the source signal line 2204. When the TFT 2217 is turned on, a video signal is written to the gate of the TFT 2215 and one electrode of the capacitor 2221 through the source signal line 2205. The gates of the TFT 2216 and the TFT 2217 are connected to the common gate signal line 2206; therefore, they are turned on at the same time. The value of a current flowing in each of the TFT 2214 and the TFT 2215 is determined by a relationship between a potential of a video signal input to the gate thereof and a potential of the power supply line 2209, thereby currents flowing into the light-emitting element 2222 and the light-emitting element 2223 are determined. That is, luminance is determined by a video signal. Since video signals are separately input to the sub-pixel 2212 and the sub-pixel 2213, the luminance of the sub-pixel 2212 and the luminance of the sub-pixel 2213 can be varied from each other. Therefore, provided that areas of the light-emitting element 2222 and the light-emitting element 2223 are designed to have a ratio of 1:2 with the condition that one sub-pixel can display 16 gray scales, 64 gray scales can be displayed. In this manner, a larger number of gray scales can be displayed. In addition, the gate signal line 2208 normally has a lower potential than the potentials held in the capacitor 2220 and the capacitor 2221. Therefore, by setting the potential of the gate signal line 2208 to be higher than the potentials held in the capacitor 2220 and the capacitor 2221 (potentials which turn off the TFT 2214 and the TFT 2215), the light-emitting element 2222 and the light-emitting element 2223 can be controlled to emit no light. In this manner, an erasing period can be provided.

Although this embodiment mode illustrates the case where two sub-pixels are provided, the number of the sub-pixels may be more than two. In addition, although two gate signal lines are provided, the invention is not limited to this, and more than two gate signal lines may be provided in accordance with the increase in the number of sub-pixels.

Since each of the TFT 2216 and the TFT 2217 operates as a switching element, it may be replaced with either an electrical switch or a mechanical switch as long as it can control a current flow. As the switching element, for example, a diode or a logic circuit constructed from a diode and a transistor may be employed. In addition, the TFT 2214 and the TFT 2215 may also be operated as switching elements. In such a case, if the operating point of the TFT 2214 and the light-emitting element 2222 and the operating point of the TFT 2215 and the light-emitting element 2223 are set so as to allow the TFT 2214 and the TFT 2215 to operate in the linear region, variations in the threshold voltage of the TFT 2214 and the TFT 2215 will not affect the display; therefore, a display device with higher image quality can be provided.

[Embodiment Mode 23]

Description will be made of an exemplary configuration of the panel 107 described in Embodiment Modes 1 and 2, with reference to FIG. 23.

Figure 23:
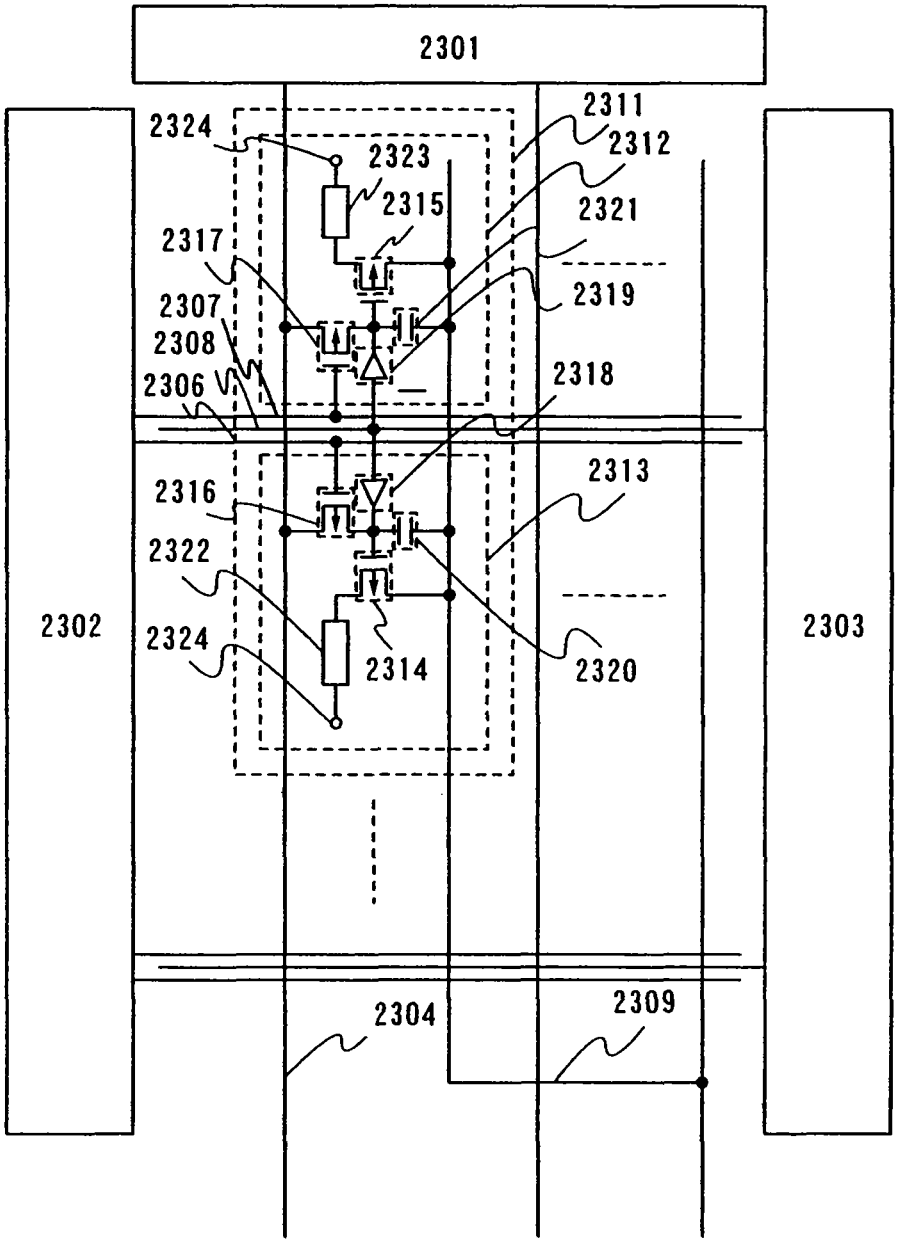
FIG. 23 shows Embodiment Mode 23.

In FIG. 23, reference numeral 2301 denotes a source driver, 2302 and 2303 denote gate drivers, 2304 denotes a source signal line, 2306, 2307, and 2308 denote gate signal lines, 2309 denotes a power supply line, 2311 denotes a pixel, 2312 and 2313 denote sub-pixels, 2314, 2315, 2316, and 2317 denote TFTs, 2318 and 2319 denote diodes, 2320 and 2321 denote capacitors each having a pair of electrodes, 2322 and 2323 denote light-emitting elements each having a pair of electrodes, and 2324 denotes a counter electrode corresponding to the other electrode of the light-emitting element 2322 and the other electrode of the light-emitting element 2323. Note that in this embodiment mode, the TFTs 2314 and 2315 are p-channel thin film transistors, while the TFTs 2316 and 2317 are n-channel thin film transistors.

The source driver 2301 is connected to and outputs video signals to the source signal line 2304. The gate driver 2302 is connected to and scans the gate signal line 2306 and the gate signal line 2307, while the gate driver 2303 is connected to and scans the gate signal line 2308. The power supply line 2309 is connected to one of either a source or a drain of the TFT 2314 and one of either a source or a drain of the TFT 2315. The other of either the source or the drain of the TFT 2314 is connected to one electrode of the light-emitting element 2322, and the other of either the source or the drain of the TFT 2315 is connected to one electrode of the light-emitting element 2323. A gate of the TFT 2314 is connected to one electrode of the capacitor 2320, an output of the diode 2318, and one of either a source or a drain of the TFT 2316. A gate of the TFT 2315 is connected to one electrode of the capacitor 2321, an output of the diode 2319, and the other of either the source or the drain of the TFT 2317. The other electrode of the capacitor 2320 and the other electrode of the capacitor 2321 are connected to the power supply line 2309. The other of either the source or the drain of the TFT 2316 and the other of either the source or the drain of the TFT 2317 are connected to the source signal line 2304. The gate of the TFT 2316 is connected to the gate signal line 2306, and the gate of the TFT 2317 is connected to the gate signal line 2307. Inputs of the diode 2318 and the diode 2319 are connected to the gate signal line 2308.

When the TFT 2316 is turned on, a video signal is written to the gate of the TFT 2314 and one electrode of the capacitor 2320 through the source signal line 2304. When the TFT 2317 is turned on, a video signal is written to the gate of the TFT 2315 and one electrode of the capacitor 2321 through the source signal line 2304. The gate of the TFT 2316 is connected to the gate signal line 2306, while the gate of the TFT 2317 is connected to the gate signal line 2307; therefore, they are separately turned on and thus the source signal line 2304 can be used in common. The value of a current flowing in each of the TFT 2314 and the TFT 2315 is determined by a relationship between a potential of a video signal input to the gate thereof and a potential of the power supply line 2309, thereby currents flowing into the light-emitting element 2322 and the light-emitting element 2323 are determined. That is, luminance is determined by a video signal. Since video signals are separately input to the sub-pixel 2312 and the sub-pixel 2313, the luminance of the sub-pixel 2312 and the luminance of the sub-pixel 2313 can be varied from each other. Therefore, provided that areas of the light-emitting element 2322 and the light-emitting element 2323 are designed to have a ratio of 1:2 with the condition that one sub-pixel can display 16 gray scales, 64 gray scales can be displayed. In this manner, a larger number of gray scales can be displayed. In addition, the gate signal line 2308 normally has a lower potential than the potentials held in the capacitor 2320 and the capacitor 2321. Therefore, by setting the potential of the gate signal line 2308 to be higher than the potentials held in the capacitor 2320 and the capacitor 2321 (potentials which turn off the TFT 2314 and the TFT 2315), the light-emitting element 2322 and the light-emitting element 2323 can be controlled to emit no light. In this manner, an erasing period can be provided.

Although this embodiment mode illustrates the case where two gate signal lines are provided, the invention is not limited to this, and more than two gate signal lines may be provided in accordance with the increase in the number of sub-pixels.

Since each of the TFT 2316 and the TFT 2317 operates as a switching element, it may be replaced with either an electrical switch or a mechanical switch as long as it can control a current flow. As the switching element, for example, a diode or a logic circuit constructed from a diode and a transistor may be employed. In addition, the TFT 2314 and the TFT 2315 may also be operated as switching elements. In such a case, if the operating point of the TFT 2314 and the light-emitting element 2322 and the operating point of the TFT 2315 and the light-emitting element 2323 are set so as to allow the TFT 2314 and the TFT 2315 to operate in the linear region, variations in the threshold voltage of the TFT 2314 and the TFT 2315 will not affect the display; therefore, a display device with higher image quality can be provided.

[Embodiment Mode 24]

Description will be made of an exemplary configuration of the panel 107 described in Embodiment Modes 1 and 2, with reference to FIG 31.

Figure 31:
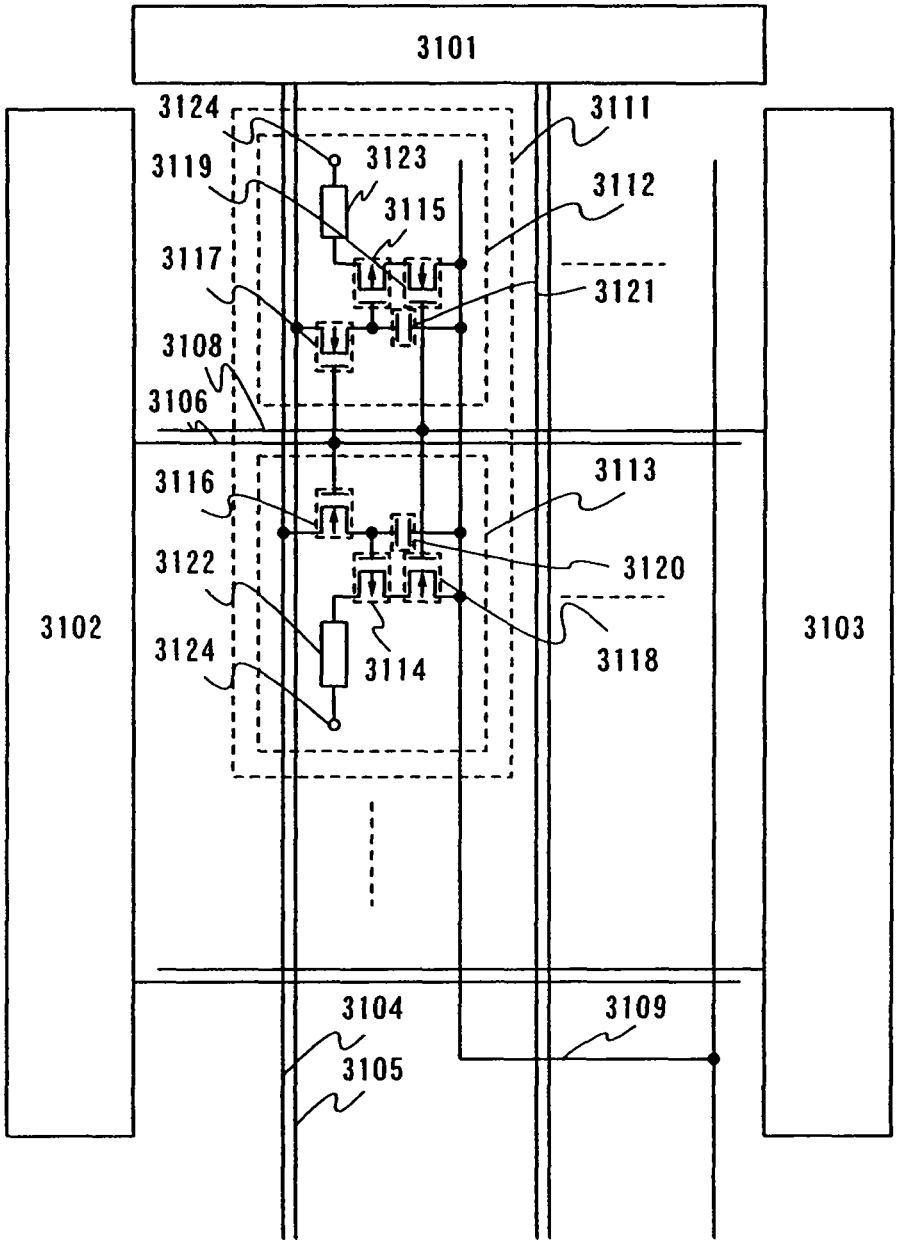
FIG. 31 shows Embodiment Mode 24.

In FIG. 31, reference numeral 3101 denotes a source driver, 3102 and 3103 denote gate drivers, 3104 and 3105 denote source signal lines, 3106 and 3108 denote gate signal lines, 3109 denotes a power supply line, 3111 denotes a pixel, 3112 and 3113 denote sub-pixels, 3114, 3115, 3116, 3117, 3118, and 3119 denote TFTs, 3120 and 3121 denote capacitors each having a pair of electrodes, 3122 and 3123 denote light-emitting elements each having a pair of electrodes, and 3124 denotes a counter electrode corresponding to the other electrode of the light-emitting element 3122 and the other electrode of the light-emitting element 3123. Note that in this embodiment mode, the TFTs 3114 and 3115 are p-channel thin film transistors, while the TFTs 3116, 3117, 3118, and 3119 are n-channel thin film transistors.

The source driver 3101 is connected to and outputs video signals to the source signal line 3104 and the source signal line 3105. The gate driver 3102 is connected to and scans the gate signal line 3106, while the gate driver 3103 is connected to and scans the gate signal line 3108. The power supply line 3109 is connected to one of either a source or a drain of the TFT 3114 and one of either a source or a drain of the TFT 3115. The other of either the source or the drain of the TFT 3114 is connected to one of either a source or a drain of the TFT 3118, and the other of either the source or the drain of the TFT 3118 is connected to one electrode of the light-emitting element 3122. The other of either the source or the drain of the TFT 3115 is connected to one of either a source or a drain of the TFT 3119, and the other of either the source or the drain of the TFT 3119 is connected to one electrode of the light-emitting element 3123. A gate of the TFT 3114 is connected to one electrode of the capacitor 3120 and one of either a source or a drain of the TFT 3116, while a gate of the TFT 3115 is connected to one electrode of the capacitor 3121 and the other of either the source or the drain of the TFT 3117. The other electrode of the capacitor 3120 and the other electrode of the capacitor 3121 are connected to the power supply line

3109. The other of either the source or the drain of the TFT 3116 is connected to the source signal line 3104, and the other of either the source or the drain of the TFT 3117 is connected to the source signal line 3105. The gates of the TFT 3116 and the TFT 3117 are connected to the gate signal line 3106, and the gates of the TFT 3118 and the TFT 3119 are connected to the gate signal line 3108.

When the TFT 3116 is turned on, a video signal is written to the gate of the TFT 3114 and one electrode of the capacitor 3120 through the source signal line 3104. When the TFT 3117 is turned on, a video signal is written to the gate of the TFT 3115 and one electrode of the capacitor 3121 through the source signal line 3105. The gates of the TFT 3116 and the TFT 3117 are connected to the common gate signal line 3106; therefore, they are turned on at the same time. The value of a current flowing in each of the TFT 3114 and the TFT 3115 is determined by a relationship between a potential of a video signal input to the gate thereof and a potential of the power supply line 3109, thereby currents flowing into the light-emitting element 3122 and the light-emitting element 3123 are determined. That is, luminance is determined by a video signal. Since video signals are separately input to the sub-pixel 3112 and the sub-pixel 3113, the luminance of the sub-pixel 3112 and the luminance of the sub-pixel 3113 can be varied from each other. Therefore, provided that areas of the light-emitting element 3122 and the light-emitting element 3123 are designed to have a ratio of 1:2 with the condition that one sub-pixel can display 16 gray scales, 64 gray scales can be displayed. In this manner, a larger number of gray scales can be displayed. In addition, since the TFT 3118 and the TFT 3119 are normally on, one electrode of the light-emitting element 3122 and one electrode of the light-emitting element 3123 are brought into a floating state when the TFT 3118 and the TFT 3119 are turned off, thereby a non-light-emitting state can be provided. In this manner, an erasing period is provided.

Although this embodiment mode illustrates the case where two sub-pixels are provided, the number of the sub-pixels may be more than two. In addition, although two gate signal lines are provided, the invention is not limited to this, and more than two gate signal lines may be provided in accordance with the increase in the number of sub-pixels.

Since each of the TFT 3116, the TFT 3117, the TFT 3118, and the TFT 3119 operates as a switching element, it may be replaced with either an electrical switch or a mechanical switch as long as it can control a current flow. As the switching element, for example, a diode or a logic circuit constructed from a diode and a transistor may be employed. In addition, the TFT 3114 and the TFT 3115 may also be operated as switching elements. In such a case, if the operating point of the TFT 3114 and the light-emitting element 3122 and the operating point of the TFT 3115 and the light-emitting element 3123 are set so as to allow the TFT 3114 and the TFT 3115 to operate in the linear region, variations in the threshold voltage of the TFT 3114 and the TFT 3115 will not affect the display; therefore, a display device with higher image quality can be provided.

[Embodiment Mode 25]

Description will be made of an exemplary configuration of the panel 107 described in Embodiment Modes 1 and 2, with reference to FIG. 32.

Figure 32:
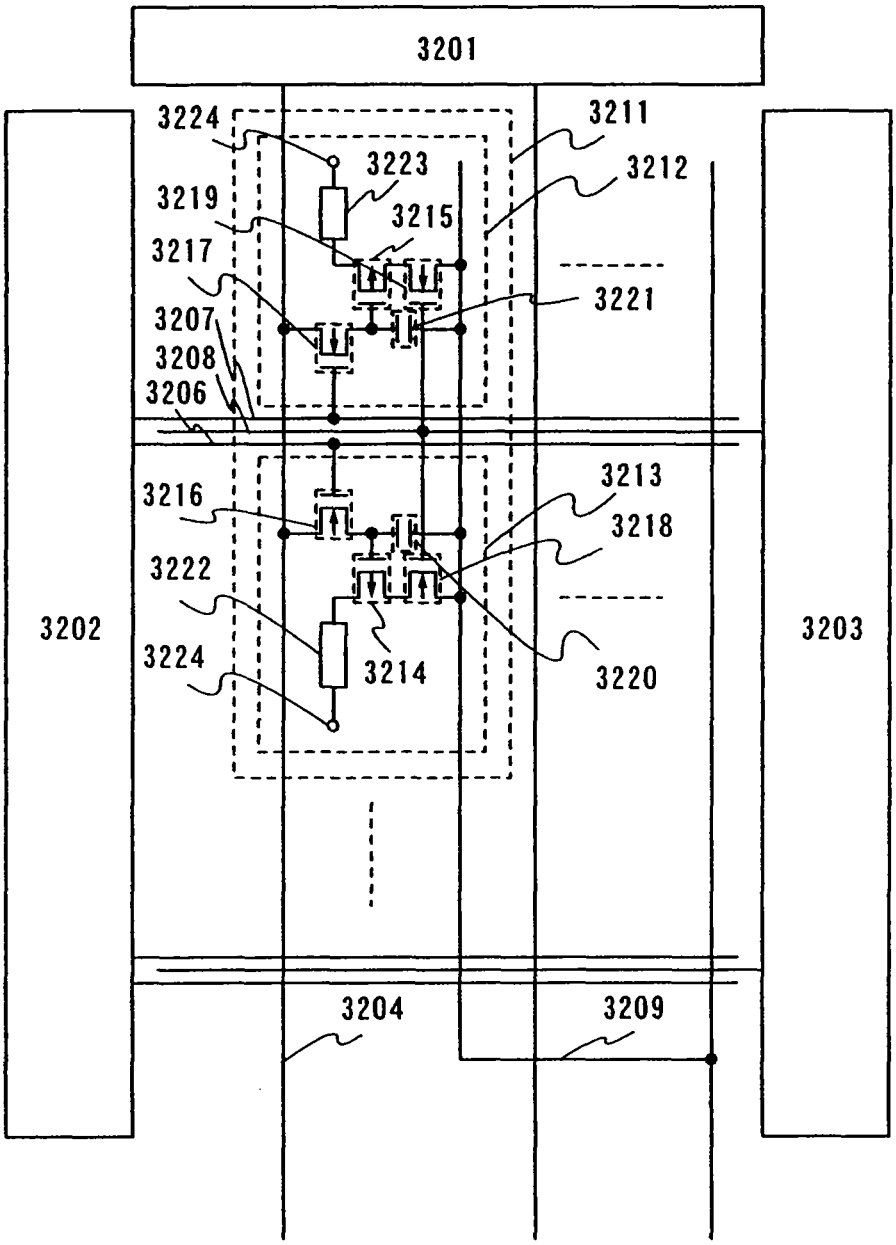
FIG. 32 shows Embodiment Mode 25.

In FIG. 32, reference numeral 3201 denotes a source driver, 3202 and 3203 denote gate drivers, 3204 denotes a source signal line, 3206, 3207, and 3208 denote gate signal lines, 3209 denotes a power supply line, 3211 denotes a pixel, 3212 and 3213 denote sub-pixels, 3214, 3215, 3216, 3217, 3218, and 3219 denote TFTs, 3220 and 3221 denote capacitors each having a pair of electrodes, 3222 and 3223 denote light-emitting elements each having a pair of electrodes, and 3224 denotes a counter electrode corresponding to the other electrode of the light-emitting element 3222 and the other electrode of the light-emitting element 3223. Note that in this embodiment mode, the TFTs 3214 and 3215 are p-channel thin film transistors, while the TFTs 3216, 3217, 3218, and 3219 are n-channel thin film transistors.

The source driver 3201 is connected to and outputs video signals to the source signal line 3204. The gate driver 3202 is connected to and scans the gate signal line 3206 and the gate signal line 3207, while the gate driver 3203 is connected to and scans the gate signal line 3208. The power supply line 3209 is connected to one of either a source or a drain of the TFT 3214 and one of either a source or a drain of the TFT 3215. The other of either the source or the drain of the TFT 3214 is connected to one of either a source or a drain of the TFT 3218, and the other of either the source or the drain of the TFT 3218 is connected to one electrode of the light-emitting element 3222. The other of either the source or the drain of the TFT 3215 is connected to one of either a source or a drain of the TFT 3219, and the other of either the source or the drain of the TFT 3219 is connected to one electrode of the light-emitting element 3223. A gate of the TFT 3214 is connected to one electrode of the capacitor 3220 and one of either a source or a drain of the TFT 3216, while a gate of the TFT 3215 is connected to one electrode of the capacitor 3221 and the other of either the source or the drain of the TFT 3217. The other electrode of the capacitor 3220 and the other electrode of the capacitor 3221 are connected to the power supply line 3209. The other of either the source or the drain of the TFT 3216 and the other of either the source or the drain of the TFT 3217 are connected to the source signal line 3204. The gate of the TFT 3216 is connected to the gate signal line 3206, the gate of the TFT 3217 is connected to the gate signal line 3207, and the gates of the TFT 3218 and the TFT 3219 are connected to the gate signal line 3208.

When the TFT 3216 is turned on, a video signal is written to the gate of the TFT 3214 and one electrode of the capacitor 3220 through the source signal line 3204. When the TFT 3217 is turned on, a video signal is written to the gate of the TFT 3215 and one electrode of the capacitor 3221 through the source signal line 3204. The gate of the TFT 3216 is connected to the gate signal line 3206, and the gate of the TFT 3217 is connected to the gate signal line 3207; therefore, they are separately turned on and thus the source signal line 3204 can be used in common. The value of a current flowing in each of the TFT 3214 and the TFT 3215 is determined by a relationship between a potential of a video signal input to the gate thereof and a potential of the power supply line 3209, thereby currents flowing into the light-emitting element 3222 and the light-emitting element 3223 are determined. That is, luminance is determined by a video signal. Since video signals are separately input to the sub-pixel 3212 and the sub-pixel 3213, the luminance of the sub-pixel 3212 and the luminance of the sub-pixel 3213 can be varied from each other. Therefore, provided that areas of the light-emitting element 3222 and the light-emitting element 3223 are designed to have a ratio of 1:2 with the condition that one sub-pixel can display 16 gray scales, 64 gray scales can be displayed. In this manner, a larger number of gray scales can be displayed. In addition, since the TFT 3218 and the TFT 3219 are normally on, one electrode of the light-emitting element 3222 and one electrode of the light-emitting element 3223 are brought into a floating state when the TFT 3218 and the TFT 3219 are turned off, thereby a non-light-emitting state can be provided. In this manner, an erasing period is provided.

Although this embodiment mode illustrates the case where two sub-pixels are provided, the number of the sub-pixels may be more than two. In addition, although two gate signal lines are provided, the invention is not limited to this, and more than two gate signal lines may be provided in accordance with the increase in the number of sub-pixels.

Since each of the TFT 3216, the TFT 3217, the TFT 3218, and the TFT 3219 operates as a switching element, it may be replaced with either an electrical switch or a mechanical switch as long as it can control a current flow. As the switching element, for example, a diode or a logic circuit constructed from a diode and a transistor may be employed. In addition, the TFT 3214 and the TFT 3215 may also be operated as switching elements. In such a case, if the operating point of the TFT 3214 and the light-emitting element 3222 and the operating point of the TFT 3215 and the light-emitting element 3223 are set so as to allow the TFT 3214 and the TFT 3215 to operate in the linear region, variations in the threshold voltage of the TFT 3214 and the TFT 3215 will not affect the display; therefore, a display device with higher image quality can be provided.

[Embodiment Mode 26]

Description will be made of an exemplary configuration of the panel 107 described in Embodiment Modes 1 and 2, with reference to FIG. 33.

Figure 33:
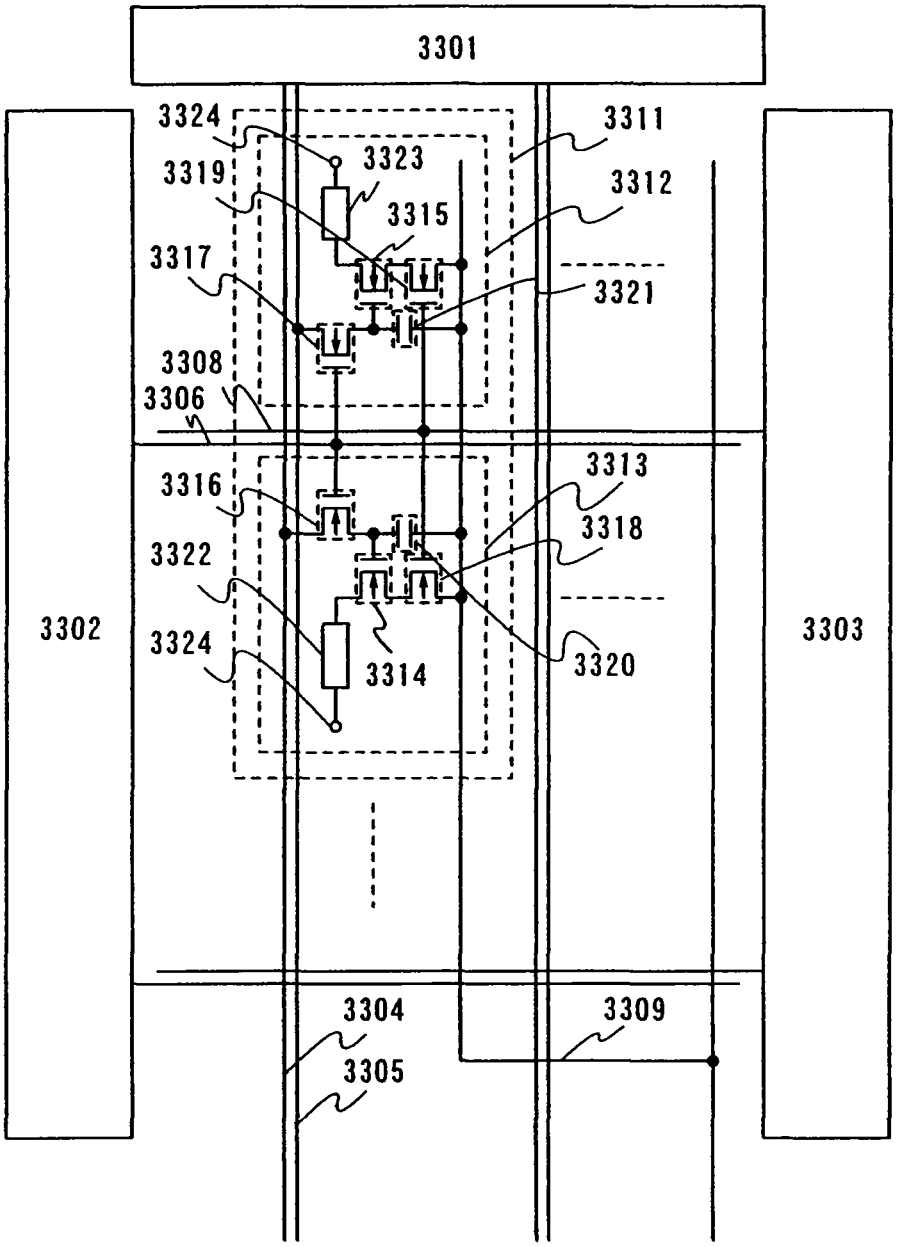
FIG. 33 shows Embodiment Mode 26.

In FIG. 33, reference numeral 3301 denotes a source driver, 3302 and 3303 denote gate drivers, 3304 and 3305 denote source signal lines, 3306 and 3308 denote gate signal lines, 3309 denotes a power supply line, 3311 denotes a pixel, 3312 and 3313 denote sub-pixels, 3314, 3315, 3316, 3317, 3318, and 3319 denote TFTs, 3220 and 3221 denote capacitors each having a pair of electrodes, 3322 and 3323 denote light-emitting elements each having a pair of electrodes, and 3324 denotes a counter electrode corresponding to the other electrode of the light-emitting element 3322 and the other electrode of the light-emitting element 3323. Note that in this embodiment mode, the TFTs 3314, 3315, 3316, 3317, 3318, and 3319 are n-channel thin film transistors.

The source driver 3301 is connected to and outputs video signals to the source signal line 3304 and the source signal line 3305. The gate driver 3202 is connected to and scans the gate signal line 3306, while the gate driver 3303 is connected to and scans the gate signal line 3308. The power supply line 3309 is connected to one of either a source or a drain of the TFT 3314 and one of either a source or a drain of the TFT 3315. The other of either the source or the drain of the TFT 3314 is connected to one of either a source or a drain of the TFT 3318, and the other of either the source or the drain of the TFT 3318 is connected to one electrode of the light-emitting element 3322. The other of either the source or the drain of the TFT 3315 is connected to one of either a source or a drain of the TFT 3319, and the other of either the source or the drain of the TFT 3319 is connected to one electrode of the light-emitting element 3323. A gate of the TFT 3314 is connected to one electrode of the capacitor 3320 and one of either a source or a drain of the TFT 3316, while a gate of the TFT 3315 is connected to one electrode of the capacitor 3321 and the other of either the source or the drain of the TFT 3317. The other electrode of the capacitor 3320 and the other electrode of the capacitor 3321 are connected to the power supply line 3309. The other of either the source or the drain of the TFT 3316 is connected to the source signal line 3304, and the other of either the source or the drain of the TFT 3317 is connected to the source signal line 3305. The gates of the TFT 3316 and the TFT 3317 are connected to the gate signal line 3306, while the gates of the TFT 3318 and the TFT 3319 are connected to the gate signal line 3308.

When the TFT 3316 is turned on, a video signal is written to the gate of the TFT 3314 and one electrode of the capacitor 3320 through the source signal line 3304. When the TFT 3317 is turned on, a video signal is written to the gate of the TFT 3315 and one electrode of the capacitor 3321 through the source signal line 3305. The gates of the TFT 3316 and the TFT 3317 are connected to the common gate signal line 3306; therefore, they are turned on at the same time. The value of a current flowing in each of the TFT 3314 and the TFT 3315 is determined by a relationship between a potential of a video signal input to the gate thereof and a potential of the power supply line 3309, thereby currents flowing into the light-emitting element 3322 and the light-emitting element 3323 are determined. That is, luminance is determined by a video signal. Since video signals are separately input to the sub-pixel 3312 and the sub-pixel 3313, the luminance of the sub-pixel 3312 and the luminance of the sub-pixel 3313 can be varied from each other. Therefore, provided that areas of the light-emitting element 3322 and the light-emitting element 3323 are designed to have a ratio of 1:2 with the condition that one sub-pixel can display 16 gray scales, 64 gray scales can be displayed. In this manner, a larger number of gray scales can be displayed. In addition, since the TFT 3318 and the TFT 3319 are normally on, one electrode of the light-emitting element 3322 and one electrode of the light-emitting element 3323 are brought into a floating state when the TFT 3318 and the TFT 3319 are turned off, thereby a non-light-emitting state can be provided. In this manner, an erasing period is provided.

Although this embodiment mode illustrates the case where two sub-pixels are provided, the number of the sub-pixels may be more than two. In addition, although two gate signal lines are provided, the invention is not limited to this, and more than two gate signal lines may be provided in accordance with the increase in the number of sub-pixels.

In this embodiment mode, all of the TFTs in the pixel 3311 are n-channel TFTs; therefore, such TFTs can be manufactured with amorphous silicon.

Since each of the TFT 3316, the TFT 3317, the TFT 3318, and the TFT 3319 operates as a switching element, it may be replaced with either an electrical switch or a mechanical switch as long as it can control a current flow. As the switching element, for example, a diode or a logic circuit constructed from a diode and a transistor may be employed. In addition, the TFT 3314 and the TFT 3315 may also be operated as switching elements. In such a case, if the operating point of the TFT 3314 and the light-emitting element 3322 and the operating point of the TFT 3315 and the light-emitting element 3323 are set so as to allow the TFT 3314 and the TFT 3315 to operate in the linear region, variations in the threshold voltage of the TFT 3314 and the TFT 3314 will not affect the display; therefore, a display device with higher image quality can be provided.

[Embodiment Mode 27]

Description will be made of an exemplary configuration of the panel 107 described in Embodiment Modes 1 and 2, with reference to FIG. 34.

Figure 34:
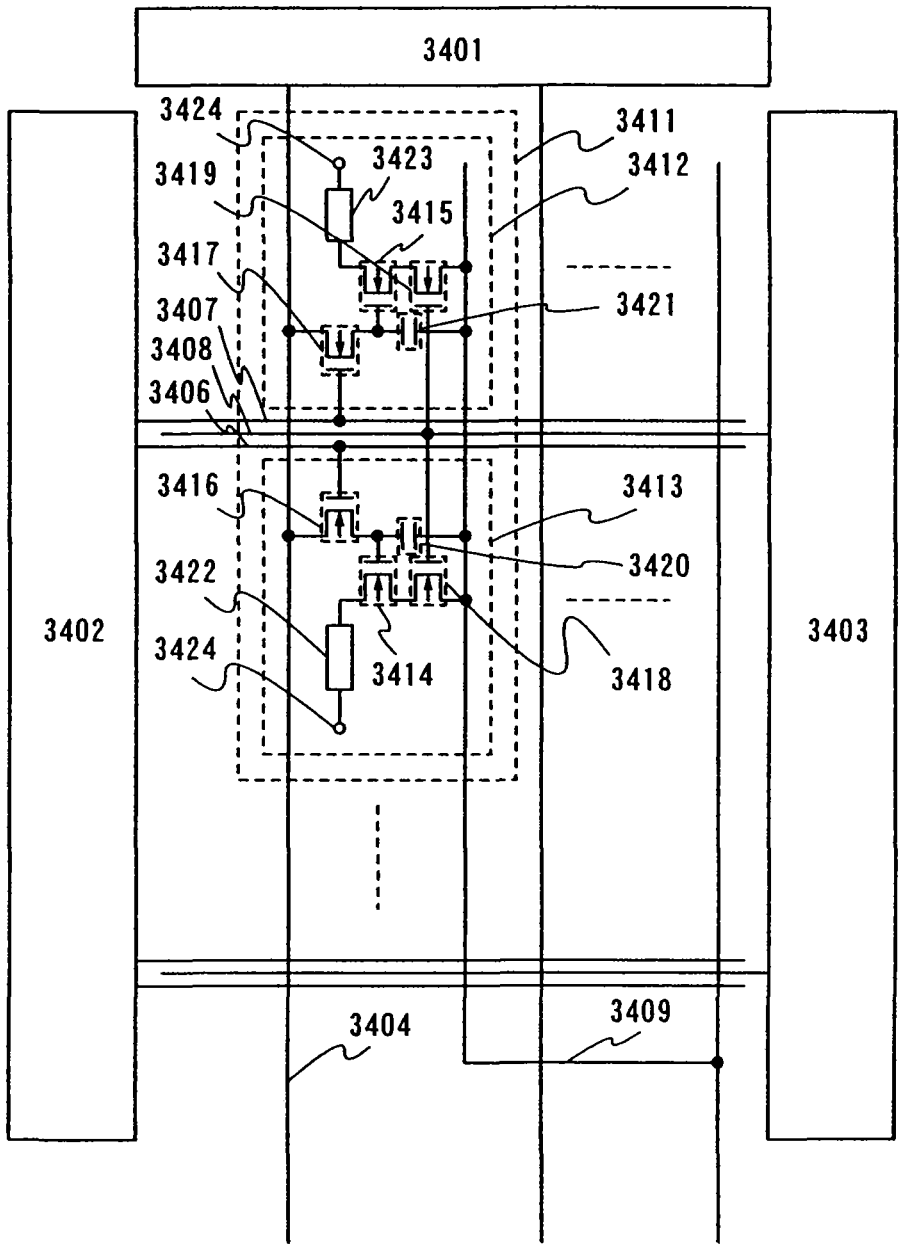
FIG. 34 shows Embodiment Mode 27.

In FIG. 34, reference numeral 3401 denotes a source driver, 3402 and 3403 denote gate drivers, 3404 denotes a source signal line, 3406, 3407, and 3408 denote gate signal lines, 3409 denotes a power supply line, 3411 denotes a pixel, 3412 and 3413 denote sub-pixels, 3414, 3415, 3416, 3417, 3418, and 3419 denote TFTs, 3420 and 3421 denote capacitors each having a pair of electrodes, 3422 and 3423 denote light-emitting elements each having a pair of electrodes, and 3424 denotes a counter electrode corresponding to the other electrode of the light-emitting element 3422 and the other electrode of the light-emitting element 3423. Note that in this embodiment mode, the TFTs 3414, 3415, 3416, 3417, 3418, and 3419 are n-channel thin film transistors.

The source driver 3401 is connected to and outputs video signals to the source signal line 3404. The gate driver 3402 is connected to and scans the gate signal line 3406 and the gate signal line 3407, while the gate driver 3403 is connected to and scans the gate signal line 3408. The power supply line 3409 is connected to one of either a source or a drain of the TFT 3414 and one of either a source or a drain of the TFT 3415. The other of either the source or the drain of the TFT 3414 is connected to one of either a source or a drain of the TFT 3418, and the other of either the source or the drain of the TFT 3418 is connected to one electrode of the light-emitting element 3422. The other of either the source or the drain of the TFT 3415 is connected to one of either a source or a drain of the TFT 3419, and the other of either the source or the drain of the TFT 3419 is connected to one electrode of the light-emitting element 3423. A gate of the TFT 3414 is connected to one electrode of the capacitor 3420 and one of either a source or a drain of the TFT 3416, while a gate of the TFT 3415 is connected to one electrode of the capacitor 3421 and the other of either the source or the drain of the TFT 3417. The other electrode of the capacitor 3420 and the other electrode of the capacitor 3421 are connected to the power supply line 3409. The other of either the source or the drain of the TFT 3416 and the other of either the source or the drain of the TFT 3417 are connected to the source signal line 3404. The gate of the TFT 3416 is connected to the gate signal line 3406, the gate of the TFT 3417 is connected to the gate signal line 3407, and the gates of the TFT 3418 and the TFT 3419 are connected to the gate signal line 3408.

When the TFT 3416 is turned on, a video signal is written to the gate of the TFT 3414 and one electrode of the capacitor 3420 through the source signal line 3404. When the TFT 3417 is turned on, a video signal is written to the gate of the TFT 3415 and one electrode of the capacitor 3421 through the source signal line 3404. The gate of the TFT 3416 is connected to the gate signal line 3406, and the gate of the TFT 3417 is connected to the gate signal line 3407; therefore, they are separately turned on and thus the source signal line 3404 can be used in common. The value of a current flowing in each of the TFT 3414 and the TFT 3415 is determined by a relationship between a potential of a video signal input to the gate thereof and a potential of the power supply line 3409, thereby currents flowing into the light-emitting element 3422 and the light-emitting element 3423 are determined. That is, luminance is determined by a video signal. Since video signals are separately input to the sub-pixel 3412 and the sub-pixel 3413, the luminance of the sub-pixel 3412 and the luminance of the sub-pixel 3413 can be varied from each other. Therefore, provided that areas of the light-emitting element 3422 and the light-emitting element 3423 are designed to have a ratio of 1:2 with the condition that one sub-pixel can display 16 gray scales, 64 gray scales can be displayed. In this manner, a larger number of gray scales can be displayed. In addition, since the TFT 3418 and the TFT 3419 are normally on, one electrode of the light-emitting element 3422 and one electrode of the light-emitting element 3423 are brought into a floating state when the TFT 3418 and the TFT 3419 are turned off, thereby a non-light-emitting state can be provided. In this manner, an erasing period is provided.

Although this embodiment mode illustrates the case where two gate signal lines are provided, the invention is not limited to this, and more than two gate signal lines may be provided in accordance with the increase in the number of sub-pixels.

In this embodiment mode, all of the TFTs in the pixel 3411 are n-channel TFTs; therefore, such TFTs can be manufactured with amorphous silicon.

Since each of the TFT 3416, the TFT 3417, the TFT 3418, and the TFT 3419 operates as a switching element, it may be replaced with either an electrical switch or a mechanical switch as long as it can control a current flow. As the switching element, for example, a diode or a logic circuit constructed from a diode and a transistor may be employed. In addition, the TFT 3414 and the TFT 3415 may also be operated as switching elements. In such a case, if the operating point of the TFT 3414 and the light-emitting element 3422 and the operating point of the TFT 3415 and the light-emitting element 3423 are set so as to allow the TFT 3414 and the TFT 3415 to operate in the linear region, variations in the threshold voltage of the TFT 3414 and the TFT 3415 will not affect the display; therefore, a display device with higher image quality can be provided.

[Embodiment Mode 28]

Description will be made of an exemplary method of displaying gray scales with the configurations described in Embodiment Modes 14 to 27, with reference to FIGS. 40A and 40B.

In this embodiment mode, description is made of a method by which one frame period is divided into a plurality of sub-frame periods, and luminance is expressed with the light-emitting time of light-emitting elements. FIGS. 40A and 40B show an example of a timing chart in the case of dividing one frame period into three sub-frame periods. Such a driving method is called a digital time gray scale driving.

Figure 40A:
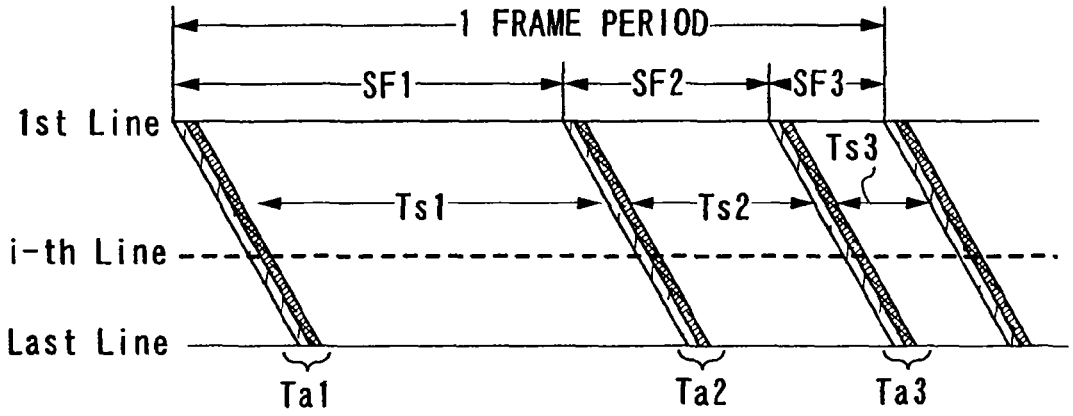
FIGS. 40A and 40B show Embodiment Mode 28.

In FIG. 40A, one frame period is divided into three sub-frame periods. The first sub-frame period is denoted by SF1; the second sub-frame period, SF2; and the third sub-frame period, SF3. A light-emitting period in SF1 is denoted by Ts1; a light-emitting period in SF2, Ts2; and a light-emitting period in SF3, Ts3. A writing period in SF1 is denoted by Ta1; a writing period in SF2, Ta2; and a writing period in SF3, Ta3. In addition, the writing period may include an erasing period.

Figure 40B:
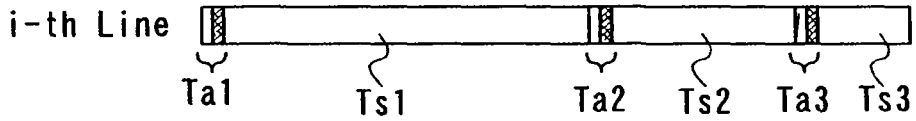

FIG. 40B is a timing chart for driving pixels in an i-th row, which shows light-emitting periods and writing periods in the respective sub-frame periods in one frame.

For example, by setting the ratio of the light-emitting periods of Ts1, Ts2, and Ts3 to 1:2:4, and selecting a sub-frame for lighting pixels, 8 gray scales can be displayed. In addition, the division number of one frame period is not specifically limited, and it may be any numbel For example, one frame period may be divided into six, and the ratio of the Ts1, Ts2, Ts3, Ts4, Ts5, and Ts6 may be set to 1:2:4:8:16:32. In addition, Ta5 and Ta6 may be further divided so that the ratio of the respective light-emitting periods is 1:2:4:8:8:8:8:8:8.

Further, if each sub-frame is shortened, more sub-frame periods can be provided within the same frame period. In addition, if the sub-frame periods are provided to be shorter than the time required for writing signals to the pixels in all rows, a method of providing an erasing period may be used. Accordingly, in the case of scanning gate signal lines in the writing period from the first row in order, the data which has been written is erased before terminating the scan operation of all gate signal lines, thereby a light-emitting period in the sub-frame period can be shortened.

In order to provide such an erasing period, there is a method in which one gate selection period is divided into a plurality of periods and the same source signal line is used, as shown in Embodiment Modes 14, 15, 16, and 17. Alternatively, in Embodiment Modes 18, 19, 20, 21, 22, and 23, another gate signal line is provided in addition to the gate signal line for writing signals, and a driving TFT is turned off when it is selected by the additional gate signal line. Further alternatively, in Embodiment modes 31, 32, 33, and 34, a TFT is provided between a light-emitting element and a power supply line, and an erasing period is provided by turning off the TFT.

[Embodiment Mode 29]

Description will be made with reference to FIG. 35, FIG. 36, and FIG. 37 on examples of the gate drivers 1402, 1502, 1602, 1702, 1802, 1803, 1902, 1903, 2002, 2003, 2102, 2103, 2202, 2203, 2302, 2303, 3102, 3103, 3202, 3203, 3302, 3303, 3402, and 3403, with the configurations described in Embodiment Modes 14 to 27.

Figure 35:
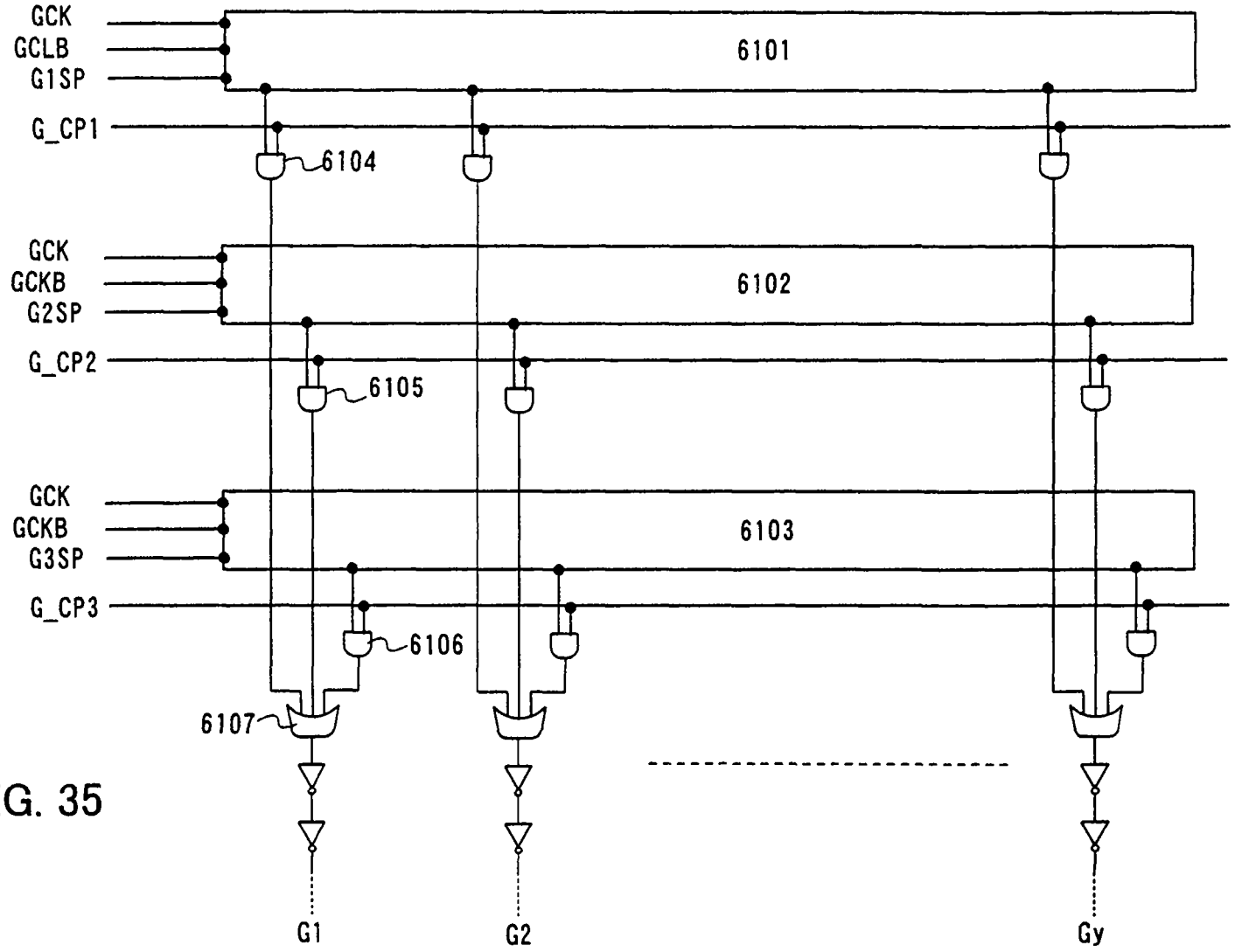
FIG. 35 shows Embodiment Mode 29.

Description is made of an example of the gate drivers 1402, 1502, 1602, and 1702, with reference to FIG. 35.

The gate driver includes a first shift register 6101, a second shift register 6102, a third shift register 6103, an AND circuit 6104, an AND circuit 6105, an AND circuit 6106, and an OR circuit 6107. GCK, GCKB, and G1SP are input to the first shift register 6101, GCK, GCKB, and G2SP are input to the second shift register 6102, and GCK, GCKB, and G3SP are input to the third shift register 6103. An output of the first shift register 6101 and G_CP1 are connected to inputs of an AND circuit 6104, an output of the second shift register 6102 and G_CP2 are connected to inputs of an AND circuit 6105, and an output of the third shift register 6103 and G_CP3 are connected to inputs of an AND circuit 6106. Outputs of the AND circuits 6104, 6105, and 6106 are connected to the OR circuit 6107. Which of the gate signal lines Gy is selected to output signals is determined by a combination of the outputs of the first shift register 6101, the second shift register 6102, and the third shift register 6103, with G_CP1, G_CP2, and G_CP3. With the configuration of FIG. 35, three sub-gate selection periods can be provided. In addition, the number of the shift registers is not specifically limited as well as the number of the sub-gate selection periods is not specifically limited.

Figure 36:
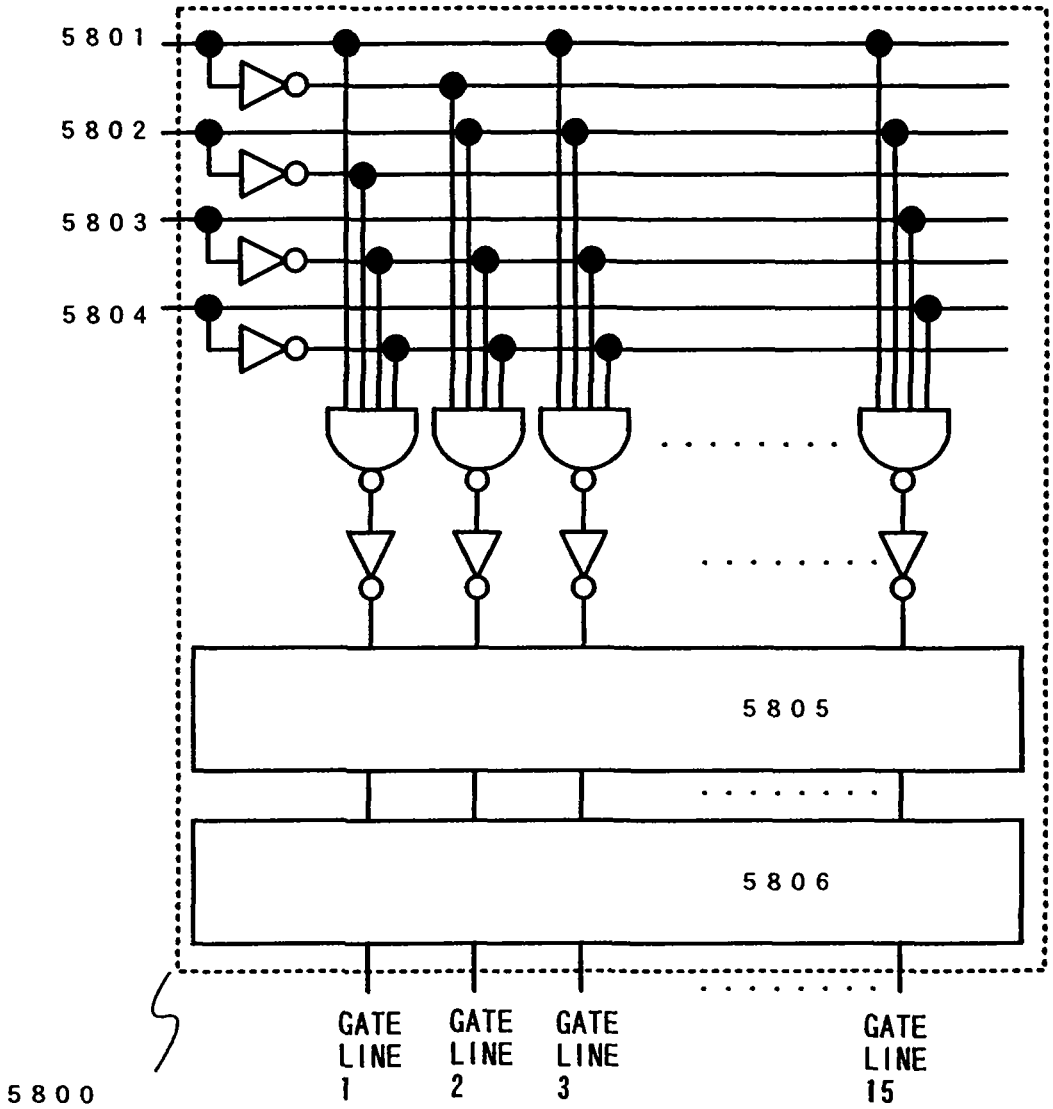
FIG. 36 shows Embodiment Mode 29.

Description is made with reference to FIG. 36, of an example where a decoder circuit is used for the gate drivers 1402, 1502, 1602, 1702, 1802, 1803, 1902, 1903, 2002, 2003, 2102, 2103, 2202, 2203, 2302, 2303, 3102, 3103, 3202, 3203, 3302, 3303, 3402, and 3403.

The gate driver using a decoder circuit includes input terminals, NAND circuits, inverter circuits, a level shifter 5805, and a buffer circuit 5806. Inputs of an NAND circuit having four input terminals are connected to four input terminals selected from among a first input terminal 5801, a second input terminal 5802, a third input terminal 5803, a fourth input terminal 5804, an inverted signal of the signal input to. the first input terminal 5801, an inverted signal of the signal input to the second input terminal 5802, an inverted signal of the signal input to the third input terminal 5803, and an inverted signal of the signal input to the fourth input terminal 5804. An output of the NAND circuit having four input terminals is connected to an input of the inverter circuit, and an output of the inverter circuit is connected to an input of the level shifter 5805. An output of the level shifter 5805 is connected to an input of the buffer circuit 5806, and an output of the buffer circuit 5806 is output to a pixel through a gate signal line. The inputs of the NAND circuit having four input terminals are determined by a combination of different signals, and with the configuration shown in FIG. 36, 16 kinds of outputs can be controlled.

Figure 37:
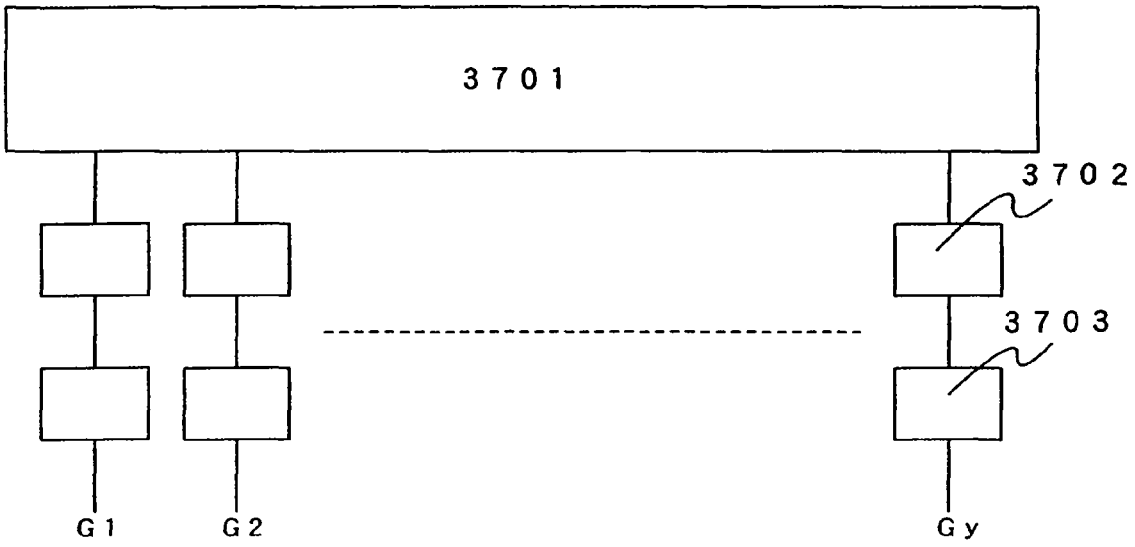
FIG. 37 shows Embodiment Mode 29.

Description is made with reference to FIG. 37 of the gate drivers 1902, 1903, 2002, 2003, 2102, 2103, 2202, 2203, 2302, 2303, 3102, 3103, 3202, 3203, 3302, 3303, 3402, and 3403.

A shift register 3701 sequentially scans gate signal lines from the first row, thereby outputting signals to gate signal lines G1, G2 . . . Gy through a level shifter 3702 and a shift register 3703. The configuration of the shift register 3701 is not specifically limited. It may have any configuration as long as it can perform a scan operation. For example, a flip-flop or an asynchronous shift register may be employed. Each of the gate drivers 1902, 1903, 2002, 2003, 2102, 2103, 2202, 2203, 2302, 2303, 3102, 3103, 3202, 3203, 3302, 3303, 3402, and 3403 operates in a manner realizing Embodiment Mode 28.

[Embodiment Mode 30]

Figure 38:
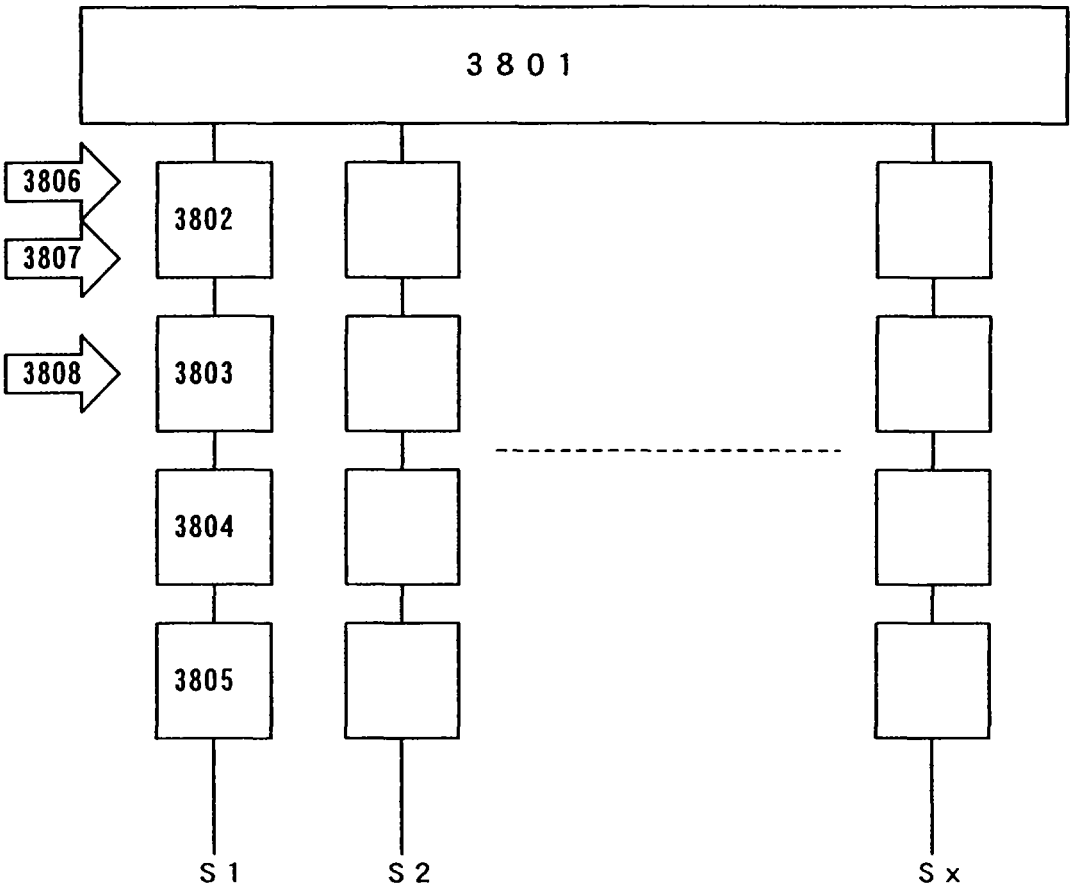
FIG. 38 shows Embodiment Mode 30.
Figure 39:
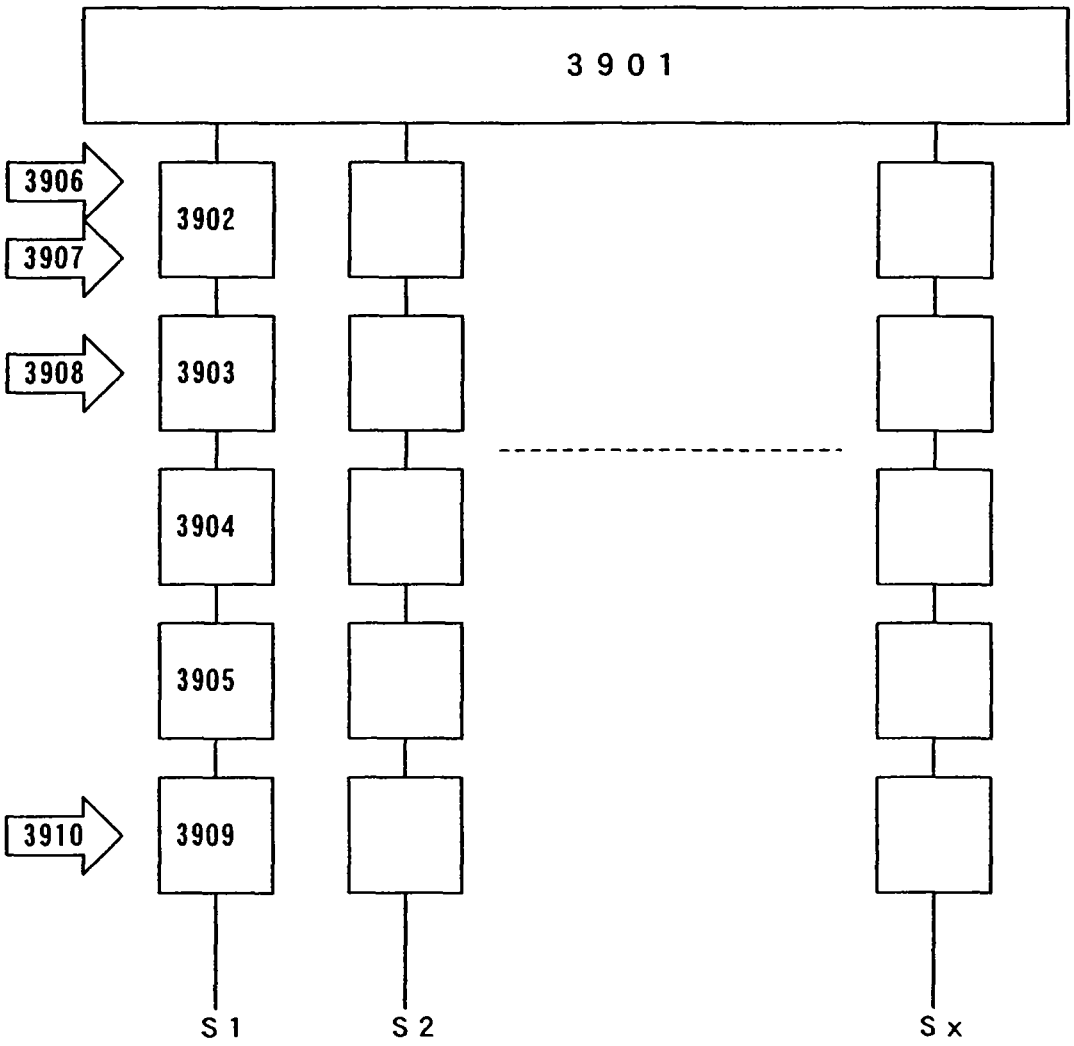
FIG. 39 shows Embodiment Mode 30.

Description is made with reference to FIG. 38 and FIG. 39 of the source drivers 1401, 1501, 1601, 1701, 1801, 1901, 2001, 2101, 2201, 2301, 3101, 3201, 3301, and 3401, with the configurations described in Embodiment Modes 14 to 27.

Description is made with reference to FIG. 38 of an example of the source drivers 1801, 1901, 2001, 2101, 2201, 2301, 3101, 3201, 3301, and 3401.

Reference numeral 3801 denotes a shift register, 3802 and 3803 denote LAT circuits, 3804 denotes a level shifter circuit, 3805 denotes a buffer circuit, 3806 denotes a video signal, 3807 denotes a latch pulse of the LAT circuit 3802, and 3808 denotes a latch pulse of the LAT circuit 3803. Outputs of the shift register 3801 are sequentially output to the latch circuits 3802, and thus video signals 3806 are held therein. Upon termination of the holding of the video signals 3806 in the LAT circuits 3802 in all rows, the video signals are output to the LAT circuits 3803 in synchronous with the latch pulse 3807 and held therein. When the latch pulse 3808 is output, the LAT circuits 3803 outputs the video signals 3806 to source signal lines through the level shifter circuits 3804 and the buffer circuits 3805.

Description is made of an example of the source drivers 1501, 1601, and 1701, with reference to FIG. 39.

Reference numeral 3901 denotes a shift register, 3902 and 3903 denote LAT circuits, 3904 denotes a level shifter circuit, 3905 denotes a buffer circuit, 3906 denotes a video signal, 3907 denotes a latch pulse of the LAT circuit 3902, 3908 denotes a latch pulse of the LAT circuit 3903, 3909 denotes a tristate buffer circuit, and 3910 denotes a control signal of the tristate buffer circuit 3909. Outputs of the shift register 3901 are sequentially output to the latch circuits 3902, and thus video signals 3906 are held therein. Upon termination of the holding of the video signals 3906 in the LAT circuits 3902 in all rows, the video signals are output to the LAT circuits 3903 in synchronous with the latch pulse 3907 and held therein. When the latch pulse 3908 is output, the LAT circuits 3903 output the video signals to the tristate buffers 3909 through the level shifter circuits 3904 and the buffer circuits 3905. Then, each tristate buffer circuit 3909 controls whether or not to output the input video signals in synchronous with the control signal 3910. In the case of not outputting the input signal, signals which can turn off the driving TFTs in all rows at the same time are output.

[Embodiment Mode 31]

Figure 41:
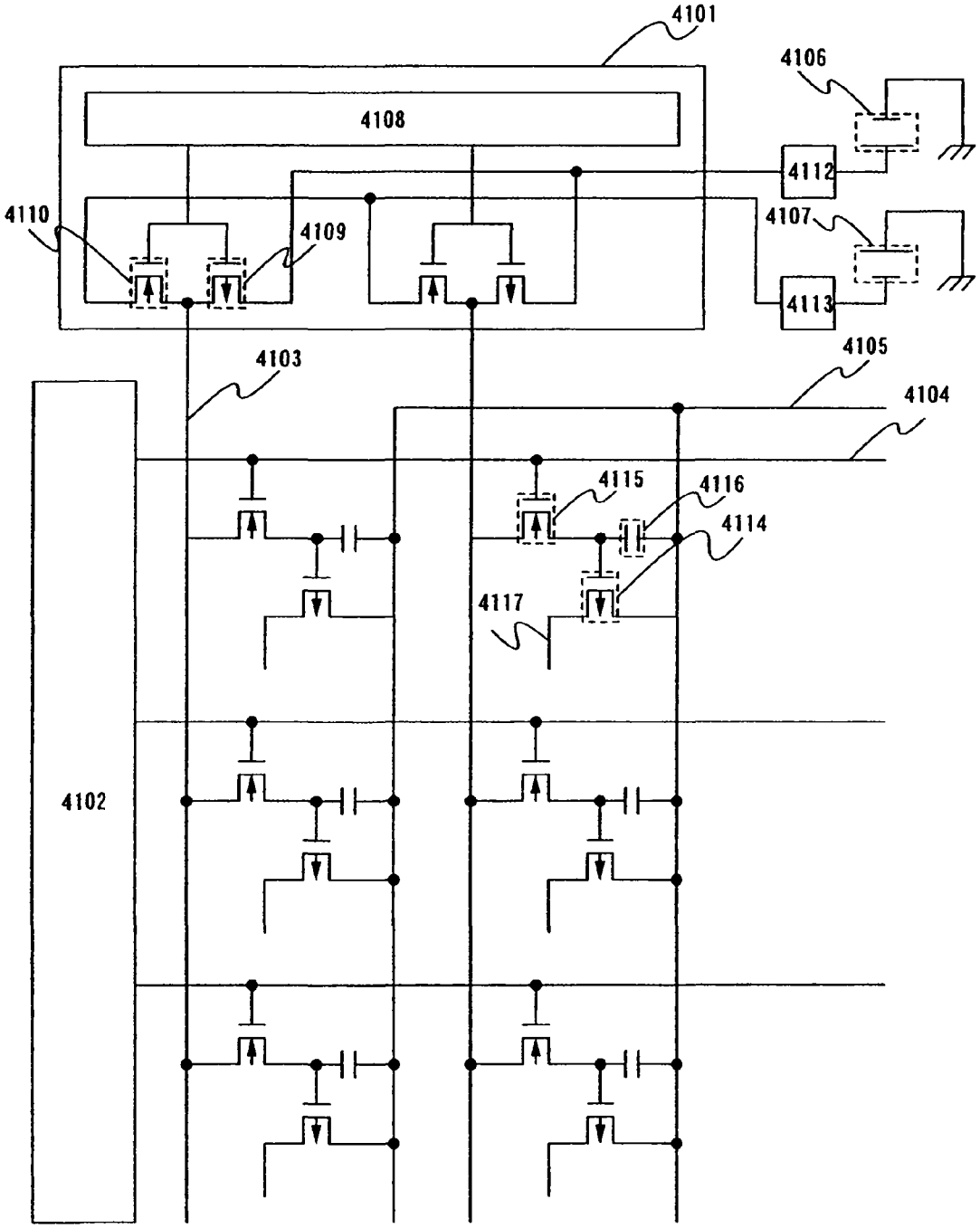
FIG. 41 shows Embodiment Mode 31.

In this embodiment mode, description is made of a method of detecting a defective pixel, which is difference from the method of detecting a defective pixel described in Embodiment Modes 1 and 2, with reference to FIG. 41. For ease of description, each pixel shown herein does not have a plurality of sub-pixels; however, it desirably has a plurality of sub-pixels.

In FIG. 41, reference numerals 4101 and 4108 denote source drivers, 4102 denotes a gate driver, 4103 denotes a source signal line, 4104 denotes a gate signal line, 4105 denotes a power supply line, 4106, 4107, and 4111 denote power supplies, 4109, 4110, 4114, and 4115 denote TFTs,

4112 and 4113 denote sensor circuits, 4116 denotes a capacitor, and 4117 denotes a wire to be connected to one electrode of a light-emitting element.

The source driver 4101 includes the source driver 4108, the TFT 4109, and the TFT 4110. An output of the source driver 4108 is connected to a gate of the TFT 4109 and a gate of the TFT 4110, one of either a source or a drain of the TFT 4109 is connected to the power supply 4106 through the sensor circuit 4112. One of either source or a drain of the TFT 4110 is connected to the power supply 4107 through the sensor circuit 4113, and the other of either the source or the drain of the TFT 4109 and the other of either the source or the drain of the TFT 4110 are connected to the source signal line 4103. An output of the gate driver 4102 is connected to the gate signal line 4104, and one of either a source or a drain of the TFT 4114 is connected to the power supply line 4105, while the other of either the source or the drain of the TFT 4114 is connected to the wire 4117. A gate of the TFT 4114 is connected to one electrode of the capacitor 4116 and one of either a source or a drain of the TFT 4115. The other electrode of the capacitor 4116 is connected to the power supply line 4105, and the other of either the source or the drain of the TFT 4115 is connected to the source signal line 4103. A gate of the TFT 4115 is connected to the gate signal line 4104.

An operation of detecting a defective pixel is described below. First, in this embodiment mode, a defective pixel is detected by inspecting whether a value of a video signal transmitted from the source signal line is held by the capacitor 4116 and the gate of the TFT 4114. Therefore, a light-emitting element may be either connected to the wire 4117 or not. In this embodiment mode, description is made of a method of detecting a defective pixel in the case where a light-emitting element is not connected to the wire 4117. In addition, although the description is made of a case where the source driver 4101 outputs signals with binary values, the invention is not limited to this.

First, the TFT 4115 in a certain row is turned on by the gate signal line 4104, thereby outputting a video signal from the source signal line 4103. Here, the source driver 4108 outputs a signal which turns on the TFT 4109 and turns off the TFT 4110 in only a certain row, but turns off the TFT 4109 and turns on the TFT 4110 in the other rows. Accordingly, a potential of the power supply 4106 is output to the capacitor 4116 and the gate of the TFT 4114 in a certain pixel through the source signal line 4103 and the TFT 4115, and after that the TFT 4115 is turned off by the gate driver 4102, thereby a potential of the power supply 4106 is held in only one pixel among all the pixels. After that, when the TFT 4115 in the pixel which holds the potential of the power supply line 4106 is turned on with the condition that a potential of the power supply 4113 is output from the source signal line 4103, a current flows from the capacitor 4116 to the power supply 4107 through the source signal line 4103 until a potential of one electrode of the capacitor 4116 reaches the potential of the power supply 4107. By detecting such a change, it can be determined whether a video signal can be held, so that a defective pixel can be detected.

With such a method, a defective pixel can be detected before a light-emitting element is connected to the wire 4117. Therefore, a video signal can be corrected in advance before shipment by storing the result of detection in a flash memory or the like. Thus, yields can be improved to increase the productivity.

[Embodiment Mode 32]

As described in Embodiment Modes 1 and 2, the invention can be similarly applied to any semiconductor device as long as it includes pixels each having a plurality of sub-pixels, and defective sub-pixels can be detected among the plurality of sub-pixels, so as to correct a video signal. In addition, any method which can detect defective sub-pixels among the plurality of sub-pixels can be used as long as the defect can be determined to be a point defect or a defective bright spot. Further, the invention can be applied to any display having a plurality of sub-pixels, such as a liquid crystal display, an FED, an SED, or a PDP.

Although a transistor is illustrated as an example of a switching element, the invention is not limited to this. The switching element may be either an electrical switch or a mechanical switch as long as it can control a current flow. As the switching element, for example, a diode or a logic circuit constructed from a diode and a transistor may be employed.

In addition, a transistor applicable to a switching element in this embodiment is not limited to a certain type, and any of a TFT using a non-single crystalline semiconductor film typified by amorphous silicon or polycrystalline silicon, a MOS transistor formed with a semiconductor substrate or an SOI substrate, a junction transistor, a bipolar transistor, a transistor formed with an organic semiconductor or a carbon nanotube, or other transistors can be employed. Further, a substrate over which transistors are formed is not limited to a certain type, and any of a single crystalline substrate, an SOI substrate, a quartz substrate, a glass substrate, a resin substrate, and the like can be freely employed.

Since a transistor is operated just as a switch, the polarity thereof (conductivity type) is not particularly limited, and either an n-channel transistor or a p-channel transistor may be employed. However, when off-current is preferred to be small, a transistor of a polarity with small off-current is desirably used. As a transistor with small off-current, there is a transistor provided with a region (called an LDD region) which is doped with impurities which impart conductivity type at a low concentration between a channel formation region and a source or drain region.

Further, it is desirable that an n-channel transistor be employed if it is driven with a source potential being closer to the low-potential-side power supply, while a p-channel transistor be employed if it is driven with a source potential being closer to the high-potential-side power supply. This helps the switch operate efficiently because the absolute value of the gate-source voltage of the transistor can be increased. Further, a CMOS switching element may be constructed by using both n-channel and p-channel transistors.

The circuit configurations in the block diagrams in Embodiment Modes 1 to 10, and Embodiment Modes 14 to 31 may be any circuit configurations as long as the drive described herein can be realized.

In this embodiment mode, a known circuit can be used as a driver circuit for inputting signals to pixels. For example, a san driver circuit or a driver circuit which can select an arbitrary row such as a converter can be used.

[Embodiment 1]

Figure 24A:
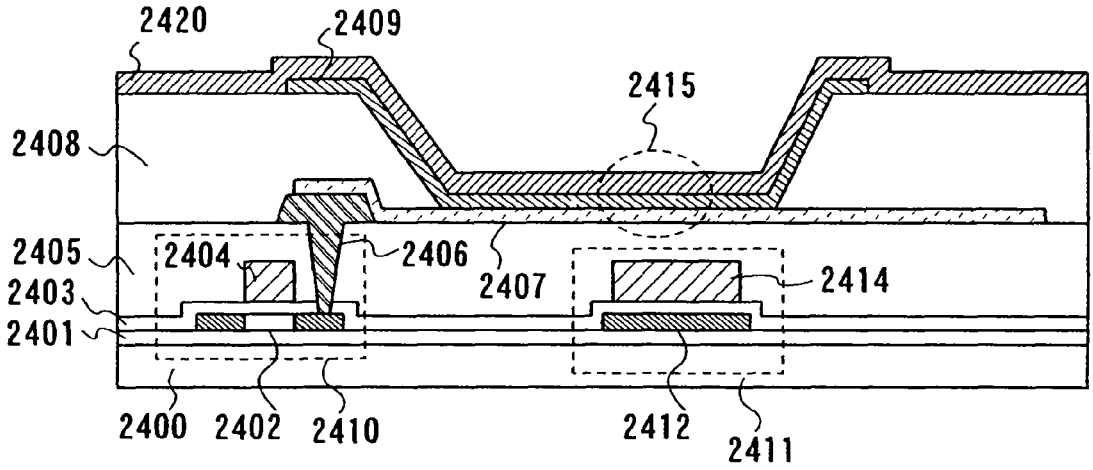
FIGS. 24A and 24B show Embodiment 1.
Figure 24B:
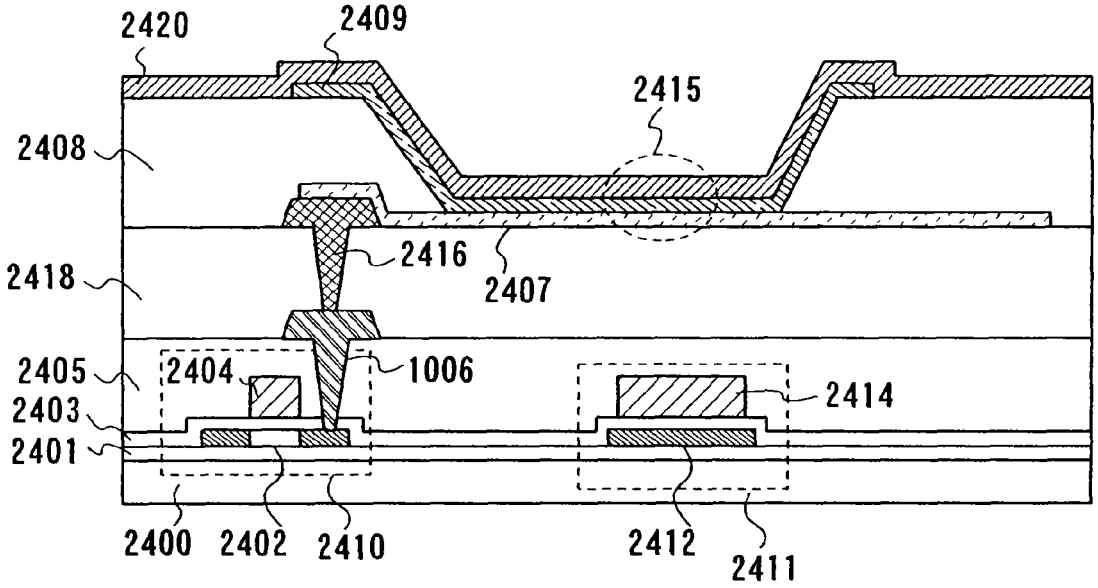

In this embodiment mode, description is made of exemplary pixel structures. FIGS. 24A and 24B show cross sections of a pixel of a panel described in Embodiment Modes 1 to 24. The examples shown herein use a TFT as a switching element disposed in the pixel and a light-emitting element as a display medium disposed in the pixel.

In FIGS. 24A and 24B, reference numeral 2400 denotes a substrate, 2401 denotes a base film, 2402 denotes a semiconductor layer, 2412 denotes a semiconductor layer, 2403 denotes a first insulating film, 2404 denotes a gate electrode, 2414 denotes an electrode, 2405 denotes a second insulating film, 2406 denotes an electrode, 2407 denotes a first electrode, 2408 denotes a third insulating film, 2409 denotes a light-emitting layer, and 2420 denotes a second electrode. Reference numeral 2410 denotes a TFT, 2415 denotes a light-emitting element, and 2411 denotes a capacitor. In FIGS. 24A and 24B, the TFT 2410 and the capacitor 2411 are shown as typical examples of the elements which constitute a pixel. A structure of FIG. 24A is described first.

As the substrate 2400, a glass substrate such as barium borosilicate glass or alumino borosilicate glass, a quartz substrate, a ceramic substrate, or the like can be used. Alternatively, a metal substrate containing stainless steel or a semiconductor substrate having a surface formed with an insulating film can be used. A substrate formed of a flexible synthetic resin such as plastic can also be used. The surface of the substrate 2400 may be planarized by polishing such as CMP.

As the base film 2401, an insulating film containing silicon oxide, silicon nitride, silicon nitride oxide, or the like can be used. The base film 2401 can prevent diffusion of alkaline metals such as Na or alkaline earth metals contained in the substrate 2400 into the semiconductor layer 2402, which would otherwise adversely affect the characteristics of the TFT 2410. Although the base film 2401 is formed in a single layer in FIG. 24A, it may have a two or more layers. Note that the base film 2401 is not necessarily provided in the case where diffusion of impurities is not of a big concern in the case of using a quartz substrate, for example.

As the semiconductor layer 2402 and the semiconductor layer 2412, a patterned crystalline semiconductor film or amorphous semiconductor film can be used. The crystalline semiconductor film can be obtained by crystallizing an amorphous semiconductor film. As the crystallization method, laser crystallization, thermal crystallization using RTA or an annealing furnace, thermal crystallization using metal elements which promote crystallization, or the like can be used. The semiconductor layer 2402 includes a channel formation region and a pair of impurity regions doped with impurity elements which impart conductivity type. Note that another impurity region which is doped with the aforementioned impurity elements at a lower concentration may be provided between the channel formation region and the pair of impurity regions. The semiconductor layer 2412 may have such a structure that the entire layer is doped with impurity elements which impart conductivity type.

The first insulating film 2403 can be formed by stacking silicon oxide, silicon nitride, silicon nitride oxide or/and the like, either in a single layer or a plurality of layers. Note that the first insulating film 2403 may be formed with a film containing hydrogen so as to hydrogenate the semiconductor layer 2402.

The gate electrode 2404 and the electrode 2414 may be formed with one element selected from among Ta, W, Ti, Mo, Al, Cu, Cr, and Nd, or an alloy or compound containing such elements, either in a single layer or stacked layers.

The TFT 2410 is formed to have the semiconductor layer 2402, the gate electrode 2404, and the first insulating film 2403 sandwiched between the semiconductor layer 2402 and the gate electrode 2404. Although FIG. 24A shows only the TFT 2410 connected to the first electrode 2407 of the light-emitting element 2415 as a TFT which partially constitutes a pixel, a plurality of TFTs may be provided. In addition, although this embodiment illustrates a top-gate transistor as the TFT 2410, the TFT 2410 may be a bottom-gate transistor having a gate electrode below a semiconductor layer, or a dual-gate transistor having gate electrodes above and below a semiconductor layer.

The capacitor 2411 is formed to have the first insulating film 2403 as a dielectric, and a pair of electrodes, namely, the semiconductor layer 2412 and the electrode 2414 facing each other with the first insulating film 2403 sandwiched therebetween. Although FIG. 24A illustrates an example of a capacitor included in the pixel, where the semiconductor layer 2412 which is formed concurrently with the semiconductor layer 2402 of the TFT 2410 is used as one of the pair of electrodes, while the electrode 2414 which is formed concurrently with the gate electrode 2404 of the TFT 2410 is used as the other electrode, the invention is not limited to such a structure.

The second insulating film 2405 may be formed to have either a single layer or stacked layers, using an inorganic insulating film or an organic insulating film. As the inorganic insulating film, there is a silicon oxide film formed by CVD or a silicon oxide film formed by SOG (Spin On Glass). As the organic insulating film, there is a film made of polyimide, polyamide, BCB (benzocyclobutene), acrylic, a positive photosensitive organic resin, a negative photosensitive organic resin, or the like.

The second insulating film 2405 may also be formed with a material having a skeletal structure with the bond of silicon (Si) and oxygen (O). As a substituent of such a material, an organic group containing at least hydrogen (e.g., an alkyl group or aromatic hydrocarbon) is used. Alternatively, a fluoro group may be used as the substituent or both the fluoro group and the organic group containing at least hydrogen may be used as the substituent.

Note that the surface of the second insulating film 2405 may be nitrided by high-density plasma treatment. High-density plasma is generated by using microwaves with a high frequency of 2.45 GHz, for example. Note that as the high-density plasma, plasma with an electron density of $1\times10^{11}$ $cm^{-3}$ or more and an electron temperature of 0.2 to 2.0 eV (preferably, 0.5 to 1.5 eV) is used. Thus, since the high-density plasma which has a feature in its low electron temperature has low kinetic energy of activated species, a less defective film with little plasma damage can be formed as compared with that formed by the conventional plasma treatment. In performing high-density plasma treatment, the substrate 2400 is set at temperatures of 350 to 450° C. In addition, the distance between an antenna for generating microwaves and the substrate 2400 in an apparatus for generating high-density plasma is set to 20 to 80 mm (preferably, 20 to 60 mm).

The surface of the second insulating film 2405 is nitrided by performing the aforementioned high-density plasma treatment under a nitrogen atmosphere, for example, an atmosphere containing nitrogen ($N_2$) and a rare gas (at least one of He, Ne, Ar, Kr, and Xe), an atmosphere containing nitrogen, hydrogen ($H_2$), and a rare gas, or an atmosphere containing $NH_3$ and a rare gas. The surface of the second insulating film 2405 formed by such nitridation treatment with high-density plasma is mixed with elements such as $N_2$, and He, Ne, Ar, Kr, or Xe. For example, by using a silicon oxide film or a silicon oxynitride film as the second insulating film 2405 and treating the surface of the film with high-density plasma, a silicon nitride film is formed. Hydrogen contained in the silicon nitride film formed in this manner may be used for hydrogenating the semiconductor layer 2402 of the TFT 2410. Note that this hydrogenation treatment may be combined with the aforementioned hydrogenation treatment using hydrogen contained in the first insulating film 2403.

Note that another insulating film may be formed over the nitride film formed by the high-density plasma treatment, so as to be used as the second insulating film 2405.

The electrode 2406 can be formed with elements selected from among Al, Ni, C, W, Mo, Ti, Pt, Cu, Ta, Au, and Mn, or alloys containing such elements, so as to have either a single-layer structure or a stacked-layer structure.

One or both of the first electrode 2407 and the second electrode 2420 can be formed as a light-transmissive electrode. The light-transmissive electrode can be formed with indium oxide containing tungsten oxide, indium zinc oxide containing tungsten oxide, indium oxide containing titanium oxide, indium tin oxide containing titanium oxide, or the like. Needless to say, indium tin oxide, indium zinc oxide, indium tin oxide doped with silicon oxide, or the like may be used.

The light-emitting layer is preferably formed with a plurality of layers having different functions, such as a hole injecting/transporting layer, a light-emitting layer, and an electron injecting/transporting layer.

The hole injecting/transporting layer is preferably formed with a composite material of an organic compound material having a hole transporting property and an inorganic compound material which exhibits an electron accepting property with respect to the organic compound material. By using such a structure, many hole carriers are generated in the organic compound which inherently has few carriers, thereby an excellent hole injecting/transporting property can be obtained. Due to such an effect, a driving voltage can be suppressed than in the conventional structure. Further, since the hole injecting/transporting layer can be formed thick without increasing the driving voltage, short circuits of the light-emitting element resulting from dust or the like can be also suppressed.

As an organic compound material having a hole transporting property, there is, for example, 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-diphenyl-N,N'-bis(3-methylphenyl)-1,1'-biphenyl-4,4'-diamine (abbreviation: TPD); 4,4'-bis[N-(1-naphthyl)-N-phenylamino]biphenyl (abbreviation: NPB); or the like. However, the invention is not limited to these.

As an inorganic compound material which exhibits an electron accepting property, there is, for example, titanium oxide, zirconium oxide, vanadium oxide, molybdenum oxide, tungsten oxide, rhenium oxide, ruthenium oxide, zinc oxide, or the like. In particular, vanadium oxide, molybdenum oxide, tungsten oxide, and rhenium oxide are preferable since they can be deposited in vacuum, and thus are easy to be handled.

The electron injecting/transporting layer is formed with an organic compound material having an electron transporting property. Specifically, there is tris(8-quinolinolato)aluminum (abbreviation: $Alq_3$), tris(4-methyl-8-quinolinolato)aluminum (abbreviation: $Almq_3$), or the like. However, the invention is not limited to these.

The light-emitting layer can be formed with, for example, 9,10-di(2-naphthyl)anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl)perylene (abbreviation: TBP); 9,10-diphenylanthracene (abbreviation: DPA); 4-(dicyanomethylene)-2-methyl-6-(p-dimethylaminostyryl)-4H-pyran (abbreviation: DCM1); 4-(dicyanomethylene)-2-methyl-6-[2-(joulolidine-9-yl)ethenyl]-4H-pyran (abbreviation: DCM2); 4-(dicyanomethylene)-2,6-bis[p-(dimethylamino)styryl]-4H-pyran (abbreviation: BisDCM); or the like. Alternatively, the following compounds capable of generating phosphorescence can be used: bis[2-(4',6'-difluorophenyl)pyridinato-N,$C^{2'}$]iridium(III)picolinate (FIrpic); bis{2-[3',5'-bis(trifluoromethyl)phenyl]pyridinato-N,$C^{2'}$}iridium(picolinate) (abbreviation: $Ir(CF_3ppy)_2(pic)$); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(2'-thienyl)pyridinato-N,$C^{3'}$]iridium(acetylacetonate) (abbreviation: $Ir(thp)_2(acac)$); bis(2-phenylquinolinato-N,$C^{2'}$)iridium(acetylacetonate) (abbreviation: $Ir(pq)_2(acac)$); bis[2-(2'-benzothienyl)pyridinato-N,$C^{3+}$]iridium(acetylacetonate) (abbreviation: $Ir(btp)_2(acac)$); or the like.

Further alternatively, the light-emitting layer may be formed with an electroluminescent polymeric material such as a polyparaphenylene-vinylene-based material, a polyparaphenylene-based material, a polythiophene-based material, or a polyfluorene-based material.

In any case, the light-emitting layer may have various layer structures, and modification is possible within the range that the object as the light-emitting element can be achieved. For example, such a structure can be employed that no specific hole or electron injecting/transporting layer is provided, but instead, a substitute electrode layer for this purpose is provided or a light-emitting material is dispersed in the layer.

The other of either the first electrode 2407 or the second electrode 2420 may be formed with a material which does not transmit light. For example, it may be formed with alkaline metals such as Li and Cs, alkaline earth metals such as Mg, Ca, or Sr, alloys containing such metals (e.g., MgAg, AlLi, or MgIn), compounds containing such metals (e.g., $CaF_2$ or $Ca_3N_2$), or rare earth metals such as Yb or Er.

The third insulating film 2408 can be formed with a similar material to that of the second insulating film 2405. The third insulating film 2408 is formed on the periphery of the first electrode 2407 so as to cover edges of the first electrode 2407, and has a function of separating the light-emitting layers 2409 of adjacent pixels.

The light-emitting layer 2409 is formed in a single layer or a plurality of layers. In the case where the light-emitting layer 2409 is formed in a plurality of layers, the layers can be classified into a hole injecting layer, a hole transporting layer, a light-emitting layer, an electron transporting layer, an electron injecting layer, and the like, in terms of the carrier transporting properties. Note that the boundary between the respective layers is not necessarily clear, and there may be a case where materials forming adjacent layers are partially mixed with each other, which makes the interface between the respective layers unclear. Each layer can be formed with an organic material or an inorganic material. The organic material may be any of a high molecular, medium molecular, and low molecular materials.

The light-emitting element 2415 is formed to have the light-emitting layer 2409 and the first electrode 2407 and the second electrode 2420 which overlap each other with the light-emitting element 2409 sandwiched therebetween. One of either the first electrode 2407 or the second electrode 2420 corresponds to an anode, while the other corresponds to a cathode. When a forward-bias voltage which is higher than the threshold voltage is applied between the anode and the cathode of the light-emitting element 2415, a current flows from the anode to the cathode, and thus the light-emitting element 2415 emits light.

A structure of FIG. 24B is described next. Note that common portions between FIGS. 24A and 24B are denoted by common reference numerals, and thus the description thereon will be omitted.

FIG. 24B shows a structure where another insulating film 2418 is provided between the second insulating layer 2405 and the third insulating film 2408 in FIG. 24A. The electrode 2406 and the first electrode 2407 are connected with the electrode 2416 in a contact hole provided in the insulating film 2418.

The insulating film 2418 can be formed to have a similar structure to that of the second insulating film 2405. The electrode 2416 can be formed to have a similar structure to that of the electrode 2406.

[Embodiment 2]

Figure 28A:
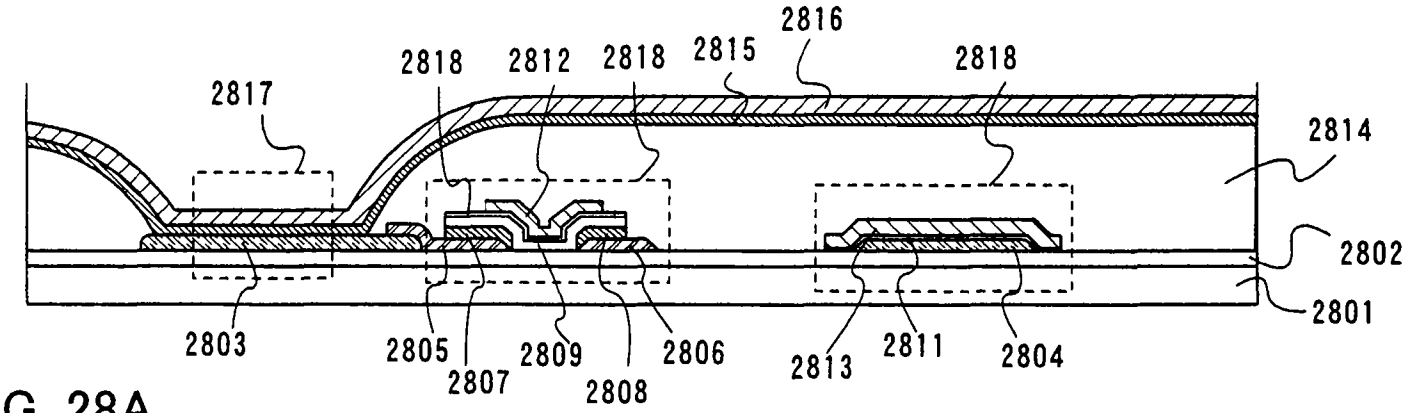
FIGS. 28A and 28B show Embodiment 2.
Figure 28B:
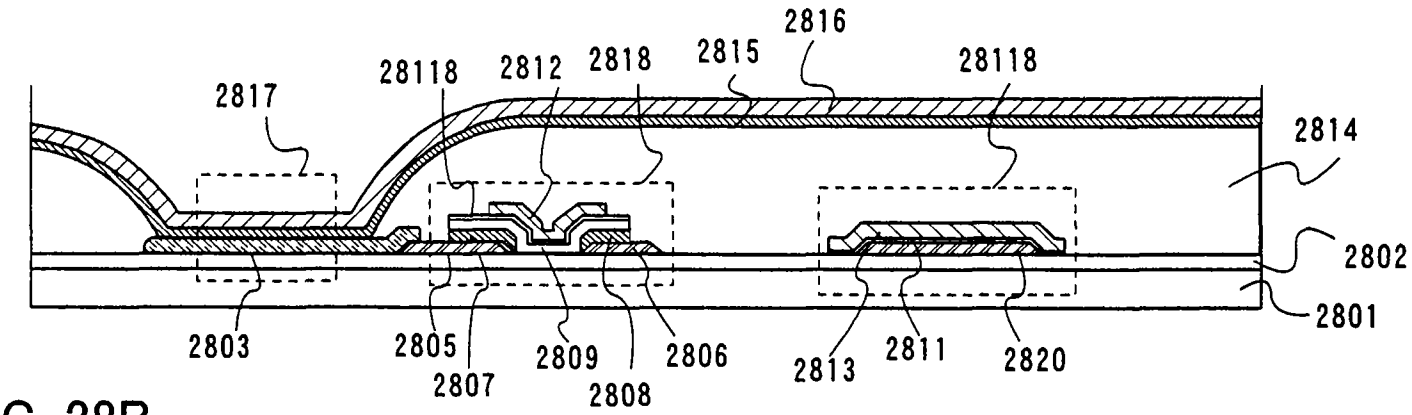

In this embodiment, description is made of a case where an amorphous silicon (a-Si:H) film is used as a semiconductor layer of a transistor. FIGS. 28A and 28B show top-gate transistors, while FIGS. 29A to 30B show bottom-gate transistors.

FIG. 28A shows a cross section of a transistor with a top-gate structure, where amorphous silicon is used for a semiconductor layer. As shown in FIG. 28A, a base film 2802 is formed over a substrate 2801. Further, a pixel electrode 2803 is formed over the base film 2802. In addition, a first electrode 2804 is formed with the same material and in the same layer as the pixel electrode 2803.

The substrate may be a glass substrate, a quartz substrate, a ceramic substrate, or the like. In addition, the base film 2802 may be formed with aluminum nitride (AlN), silicon oxide ($SiO_2$), silicon oxynitride ($SiO_xN_y$), and/or the like, in either a single layer or stacked layers.

Further, wires 2805 and 2806 are formed over the base film 2802, and an edge of the pixel electrode 2803 is covered with the wire 2805. N-type semiconductor layers 2807 and 2808 each having n-type conductivity are formed over the wires 2805 and 2806 respectively. In addition, a semiconductor layer 2809 is formed between the wires 2805 and 2806, and over the base film 2802. The semiconductor layer 2809 is extended to partially cover the n-type semiconductor layers 2807 and 2808. Note that the semiconductor layer 2809 is formed with an amorphous semiconductor film such as amorphous silicon (a-Si:H), a microcrystalline semiconductor (μ-Si:H), or the like. A gate insulating film 2810 is formed over the semiconductor layer 2809. In addition, an insulating film 2811 is formed with the same material and in the same layer as the gate insulating film 2810, over the first electrode 2804. Note that the gate insulating film 2810 is formed with a silicon oxide film, a silicon nitride film, or the like.

A gate electrode 2812 is formed over the gate insulating film 2810. In addition, a second electrode 2813 is formed with the same material and in the same layer as the gate electrode 2812, over the first electrode 2811 with the insulating film 2811 sandwiched therebetween. Thus, a capacitor 2819 is formed, in which the insulating film 2811 is sandwiched between the first electrode 2804 and the second electrode 2813. An interlayer insulating film 2814 is formed covering edges of the pixel electrode 2803, a driving transistor 2818, and the capacitor 2819.

A layer 2815 containing an organic compound and a counter electrode 2816 are formed over the interlayer insulating film 2814 and the pixel electrode 2803 positioned in an opening of the interlayer insulating film 2814. Thus, a light-emitting element 2817 is formed in a region where the layer 2815 containing an organic compound is sandwiched between the pixel electrode 2803 and the counter electrode 2816.

The first electrode 2804 shown in FIG. 28A may be replaced with a first electrode 2820 as shown in FIG. 28B. The first electrode 2820 is formed of the same material and in the same layer as the wires 2805 and 2806.

Figure 29A:
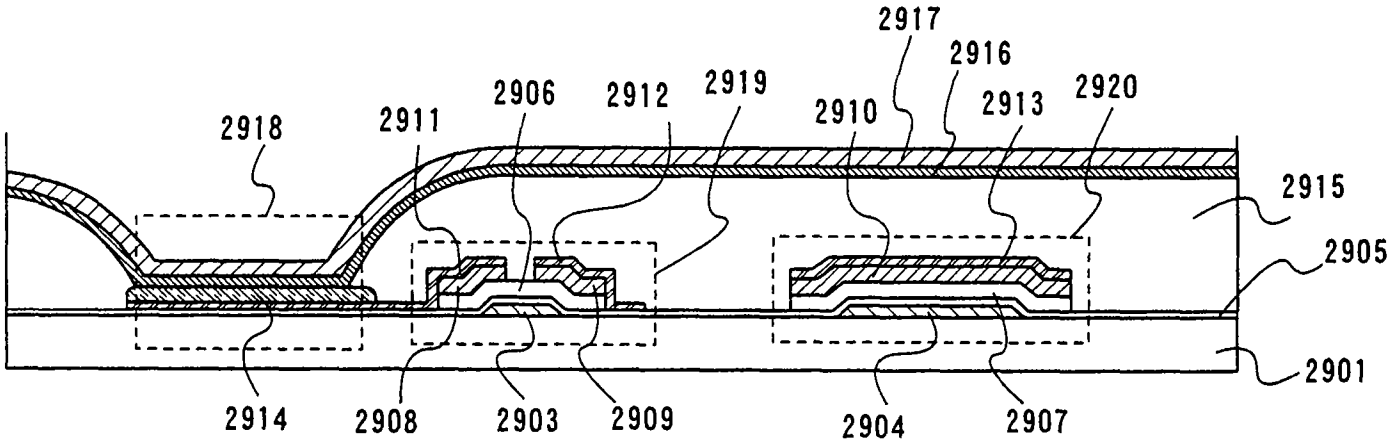
FIGS. 29A and 29B show Embodiment 2.
Figure 29B:
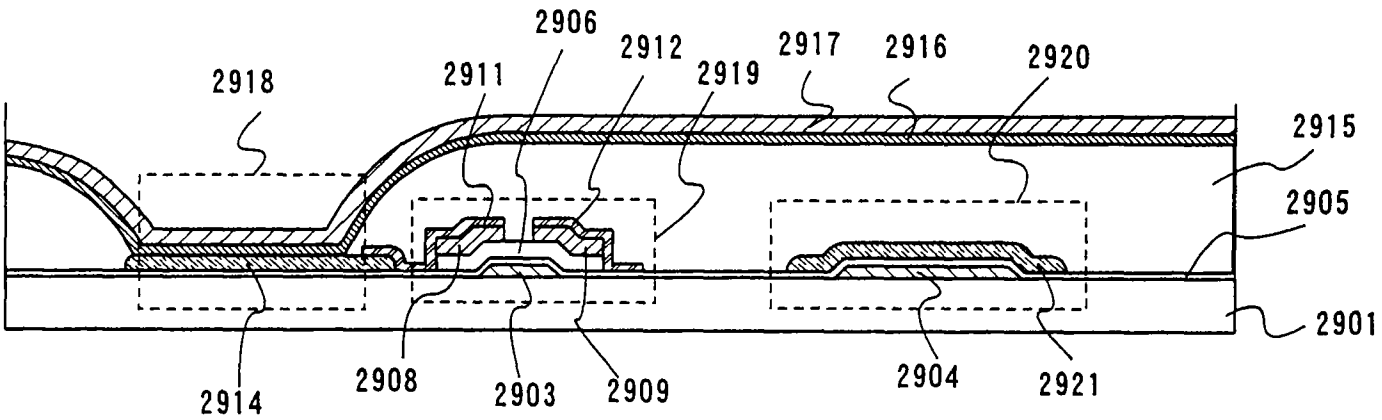

FIGS. 29A and 29B show partial cross sections of a panel of a semiconductor device which has a bottom-gate transistor using amorphous silicon for its semiconductor layer.

A gate electrode 2903 is formed over a substrate 2901. In addition, a first electrode 2904 is formed in the same layer and with the same material as the gate electrode 2903. As a material of the gate electrode 2903, polycrystalline silicon doped with phosphorus can be used. Silicide which is a compound of a metal and silicon may be used as well as the polycrystalline silicon.

In addition, a gate insulating film 2905 is formed covering the gate electrode 2903 and the first electrode 2904. The gate insulating film 2905 is formed with a silicon oxide film, a silicon nitride film, or the like. A semiconductor layer 2906 is formed over the gate insulating film 2905. In addition, a semiconductor layer 2907 is formed with the same material and in the same layer as the semiconductor layer 2906.

The substrate may be any of a glass substrate, a quartz substrate, a ceramic substrate, and the like.

N-type semiconductor layers 2908 and 2909 each having n-type conductivity are formed over the semiconductor layer 2906, while an n-type semiconductor layer 2910 is formed over the semiconductor layer 2907.

Wires 2911, 2912, and 2913 are formed over the n-type semiconductor layers 2908, 2909, and 2910 respectively, and a conductive layer 2913 is formed with the same material and in the same layer as the wires 2911 and 2912, over the n-type semiconductor layer 2910.

A second electrode is formed to have the semiconductor layer 2907, the n-type semiconductor layer 2910, and the conductive layer 2913. Note that a capacitor 2920 is formed to have a structure where the gate insulating film 2905 is sandwiched between the second electrode and the first electrode 2904.

In addition, an edge of the wire 2911 is extended, and a pixel electrode 2914 is formed in contact with the top surface of the extended portion of the wire 2911. An insulator 2915 is formed covering edges of the pixel electrode 2914, a driving transistor 2919, and the capacitor 2920.

A layer 2916 containing an organic compound and a counter electrode 2917 are formed over the pixel electrode 2914 and the insulator 2915, and a light-emitting element 2918 is formed in a region where the layer 2916 containing an organic compound is sandwiched between the pixel electrode 2914 and the counter electrode 2917.

The semiconductor layer 2907 and the n-type semiconductor layer 2910 which partially function as a second electrode of the capacitor are not necessarily provided. That is, only the conductive layer 2913 may be used as the second electrode so that a capacitor is provided to have a structure where a gate insulating film is sandwiched between the first electrode 2904 and the conductive layer 2913.

Note that if the pixel electrode 2914 is formed before forming the wire 2911 shown in FIG. 29A, a capacitor 2922 as shown in FIG. 29B can be formed, which has a structure where the gate insulating film 2905 is sandwiched between the first electrode 2904 and a second electrode 2921 formed of the same material and in the same layer as the pixel electrode 2914.

Although FIGS. 29A and 29B show examples of an inversely staggered transistor with a channel-etched structure, a transistor with a channel-protected structure may be employed as well. Next, description is made of a transistor with a channel-protected structure, with reference to FIGS. 30A and 30B.

Figure 30A:
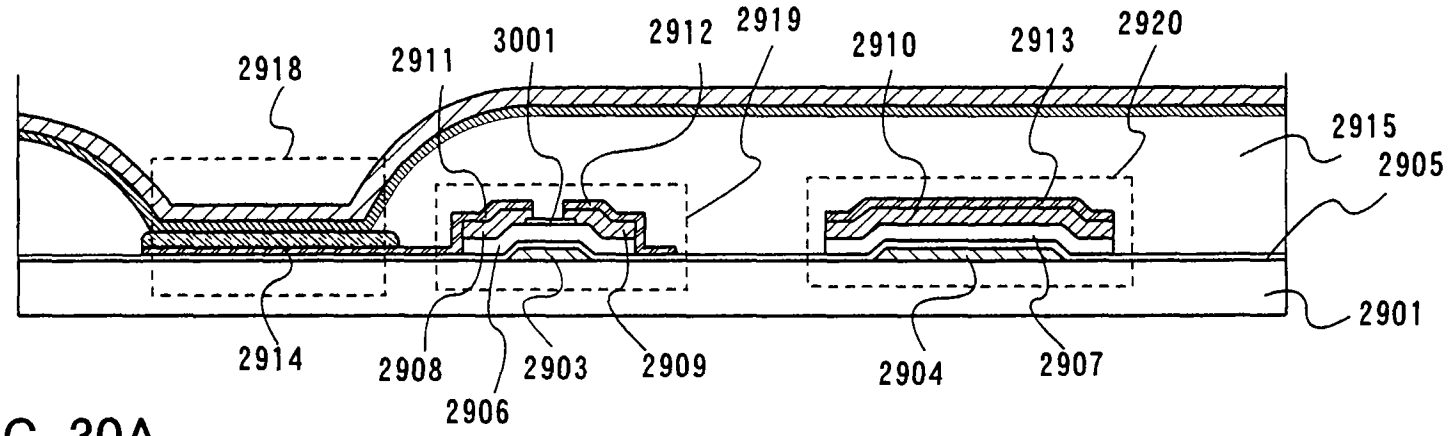
FIGS. 30A and 30B show Embodiment 2.

A transistor with a channel-protected structure shown in FIG. 30A differs from the driving transistor 2919 with a channel-etched structure shown in FIG. 29A in that an insulator 3001 serving as an etching mask is provided over a channel formation region in the semiconductor layer 2906.

Common portions between FIGS. 29A and 30A are denoted by common reference numerals.

Figure 30B:
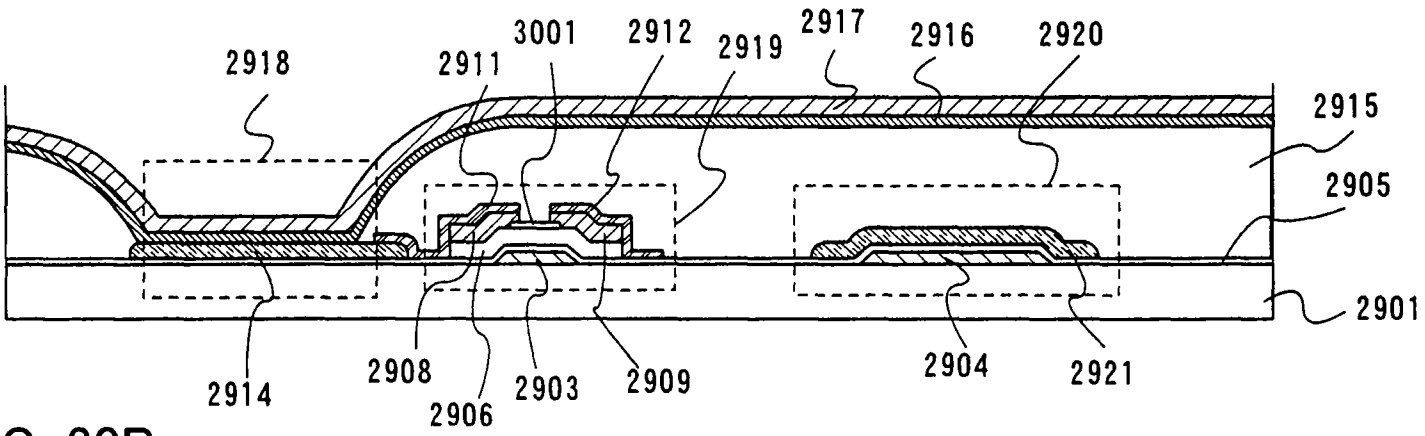

Similarly, a transistor with a channel-protected structure shown in FIG. 30B differs from the driving transistor 2919 with a channel-etched structure shown in FIG. 29B in that an insulator 3001 serving as an etching mask is provided over a channel formation region in the semiconductor layer 2906. Common portions between FIGS. 29B and 30B are denoted by common reference numerals.

By using an amorphous semiconductor film for a semiconductor layer (e.g., a channel formation region, a source region, or a drain region) of a transistor which is one constituent element of a pixel of the invention, manufacturing cost can be reduced. For example, an amorphous semiconductor film can be used in the case of using the pixel structure shown in FIGS. 28A to 30B.

Note that the structures of transistors or capacitors to which the pixel structure of the invention can be applied are not limited to the structures described heretofore, and various structures of transistors or capacitors can be employed.

[Embodiment 3]

In this embodiment, description is made of a method of manufacturing a semiconductor device using plasma treatment, as a method of manufacturing a semiconductor device including transistors, for example.

Figure 42A:
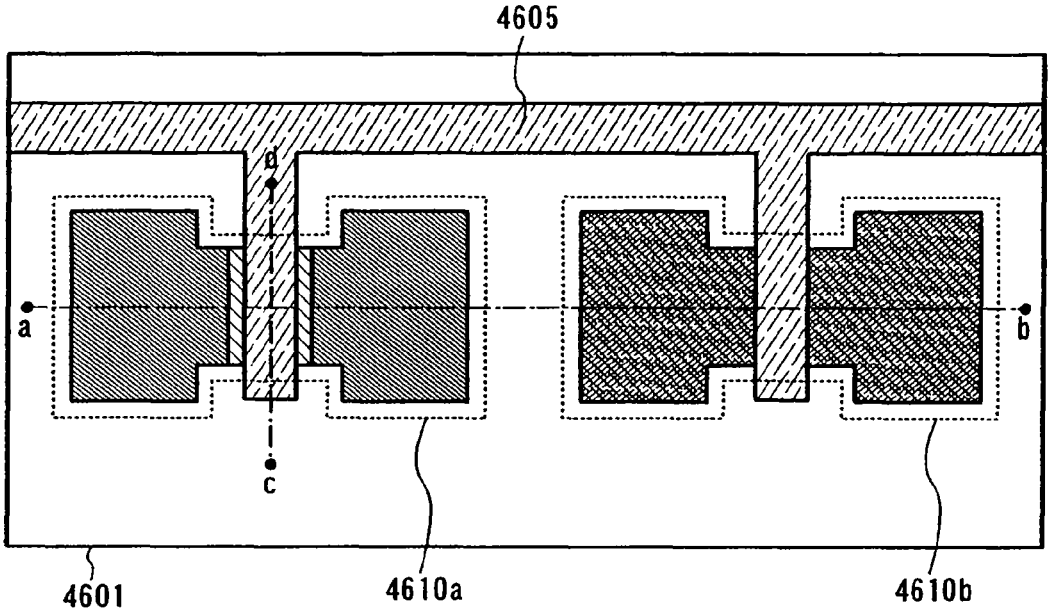
FIGS. 42A to 42C show Embodiment 3.
Figure 42B:
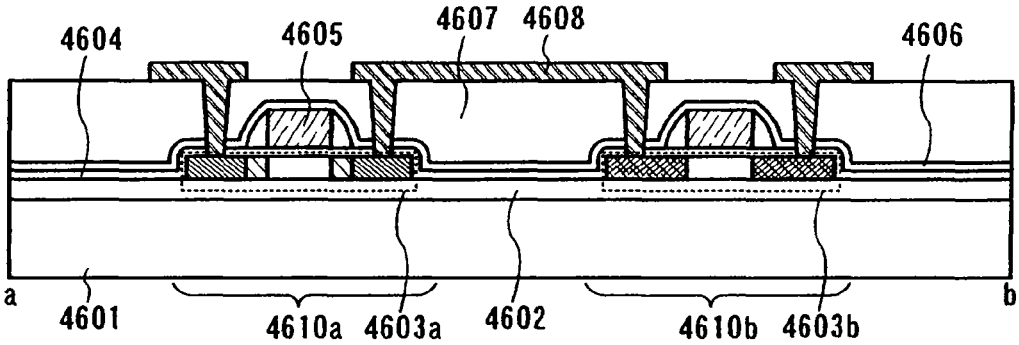
Figure 42C:
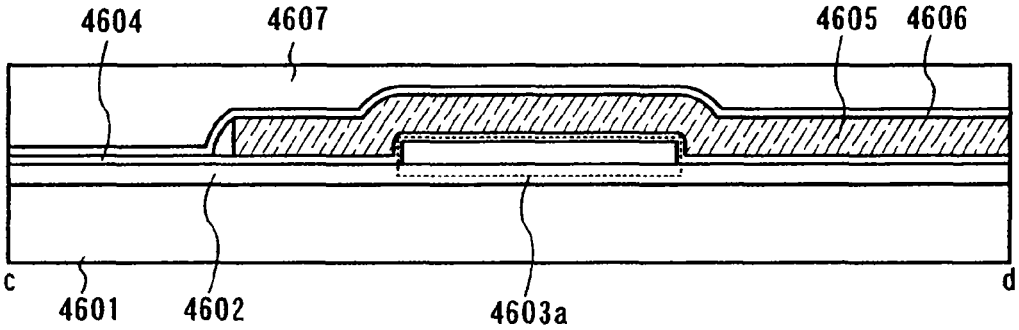

FIGS. 42A to 42C show exemplary structures of a semiconductor device including transistors. Note that FIG. 42B corresponds to a cross section taken along a line a-b in FIG. 42A, while FIG. 42C corresponds to a cross section taken along a line c-d in FIG. 42A.

The semiconductor device shown in FIGS. 42A to 42C includes semiconductor films 4603*a* and 4603*b* provided over a substrate 4601 with an insulating film 4602 sandwiched therebetween, gate electrodes 4605 provided over the semiconductor films 4603*a* and 4603*b* with a gate insulating layer 4604 sandwiched therebetween, insulating films 4606 and 4607 provided to cover the gate electrodes 4605, and a conductive film 4608 provided over the insulating film 4607 in a manner electrically connected to a source region or a drain region of the semiconductor films 4603*a* and 4603*b*. Although FIGS. 42A to 42C show a case of providing an n-channel transistor 4610*a* which uses a part of the semiconductor film 4603*a* as a channel region, and a p-channel transistor 4610*b* which uses a part of the semiconductor film 4603*b* as a channel region, the invention is not limited to such a structure. For example, although the n-channel transistor 4610*a* is provided with LDD regions, while the p-channel transistor 4610*b* is not provided with LDD regions in FIGS. 42A to 42C, such structures may be provided that both of the transistors are provided with LDD regions or neither of the transistors is provided with LDD regions.

In this embodiment mode, the semiconductor device shown in FIGS. 42A to 42C is manufactured by oxidizing or nitriding a semiconductor film or an insulating film, that is, by performing plasma oxidation or nitridation treatment to at least one layer among the substrate 4601, the insulating film 4602, the semiconductor films 4603*a* and 4603*b*, the gate insulating film 4604, the insulating film 4606, and the insulating film 4607. In this manner, by oxidizing or nitriding a semiconductor film or an insulating film by plasma treatment, the surface of the semiconductor film or the insulating film can be modified, thereby a denser insulating film can be formed, compared with an insulating film formed by CVD or sputtering. Therefore, defects such as pin holes can be suppressed, and thus the characteristics and the like of the semiconductor device can be improved.

In this embodiment, description is made of a method of manufacturing a semiconductor device by oxidizing or nitriding the semiconductor films 4603*a* and 4603*b* or the gate insulating film 4604 shown in FIGS. 42A to 42C by plasma treatment, with reference to the drawings.

Figures 43A, 43B, 43C, 43D:
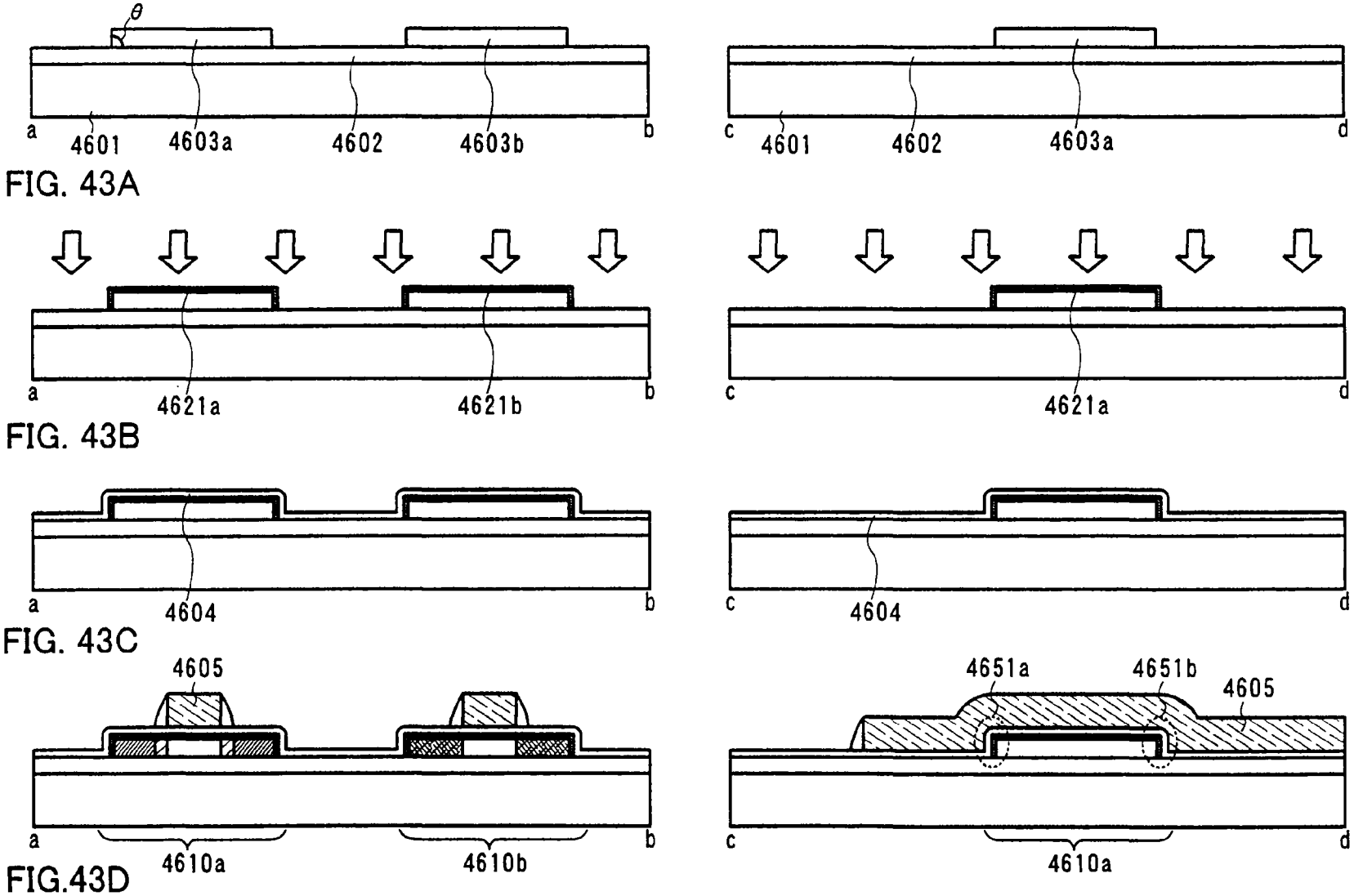
FIGS. 43A to 43D show Embodiment 3.

First, the semiconductor films 4603*a* and 4603*b* with island shapes are formed over the substrate 4601 (FIG. 43A). The island-shaped semiconductor films 4603*a* and 4603*b* can be provided by forming an amorphous semiconductor film by a known method (e.g., sputtering, LPCVD, or plasma CVD) using a material containing silicon (Si) as a main component (e.g., SixGe1-x) over the insulating film 4602 which is formed in advance over the substrate 4601, and then crystallizing the amorphous semiconductor film, and further etching the semiconductor film selectively. Note that the crystallization of the amorphous semiconductor film can be performed by a known crystallization method such as laser crystallization, thermal crystallization using RTA or an annealing furnace, thermal crystallization using metal elements which promote crystallization, or a combination of them. Note that in FIG. 43A, the island-shaped semiconductor films 4603*a* and 4603*b* are each formed to have an edge with about 90 degrees (θ=85 to 100 degrees).

Next, the semiconductor films 4603*a* and 4603*b* are oxidized or nitrided by plasma treatment to form oxide or nitride films 4621*a* and 4621*b* (hereinafter also called insulating films 4621*a* and 4621*b*) on the surfaces of the semiconductor films 4603*a* and 4603*b* respectively (FIG. 43B). For example, when Si is used for the semiconductor films 4603*a* and 4603*b*, silicon oxide ($SiO_x$) or silicon nitride ($SiN_x$) is formed as the insulating films 4621*a* and 4621*b*. Further, after being oxidized by plasma treatment, the semiconductor films 4603*a* and 4603*b* may be subjected to plasma treatment again to be nitrided. In this case, silicon oxide ($SiO_x$) is formed on the semiconductor films 4603*a* and 4604*b* first, and then silicon nitride oxide ($SiN_xO_y$) (x>y) is formed on the surface of the silicon oxide. Note that in the case of oxidizing the semiconductor film by plasma treatment, the plasma treatment is performed under an oxygen atmosphere (e.g., an atmosphere containing oxygen ($O_2$) and a rare gas (at least one of He, Ne, Ar, Kr, and Xe), an atmosphere containing oxygen, hydrogen ($H_2$), and a rare gas, or an atmosphere containing nitrous oxide and a rare gas). Meanwhile, in the case of nitriding the semiconductor film by plasma treatment, the plasma treatment is performed under a nitrogen atmosphere (e.g., an atmosphere containing nitrogen ($N_2$) and a rare gas (at least one of He, Ne, Ar, Kr, and Xe), an atmosphere containing nitrogen, hydrogen, and a rare gas, or an atmosphere containing $NH_3$ and a rare gas). As the rare gas, Ar can be used, for example. Alternatively, a mixed gas of Ar and Kr may be used. Therefore, the insulating films 4621*a* and 4621*b* contain the rare gas (at least one of He, Ne, Ar, Kr, and Xe) used in the plasma treatment, and in the case where Ar is used, the insulating films 4621*a* and 4621*b* contain Ar.

Since the plasma treatment is performed in the atmosphere containing the aforementioned gas, with the conditions of a plasma electron density of $1\times10^{11}$ to $1\times10^{13}$ $cm^{-3}$, and a plasma electron temperature of 0.5 to 1.5 eV. Since the plasma electron density is high and the electron temperature in the vicinity of the treatment subject (here, the semiconductor films 4603*a* and 4603*b*) formed over the substrate 4601 is low, plasma damage to the treatment subject can be prevented. In addition, since the plasma electron density is as high as $1\times10^{11}$ $cm^{-3}$ or more, an oxide or nitride film formed by oxidizing or nitriding the treatment subject by plasma treatment is advantageous in its uniform thickness or the like as well as being dense, compared with a film formed by CVD, sputtering, or the like. Further, since the plasma electron temperature is as low as 1 eV, oxidation or nitridation treatment can be performed at a lower temperature, compared with the conventional plasma treatment or thermal oxidation. For example, oxidation or nitridation treatment can be performed sufficiently even when plasma treatment is performed at a temperature lower than the strain point of a glass substrate by 100 degrees or more. Note that as a frequency for generating plasma, high frequencies such as microwaves (2.45 GHz) can be used. Note also that the plasma treatment is to be performed with the aforementioned conditions unless otherwise specified.

Next, the gate insulating film 4604 is formed so as to cover the insulating films 4621*a* and 4621*b* (FIG. 43C). The gate insulating film 4604 can be formed by a known method (e.g., sputtering, LPCVD, or plasma CVD) to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y). For example, when Si is used for the semiconductor films 4603*a* and 4603*b*, and the Si is oxidized by plasma treatment to form silicon oxide as the insulating films 4621*a* and 4621*b* on the surfaces of the semiconductor films 4603*a* and 4603*b*, silicon oxide ($SiO_x$) is formed as a gate insulating film on the insulating films 4621*a* and 4621*b*. In addition, referring to FIG. 43B, if the insulating films 4621*a* and 4621*b* formed by oxidizing or nitriding the semiconductor films 4603*a* and 4603*b* by plasma treatment are sufficiently thick, the insulating films 4621*a* and 4621*b* can be used as the gate insulating film.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIG. 43D).

In this manner, by oxidizing or nitriding the surfaces of the semiconductor films 4603*a* and 4603*b* by plasma treatment before providing the gate insulating film 4604 over the semiconductor films 4603*a* and 4603*b*, short circuits or the like between the gate electrodes and the semiconductor films can be prevented, which would otherwise be caused by coverage defects of the gate insulating film 4604 at edges 4651*a* and 4651*b* of the channel regions. That is, if the edges of the island-shaped semiconductor films have an angle of about 90 degrees (θ=85 to 100 degrees), there is a concern that at the time when a gate insulating film is formed so as to cover the semiconductor films by CVD, sputtering, or the like, a coverage defect might be caused, resulting from breaking of the gate insulating film at the edges of the semiconductor films, or the like. However, such a coverage defect or the like can be prevented by oxidizing or nitriding the surfaces of the semiconductor films by plasma treatment in advance.

Alternatively, referring to FIG. 43C, the gate insulating film 4604 may be oxidized or nitrided by performing plasma treatment after forming the gate insulating film 4604. In this case, an oxide or nitride film 4623 (hereinafter also referred to as an insulating film 4623) is formed on the surface of the gate insulating film 4604 (FIG. 44A) by oxidizing or nitriding the gate insulating film 4604 by performing plasma treatment to the gate insulating film 4604 which is formed to cover the semiconductor films 4603*a* and 4603*b* (FIG. 44B). The plasma treatment can be performed with similar conditions to those in FIG. 43B. In addition, the insulating film 4623 contains a rare gas which is used in the plasma treatment, and for example contains Ar if Ar is used for the plasma treatment.

Alternatively, referring to FIG. 44B, after oxidizing the gate insulating film 4604 by performing plasma treatment under an oxygen atmosphere, the gate insulating film 4604 may be subjected to plasma treatment again under a nitrogen atmosphere, so as to be nitrided. In this case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed to be in contact with the gate electrodes 4605. After that, by forming the gate electrodes 4605 or the like over the insulating film 4623, a semiconductor device having the n-channel transistor 4610*a* and the p-channel transistor 4610*b* which respectively have the island-shaped semiconductor films 4603*a* and 4603*b* as channel regions can be manufactured (FIG. 44C). In this manner, by oxidizing or nitriding the surface of the gate insulating film by plasma treatment, the surface of the gate insulating film can be modified to form a dense film. The insulating film obtained by plasma treatment is dense and has few defects such as pin holes, compared with an insulating film formed by CVD or sputtering. Therefore, the characteristics of the transistors can be improved.

Figure 44A:
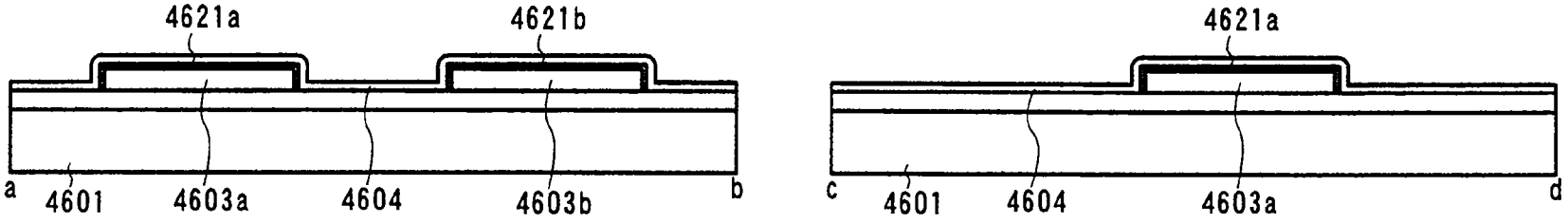
FIGS. 44A to 44C show Embodiment 3.
Figure 44B:
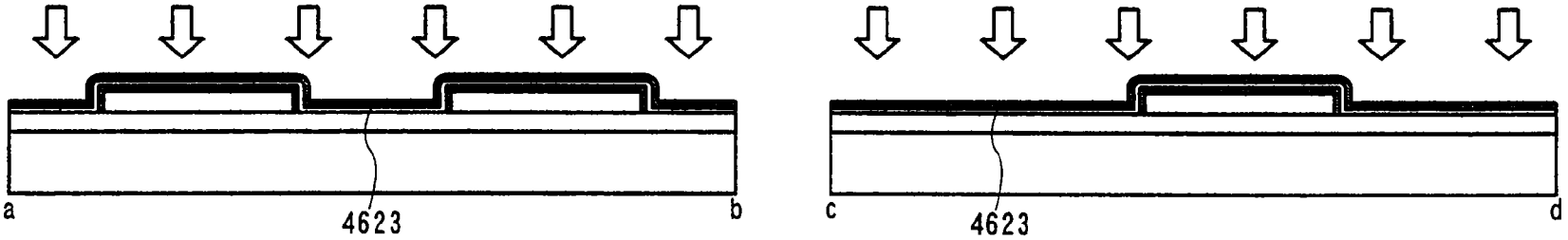
Figure 44C:
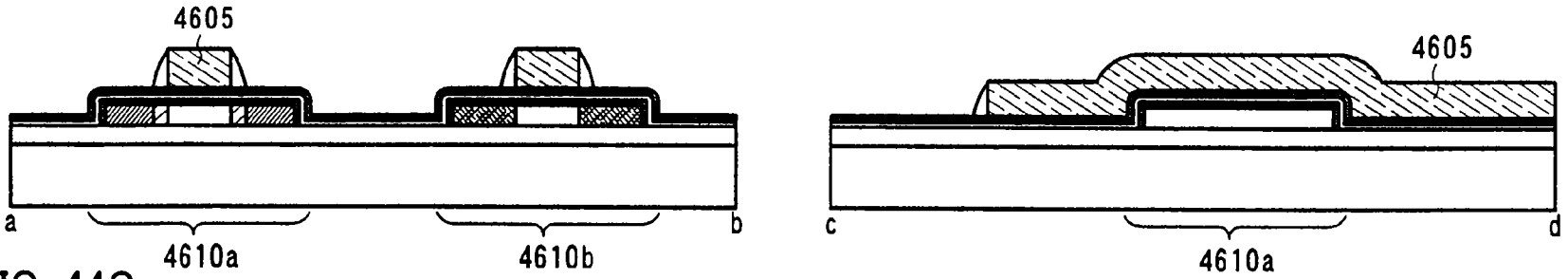

Although FIGS. 44A to 44C show the case where the surfaces of the semiconductor films 4603*a* and 4603*b* are oxidized or nitrided by performing plasma treatment to the semiconductor films 4603*a* and 4603*b* in advance, such a method may be employed that plasma treatment is not performed to the semiconductor films 4603*a* and 4603*b*, but plasma treatment is performed after forming the gate insulating film 4604. In this manner, by performing plasma treatment before forming a gate electrode, a semiconductor film can be oxidized or nitrided even if the semiconductor film is exposed due to a coverage defect such as breaking of a gate insulating film at edges of the semiconductor film; therefore, short circuits or the like between the gate electrode and the semiconductor film can be prevented, which would otherwise be caused by a coverage defect of the gate insulating film at the edges of the semiconductor film.

In this manner, by oxidizing or nitriding the semiconductor films or the gate insulating film by plasma treatment, short circuits or the like between the gate electrodes and the semiconductor films can be prevented, which would otherwise be caused by a coverage defect of the gate insulating film at the edges of the semiconductor films, even if the island-shaped semiconductor films are formed to have edges with an angle of about 90 degrees (θ=30 to 85 degrees).

Next, a case is shown where the island-shaped semiconductor films formed over the substrate are provided with tapered edges (θ=30 to 85 degrees).

Figures 45A, 45B, 45C, 45D:
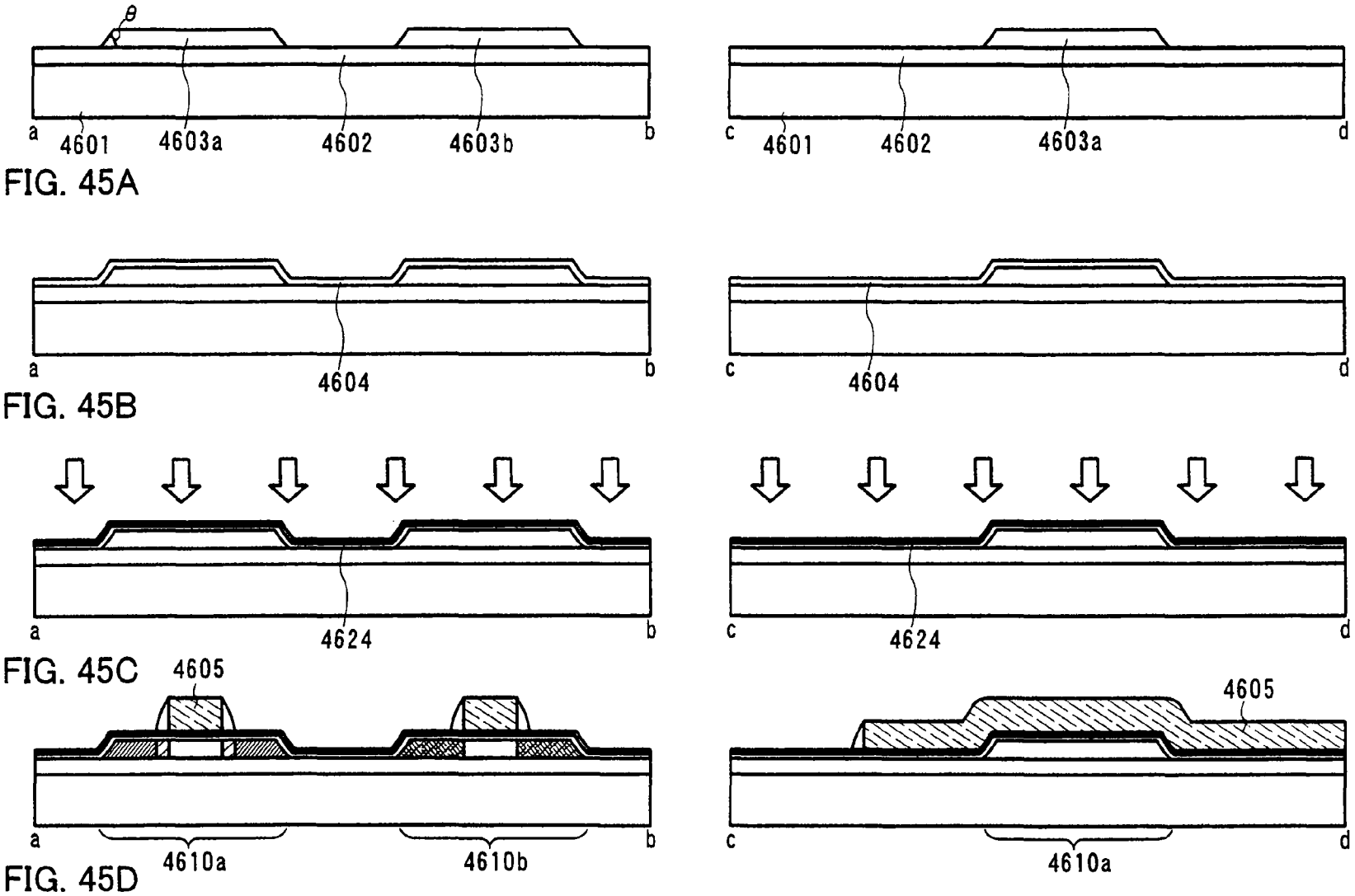
FIGS. 45A to 45D show Embodiment 3.

First, the island-shaped semiconductor films 4603*a* and 4603*b* are formed over the substrate 4601 (FIG. 45A). The island-shaped semiconductor films 4603*a* and 4603*b* can be provided by forming an amorphous semiconductor film over the insulating film 4602 which is formed over the substrate 4601 in advance, by sputtering, LPCVD, plasma CVD, or the like using a material containing silicon (Si) as a main component, and then crystallizing the amorphous semiconductor film by a known crystallization method such as laser crystallization, thermal crystallization using RTA or an annealing furnace, or thermal crystallization using metal elements which promote crystallization, and further etching the semiconductor film selectively. Note that in FIG. 45A, the island-shaped semiconductor films are formed to have tapered edges (θ=30 to 85 degrees).

Next, the gate insulating film 4604 is formed so as to cover the semiconductor films 4603*a* and 4603*b* (FIG. 45B). The gate insulating film 4604 can be provided to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y) by a known method such as sputtering, LPCVD, or plasma CVD.

Next, an oxide or nitride film 4624 (hereinafter also referred to as an insulating film 4624) is formed on the surface of the gate insulating film 4604 by oxidizing or nitriding the gate insulating film 4604 by plasma treatment (FIG. 45C). The plasma treatment can be performed with the aforementioned conditions. For example, if silicon oxide ($SiO_x$) or silicon oxynitride ($SiO_xN_y$) (x>y) is used as the gate insulating film 4604, the gate insulating film 4604 is oxidized by performing plasma treatment under an oxygen atmosphere, thereby a dense film with few defects such as pin holes can be formed on the surface of the gate insulating film, compared with a gate insulating film formed by CVD, sputtering, or the like. On the other hand, if the gate insulating film 4604 is nitrided by plasma treatment under a nitrogen atmosphere, a silicon nitride oxide film ($SiN_xO_y$) (x>y) can be provided as the insulating film 4624 on the surface of the gate insulating film 4604. Alternatively, after oxidizing the gate insulating film 4604 by performing plasma treatment under an oxygen atmosphere, the gate insulating film 4604 may be subjected to plasma treatment again under a nitrogen atmosphere, so as to be nitrided. In addition, the insulating film 4624 contains a rare gas which is used in the plasma treatment, and for example contains Ar if Ar is used in the plasma treatment.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIG. 44D).

In this manner, by performing plasma treatment to the gate insulating film, an insulating film made of an oxide or nitride film can be provided on the surface of the gate insulating film, and thus the surface of the gate insulating film can be modified. Since the insulating film obtained by oxidation or nitridation with plasma treatment is dense and has few defects such as pin holes, compared with a gate insulating film formed by CVD or sputtering, the characteristics of the transistors can be improved. In addition, whereas short circuits or the like between the gate electrodes and the semiconductor films can be prevented by forming the semiconductor films to have tapered edges, which would otherwise be caused by a coverage defect of the gate insulating film at the edges of the semiconductor films, short circuits or the like between the gate electrodes and the semiconductor films can be prevented even more effectively by performing plasma treatment after forming the gate insulating film.

Next, description is made of a manufacturing method of a semiconductor device which differs from that in FIGS. 45A to 45D, with reference to the drawings. Specifically, a case is shown where plasma treatment is selectively performed to tapered edges of semiconductor films.

Figures 46A, 46B, 46C, 46D:
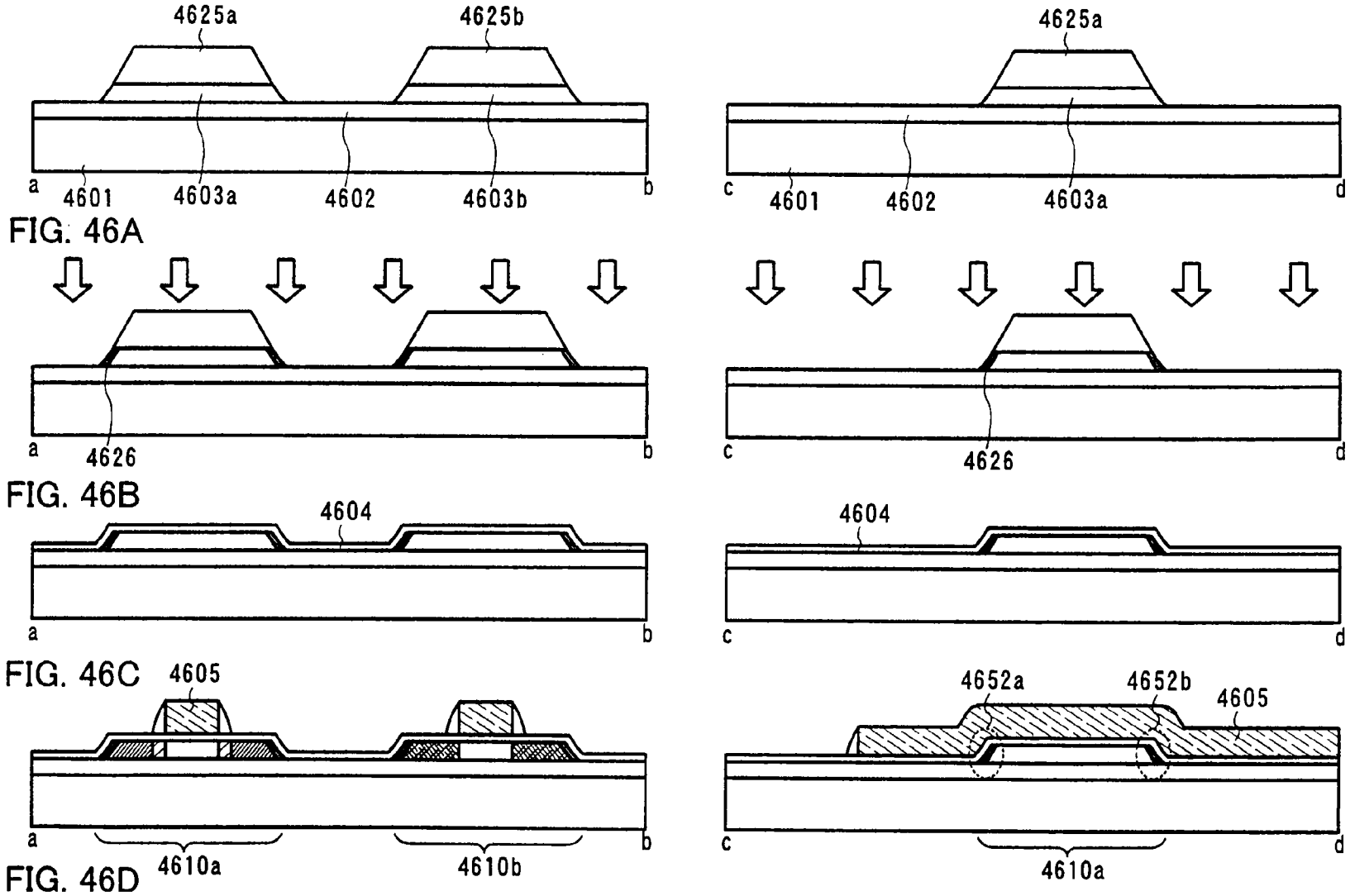
FIGS. 46A to 46D show Embodiment 3.

First, the island-shaped semiconductor films 4603*a* and 4603*b* are formed over the substrate 4601 (FIG. 46A). The island-shaped semiconductor films 4603*a* and 4603*b* can be provided by forming an amorphous semiconductor film over the insulating film 4602 which is formed over the substrate 4601 in advance, by a known method (e.g., sputtering, LPCVD, or plasma CVD) using a material containing silicon (Si) as a main component (e.g., SixGe1-x) or the like, and crystallizing the amorphous semiconductor film, and further etching the semiconductor film selectively by using resists 4625*a* and 4625*b* as masks. Note that the crystallization of the amorphous semiconductor film can be performed by a known crystallization method such as laser crystallization, thermal crystallization using RTA or an annealing furnace, thermal crystallization using metal elements which promote crystallization, or a combination of them.

Next, the edges of the island-shaped semiconductor films 4603*a* and 4603*b* are selectively oxidized or nitrided by plasma treatment before removing the resists 4625*a* and 4625*b* which are used for etching the semiconductor films, thereby an oxide or nitride film 4626 (hereinafter also referred to as an insulating film 4626) is formed on each of the semiconductor films 4603*a* and 4603*b* (FIG. 46B). The plasma treatment is performed with the aforementioned conditions. In addition, the insulating film 4626 contains a rare gas which is used in the plasma treatment.

Next, the gate insulating film 4604 is formed to cover the semiconductor films 4603*a* and 4603*b* (FIG. 46C). The gate insulating film 4604 can be formed in a similar manner to the aforementioned.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIG. 46D).

If the semiconductor films 4603*a* and 4603*b* are provided with tapered edges, edges 4652*a* and 4652*b* of the channel regions which are formed in parts of the semiconductor films 4603*a* and 4603*b* are also tapered, thereby the thickness of the semiconductor films and the gate insulating film in that portion differs from that in the central portion, which may adversely affect the characteristics of the transistors. Thus, such effects on the transistors due to the edges of the channel regions can be reduced by forming insulating films on the edges of the semiconductor films, namely, the edges of the channel regions, by selectively oxidizing or nitriding the edges of the channel regions by plasma treatment here.

Figure 48A:
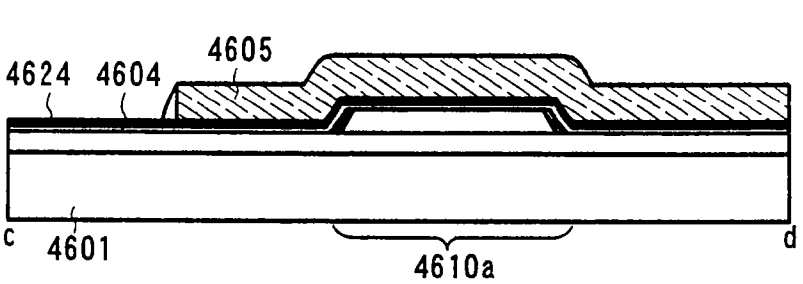
FIGS. 48A and 48B show Embodiment 3.
Figure 48A:
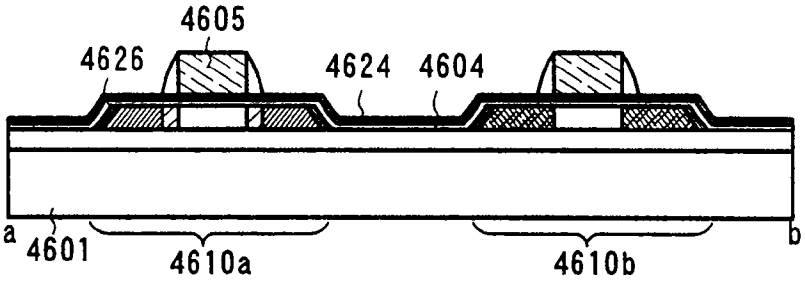

Although FIGS. 46A to 46D show an example where only the edges of the semiconductor films 4603*a* and 4603*b* are oxidized or nitrided by plasma treatment, the gate insulating film 4604 can also be oxidized or nitrided by plasma treatment as shown in FIG. 45C (FIG. 48A).

Next, description is made of a manufacturing method of a semiconductor device which differs from the aforementioned, with reference to the drawings. Specifically, a case is shown where plasma treatment is performed to semiconductor films with tapered shapes.

Figures 47A, 47B, 47C, 47D:
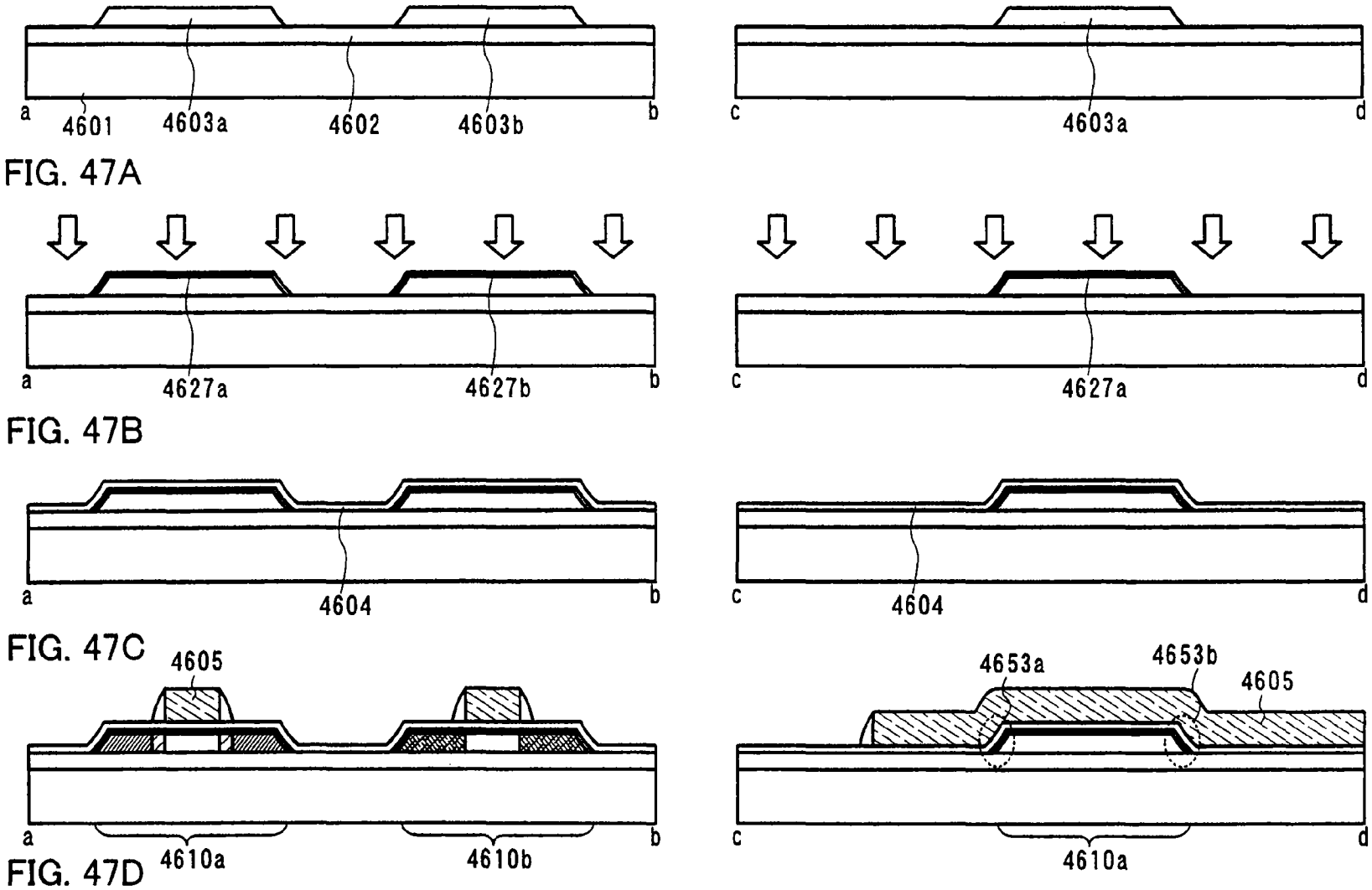
FIGS. 47A to 47D show Embodiment 3.

First, the island-shaped semiconductor films 4603*a* and 4603*b* are formed over the substrate 4601 in a similar manner to the aforementioned (FIG. 47A).

Next, the semiconductor films 4603*a* and 4603*b* are oxidized or nitrided by plasma treatment, thereby forming oxide or nitride films 4627*a* and 4627*b* (hereinafter also referred to as insulating films 4627*a* and 4627*b*) on the surfaces of the semiconductor films 4603*a* and 4603*b* (FIG. 47B). The plasma treatment can be performed with the aforementioned conditions. For example, when Si is used for the semiconductor films 4603*a* and 4603*b*, silicon oxide ($SiO_x$) or silicon nitride ($SiN_x$) is formed as the insulating films 4627*a* and 4627*b*. In addition, after oxidizing the semiconductor films 4603*a* and 4603*b* by plasma treatment, the semiconductor films 4603*a* and 4603*b* may be subjected to plasma treatment again to be nitrided. In this case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed on the silicon oxide or the silicon oxynitride. Therefore, the insulating films 4627*a* and 4627*b* contain a rare gas which is used in the plasma treatment. Note that the edges of the semiconductor films 4603*a* and 4603*b* are concurrently oxidized or nitrided by performing plasma treatment.

Next, the gate insulating film 4604 is formed to cover the insulating films 4627*a* and 4627*b* (FIG. 47C). The gate insulating film 4604 can be formed to have either a single-layer structure or a stacked-layer structure of an insulating film containing oxygen or nitrogen, such as silicon oxide ($SiO_x$), silicon nitride ($SiN_x$), silicon oxynitride ($SiO_xN_y$) (x>y), or silicon nitride oxide ($SiN_xO_y$) (x>y) by a known method (e.g., sputtering, LPCVD, or plasma CVD). For example, when Si is used for the semiconductor films 4603*a* and 4603*b*, and the surfaces of the semiconductor films 4603*a* and 4603*b* are oxidized by plasma treatment to form silicon oxide as the insulating films 4627 and 4627*b*, silicon oxide ($SiO_x$) is formed as a gate insulating film over the insulating films 4627*a* and 4627*b*.

Next, by forming the gate electrodes 4605 or the like over the gate insulating film 4604, a semiconductor device having the n-channel transistor 4610*a* and the p-channel transistor 4610*b* which respectively have the island-shaped semiconductor films 4603*a* and 4603*b* as channel regions can be manufactured (FIG. 47D).

If the semiconductor films are provided with tapered edges, edges 4653*a* and 4653*b* of the channel regions which are formed in parts of the semiconductor films are also tapered, which might adversely affect the characteristics of the semiconductor elements. Such effects on the semiconductor elements can be reduced by oxidizing or nitriding the semiconductor films by plasma treatment, since the edges of the channel regions can be also oxidized or nitrided accordingly.

Figure 48B:
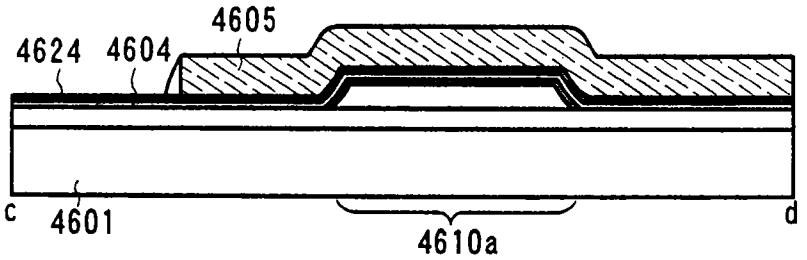
Figure 48B:
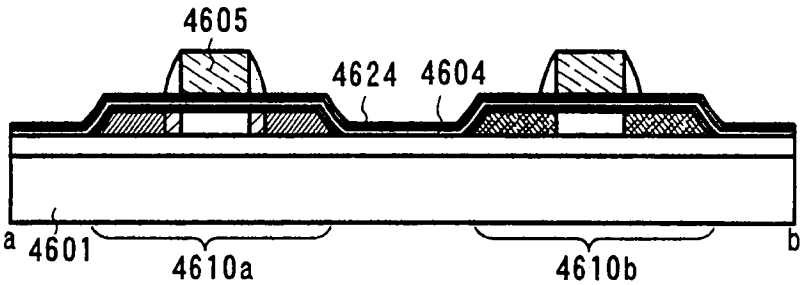

Although FIGS. 47A to 47D show an example where only the semiconductor films 4603*a* and 4603*b* are oxidized or nitrided by plasma treatment, the gate insulating film 4604 may also be oxidized or nitrided by plasma treatment as shown in FIG. 45B (FIG. 48B). In this case, after oxidizing the gate insulating film 4604 by plasma treatment under an oxygen atmosphere, the gate insulating film 4604 may be subjected to plasma treatment again to be nitrided. In such a case, silicon oxide ($SiO_x$) or silicon oxynitride ($SiO_xN_y$) (x>y) is formed on the semiconductor films 4603*a* and 4603*b* first, and then silicon nitride oxide ($SiN_xO_y$) (x>y) is formed to be in contact with the gate electrodes 4605.

Figure 49A:
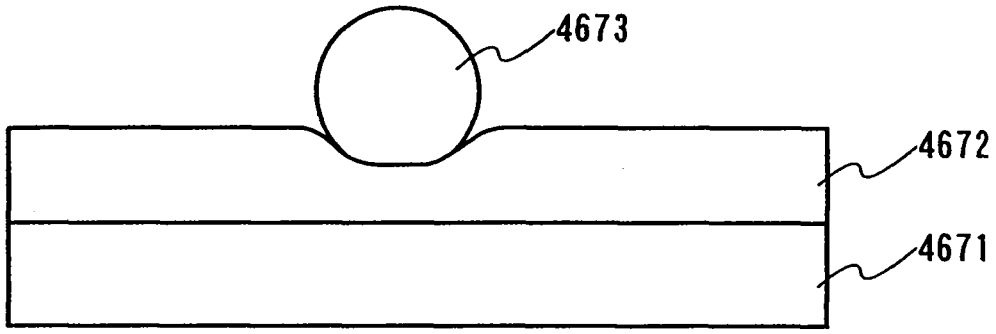
FIGS. 49A and 49B show Embodiment 3.
Figure 49B:
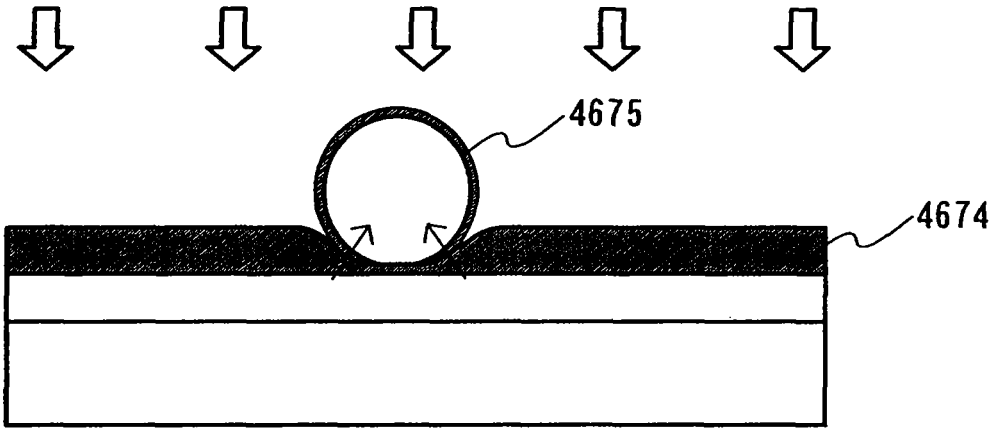

By performing plasma treatment in the aforementioned manner, impurities such as dust which have adhered to the semiconductor films or the insulating film can be easily removed. In general, a film formed by CVD, sputtering, or the like may have dust (also called particles) on its surface. For example, as shown in FIG. 49A, there is a case where dust 4673 adheres to the insulating film 4672 which is formed by CVD, sputtering, or the like over a film 4671 such as an insulating film, a conductive film, or a semiconductor film. Even in such a case, an oxide or nitride film 4674 (hereinafter also referred to as an insulating film 4674) is formed on the surface of the insulating film 4672 by oxidizing or nitriding the insulating film 4672 by plasma treatment. The insulating film 4674 is oxidized or nitrided in such a manner that not only a portion where no dust exists but also a portion below the dust 4673 is oxidized or nitrided; therefore, the volume of the insulating film 4674 is increased. Meanwhile, since the surface of the dust 4673 is also oxidized or nitrided by plasma treatment to form an insulating film 4675, the volume of the dust 4673 is also increased accordingly (FIG. 49B).

At this time, the dust 4673 is in a state of being easily removed from the surface of the insulating film 4674 by simple washing such as brushing. In this manner, by performing plasma treatment, even fine dust which has adhered to the insulating film or the semiconductor film can be easily removed. Note that this effect is obtained by performing plasma treatment; therefore, the same can be said for not only this embodiment mode, but for other embodiment modes.

In this manner, by modifying the surface of a semiconductor film or an insulating film by oxidation or nitridation using plasma treatment, a dense and high-quality insulating film can be formed. In addition, dust or the like which has adhered to the surface of the insulating film can be easily removed by washing. Accordingly, defects such as pin holes can be prevented even when the insulating film is formed thin, thereby microfabrication and high performance of semiconductor elements such as transistors can be realized.

Although this embodiment shows an example where plasma treatment is performed to the semiconductor films 4603*a* and 4603*b* or the gate insulating film 4604 so as to oxidize or nitride the semiconductor films 4603*a* and 4603*b* or the gate insulating film 4604, a layer to be subjected to the plasma treatment is not limited to these. For example, plasma treatment may be performed to the substrate 4601 or the insulating film 4602, or to the insulating film 4607.

Note that this embodiment may be appropriately implemented in combination with Embodiment 1 or 2.

[Embodiment 4]

In this embodiment, description is made of a halftone process as a process for manufacturing a semiconductor device including transistors, for example.

Figure 50:
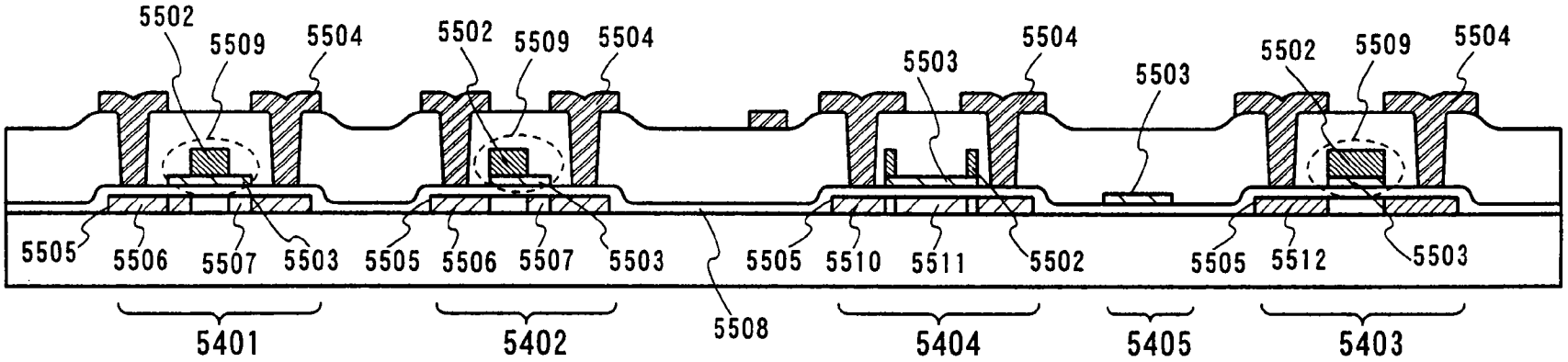
FIG. 50 shows Embodiment 4.

FIG. 50 shows a cross section of a semiconductor device including transistors, a capacitor, and a resistor. FIG. 50 shows n-channel transistors 5401 and 5402, a capacitor 5404, a resistor 5405, and a p-channel transistor 5403. Each transistor has a semiconductor layer 5505, an insulating layer 5508, and a gate electrode 5509. The gate electrode 5509 is formed to have a stacked structure of a first conductive layer 5503 and a second conductive layer 5502. FIGS. 51A to 51E are top views of the transistors, the capacitor, and the resistor shown in FIG. 50, which can be referred to in conjunction with FIG. 50.

Referring to FIG. 50, the n-channel transistor 5401 has impurity regions 5507 (also called low concentration drain: LDD regions) on opposite sides of a channel region in the semiconductor layer 5505, which are doped with impurities at a lower concentration than impurity regions 5506 which form source and drain regions for forming a contact with wires 5504. In forming the n-channel transistor 5401, the impurity regions 5506 and 5507 are doped with phosphorus as impurities which impart n-type conductivity. The LDD regions are formed in order to suppress hot-electron degradation and a short-channel effect.

Figure 51A:
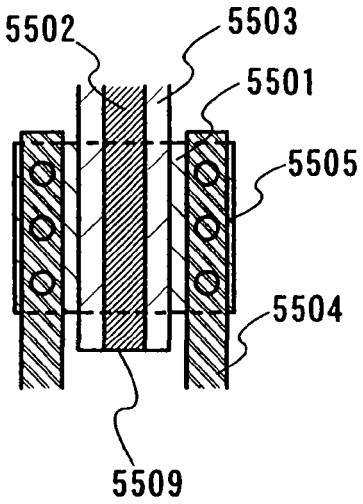
FIGS. 51A to 51E show Embodiment 5.

As shown in FIG. 51A, the first conductive layer 5503 is formed wider than the second conductive layer 5502 in the gate electrode 5509 of the n-channel transistor 5401. In this case, the first conductive layer 5503 is formed thinner than the second conductive layer 5502. The first conductive layer 5503 is formed to have a thickness enough for ion species which are accelerated with an electric field of 10 to 100 kV to travel through. The impurity regions 5507 are formed to overlap the first conductive layer 5503 of the gate electrode 5509. That is, LDD regions which overlap the gate electrode 5509 are formed. In this structure, the impurity regions 5507 are formed in a self-aligned manner by doping the semiconductor layer 5505 with impurities having one conductivity type through the first conductive layer 5503 of the gate electrode 5509, using the second conductive layer 5502 as a mask. That is, the LDD regions which overlap the gate electrode are formed in a self-aligned manner.

Figure 51B:
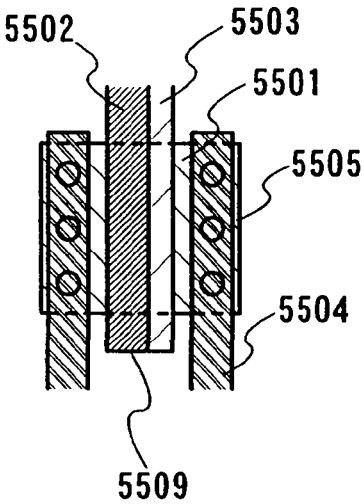

Referring again to FIG. 50, the n-channel transistor 5402 has the impurity region 5507 on one side of a channel region in the semiconductor layer 5505, which is doped with impurities at a lower concentration than the impurity regions 5506. As shown in FIG. 51B, the first conductive layer 5503 is formed wider than one side of the second conductive layer 5502 in the gate electrode 5509 of the n-channel transistor 5402. In this case also, an LDD region can be formed in a self-aligned manner by doping the semiconductor layer 5505 with impurities having one conductivity type through the first conductive layer 5503 using the second conductive layer 5502 as a mask.

A transistor having an LDD region on one side of a channel region may be used as a transistor where only a positive voltage or a negative voltage is applied between source and drain electrodes. Specifically, such a transistor may be applied to a transistor which partially constitutes a logic gate such as an inverter circuit, a NAND circuit, a NOR circuit, or a latch circuit, or a transistor which partially constitutes an analog circuit such as a sense amplifier, a constant voltage generation circuit, or a VCO.

Figure 51C:
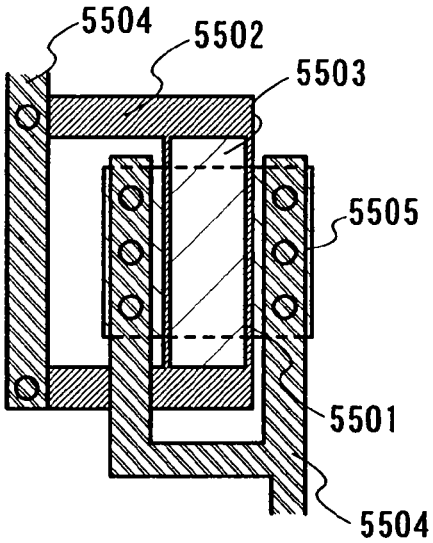

Referring again to FIG. 50, the capacitor 5404 is formed by sandwiching the insulating layer 5508 with the first conductive layer 5503 and the semiconductor layer 5505. The semiconductor layer 5505 for forming the capacitor 5404 is provided with impurity regions 5510 and 5511. The impurity region 5511 is formed in the semiconductor layer 5505 in a position overlapping the first conductive layer 5503. The impurity region 5510 forms a contact with the wire 5504. The impurity region 5511 can be formed by doping the semiconductor layer 5505 with impurities having one conductivity type through the first conductive layer 5503; therefore, the concentration of impurities having one conductivity type which are contained in the impurity regions 5510 and 5511 may be set either the same or different. In either case, since the semiconductor layer 5505 in the capacitor 5404 functions as an electrode, it is preferably lowered in resistance by adding impurities with one conductivity type thereto. Further, the first conductive layer 5503 can fully function as an electrode by utilizing the second conductive layer 5502 as an auxiliary electrode as shown in FIG. 51C. In this manner, by forming a composite electrode structure where the first conductive layer 5503 is combined with the second conductive layer 5502, the capacitor 5404 can be formed in a self-aligned manner.

Referring again to FIG. 50, the resistor 5405 is formed of the first conductive layer 5503. The first conductive layer 5503 is formed to have a thickness of 30 to 150 nm; therefore, the resistor can be formed by appropriately setting the width or length of the first conductive layer 5503.

Figure 51D:
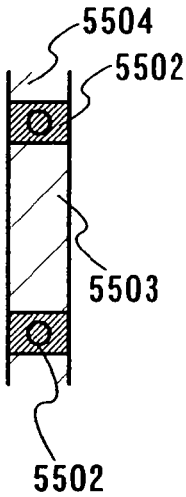

The resistor may be formed with a semiconductor layer containing impurity elements at a high concentration or a thin metal layer. A metal layer is preferable since the resistance value thereof is determined by the thickness and quality of the film itself, and thus has small variations, whereas the resistance value of a semiconductor layer is determined by the thickness and quality of the film, the concentration and activation rate of impurities, and the like. FIG. 51D shows a top view of the resistor 5405.

Figure 51E:
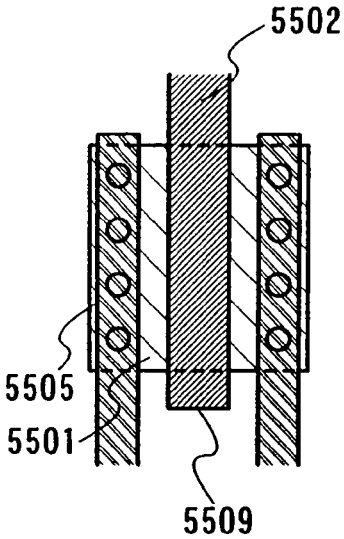

Referring again to FIG. 50, the semiconductor layer 5505 in the p-channel transistor 5403 has the impurity region 5512. This impurity region 5512 forms a source or drain region for forming a contact with the wire 5504. The gate electrode 5509 has a structure where the first conductive layer 5503 and the second conductive layer 5502 overlap each other. The p-channel transistor 5403 is a transistor with a single-drain structure where no LDD region is provided. In forming the p-channel transistor 5403, the impurity region 5512 is doped with boron or the like as impurities which impart p-type conductivity. On the other hand, an n-channel transistor with a single-drain structure may also be formed if the impurity region 5512 is doped with phosphorus. FIG. 51E shows a top view of the p-channel transistor 5403.

One or both of the semiconductor layer 5505 and the gate insulating layer 5508 may be oxidized or nitrided by high-density plasma treatment with the conditions of microwave excitation, an electron temperature of 2 eV or less, an ion energy of 5 eV or less, and an electron density of about $1\times10^{11}$ to $1\times10^{13}$ $cm^{-3}$. At this time, by treating the layer in an oxygen atmosphere (e.g., $O_2$ or $N_2O$) or a nitrogen atmosphere (e.g., $N_2$, or $NH_3$) with the substrate temperature being set at 300 to 450° C., a defect level of an interface between the semiconductor layer 5505 and the gate insulating layer 5508 can be lowered. By performing such treatment to the gate insulating layer 5508, the gate insulating layer 5508 can be densified. That is, generation of defective charges can be suppressed, and thus fluctuations of the threshold voltage of the transistor can be suppressed. In addition, in the case of driving the transistor with a voltage of 3 V or less, an insulating layer oxidized or nitrided by the aforementioned plasma treatment can be used as the gate insulating layer 5508. Meanwhile, in the case of driving the transistor with a voltage of 3 V or more, the gate insulating layer 5508 can be formed by combining an insulating layer formed on the surface of the semiconductor layer 5505 by the aforementioned plasma treatment with an insulating layer deposited by CVD (plasma CVD or thermal CVD). Similarly, such an insulating layer can be utilized as a dielectric layer of the capacitor 5404 as well. In this case, the insulating layer formed by the plasma treatment is a dense film with a thickness of 1 to 10 nm; therefore, a capacitor with high capacity can be formed.

As has been described with reference to FIGS. 50 to 51E, elements with various structures can be formed by combining conductive layers with various thickness. A region where only the first conductive layer is formed and a region where both the first conductive layer and the second conductive layer are formed can be formed with a photomask or a reticle having an auxiliary pattern which is formed of a diffraction grating pattern or a semi-transmissive film and has a function of reducing the light intensity. That is, the thickness of the resist mask to be developed is varied by controlling the quantity of light that the photomask transmits, at the time of exposing the photoresist to light in the photolithography process. In this case, a resist with the aforementioned complex shape may be formed by providing the photomask or the reticle with slits with a resolution limit or narrower. Further, the mask pattern formed of the photoresist material may be transformed by baking at 200° C. after development.

By using a photomask or a reticle having an auxiliary pattern which is formed of a diffraction grating pattern or a semi-transmissive film and has a function of reducing the light intensity, the region where only the first conductive layer is formed and the region where the first conductive layer and the second conductive layer are stacked can be continuously formed. As shown in FIG. 51A, the region where only the first conductive layer is formed can be selectively formed over the semiconductor layer. Whereas such a region is effective over the semiconductor layer, it is not required in other regions (a wire region which is provided connecting to a gate electrode). With such a photomask or reticle, the region where only the first conductive layer is formed is not required in the wire portion; therefore, the density of the wire can be substantially increased.

In FIGS. 50 and 51A to 51E, the first conductive layer is formed with a thickness of 30 to 50 nm, using high-melting-point metals such as tungsten (W), chromium (Cr), tantalum (Ta), tantalum nitride (TaN), or molybdenum (Mo), or alloys or compounds containing such metals as a main component, while the second conductive layer is formed with a thickness of 300 to 600 nm, using high-melting-point metals such as tungsten (W), chromium (Cr), tantalum (Ta), tantalum nitride (TaN), or molybdenum (Mo), or alloys or compounds containing such metals as a main component. For example, the first conductive layer and the second conductive layer are formed with different conductive materials, so that the etching rate of each conductive layer can be varied in the etching process to be performed later. For example, TaN can be used for the first conductive layer, while a tungsten film can be used for the second conductive layer.

This embodiment shows that transistors, a capacitor, and a resistor each having a different electrode structure can be formed concurrently by the same patterning process, using a photomask or a reticle having an auxiliary pattern which is formed of a diffraction grating pattern or a semi-transmissive film and has a function of reducing the light intensity. Accordingly, elements with different modes can be formed and integrated in accordance with the characteristics required for a circuit, without increasing the number of manufacturing steps.

Note that this embodiment can be appropriately implemented in combination with any of Embodiments 1 to 3.

[Embodiment 5]

In this embodiment, description is made of an exemplary mask pattern for manufacturing a semiconductor device including transistors, for example, with reference to FIGS. 52A to 54B.

Figure 52A:
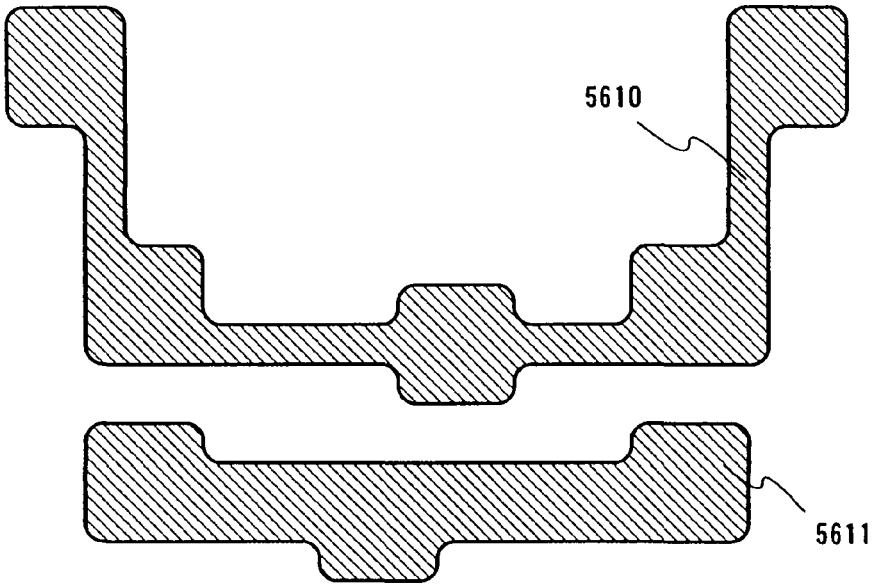
FIGS. 52A and 52B show Embodiment 5.

Semiconductor layers 5610 and 5611 shown in FIG. 52A are preferably formed with silicon or a crystalline semiconductor containing silicon as a main component. For example, single crystalline silicon, polycrystalline silicon obtained by crystallizing a silicon film by laser annealing, or the like can be employed. Alternatively, a metal oxide semiconductor, amorphous silicon, or an organic semiconductor can be employed as long as it exhibits the semiconductor characteristics.

In any case, a semiconductor to be formed first is provided over the entire surface of a substrate having an insulating surface, or a part thereof (region having a larger area than the area which is defined as a semiconductor region of a transistor). Then, a mask pattern is formed over the semiconductor layer by a photolithography technique. By etching the semiconductor layer using the mask pattern, the semiconductor layers 5610 and 5611 each having a specific island shape are formed, which include source and drain regions and a channel formation region of a transistor. The semiconductor layers 5610 and 5611 are determined in accordance with the layout design.

Figure 52B:
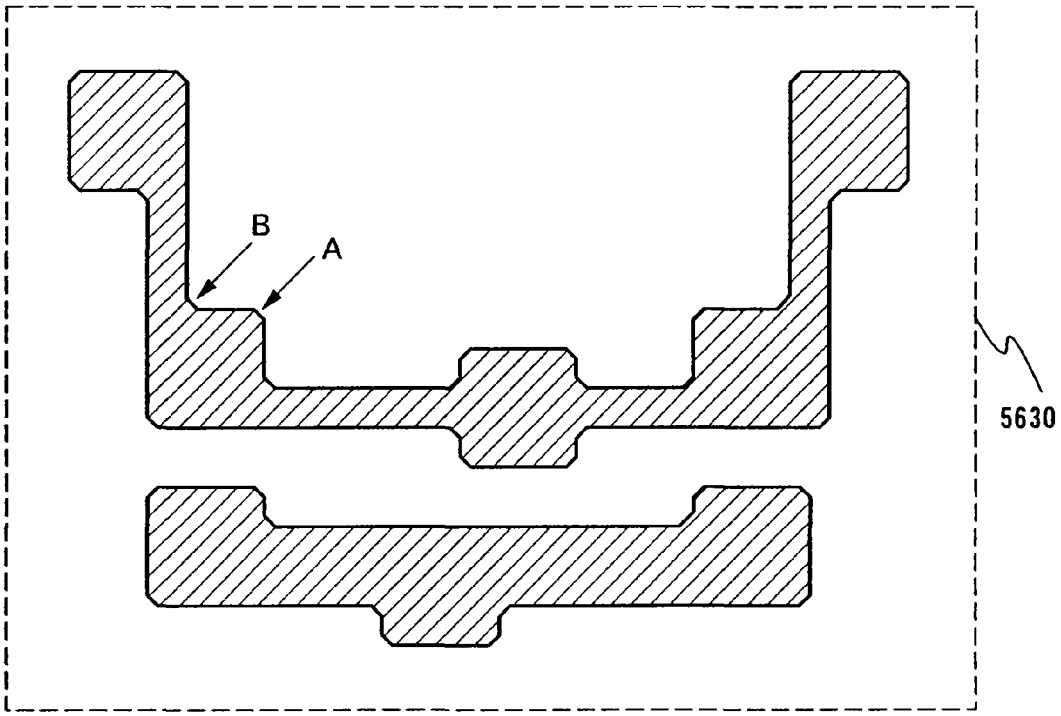

The photomask for forming the semiconductor layers 5610 and 5611 shown in FIG. 52A are provided with a mask pattern 5630 shown in FIG. 52B. The shape of this mask pattern 5630 differs depending on whether the resist used for the photolithography process is a positive type or negative type. In the case of using a positive resist, the mask pattern 5630 shown in FIG. 52B is formed as a light-blocking portion. The mask pattern 5630 has such a shape that a vertex A of a polygon is removed. In addition, a corner B has such a shape that a plurality of corners are provided so as not to form a right-angled corner. In the pattern of this photomask, corners are removed so that one side of each removed corner (right-angled triangle) has a length of 10 μm or less, for example.

The semiconductor layers 5610 and 5611 shown in FIG. 52A reflect the mask pattern 5630 shown in FIG. 52B. In this case, the mask pattern 5630 may be transferred in such a manner that a pattern similar to the original one is formed or corners of the transferred pattern are rounded more than those of the original one. That is, corner portions with a roundish and smoother shape may be provided, more than those of the mask pattern 5630.

Figure 53A:
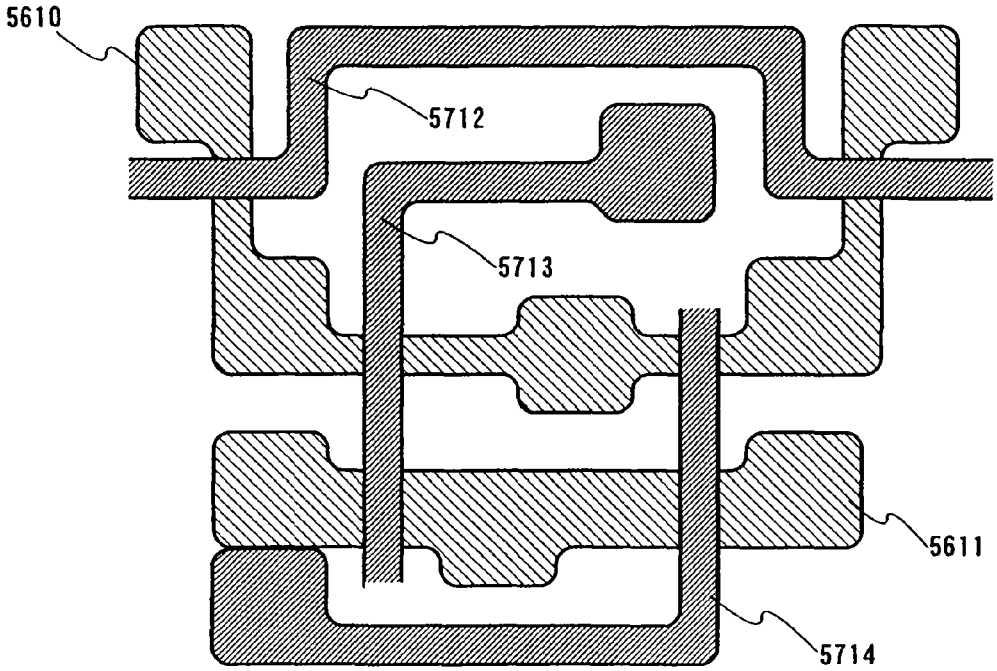
FIGS. 53A and 53B show Embodiment 5.

An insulating layer which at least partially contains silicon oxide or silicon nitride is formed over the semiconductor layers 5610 and 5611. One purpose of forming this insulating layer is to form a gate insulating layer. Then, gate wires 5712, 5713, and 5714 are formed so as to partially overlap the semiconductor layers as shown in FIG. 53A. The gate wire 5712 is formed corresponding to the semiconductor layer 5610. The gate wire 5713 is formed corresponding to the semiconductor layers 5610 and 5611. The gate wire 5714 is formed corresponding to the semiconductor layers 5610 and 5611. The gate wires are formed by depositing a metal layer or a highly conductive semiconductor layer over the insulating layer and then printing a pattern onto the layer by a photolithography technique.

Figure 53B:
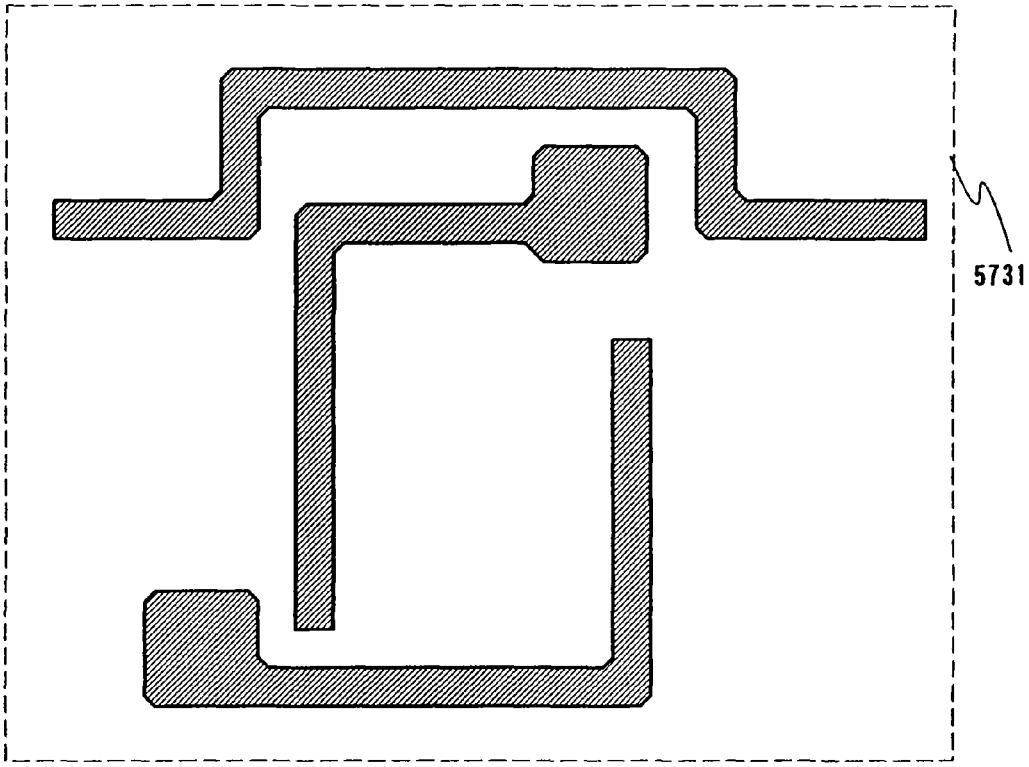

The photomask for forming such gate wires is provided with a mask pattern 5731 shown in FIG. 53B. This mask pattern 5731 is removed its corners in such a manner that each removed corner (right-angled triangle) has one side of 10 μm or less, or has one side of ⅕ to ½ of the wire width. The gate wires 5712, 5713, and 5714 shown in FIG. 53A reflect the shape of the mask pattern 5731 shown in FIG. 53B. In this case, although the mask pattern 5731 may be transferred in such a manner that a pattern similar to the original one is formed or corners of the transferred pattern are rounded more than those of the original one. That is, corner portions with a roundish and smoother shape may be provided, more than those of the mask pattern 5731. Specifically, each corner of the gate wires 5712, 5713, and 5714 is formed to be roundish by removing an edge so that the removed corner (right-angled triangle) has one side of 10 μm or less, or has a length of ⅕ to ½ of the wire width. By forming a corner of a projecting portion to be roundish, generation of particles due to overdischarge can be suppressed in dry etching with plasma. In addition, by forming a corner of a depressed portion to be roundish, such an effect can be obtained that, even when particles are generated in washing, they can be washed away without gathering in the corner. Thus, yields can be significantly improved.

An interlayer insulating layer is a layer to be formed after the gate wires 5712, 5713, and 5714. The interlayer insulating layer is formed with an inorganic insulating material such as silicon oxide or an organic insulating material such as polyimide or an acrylic resin. Another insulating layer such as silicon nitride or silicon nitride oxide may be provided between the interlayer insulating layer and the gate wires 5712, 5713, and 5714. Further, an insulating layer such as silicon nitride or silicon nitride oxide may be provided over the interlayer insulating layer as well. Such an insulating layer can prevent contamination of the semiconductor layer and the gate insulating layer with impurities which would adversely affect the transistor, such as extrinsic metal ions or moisture.

Figure 54A:
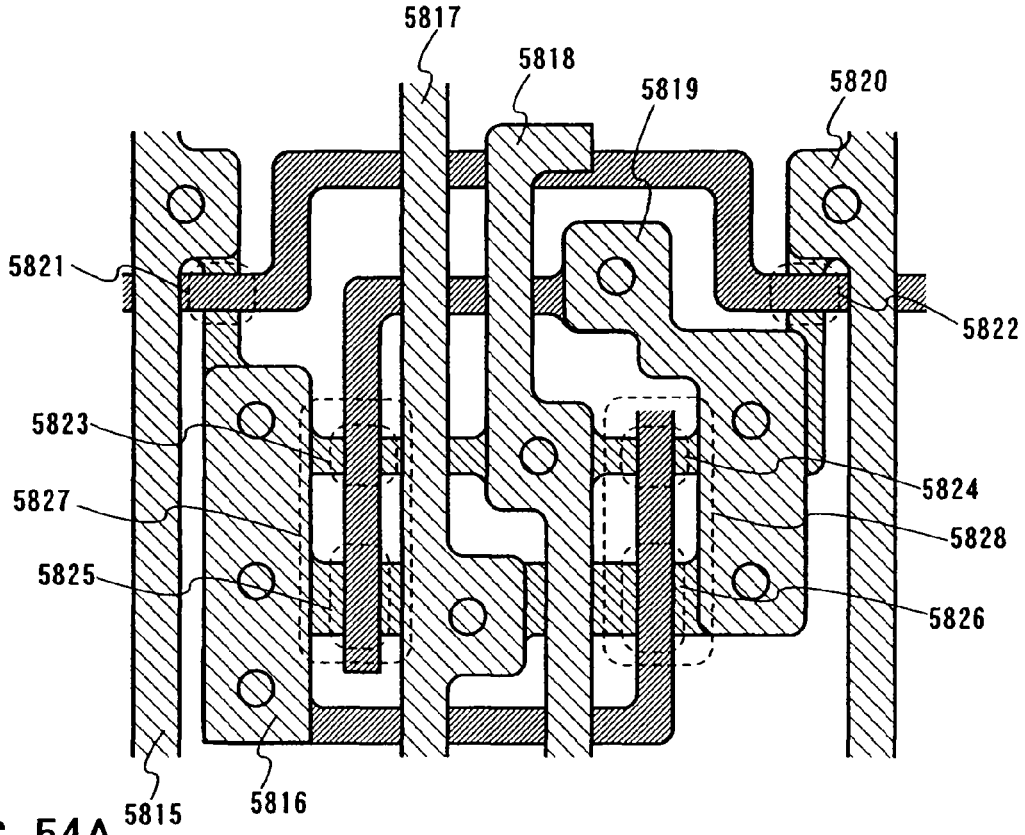
FIGS. 54A and 54B show Embodiment 5.

Openings are formed in predetermined positions of the interlayer insulating layer. For example, the openings are provided in corresponding positions to the gate wires and the semiconductor layers located below the interlayer insulating layer. A wire layer which has a single layer or a plurality of layers of metals or metal compounds is formed by photolithography with the use of a mask pattern, and then etching into a desired pattern. Then, as shown in FIG. 54A, the wires 5815 to 5820 are formed to partially overlap the semiconductor layers. A wire connects specific elements to each other, which means a wire connects specific elements not linearly but connects so as to include corners due to the restriction of a layout. In addition, the width of the wire varies in a contact portion and other portions. As for the contact portion, if the width of a contact hole is equal to or wider than the wire width, the wire in the contact portion is formed wider than the width of the other portions.

Figure 54B:
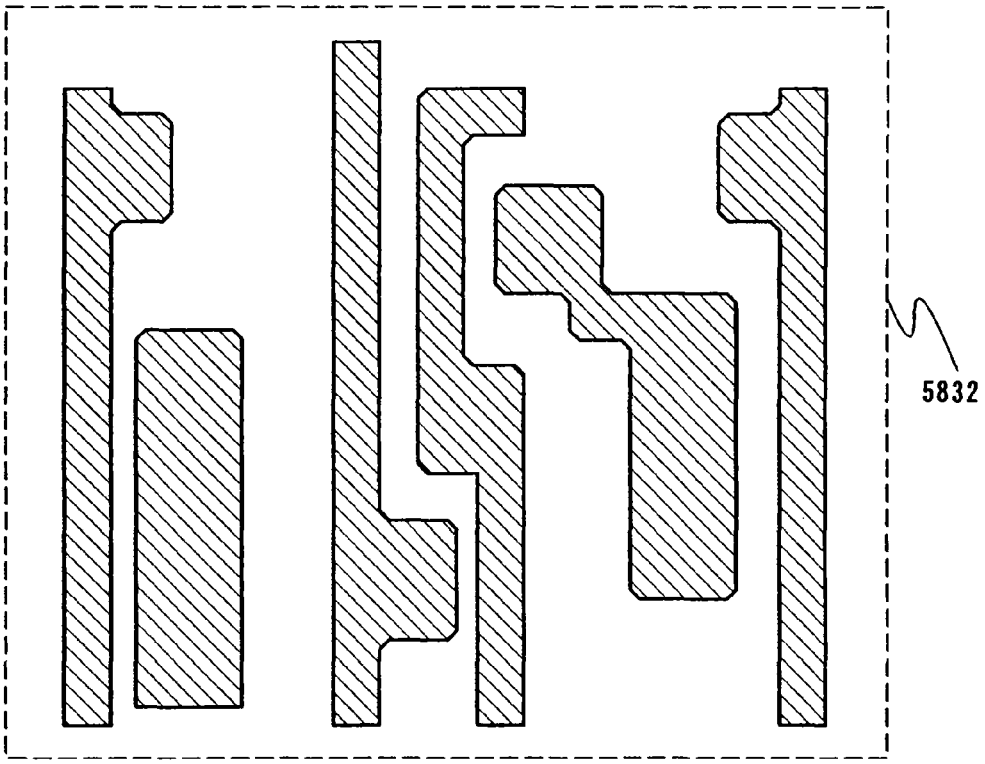

A photomask for forming the wires 5815 and 5820 has a mask pattern 5832 shown in FIG. 54B. In this case also, each wire is formed to have such a pattern that a corner (right-angled triangle) at an L-shaped edge is removed with the condition that one side of the removed triangle is 10 μm or less, or has a length of ⅕ to ½ of the wire width, so that the corner is rounded. That is to say, the outer circumference of the corner of the wire layer is curved when seen from the above. Specifically, in order to form the outer circumference of the corner to be roundish, a part of the wire layer is removed, which corresponds to a right-angled isosceles triangle having two first straight lines which make a right angle with each other to form an edge, and a second straight line which makes an angle of about 45 degrees with the two first straight lines. After removing the triangle, two obtuse angles are formed in the remaining wire layer Thus, it is preferable to etch the wire layer by appropriately adjusting the mask design or etching conditions so as to form curved lines in contact with the respective first straight lines and the second straight line, in the obtuse angle portions. Note that each of the two sides of the right-angled isosceles triangle, which are equal to each other, has a length of ⅕ to ½ of the width of the wire layer. In addition, the inner circumference of the corner is also made roundish along the outer circumference of the corner. By forming a corner of a projecting portion to be roundish, generation of particles due to overdischarge can be suppressed in dry etching with plasma. In addition, by forming a corner in a depressed portion to be roundish, such an effect can be obtained that, even when particles are generated in washing, they can be washed away without gathering in the corner. Thus, yields can be significantly improved. When corners of wires are formed to be roundish, electrical conduction can be expected to be maintained. Further, when a plurality of wires are formed in parallel, dust can be easily washed away.

In FIG. 54A, n-channel transistors 5821 to 5824 and p-channel transistors 5825 and 5826 are formed. The n-channel transistor 5823 and the p-channel transistor 5825, and the n-channel transistor 5824 and the p-channel transistor 5826 constitute inverters 5827 and 5828 respectively. Note that a circuit including the six transistors constitutes an SRAM. An insulating layer such as silicon nitride or silicon oxide may be formed over these transistors.

Note that this embodiment mode can be appropriately implemented in combination with any of Embodiments 1 to 4.

[Embodiment 6]

In this embodiment, description is made of a vapor-deposition apparatus used for manufacturing a display device where an electroluminescence element (EL element) is used in each pixel, with reference to the drawings.

A display panel is manufactured by forming an EL layer over an element substrate where a pixel circuit and/or a driver circuit are/is constructed from transistors. An EL layer is formed so as to at least partially contain a material exhibiting electroluminescence. The EL layer may be formed with a plurality of layers having different functions. In such a case, the EL layer may be formed by combining a hole injecting/transporting layer, a light-emitting layer, an electron injecting/transporting layer, and the like.

Figure 55:
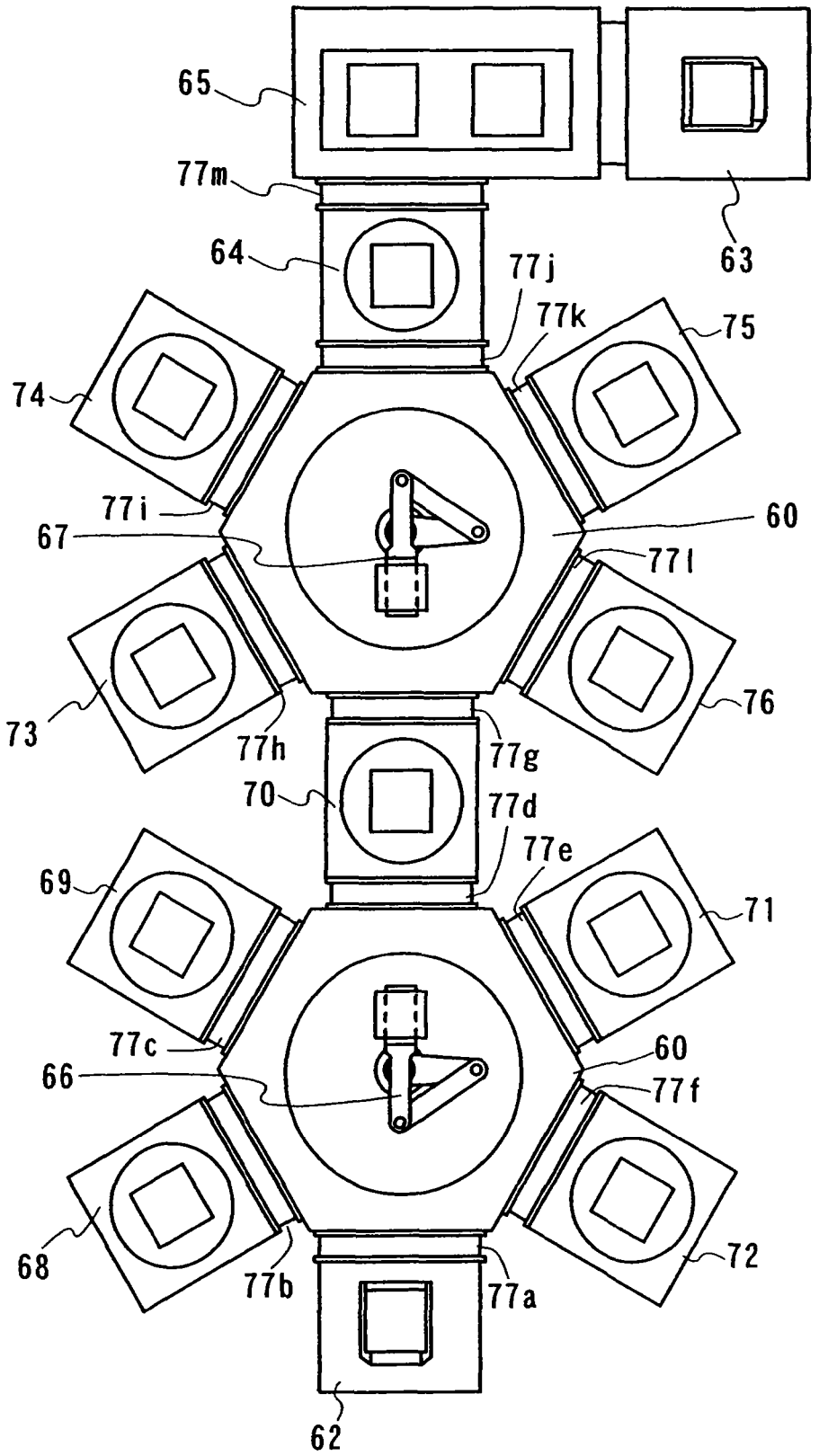
FIG. 55 shows a structure of a vapor-deposition apparatus for forming an EL layer.

FIG. 55 shows a structure of a vapor-deposition apparatus for forming an EL layer over an element substrate over which transistors are formed. This vapor-deposition apparatus includes transfer chambers 60 and 61 each of which connects a plurality of treatment chambers. The treatment chambers include a load chamber 62 for loading substrates, an unloading chamber 63 for unloading substrates, a heat treatment chamber 68, a plasma treatment chamber 72, film-deposition chambers 69 to 75 for vapor-depositing EL materials, and a film-deposition chamber 76 for forming a conductive film containing aluminum or containing aluminum as a main component, as one electrode of an EL element. Gate valves 77*a* to 77*m* are provided between the transfer chambers and the respective treatment chambers, and the pressure of each treatment chamber can be independently controlled to prevent mutual contamination between treatment chambers.

A substrate introduced from the load chamber 62 to the transfer chamber 60 is transferred to a predetermined treatment chamber with a freely rotatable transfer means 66 with a robot arm. In addition, the substrate is transferred from one treatment chamber to another treatment chamber with the transfer means 66. The transfer chambers 60 and 61 are connected through the film-deposition chamber 70, and substrates are delivered by the transfer means 66 to a transfer means 67.

Each treatment chamber connected with the transfer chamber 60 or 61 is kept at a reduced pressure. Accordingly, film-deposition treatment of an EL layer is continuously performed in this vapor-deposition apparatus without exposure to the air. A display panel where the film-deposition treatment of an EL layer is completed might be degraded by moisture vapor and the like; therefore, a sealing treatment chamber 65 for performing sealing treatment without exposure to the air is connected with the transfer chamber 61 in order to retain the quality. Since the sealing treatment chamber 65 is set at the atmospheric pressure or reduced pressure close to the atmospheric pressure, an intermediate chamber 64 is provided between the transfer chamber 61 and the sealing treatment chamber 65. The intermediate chamber 64 is provided in order to deliver substrates and alleviate the pressure in the space.

Each of the load chamber, the unload chamber, the transfer chamber, and the film-deposition chamber is provided with an exhaust system for maintaining the chamber at a reduced pressure. Various vacuum pumps can be used as the exhaust system, such as a dry-sealed vacuum pump, a turbo-molecular pump, or a diffusion pump.

In the vapor-deposition apparatus of FIG. 55, the number and structure of the treatment chambers connected with the transfer chambers 60 and 61 can be changed as appropriate according to the stacked structure of an EL element. An example of the combination is shown below.

In the heat treatment chamber 68, degasification treatment is performed first by heating a substrate over which a bottom electrode, an insulating partition wall, and the like are formed. In the plasma treatment chamber 72, the surface of the base electrode is subjected to plasma treatment with a rare gas or oxygen. This plasma treatment is performed in order to clean the surface, stabilize the surface state, and stabilize the physical or chemical state of the surface (e.g., work functions).

The film-deposition chamber 69 is a treatment chamber for forming an electrode buffer layer to be in contact with one electrode of an EL element. The electrode buffer layer is a layer having a carrier injecting property (hole injecting or electron injecting property), which can suppress short circuits of an EL element and generation of defects such as dark spots.

Typically, the electrode buffer layer is formed from a composite material of organic and inorganic compounds, to have a resistivity of $5\times10^4$ to $1\times10^6$ Ωcm and a thickness of 30 to 300 nm. The film-deposition chamber 71 is a treatment chamber for depositing a hole transporting layer.

A structure of a light-emitting layer included in an EL element differs depending on whether it emits light with a single color or light with a white color. It is preferable to provide film-deposition chambers in the vapor-deposition apparatus, in accordance with the respective structures. For example, in the case of forming three kinds of EL elements each of which exhibits light with a different light-emission color in a display panel, light-emitting layers corresponding to the respective light-emission colors are required to be deposited. In this case, the film-deposition chamber 70 can be used for depositing a first light-emitting layer, the film-deposition chamber 73 can be used for depositing a second light-emitting layer, and the film-deposition chamber 74 can be used for depositing a third light-emitting layer. By separately providing the film-deposition chambers for the respective light-emitting layers, mutual contamination between treatment chambers with different light-emitting materials can be prevented, resulting in improvement in the throughput of the film-deposition treatment.

Alternatively, the three kinds of EL materials each of which exhibits light with a different color may be sequentially vapor-deposited in the film-deposition chambers 70, 73, and 74. In this case, a shadow mask is used so that vapor deposition is performed by shifting the mask above each region to be vapor-deposited with the EL material.

In the case of forming an EL element which exhibits light with a white color, light-emitting layers which exhibit light with different colors are vertically stacked from the bottom. In this case also, each light-emitting layer can be deposited by sequentially moving an element substrate through the film-deposition chambers. Alternatively, different light-emitting layers can be continuously deposited in the same film-deposition chamber.

In the film-deposition chamber 76, an electrode is deposited over the EL layer. Although the electrode can be formed by electron-beam vapor deposition or sputtering, vapor deposition by resistance heating is preferably employed.

An element substrate where the treatment up to the formation of an electrode is completed is transferred to the sealing treatment chamber 65 through the intermediate chamber 64. The sealing treatment chamber 65 is filled with an inert gas such as helium, argon, neon, or nitrogen, and sealing is performed by attaching a sealing substrate onto one side of the element substrate where the EL layer is formed, under the inert gas atmosphere. The space between the element substrate and the sealing substrate in the state of being sealed may be filled with an inert gas or a resin material. The sealing treatment chamber 65 is provided with a dispenser for drawing a sealing material, a mechanical component such as an arm or a fastening stage for fastening a sealing substrate to face an element substrate, a dispenser for filling the space with a resin material or a spin coater, and the like.

Figure 56:
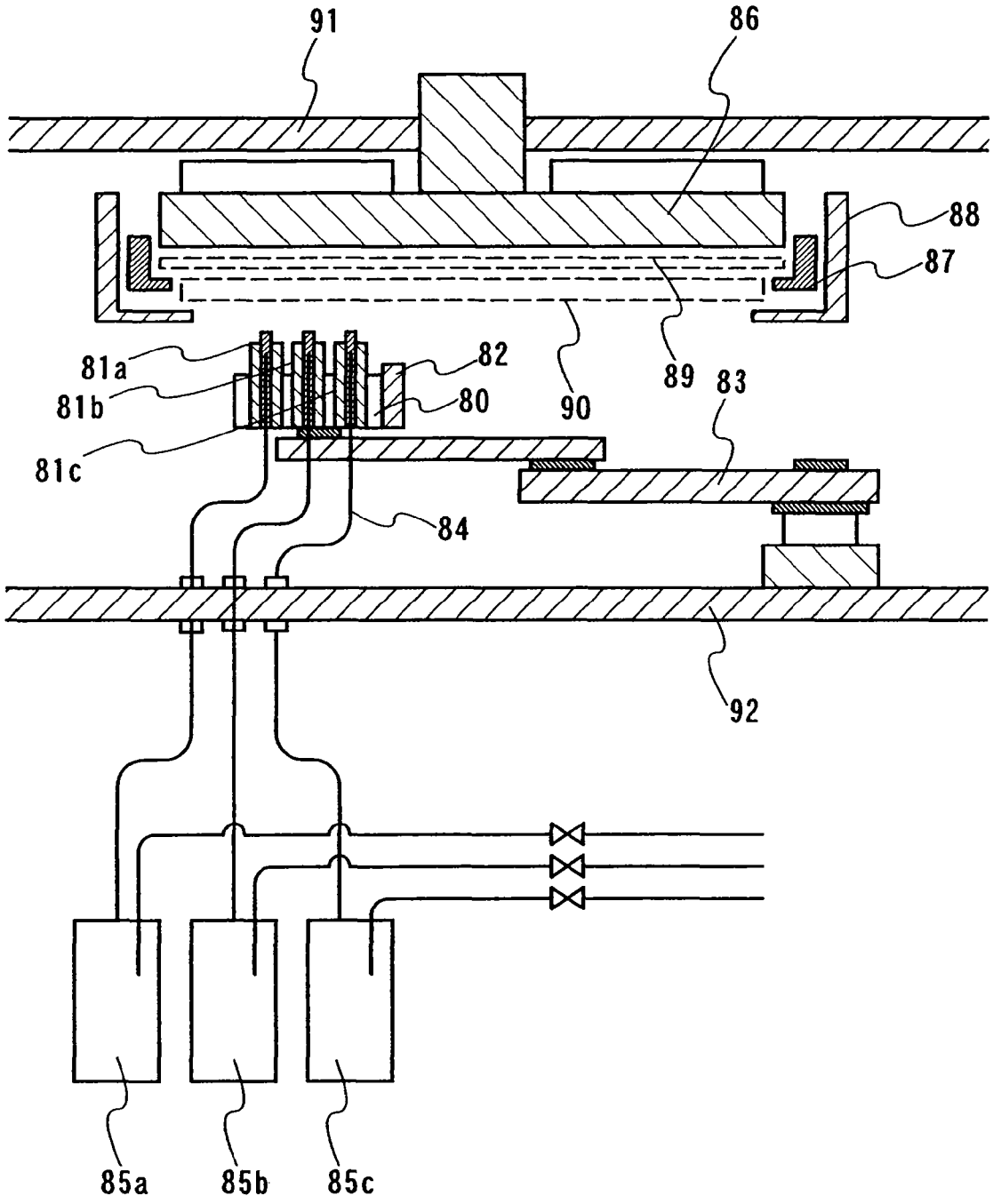
FIG. 56 shows a structure of a vapor-deposition apparatus for forming an EL layer.

FIG. 56 shows an internal structure of a film-deposition chamber. The film-deposition chamber is kept at a reduced pressure. In FIG. 56, an interior side of a top plate 91 and a bottom plate 92 corresponds to the inside of a chamber, which is kept at a reduced pressure.

The treatment chamber is provided with one or a plurality of evaporation sources. This is because it is preferable to provide a plurality of evaporation sources in the case of depositing a plurality of layers each having a different composition or vapor-depositing different materials at a time. In FIG. 56, evaporation sources 81*a*, 81*b*, and 81*c* are set in an evaporation source holder 80. The evaporation source holder 80 is held by a multi-joint arm 83. The multi-joint arm 83 allows the evaporation source holder 80 to move within its traveling range, with the use of telescopic joints. In addition, the evaporation source holder 80 may be provided with a distance sensor 82 so as to control the optimal distance for vapor deposition between the evaporation sources 81*a* to 81*c* and the substrate 89 by monitoring. In this case, the multi-joint arm may be also capable of traveling in the vertical direction (Z direction).

A substrate stage 86 and a substrate chuck 87 jointly secure a substrate 89. The substrate stage 86 may incorporate a heater so as to heat the substrate 89. The substrate 89 is carried in/out with stretching and shrinking functions of the substrate chuck 87, while being secured to the substrate stage 86. In vapor deposition, a shadow mask 90 which has openings corresponding to the pattern to be vapor-deposited can be used according to need. In that case, the shadow mask 90 is disposed between the substrate 89 and the evaporation sources 81*a* to 81*c*. The shadow mask 90 is secured by a mask chuck 88 so as to be in close position to or with a fixed distance from the substrate 89. In the case where alignment of the shadow mask 90 is required, a camera is disposed in the treatment chamber and a positioning device capable of micromotion in the X-Y-θ direction is provided to the mask chuck 88, thereby alignment is carried out.

The evaporation sources 81*a* to 81*c* are provided with a vapor-deposition-material supply unit in order to continuously supply vapor-deposition materials to the evaporation sources. The vapor-deposition-material supply unit includes vapor-deposition-material supply sources 85*a* to 85*c* which are provided apart from the evaporation sources 81*a* to 81*c*, and material supply pipes 84 for connecting the evaporation sources with the vapor-deposition-material supply sources. Typically, the material supply sources 85*a* to 85*c* are provided corresponding to the evaporation sources 81*a* to 81*c* respectively. In FIG. 56, the material supply source 85*a* corresponds to the evaporation source 81*a*, the material supply source 85*b* corresponds to the evaporation source 81*b*, and the material supply source 85*c* corresponds to the evaporation source 81*c*.

As a method of supplying vapor-deposition materials, an airflow carry method, an aerosol method, or the like can be used. The airflow carry method is a method for delivering fine particles of a vapor-deposition material using an airflow, for example by delivering the vapor-deposition material to the evaporation sources 81*a* to 81*c* using an inert gas or the like. The aerosol method is a method for delivering a material liquid which is formed by dissolving or dispersing a vapor-deposition material in a solvent, so that the material liquid is made into aerosols with an atomizer, and the solvent in the aerosols is vaporized to be vapor-deposited. In any case, the evaporation sources 81*a* to 81*c* are provided with a heater, and the vapor-deposition material which has been delivered is vaporized to be deposited onto the substrate 89. In FIG. 56, the material supply pipes 84 are constructed from stiff and narrow tubes which can be bent flexibly and do not change in shape even under a reduced pressure.

In the case of using the airflow carry method or the aerosol method, film deposition may be performed with the film-deposition chamber being set at an atmospheric pressure or a pressure lower than that, preferably 133 to 13300 Pa. After filling the film-deposition chamber with an inert gas such as helium, argon, neon, krypton, xenon, or nitrogen, the pressure of the chamber can be controlled by continuously supplying the gas (while at the same time evacuating the gas). In addition, a film-deposition chamber for forming an oxide film may be set at an oxygen atmosphere by introducing a gas such as oxygen or nitrous oxide. Meanwhile, a film-deposition chamber for vapor-depositing an organic material may be set at a reducing atmosphere by introducing a gas such as hydrogen.

As an alternative method of supplying a vapor-deposition material, a screw may be provided in the material supply pipes 84 so that the vapor-deposition material can be continuously pushed out toward the evaporation sources.

According to the vapor-deposition apparatus in this embodiment, film deposition can be carried out uniformly and continuously even onto a display panel with a large screen. Further, since there is no need to supply vapor-deposition materials every time the evaporation sources run out of vapor-deposition materials, the throughput can be improved.

[Embodiment 7]

Figure 25A:
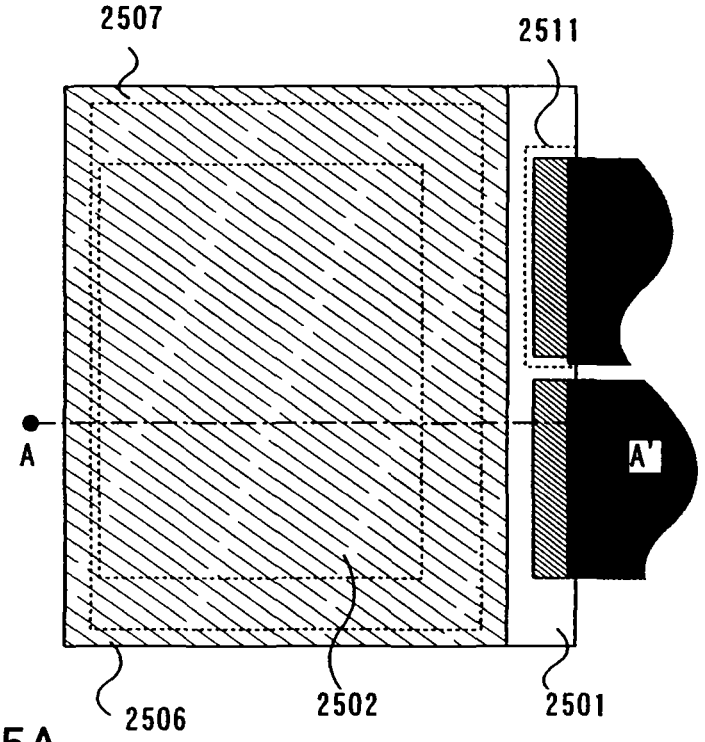
FIGS. 25A to 25C show Embodiment 7.
Figure 25B:
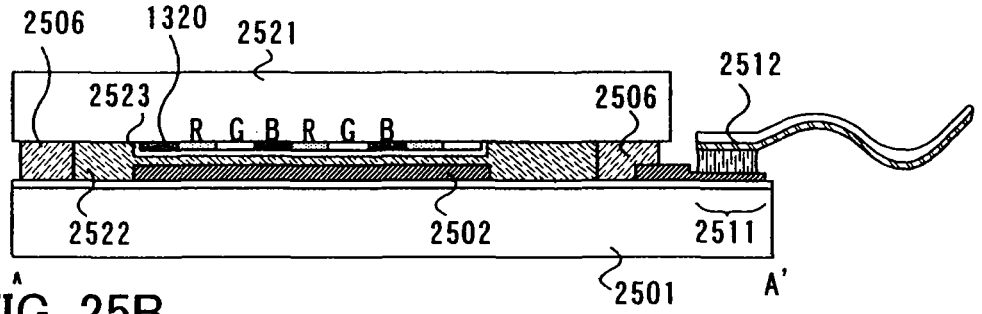
Figure 25C:
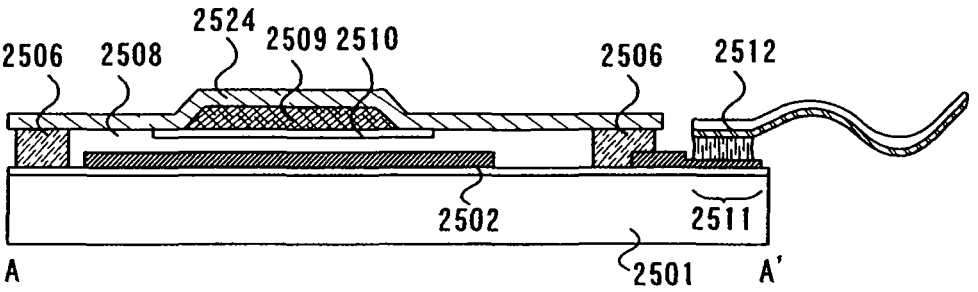

In this embodiment, description is made of a structure where a substrate formed with pixels is sealed, with reference to FIGS. 25A to 25C. FIG. 25A is a top view of a panel where a substrate formed with pixels is sealed, and FIGS. 25B and 25C are cross sections taken along a line A-A' of FIG. 25A. FIGS. 25B and 25C show examples where sealing is performed by different methods.

In FIGS. 25A to 25C, a pixel portion 2502 having a plurality of pixels is provided over a substrate 2501, and a sealing material 2506 is provided to surround the pixel portion 2502, while a sealing material 2507 is attached thereto. For the structure of pixels, those shown in embodiment modes or Embodiment 1 can be employed.

In the display panel in FIG. 25B, the sealing material 2507 in FIG. 25A corresponds to a counter substrate 2521. The counter substrate 2521 which transmits light is attached to the substrate 2501 using the sealing material 2506 as an adhesive layer, and accordingly, a hermetically sealed space 2522 is formed by the substrate 2501, the counter substrate 2521, and the sealing member 2506. The counter substrate 2521 is provided with a color filter 2520 and a protective film 2523 for protecting the color filter. Light emitted from light-emitting elements which are disposed in the pixel portion 2502 is emitted to the outside through the color filter 2520. The hermetically sealed space 2522 is filled with an inert resin or liquid. Note that the resin for filling the hermetically sealed space 2522 may be a light-transmissive resin in which a moisture absorbent is dispersed. In addition, the same materials may be used for the sealing material 2506 and the hermetically sealed space 2522, so that the adhesion of the counter substrate 2521 and the sealing of the pixel portion 2502 may be performed concurrently.

In the display panel shown in FIG. 25C, the sealing material 2507 in FIG. 25A corresponds to a sealing material 2524. The sealing material 2524 is attached to the substrate 2501 using the sealing material 2506 as an adhesive layer, and a hermetically sealed space 2508 is formed by the substrate 2501, the sealing material 2506, and the sealing material 2524. The sealing material 2524 is provided with a moisture absorbent 2509 in advance in its depressed portion, and the moisture absorbent 2509 functions to keep a clean atmosphere in the hermetically sealed space 2508 by adsorbing moisture, oxygen, and the like, and to suppress degradation of the light-emitting elements. The depressed portion is covered with a fine-meshed cover material 2510. Whereas the cover material 2510 transmits air and moisture, the moisture absorbent 2509 does not transmit them. Note that the hermetically sealed space 2508 may be filled with a rare gas such as nitrogen or argon, as well as an inert resin or liquid.

An input terminal portion 2511 for transmitting signals to the pixel portion 2502 and the like are provided over the substrate 2501. Signals such as video signals are transmitted to the input terminal portion 2511 through an FPC (Flexible Printed Circuit) 2512. At the input terminal portion 2511, wires formed over the substrate 2501 are electrically connected to wires provided in the FPC 2512 with the use of a resin in which conductors (anisotropic conductive resin: ACF) are dispersed.

A driver circuit for inputting signals to the pixel portion 2502 may be formed over the same substrate 2501 as the pixel portion 2502. Alternatively, the driver circuit for inputting signals to the pixel portion 2502 may be formed in an IC chip so as to be connected onto the substrate 2501 by COG (Chip-On-Glass) bonding, or the IC chip may be disposed on the substrate 2501 by TAB (Tape Automated Bonding) or by use of a printed board.

This embodiment can be appropriately implemented in combination with any of Embodiments 1 to 6.

[Embodiment 8]

The invention can be applied to a display module where a circuit for inputting signals to a panel is mounted on the panel.

Figure 26:
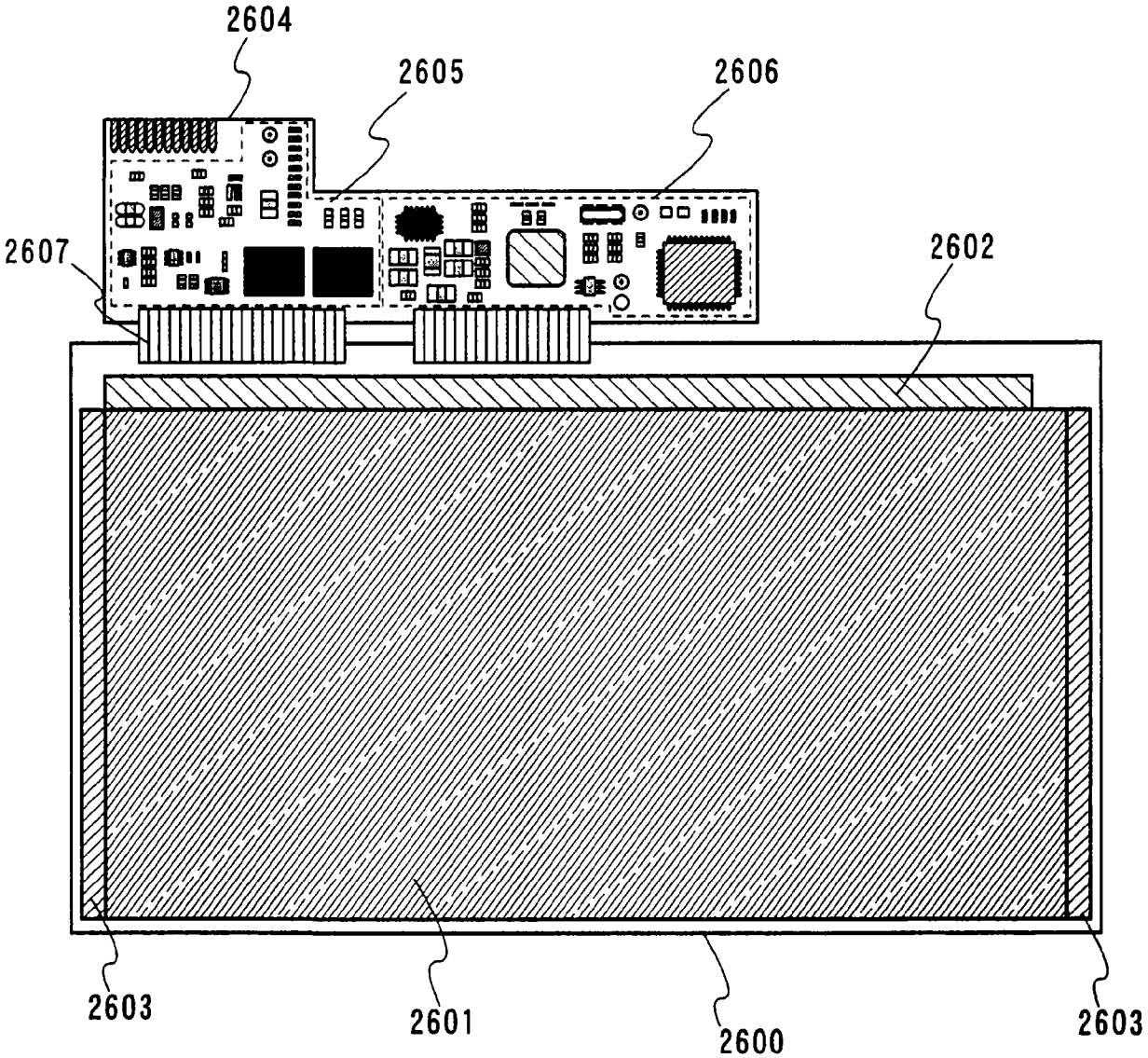
FIG. 26 shows Embodiment 8.

FIG. 26 shows a display module where a panel 2600 is combined with a circuit board 2604. Although FIG. 26 shows an example where a controller 2605, a signal dividing circuit 2606, and the like are formed over the circuit board 2604, circuits formed over the circuit board 2604 are not limited to these. Any circuit which can generate signals for controlling the panel may be employed.

Signals output from the circuits formed over the circuit board 2604 are input to the panel 2600 through a connecting wire 2607.

The panel 2600 includes a pixel portion 2601, a source driver 2602, and gate drivers 2603. The structure of the panel 2600 may be similar to those shown in Embodiments 1, 2, and the like. Although FIG. 26 shows an example where the source driver 2602 and the gate drivers 2603 are formed over the same substrate as the pixel portion 2601, the display module of the invention is not limited to this. Such a structure may also be employed that only the gate drivers 2603 are formed over the same substrate as the pixel portion 2601, while the source driver 2602 is formed over a circuit board. Alternatively, both of the source driver and the gate drivers may be formed over a circuit board.

Figure 57:
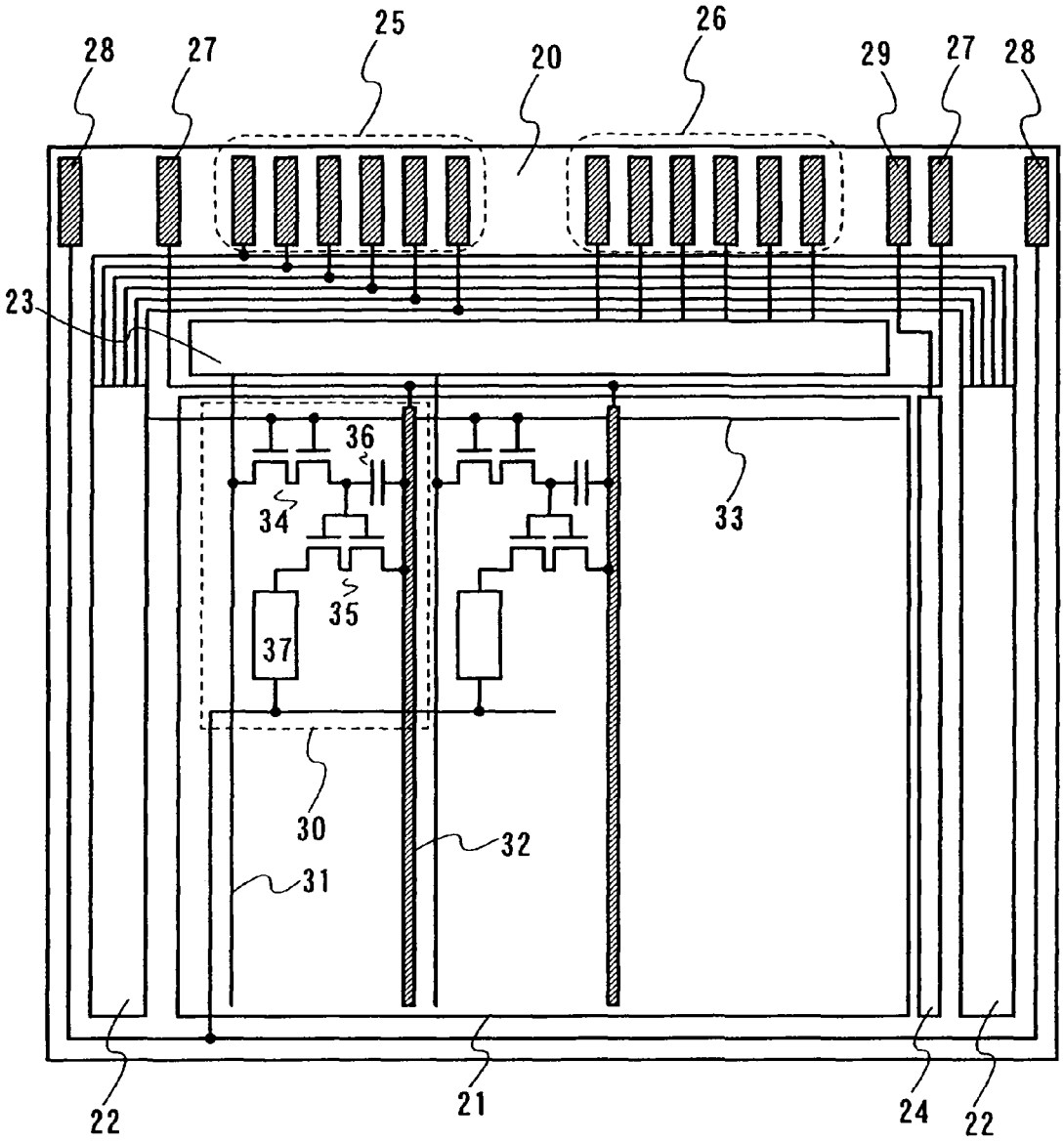
FIG. 57 shows an exemplary configuration of a display panel.

FIG. 57 shows an exemplary configuration of the panel 2600 which is suitable for a module with a large display screen. In the panel shown in FIG. 57, a pixel portion 21 where a plurality of sub-pixels 30 are arranged, scan line driver circuits 22 for controlling signals through a scan line 33, and a data line driver circuit 23 for controlling signals through a data line 31 are formed over a substrate 20. In addition, a monitoring circuit 24 may be provided in order to compensate the change in luminance of a light-emitting element 37 included in each sub-pixel 30. The light-emitting element 37 has the same structure as a light-emitting element included in the monitoring circuit 24. The light-emitting element 37 has a structure where a material exhibiting electroluminescence is sandwiched between a pair of electrodes.

Input terminals 25 for inputting signals from an external circuit to the scan line driver circuits 22, an input terminal 26 for inputting signals from an external circuit to the data line driver circuit 23, and an input terminal 29 for inputting signals to the monitoring circuit 24 are provided in the peripheral portion of the substrate 20.

Each sub-pixel 30 includes a transistor 34 connected to the data line 31, and a transistor 35 connected in series between a power supply line 32 and the light-emitting element 37. Gates of the transistor 34 are connected to the scan line 33. When the transistor 34 is selected with a scan signal, it inputs a signal from the data line 31 into the sub-pixel 30. The input signal is supplied to gates of the transistor 35 as well as a storage capacitor 36 to be charged. In response to the signal, the power supply line 32 and the light-emitting element 37 are electrically connected, thereby the light-emitting element 37 emits light.

In order to control the light-emitting element 37 in each sub-pixel 30 to emit light, power is required to be supplied thereto from an external circuit. The power supply line 32 provided in the pixel portion 21 is connected to an external circuit at input terminals 27. Since the resistance of the power supply line 32 is lost in accordance with the length of a lead wire, the input terminals 27 are preferably provided at a plurality of portions in the peripheral portion of the substrate 20. The input terminals 27 are provided at both ends of the substrate 20, so that luminance unevenness can be made less noticeable in the plane of the pixel portion 20. That is, it can be prevented that only one side of the display screen is brighter, while the other side thereof is darker. In addition, the light-emitting element 37 has a pair of electrodes, and a counter electrode thereof which is not connected to the power supply line 32 is formed as a common electrode to be shared by the plurality of sub-pixels 30. This electrode is also provided with a plurality of terminals 28 in order to suppress the loss in resistance of the electrode.

Since power supply lines in such a display panel are formed of a low-resistance material such as Cu, they are effective when a display screen is increased in size, in particular. For example, while a 13-inch display screen has a diagonal line of 340 mm, a 60-inch display screen has a diagonal line of 1500 mm or more. In such a case, the wiring resistance is necessarily taken into account, and thus a low-resistance material such as Cu is preferably used for the wires. In addition, taking into account a wiring delay, the data line and the scan line may be formed in a similar manner.

Display portions of various electronic devices can be formed by incorporating such a display module.

This embodiment can be appropriately implemented in combination with any of Embodiments 1 to 7.

The invention can be applied to various electronic devices. The electronic devices include a camera (e.g., a video camera or a digital camera), a projector, a head-mounted display (goggle display), a navigation system, a car stereo, a computer, a game machine, a portable information terminal (e.g., a mobile computer, a portable phone, or an electronic book), an image reproducing device provided with a recording medium (specifically, a device for reproducing a recording medium such as a digital versatile disc (DVD), and having a display portion for displaying the reproduced image), and the like. FIGS. 27A to 27D show examples of the electronic devices.

Figure 27A:
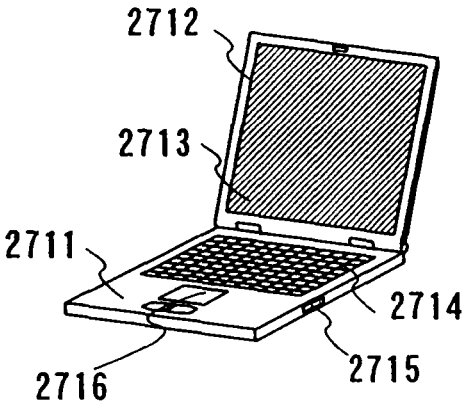
FIGS. 27A and 27D show Embodiment 9.

FIG. 27A shows a computer, which includes a main body 2711, a housing 2712, a display portion 2713, a keyboard 2714, an external connecting port 2715, a pointing mouse 2716, and the like. The invention is applied to the display portion 2713. With the invention, power consumption of the display portion can be reduced.

Figure 27B:
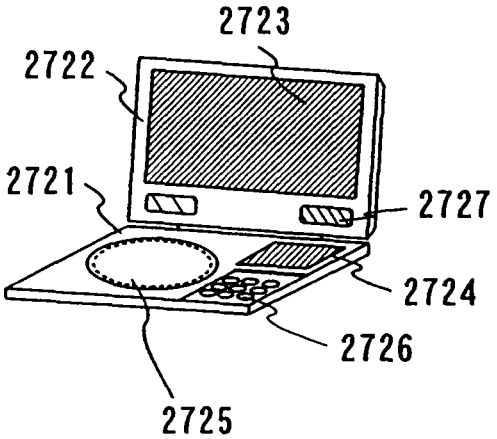

FIG. 27B shows an image reproducing device provided with a recording medium (specifically, a DVD reproducing device), which includes a main body 2721, a housing 2722, a first display portion 2723, a second display portion 2724, a recording medium (e.g., DVD) reading portion 2725, an operating key 2726, a speaker portion 2727, and the like. The first display portion 2723 mainly displays image data, while the second display portion 2724 mainly displays text data. The invention is applied to the first display portion 2723 and the second display portion 2724. With the invention, power consumption of the display portion can be reduced.

Figure 27C:
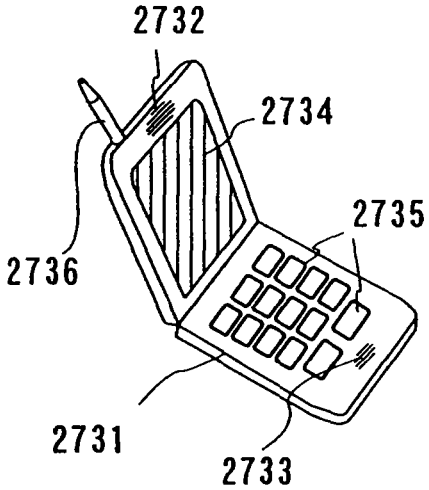

FIG. 27C shows a portable phone, which includes a main body 2731, an audio output portion 2732, an audio input portion 2733, a display portion 2734, operating switches 2735, an antenna 2736, and the like. The invention is applied to the display portion 2734. With the invention, power consumption of the display portion can be reduced.

Figure 27D:
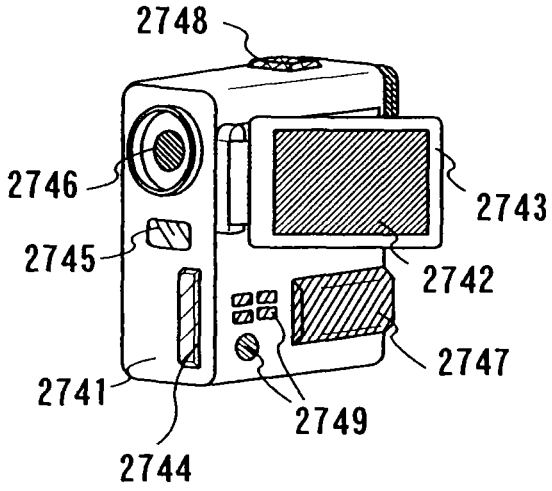

FIG. 27D shows a camera, which includes a main body 2741, a display portion 2742, a housing 2743, an external connecting port 2744, a remote controlling portion 2745, an image receiving portion 2746, a battery 2747, an audio input portion 2748, operating keys 2749, and the like. The invention is applied to the display portion 2742. With the invention, power consumption of the display portion can be reduced.

This embodiment can be appropriately implemented in combination with any of Embodiments 1 to 7.

The present application is based on Japanese Priority Application No. 2005-194684 filed on Jul. 4, 2005 with the Japanese Patent Office, the entire contents of which are hereby incorporated by reference.

What is claimed is:

1. A semiconductor device comprising:

a plurality of pixels;

a driver circuit;

a detection circuit; and a compensation circuit, wherein each of the plurality of pixels comprises a first sub-pixel and a second sub-pixel, wherein each of the first sub-pixel and the second sub-pixel comprises a light-emitting element, a first transistor configured to control a supply of a current to the light-emitting element, and a second transistor configured to control an input of a video signal to a gate of the first transistor, wherein an area of the first sub-pixel is different from an area of the second sub-pixel, wherein one of a source and a drain of the first transistor of the first sub-pixel is electrically connected to the light-emitting element of the first sub-pixel, wherein one of a source and a drain of the first transistor of the second sub-pixel is electrically connected to the light-emitting element of the second sub-pixel, wherein the other of the source and the drain of the first transistor of the first sub-pixel and the other of the source and the drain of the first transistor of the second sub-pixel are electrically connected to a power supply line, wherein a gate of the second transistor of the first sub-pixel and a gate of the second transistor of the second sub-pixel are electrically connected to a same gate signal line, wherein the detection circuit detects a value of a current to the light-emitting element included in a point defective sub-pixel, wherein the compensation circuit generates a compensation signal based on a result obtained by the detection circuit, wherein the driver circuit is configured to drive a pixel having the point defective sub-pixel such that the pixel having the point defective sub-pixel is compensated by increasing an amount of a current to the light-emitting element of the second sub-pixel when the first sub-pixel is the point defective sub-pixel, wherein the detection circuit comprises a resistor, a switching element, a noise-reduction circuit and an analog-digital converter circuit, wherein a first terminal of the resistor is electrically connected to a first terminal of the switching element, wherein a second terminal of the resistor is electrically connected to a second terminal of the switching element, wherein the second terminal of the resistor is electrically connected to the power supply line and an input terminal of the noise-reduction circuit, and wherein an output terminal of the noise-reduction circuit is electrically connected to the input terminal of the analog-digital converter circuit.

2. The semiconductor device according to claim 1, wherein the analog-digital converter circuit is a comparator.

3. The semiconductor device according to claim 1, wherein the second transistor comprises a metal oxide semiconductor.

4. The semiconductor device according to claim 1, further comprising an amplifier circuit, wherein the output terminal of the noise-reduction circuit is electrically connected to the input terminal of the analog-digital converter circuit via the amplifier circuit.

5. A semiconductor device comprising:

a plurality of pixels;

a driver circuit;

a detection circuit; and a compensation circuit, wherein each of the plurality of pixels comprises a first sub-pixel and a second sub-pixel, wherein each of the first sub-pixel and the second sub-pixel comprises a light-emitting element, a first transistor configured to control a supply of a current to the light-emitting element, and a second transistor configured to control an input of a video signal to a gate of the first transistor, wherein an area of the first sub-pixel is different from an area of the second sub-pixel, wherein one of a source and a drain of the first transistor of the first sub-pixel is electrically connected to a first electrode of the light-emitting element of the first sub-pixel, wherein one of a source and a drain of the first transistor of the second sub-pixel is electrically connected to a first electrode of the light-emitting element of the second sub-pixel, wherein the other of the source and the drain of the first transistor of the first sub-pixel and the other of the source and the drain of the first transistor of the second sub-pixel are electrically connected to a power supply line, wherein a gate of the second transistor of the first sub-pixel and a gate of the second transistor of the second sub-pixel are electrically connected to a gate signal line, wherein the detection circuit detects a value of a current to the light-emitting element included in a point defective sub-pixel, wherein the compensation circuit generates a compensation signal based on a result obtained by the detection circuit, wherein the driver circuit is configured to drive a pixel having the point defective sub-pixel such that the pixel having the point defective sub-pixel is compensated by increasing an amount of the current to the light-emitting element of the second sub-pixel when the first sub-pixel is the point defective sub-pixel, wherein the detection circuit comprises a resistor, a switching element, a noise-reduction circuit and an analog-digital converter circuit, wherein a first terminal of the resistor is electrically connected to a first terminal of the switching element, wherein a second terminal of the resistor is electrically connected to a second terminal of the switching element, wherein the second terminal of the resistor is electrically connected to a second electrode of the light-emitting element of the first sub-pixel, a second electrode of the light-emitting element of the second sub-pixel and an input terminal of the noise-reduction circuit, and wherein an output terminal of the noise-reduction circuit is electrically connected to the input terminal of the analog-digital converter circuit.

6. The semiconductor device according to claim 5, wherein the analog-digital converter circuit is a comparator.

7. The semiconductor device according to claim 5, wherein the second transistor comprises a metal oxide semiconductor.

8. The semiconductor device according to claim 5, further comprising an amplifier circuit, wherein the output terminal of the noise-reduction circuit is electrically connected to the input terminal of the analog-digital converter circuit via the amplifier circuit.

* * * * *